US012201876B2

(12) United States Patent
McCarthy

(10) Patent No.: US 12,201,876 B2
(45) Date of Patent: Jan. 21, 2025

(54) HYDROFOILS AND METHODS

(71) Applicant: Nature's Wing Fin Design, LLC, Newport Beach, CA (US)

(72) Inventor: Peter T. McCarthy, Oxnard, CA (US)

(73) Assignee: NATURE'S WING FIN DESIGN, LLC, Newport Beach, CA (US)

( * ) Notice: Subject to any disclaimer, the term of this patent is extended or adjusted under 35 U.S.C. 154(b) by 0 days.

(21) Appl. No.: 18/590,189

(22) Filed: Feb. 28, 2024

(65) Prior Publication Data

US 2024/0207686 A1 Jun. 27, 2024

Related U.S. Application Data

(63) Continuation of application No. 17/973,162, filed on Oct. 25, 2022, now Pat. No. 11,944,873, which is a continuation of application No. 17/076,127, filed on Oct. 21, 2020, now Pat. No. 11,511,161, which is a continuation of application No. 16/239,150, filed on Jan. 3, 2019, now Pat. No. 10,843,043.

(Continued)

(51) Int. Cl.
*A63B 31/11* (2006.01)
*A63B 31/08* (2006.01)

(52) U.S. Cl.
CPC ..... *A63B 31/11* (2013.01); *A63B 31/08* (2013.01); *A63B 2209/00* (2013.01)

(58) Field of Classification Search
CPC ..... A63B 31/00; A63B 31/08; A63B 31/11; A63B 2209/00
USPC ..... 441/64
See application file for complete search history.

(56) References Cited

U.S. PATENT DOCUMENTS 2,423,571 A 7/1947 Wilen
3,411,165 A 11/1968 Murdoch
(Continued)

FOREIGN PATENT DOCUMENTS

IT 201700037067 A1 10/2018

OTHER PUBLICATIONS

Young, Lee W.; PCT International Search Report and the Written Opinion; Apr. 1, 2019; 14 pages, Alexandria, Virginia.

(Continued)

*Primary Examiner* — Lars A Olson
(74) *Attorney, Agent, or Firm* — STETINA BRUNDA GARRED & BRUCKER

(57) ABSTRACT

A method for providing a swim fin includes providing a foot attachment member and a blade member having a predetermined blade length. The blade member has a soft portion made with a relatively soft thermoplastic material. The method includes providing a relatively harder portion and the relatively soft thermoplastic portion that is molded to the relatively harder thermoplastic portion. The method includes providing an orthogonally spaced portion of the relatively harder portion that is arranged a predetermined orthogonal direction while said swim fin is in state of rest. The method includes providing the blade member with a predetermined biasing force portion that is arranged to urge the orthogonally spaced portion while the swim fin is in a state of rest. The method includes arranging a significant portion of the blade length to experience pivotal motion a lengthwise angle of attack during use.

48 Claims, 20 Drawing Sheets

Related U.S. Application Data

(60) Provisional application No. 62/758,590, filed on Nov. 11, 2018, provisional application No. 62/613,652, filed on Jan. 4, 2018.

(56) References Cited

U.S. PATENT DOCUMENTS

| | | | |
|---|---|---|---|
| D278,165 | S | 3/1985 | Evans |
| 4,738,645 | A | 4/1988 | Garofalo |
| 4,857,024 | A | 8/1989 | Evans |
| 4,887,985 | A | 12/1989 | Garofalo |
| 4,929,206 | A | 5/1990 | Evans |
| 5,304,081 | A | 4/1994 | Takizawa |
| 5,356,323 | A | 10/1994 | Evans |
| 5,358,439 | A | 10/1994 | Paolo |
| 5,417,599 | A | 5/1995 | Evans |
| 5,443,593 | A | 8/1995 | Garofalo |
| 5,527,197 | A | 6/1996 | Evans |
| 5,746,631 | A | 5/1998 | McCarthy |
| D404,456 | S | 1/1999 | Evans |
| 6,126,503 | A | 10/2000 | Viale et al. |
| D450,365 | S | 11/2001 | Evans |
| 6,322,411 | B1 | 11/2001 | Evans |
| 6,354,894 | B1 | 3/2002 | Evans |
| D455,188 | S | 4/2002 | Evans |
| 6,364,728 | B1 | 4/2002 | Viale et al. |
| 6,413,133 | B1 | 7/2002 | McCarthy |
| 6,483,693 | B2 | 11/2002 | Kormendy et al. |
| 6,884,134 | B2 | 4/2005 | McCarthy |
| 7,086,916 | B2 | 8/2006 | Godoy |
| 7,465,205 | B2 | 12/2008 | McCarthy |
| 7,601,041 | B2 | 10/2009 | McCarthy |
| 7,988,510 | B2 | 8/2011 | Beltrani |
| 8,257,124 | B2 | 9/2012 | Garofalo et al. |
| D704,292 | S | 5/2014 | Garraffa et al. |
| 8,926,385 | B1 | 1/2015 | Woods et al. |
| 9,375,610 | B1 | 6/2016 | Bilge |
| 10,843,043 | B2 | 11/2020 | McCarthy |
| 11,511,161 | B2 | 11/2022 | McCarthy |
| 11,944,873 | B2 * | 4/2024 | McCarthy ..... A63B 31/08 |
| 2002/0025744 | A1 | 2/2002 | McCarthy |
| 2004/0127117 | A1 | 7/2004 | McCarthy |
| 2007/0049140 | A1 | 3/2007 | McCarthy |
| 2009/0088036 | A1 | 4/2009 | Garofalo |

OTHER PUBLICATIONS

Morano, Samuel J.; International Preliminary Examining Authority; Mar. 17, 2020; 48 pages, Alexandria, Virginia.
Idea3 fin (photo).
Seawing Nova fin (photo).
Mares Superchannel fin (photo).
Mares Wave fin (photo).
Mares Power Plana fin (photo).
Sherwood Elite fin (photo).
Cressi-Sub Frog Plus fin (photo).
Atomic Blade X1 fin (photo).
Cressi-Sub Thor fin (photo).
AquaLung Phazer fin (photo).

* cited by examiner 76
96
72
84
92
94
64
78
86
103
70
81
68
62
74
110
60
79
88
66
80
100
82
70
81
90
64
98
102
68

76
96
72
92
94
64
100
78
103
74
110
84
62
60
79
86
68
81
88
66
102
82
98
80
100
90
64
98
70
78
81
102
68

76
96
72
92
100
94
64
78
98
68
70
62
74
110
60
84
103
81
68
88
66
79
86
82
102
80
104
100
90
64
98
70
102
81
68
108
106

HYDROFOILS AND METHODS

CROSS-REFERENCE TO RELATED APPLICATIONS

This patent application is a continuation of U.S. patent application Ser. No. 17/973,162 filed Oct. 25, 2022, titled "Hydrofoils and Methods" and claims benefit to U.S. patent application Ser. No. 17/076,127 filed Oct. 21, 2020 titled "Hydrofoils and Methods" (now U.S. Pat. No. 11,511,161, issued Nov. 29, 2022), U.S. patent application Ser. No. 16/239,150 titled "Hydrofoils and Methods" filed Jan. 3, 2019 (now U.S. Pat. No. 10,843,043, issued Nov. 24, 2020), U.S. Provisional Patent Application Ser. No. 62/758,590 titled "Hydrofoils and Methods" filed Nov. 11, 2018 and U.S. Provisional Patent Application Ser. No. 62/613,652 titled "Hydrofoils and Methods" filed Jan. 4, 2018, and, the entire disclosure of each is hereby incorporated by reference.

STATEMENT RE: FEDERALLY SPONSORED RESEARCH/DEVELOPMENT

Not Applicable

BACKGROUND

1. Technical Field

This invention relates to swimming aids, and more specifically to such devices which are hydrofoils that attach to the feet of a swimmer and create propulsion from a kicking motion.

2. Related Art

Prior art swim fins and hydrofoils that attempt to form a scoop shaped blade have many disadvantages, including but not limited to, that they often lack the ability to facilitate efficient water channeling in the opposite direction of intended swimming.

BRIEF SUMMARY

According to an embodiment of the invention, there is provided a method for providing a swim fin. The method includes providing a foot attachment member and a blade member in front of the foot attachment member. The blade member has a longitudinal alignment and a predetermined blade length relative to the foot attachment member. The blade member has opposing surfaces, outer side edges and a transverse plane of reference extends in a transverse direction between the outer side edges, a root portion adjacent to the foot attachment member and a free end portion spaced from the root portion and the foot attachment member. The blade member has a soft portion made with a relatively soft thermoplastic material that is located in an area that is forward of the foot attachment member. The method further includes providing at least one relatively harder portion made with a relatively harder thermoplastic material that is relatively harder than the relatively soft thermoplastic material, and the relatively soft thermoplastic material being molded to the relatively harder thermoplastic material with a chemical bond created during at least one phase of an injection molding process. The method further includes providing at least one orthogonally spaced portion of the relatively harder portion that is arranged to be significantly spaced in a predetermined orthogonal direction away from the transverse plane of reference to a predetermined orthogonally spaced position while the swim fin is in state of rest. The method further includes providing the blade member with a predetermined biasing force portion that is arranged to urge the orthogonally spaced portion in the predetermined orthogonal direction away from the transverse plane of reference and toward the predetermined orthogonally spaced position while the swim fin is in the state of rest. The method further includes arranging a significant portion of the blade length of the blade member to experience pivotal motion around a transverse axis to a significantly reduced lengthwise angle of attack of at least 10 degrees during use.

According to various embodiments, the significantly reduced lengthwise angle of attack may be at least 15 degrees during a relatively moderate kicking stroke used to reach a relatively moderate swimming speed. The predetermined biasing force may be arranged to be sufficiently low enough to permit the orthogonally spaced portion to experience predetermined orthogonal movement that is directed away from the predetermined orthogonally spaced position and toward the transverse plane of reference to a predetermined deflected position under the exertion of water pressure created during at least one phase of a reciprocating kicking stroke cycle, and the predetermined biasing force may be also arranged to be sufficiently strong enough to automatically move the orthogonally spaced portion in a direction that is away from the predetermined deflected position and back to the predetermined orthogonally spaced position at the end of the at least one phase of the reciprocating kicking stroke cycle.

According to another aspect of the invention, there is provided a method for providing a swim fin. The method includes providing a foot attachment member and a blade member in front of the foot attachment member. The blade member has a longitudinal alignment relative to the foot attachment member. The blade member has opposing surfaces, outer side edges and a blade member transverse plane of reference extending in a transverse direction between the outer side edges, a root portion adjacent to the foot attachment member and a free end portion spaced from the root portion and the foot attachment member. The blade member has a relatively harder portion made with a relatively harder thermoplastic material that is located in an area that is forward of the foot attachment member. Providing the blade member with at least one relatively softer portion made with a relatively softer thermoplastic material that is relatively softer than the relatively harder thermoplastic material. The relatively softer thermoplastic material is molded to the relatively harder thermoplastic material with a chemical bond created during at least one phase of an injection molding process. The at least one relatively softer portion has outer side edge portions and a transverse flexible member plane of reference that extends in a substantially transverse direction between the outer side edge portions. The method further includes arranging the transverse flexible member plane of reference of the at least one relatively softer portion to be oriented in a orthogonally spaced position that is significantly spaced in a predetermined orthogonal direction away from the blade member transverse plane of reference while the swim fin is in state of rest. The method further includes providing the blade member with sufficient flexibility to permit the transverse flexible member plane of reference of the at least one relatively softer portion to experience a predetermined range of orthogonal movement relative to the blade member transverse plane of reference in response to the exertion of water pressure created during at least one phase of a reciprocating kicking stroke cycle. The method further includes providing the blade member with at least one biasing force portion having a predetermined biasing force that is arranged to urge the transverse flexible member plane of reference of the at least one relatively softer portion in the predetermined orthogonal direction away from the blade member transverse plane of reference and toward the predetermined orthogonally spaced position while the swim fin is in the state of rest. A significant portion of the blade member may be arranged to experience a deflection around a transverse axis to a significantly reduced lengthwise angle of attack of at least 10 degrees during use.

According to another aspect of the invention, there is provided a method for providing a swim fin. The method includes providing a foot attachment member and a blade member having a predetermined blade length in front of the foot attachment member. The blade member has a longitudinal alignment relative to the foot attachment member. The blade member has opposing surfaces, outer side edges and a blade member transverse plane of reference extends in a transverse direction between the outer side edges, a root portion adjacent to the foot attachment member and a free end portion spaced from the root portion and the foot attachment member. The blade member has a relatively harder portion made with at least one relatively harder thermoplastic material that is located in an area that is forward of the foot attachment member. The method further includes providing the blade member with at least one relatively softer portion made with at least one relatively softer thermoplastic material that is relatively softer than the relatively harder thermoplastic material, the relatively softer thermoplastic material being molded to the relatively harder thermoplastic material with a chemical bond created during at least one phase of an injection molding process in an area that is forward of the blade member. The method further includes providing at least one predetermined element portion that is disposed within the blade member, the at least one predetermined element portion having outer side edge portions and an element transverse plane of reference that extends in a substantially transverse direction between the outer side edge portions. The method further includes arranging the element transverse plane of reference the at least one predetermined element portion to be oriented in a predetermined orthogonally spaced position that is significantly spaced in a predetermined orthogonal direction away from the blade member transverse plane of reference while the swim fin is in state of rest. The method further includes providing the blade member with sufficient flexibility to permit the element transverse plane of reference and the at least one predetermined element portion to experience a predetermined range of orthogonal movement relative to the blade member transverse plane of reference in response to the exertion of water pressure created during at least one phase of a reciprocating kicking stroke cycle. The method further includes providing the blade member with at least one biasing force portion having a predetermined biasing force that is arranged to urge the transverse flexible member plane of reference of the at least one relatively softer portion in the predetermined orthogonal direction away from the blade member transverse plane of reference and toward the predetermined orthogonally spaced position at the end of the at least one phase of a reciprocating kicking stroke cycle and when the swim fin is returned to the state of rest.

According to various embodiments, the at least one predetermined element portion is selected from the group consisting of a flexible membrane, a flexible membrane made with the at least one relatively softer thermoplastic material, a transversely inclined flexible membrane element having a substantially transverse alignment, a flexible hinge element, a flexible hinge element having a substantially transverse alignment, a flexible hinge element having a substantially lengthwise alignment, a thickened portion of the blade member, a relatively stiffer portion of the blade member, a region of reduced thickness, a folded member, a rib member, a planar shaped member, a laminated member that is laminated onto at least one portion of the blade member, a reinforcement member made with the at least one relatively harder thermoplastic material, a recess, a vent, a venting member, a venting region, an opening, a void, region of increased flexibility, region of increased hardness, a predetermined design feature made with the relatively softer thermoplastic material and connected to at least one harder portion of the blade member made with the relatively harder thermoplastic material and secured with a thermo-chemical bond created during at least one phase of a manufacturing or molding process. A significant portion of the blade member may be arranged to experience a deflection around a transverse axis to a significantly reduced lengthwise angle of attack of at least 10 degrees during use. A significant portion of the blade member may be arranged to experience a deflection to a significantly reduced lengthwise angle of attack of at least 15 degrees during use around a transverse axis.

According to another aspect of the invention, there is provided a method for providing a swim fin. The method includes providing a foot attachment member and a blade member extending a predetermined blade length in front of the foot attachment. The blade member has opposing surfaces, outer side edges and a transverse plane of reference extending in a transverse direction between the outer side edges, a root portion adjacent the foot attachment member and a trailing edge portion spaced from the root portion and the foot attachment member. The blade member has a predetermined transverse blade dimension between the outer side edges along the predetermined blade length. The blade member has a longitudinal midpoint between the root portion and the foot attachment member, and a three quarter position between the midpoint and the trailing edge. The method further includes providing the blade member with at least one pivoting blade region connected to the swim fin in a manner that permits the at least one pivoting blade region to experience pivotal motion to a lengthwise reduced angle of attack of at least 10 degrees during use around a transverse pivotal axis that is located within the blade member between the foot attachment member and the three quarter position. The method further includes providing the pivoting blade portion with a predetermined scoop shaped portion that is arranged to have a predetermined transverse convex contour relative to at least one of the opposing surfaces, a significant portion of the at least one of the opposing surfaces of the predetermined convex contour having a orthogonally spaced surface portion that is arranged to be orthogonally spaced a predetermined orthogonal distance away from the transverse plane of reference while the swim fin is at rest, the transverse convex contour having a predetermined longitudinal scoop shaped dimension that is at least 25% of the blade length, the predetermined orthogonal distance being at least 10% of the predetermined transverse blade dimension along a majority of the predetermined longitudinal scoop shaped dimension, the predetermined transverse convex contour having a predetermined transverse scoop dimension that is at least 50% of the predetermined transverse blade dimension along at least one portion of the predetermined longitudinal scoop shaped dimension. The lengthwise reduced angle of attack may be arranged to not be less than 15 degrees during at least one phase of a reciprocating kicking stroke cycle used to reach a relatively moderate swimming speed. The predetermined orthogonal distance may be arranged to not be less than 15% of the predetermined transverse blade dimension along at least one portion of the predetermined longitudinal scoop shaped dimension. The predetermined transverse scoop dimension may be arranged to not be less than 60% of the predetermined transverse blade dimension along at least one portion of the predetermined longitudinal scoop shaped dimension.

According to another aspect of the invention, there is provided a method for providing a swim fin. The method further includes providing a foot attachment member and a blade member that extends a predetermined blade length in front of the foot attachment, the blade member having opposing surfaces. The blade member has outer side edges and a predetermined transverse blade dimension between the outer side edges, a root portion adjacent the foot attachment member and a trailing edge portion spaced from the root portion and the foot attachment member. The blade member has a predetermined length and a longitudinal midpoint between the root portion and the foot attachment member and a three quarter position between the midpoint and the trailing edge. The method further includes providing the blade member with at least one pivoting blade region connected to the swim fin in a manner that permits the at least one pivoting blade region to experience pivotal motion to a lengthwise reduced angle of attack of at least 10 degrees during use around a transverse pivotal axis that is located within the blade member between the foot attachment member and the three quarter position. The method further includes providing the pivoting blade portion with two substantially vertically oriented members connected to the pivoting blade portion adjacent the outer side edges, the substantially vertically oriented members having a predetermined longitudinal dimension along the blade length and having outer vertical edges that extend a predetermined vertical distance away from at least one of the opposing surfaces along the predetermined longitudinal dimension, the pivoting blade portion having a predetermined transverse plane of reference extending in a transverse direction between the outer vertical edges, the pivoting blade portion and the vertically oriented members together forming a pivoting scoop shaped portion that is arranged to exist while the swim fin is at rest, the pivoting scoop shaped region having a predetermined longitudinal scoop shaped dimension that is at least 25% of the blade length, and the predetermined vertical distance being at least 15% of the transverse blade dimension along a majority of the pivoting scoop shaped portion, the pivoting scoop shaped portion having a predetermined transverse scoop dimension that is at least 75% of the predetermined transverse blade dimension along at least one portion of the predetermined longitudinal scoop shaped dimension. The lengthwise reduced angle of attack may be arranged to not be less than 15 degrees during at least one phase of a reciprocating kicking stroke cycle used to reach a relatively moderate swimming speed. The predetermined vertical distance may be at least 20% of the transverse blade dimension along a majority of the pivoting scoop shaped portion.

According to another aspect of the invention, there is provided a method for providing a swim fin. The method includes providing a foot attachment and a blade member that extends a predetermined blade length in front of the foot attachment. The blade member has opposing surfaces, the blade member having outer side edges and a predetermined transverse blade dimension along a transverse blade alignment of the blade member that extends between the outer side edges, a root portion adjacent the foot attachment member and a trailing edge portion spaced from the root portion and the foot attachment member, the blade member having a longitudinal midpoint between the root portion and the foot attachment member, and a three quarter position between the midpoint and the trailing edge. The method further includes providing the blade member with at least one pivoting blade region connected to the swim fin in a manner that permits the at least one pivoting blade region to experience pivotal motion to a lengthwise reduced angle of attack of at least 10 degrees during use around a transverse pivotal axis that is located within the blade member between the foot attachment member and the three quarter position. The method further includes providing the pivoting blade portion with two sideways spaced apart longitudinally elongated vertical members connected to the pivoting blade portion adjacent the outer side edges and extending along a predetermined longitudinal dimension along the blade length, the longitudinally elongated vertical members having a substantially vertical alignment that extends in a significantly vertical direction away from at least one of the opposing surfaces of the blade member and terminating along at least one outer vertical edge portion that is vertically spaced from both of the opposing surfaces, the pivoting blade portion having a transverse plane of reference extending in a transverse direction between the outer vertical edges, the pivoting blade portion having a pivoting scoop shaped portion existing between the transverse plane of reference and at least one of the opposing surfaces of the blade member in area that is between the two sideways spaced apart longitudinally elongated vertical members along the predetermined longitudinal dimension while the swim fin is at rest, the pivoting scooped shaped portion having a predetermined vertical scoop dimension that extends in an orthogonal direction between the transverse plane of reference and the at least one of the opposing surfaces, the substantially vertical alignment of the two sideways spaced apart longitudinally elongated vertical members being arranged to maintain a significantly vertical orientation during use under the exertion of water pressure created during both opposing stroke directions of a reciprocating kicking stroke cycle, the predetermined longitudinal dimension of the pivoting scoop portion being at least 40% of the blade length, the pivoting scoop shaped portion having a predetermined transverse scoop dimension that is at least 75% of the predetermined transverse blade dimension along a significant portion of the predetermined longitudinal dimension, the predetermined vertical scoop dimension being at least 15% of the transverse blade dimension along a majority of both the predetermined longitudinal scoop shaped dimension and the predetermined transverse scoop dimension. The reduced angle of attack may be not less than 15 degrees during relatively moderate kicking strokes used to reach a significantly moderate swimming speed.

According to another aspect of the invention, there is provided a method for providing a swim fin. The method includes providing a foot attachment member and a blade member in front of the foot attachment member. The blade member has a longitudinal alignment relative to the foot attachment member, the blade member having opposing surfaces, outer side edges and a blade member transverse plane of reference that extends in a transverse direction between the outer side edges, a root portion adjacent to the foot attachment member and a free end portion spaced from the root portion and the foot attachment member, the blade member having a relatively harder portion made with at least one relatively harder thermoplastic material that is located in an area that is forward of the foot attachment member. The blade member has a predetermined blade length between the root portion and the trailing edge. The blade member has a predetermined transverse blade dimension between the outer side edges. The blade member has a longitudinal midpoint between the root portion and the foot attachment member, a three quarter position between the midpoint and the trailing edge. The method further includes providing the blade member with at least one relatively softer portion made with at least one relatively softer thermoplastic material that is relatively softer than the relatively harder thermoplastic material, the relatively softer thermoplastic material being molded to the relatively harder thermoplastic material with a chemical bond created during at least one phase of an injection molding process in an area that is forward of the blade member. The method further includes providing at least one predetermined element portion that is disposed within the blade member, the at least one predetermined element portion having outer side edge portions and an element transverse plane of reference that extends in a substantially transverse direction between the outer side edge portions. The method further includes arranging the element transverse plane of reference and the at least one predetermined element portion to be oriented in a predetermined orthogonally spaced position that is significantly spaced in a predetermined orthogonal direction away from the blade member transverse plane of reference while the swim fin is in a state of rest. The method further includes providing the blade member with sufficient flexibility to permit the element transverse plane of reference and the at least one predetermined element portion to experience a predetermined range of orthogonal movement relative to the blade member transverse plane of reference in response to the exertion of water pressure created during at least one phase of a reciprocating kicking stroke cycle. The method further includes providing the blade member with a predetermined biasing force that is arranged to urge the element transverse plane of reference of the at least one predetermined element in the predetermined orthogonal direction away from the blade member transverse plane of reference and toward the predetermined orthogonally spaced position at the end of the at least one phase of the reciprocating kicking stroke cycle and when the swim fin is returned to the state of rest. The method further includes providing the blade member with at least one pivoting blade region connected to the swim fin in a manner that permits the at least one pivoting blade region to experience pivotal motion to a lengthwise reduced angle of attack of at least 10 degrees during at least one kicking stroke direction of the reciprocating kicking stroke cycle around a transverse pivotal axis that is located along the blade member in an area between the foot attachment member and the three quarter position. The method further includes providing the pivoting blade portion having with a pivoting scoop shaped portion that is arranged to have a predetermined scoop shaped contour relative to at least one of the opposing surfaces, the predetermined scoop shaped contour having two sideways spaced apart longitudinally elongated vertical members connected to the pivoting blade portion adjacent the outer side edges, the pivoting scoop shaped portion having a predetermined longitudinal scoop dimension that is at least 25% of the predetermined blade length, the pivoting scoop shaped portion having a predetermined transverse scoop dimension that is at least 60% of the predetermined transverse blade dimension along a significant portion of the predetermined longitudinal dimension, the pivoting scoop shaped portion having predetermined vertically directed scoop dimension that is at least 10% of the predetermined transverse blade dimension while the swim fin is at rest along a majority of the predetermined longitudinal scoop shaped dimension and along a majority of the predetermined transverse scoop dimension.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings.

FIG. 46 shows water flow occurring during an upward stroke direction.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities. While this specification provides many theories of operation and descriptions of flow conditions, these are merely exemplifications and the inventor does not intend or wish to be limited or bound by such theories or descriptions.

Figure 1:
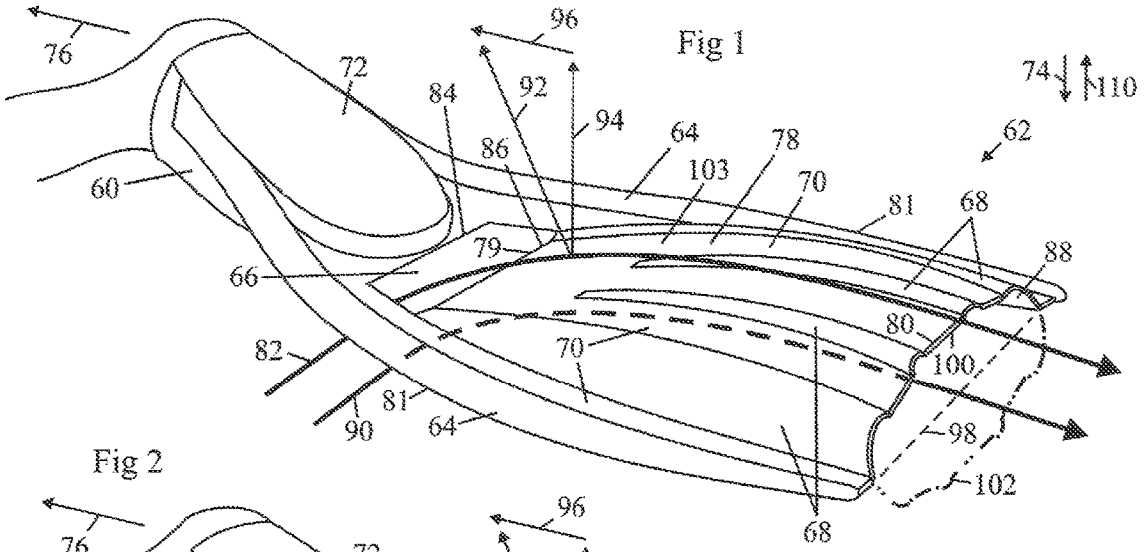
FIG. 1 shows a side perspective view of an embodiment.

FIG. 1 shows a side perspective view of an embodiment. A foot pocket 60 is connected to a blade member 62. In this embodiment, blade 62 has two stiffening members 64 which are connected to blade 62 near the outer side edges of blade 62. In this embodiment, blade 62 has a vent 66; however, any form or quantity of one or more vents, voids, recesses, venting members, openings, or no vent at all may be used in alternate embodiments. Vent 66 can be used to create a region of increased flexibility in the swim fin by creating a region of reduced material. In other alternate embodiments, vent 66 can be partially or completely filled in and/or covered by a membrane, a flexible membrane, or multiple flexible and/or stiffer members, or any desired material, and secured in any suitable manner. Blade 62 is seen to have membranes 68 which may be made with a relatively flexible thermoplastic material that are connected to a relatively harder blade portion 70 made with a relatively harder thermoplastic material. Membranes 68 and the harder portion 70 may be connected with a thermal-chemical bond created during at least one phase of an injection molding process. In alternate embodiments, membranes 68 and harder portion 70 can be made with the same material, but with different thickness to create different levels of flexibility so that membranes 68 are relatively thin to create flexibility and harder portion 70 is relatively thicker to create reduced flexibility, or vice versa, so as to create variations in flexibility and stiffness. Also, variations in flexibility can be created by contour as shaper corners and angles between joining parts can create areas of stiffness without the presence of significant changes in thickness, hardness, or material characteristics. Any method for creating more flexible portions and less flexible portions may be used. Membranes 68 may have any desired length, width, thickness, contour, shape, direction, degree of flexibility or any desired configuration relative to harder portion 70 and/or blade 62.

In this embodiment, membranes 68 near stiffening members 64 are seen to be larger than membranes 68 near the center of blade 62. Foot pocket 60 is inverted in this view so that a sole 72 is visible as a swimmer is swimming face down in a prone position in this view while kicking the swim fin in a downward stroke direction 74 or is at rest and is ready to kick the swim fin in downward stroke direction 74, and the swimmer has an intended direction of travel 76 that is currently in a forward direction relative to the prone alignment of the swimmer. The upside down orientation of the swim fin causes a lower surface 78 of blade 62 to be seen in this view.

In this embodiment, lower surface 78 is seen to be convexly curved in both a transverse and lengthwise direction. The larger membranes 68 near stiffening members 64 are seen to be curved around a transverse axis to form a convex curvature in a lengthwise direction. This can be achieved by molding blade 62 in such a shape and/or by providing membrane 68 near stiffening member 64 with a lengthwise bowed shape along a transverse axis as seen on the upper/inside edge of membrane 68 closest to the viewer. Blade member 62 has a root portion 79 near foot pocket 60 and a trailing edge 80 spaced from root portion 79 and foot pocket 60. Blade member 62 has outer side edges 81. The lengthwise bowed shape in this embodiment along blade 62 can increase the volume of water held by the scoop shape created by the transversely bowed contour that is visible at trailing edge 80. The lengthwise bowed shape can also be used to create a lengthwise airfoil or hydrofoil like shape or camber for increasing smooth flow over lower surface 78 of blade 62, to reduce turbulence and drag, and to increase lift generation used for propulsion and maneuvering. Such lengthwise curvature around a transverse axis can be arranged to form under the exertion of water pressure or can be prearranged during the molding process; however, it is desirable to have such shape prearranged during a predetermined molding process such as injection molding. In alternate embodiments, this lengthwise curved contour around a transverse axis can also be created by having a lengthwise membrane that is folded around a lengthwise axis and the outer surface can be convexly curved around a transverse axis along a lengthwise direction, such as an arched or angled upper or lower apex of the longitudinal fold, or any other method capable of creating such a curved shape along a scoop shaped contour in blade 62 may be used as well.

In this embodiment, a flow direction 82 is shown by an arrow that flows through vent 66 between a vent forward edge 84 and a vent aftward edge 86, over lower surface 78 and past trailing edge 80. An upper surface 88 of blade 62 is visible near trailing edge 80 due to the transverse scoop shape of blade 62. A flow direction 90 is shown by an arrow that passes below upper surface 88 (shown by dotted lines) and past trailing edge 80. Flow direction 82 is longer than flow direction 90 and this causes the water along flow direction 82 to flow faster along lower surface 78 (the lee surface) than along upper surface 88 (the attacking surface) so as to create a lift vector 92 which is tilted forward toward direction of travel 76. Lift vector 92 has a vertical component 94 of lift vector 92 and a forward component 96 of lift vector 92, and forward component 96 is seen to be directed toward direction of travel 76 to improve forward propulsion. A horizontal dotted line near trailing edge 80 shows a transverse plane of reference 98 that extends between the outer side edges of blade 62. In this particular embodiment, at least one of membranes 68 is arranged to bias at least one portion of harder portion 70 away from transverse plane 98 toward and/or to a bowed position 100 as shown in FIG. 1 so that at least one portion of harder portion 70 is positioned vertically away from transverse plane 98 while the swim fin is at rest. In this particular embodiment, it is desirable that bowed position 100 and the shape of blade 62 will be substantially the same as shown while the swim fin is at rest. This allows the lift generating and/or channeling effects of the blade to exist immediately on the first down kick in downward stroke direction 74 without any delays, or excessive delays in time while waiting for blade 62 to deflect as it is already in a desirable position. As described in more detail further below, this biasing toward bowed position 100 can be combined with the flexibility of membranes 68 and the relatively stiffer characteristics of harder portion 70 to cause rapid and powerful inversions of bowed position 100 for improved efficiency and propulsion.

In this embodiment, membranes 68 are seen to have a transversely curved shape to show that a predetermined amount of loose material exists within membranes 68 to permit membranes 68 to expand under the exertion of water pressure, or increased water pressure during use. This can allow the size of the scoop shape of blade 62 to increase beyond that shown as kicking pressure is increased. Broken lines below transverse plane 98 show an inverted bowed position 102, which shows the position of trailing edge 88 when the downward stroke direction 74 is reversed; however, in alternate embodiments, inverted bowed position can be increased, reduced or eliminated entirely as desired. In this embodiment, the biasing force created by membranes 68 toward bowed position 100 will cause harder portion 70 to quickly snap back from inverted bowed position 102 to bowed position 100 when downward stroke direction 74 is reinstated after having been reversed. In this embodiment, harder portion 70 is sufficiently stiff enough to avoid collapsing excessively during inversion and instead rapidly and efficiently leverage an increased amount of water along blade 62 during inversion portions of the stroke as harder portion 70 is snapped rapidly back and forth between bowed position 100 and inverted bowed position 102. Because harder portions 70 may be biased away from transverse plane 98, the desired increased rigidity of harder portions 70 can rapidly snap back and forth between bowed position 100 and inverted bowed position 102 during kick inversions to reduce lost motion, and create increased movement and acceleration of water for increased efficiency and improved leverage against the water during such rapid inversions of the orientation of blade 62.

The back and forth movement between bowed position 100 and transverse plane of reference 98, and/or between inverted bowed position 102, creates a pivoting blade portion 103 that includes the portions of harder portions that are 70 between membranes 68 and between vent aftward edge 86 and trailing edge 80. In this embodiment, pivoting blade portion 103 is arranged to pivot around a transverse axis near root portion 79 and/or near vent 66.

Membranes 98 may be molded in a substantially expanded condition and with a sufficiently resilient high memory material to provide a bias force that pushes harder portion 70 away from transverse plane of reference 98 while the swim fin is at rest. Membranes 98 may be sufficiently flexible to permit blade 62 to quickly and efficiently move back and forth between bowed position 100 and inverted bowed position 102 with significantly low levels of damping or resistance to such back and forth movement. If desired, membranes 68 can be arranged, molded, configured, shaped, contoured or adjusted in any suitable manner to provide less resistance to moving in one direction than the other direction when moving back and forth between positions 100 and 102 during use, or to provide relatively similar levels of ease of movement between positions 100 and 102.

Membranes may be arranged to create a biasing force that urges at least one portion of harder portion 70 to bowed position 100 as this not only permits blade 62 to immediately form bowed position 100 even before downward kick direction 74 is started, but this also permits blade 62 to immediately move back to bowed position 100 from inverted bowed position 102 at the end of a reciprocating kick cycle. In other words, after a reverse kick direction is used that is opposite to direction 74 so as to cause blade 62 to move from bowed position 100 to inverted bowed position 102 under the exertion of water pressure, as soon as such water pressure is reduced or eliminated due to a reduction or termination of such reverse kick direction, then membranes 68 quickly move harder portion 70 and blade 62 from inverted bowed position 102 back to bowed position 100. This greatly reduces lost motion between strokes where propulsion would otherwise be significantly delayed while a blade repositions itself or depends upon water pressure to create movement.

In alternate embodiments, at least one of membranes 68 can be arranged to bias at least one portion of harder portion 70 to and/or toward transverse plane 98 so that harder portions 78 are substantially within transverse plane 98 when the swim fin is at rest.

In alternate embodiments, the shape of blade 62 or any portions thereof can be reversed in contour. For example, at least one of membranes 68 can bias at least one portion of harder portion 70 toward or to inverted bowed position 102 instead of bowed position 100, or vice versa, or any combination of biasing different parts of harder portions 78 toward and/or to both bowed position 100 and/or inverted bowed position 102. For example, bowed position 100 can merely be reduced or even remain constant when kick stroke direction 74 is reversed.

Figure 2:
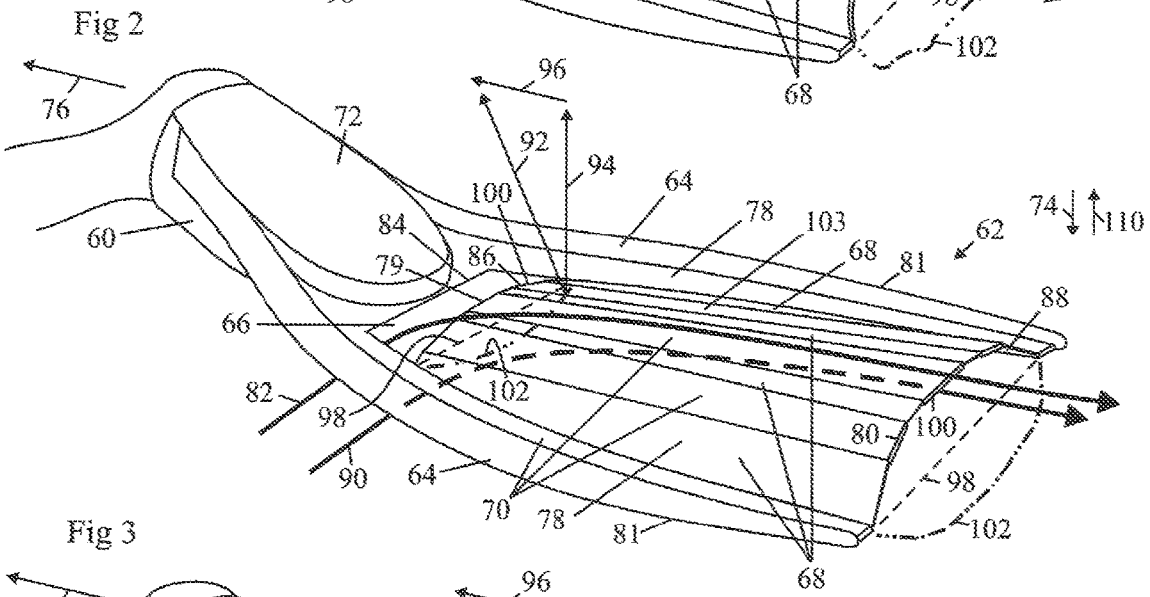
FIG. 2 shows a side perspective view of an alternate embodiment.

FIG. 2 shows a perspective side view of an alternate embodiment in which vent aftward edge 86 is arranged to bow around a lengthwise axis. In this embodiment, membranes 68 along the center of blade 62 extend sufficiently close to or reach the middle portions of vent aftward edge 86 to permit harder portions 70 at vent aftward edge 86 to move away from transverse plane of reference 98 (shown be dotted lines) below vent afterward edge 86 and to achieve bowed position 100 along at least one portion of vent afterward edge 86 during use. Membranes 68 can be arranged to bias vent aftward edge away from transverse plane 98 and/or toward bowed position 100, or to any other desired position. Alternatively, membranes 68 can bias vent aftward edge toward or to transverse plan 98, or toward or two inverted bowed position 102, while the swim fin is at rest.

In the embodiment in FIG. 2, trailing edge 80 shows that membranes 68 have a substantially flat cross sectional shape while in bowed position 100. In this situation, at least one of membranes 68 can be molded in a relatively flat condition with a sufficiently high memory material to provide at least a slight spring tension that is arranged to bias blade 62 away from transverse plane 98 and toward position 100 or toward position 102 as desired. As seen along trailing edge 80, this embodiment employs significantly differences in thickness between membranes 68 and adjacent harder portions 70, which may be made with the same material at different thickness and/or different materials with different thicknesses and/or different materials and substantially the same thicknesses as desired. In alternate embodiments, such a biasing force can be arranged to be created within at least one portion of harder portion 70 or any other portion of blade member 62.

In the embodiment in FIG. 2, membranes 68 near stiffening members 64 are seen to become wider near trailing edge 80 than near vent aftward edge 86 to permit harder portion 70 and blade 62 to be biased toward a tilted position relative to a transverse axis to achieve a reduced lengthwise angle of attack relative to stiffening members 64 and the outer side edges of blade 62, so that such titled orientation exists while the swim fin is at rest. In alternate embodiments, such tilting can occur under the exertion of water pressure rather than being biased to such an angle at rest. Such tilted orientation can be arranged to be inverted at any desired angle when downward stroke direction 74 is reversed and blade 62 moves to inverted bowed position 102. Such tilting can also be used to increase the efficiency of generating lift vector 92 and forward component 96.

Looking back to FIG. 1, the convexly curved orientation around a transverse axis can also be created at rest by arranging membranes 68 to bias harder portion 70 and blade 62 toward such position at rest, or a reverse of such curvature if desired, either towards bowed position 100 or toward inverted bowed position 102.

Figure 3:
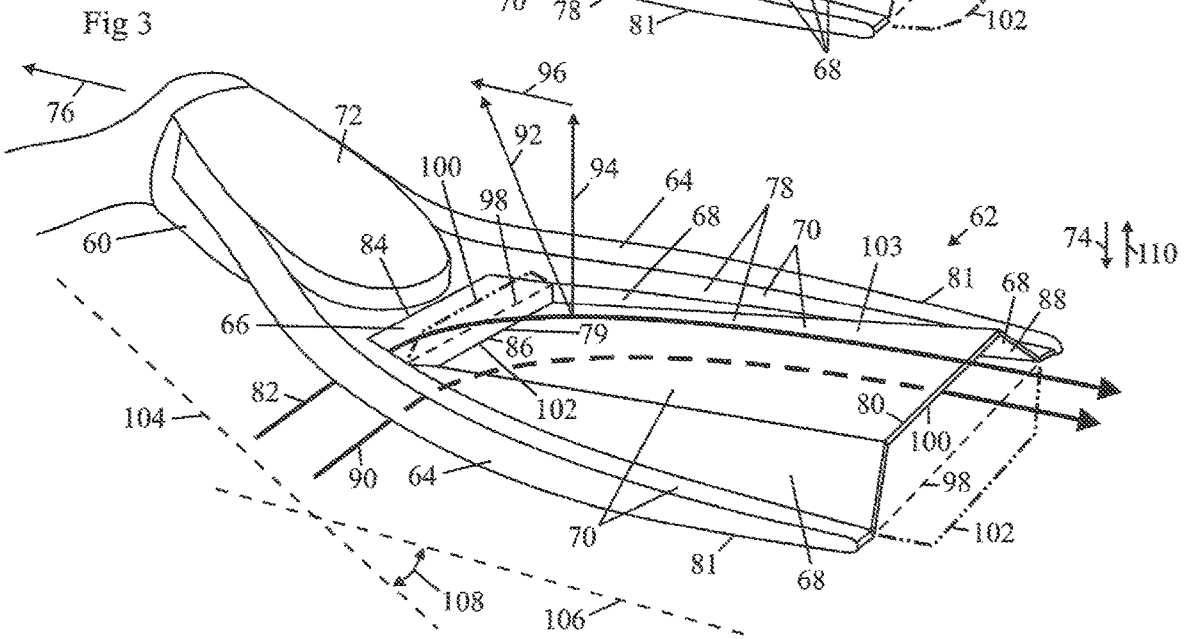
FIG. 3 shows a side perspective view of an alternate embodiment.

FIG. 3 shows a side perspective view of an alternate embodiment in which harder portion 70 is arranged to be substantially planar shaped, at least while at rest, and membranes 68 are arranged to bias harder portion 70 away from transverse plane 98 and toward bowed position 100 near trailing edge 80, while also biasing vent aftward edge 86 away from transverse plane 98 but in the opposite direction than trailing edge 80 so that vent aftward edge 86 is biased toward inverted bowed position 102. This can permit harder portion 70 to be biased in a tilted position relative to a transverse axis so as to achieve a reduced lengthwise angle of attack relative to stiffening members 64 and/or the outer side edges of blade 62 as desired. Such tilted orientation can be arranged to reverse or invert when kicking stroke direction 74 is inverted, so that trailing edge 80 moves through plane 98 and to inverted bowed position 102 and vent aftward edge 86 moves in the opposite direction through plane 98 from inverted bowed position 102 to bowed position 100 along vent aftward edge 86. Such tilted orientation can be arranged to be inverted at any desired angle when downward stroke direction 74 is reversed and blade 62 moves to inverted bowed position 102. Such tilting can also be used to increase the efficiency of generating lift vector 92 and forward component 96.

In alternate embodiments, any portion of vent aftward edge 86 and/or any portion of trailing edge 80 can be biased toward or to plane 98 or to any desired position that is away from plane 98, including separately, oppositely or together. Also, alternate embodiments can have vent aftward edge 80 originally biased toward or to transverse plane 98 or biased to or toward bowed position 100, but then move toward inverted bowed position 102 under the exertion of water pressure is applied to blade 62 as trailing edge 80 achieves bowed position 100, so that the orientation shown in FIG. 3 exists under the exertion of water pressure during use in downward stroke direction 74.

This can be achieved by arranging membranes 68 to be sufficiently flexible to permit harder portion 70 to rotate around a transverse axis in a manner that causes vent aftward edge to rotate in the opposite direction as trailing edge 80 during at least one stroke direction. This can be compounded by arranging the outer portions of stiffening members 64 that are between vent aftward edge 86 and trailing edge 80 to be more flexible than the portions of stiffening members 64 that are between vent aftward edge and foot pocket 60 so that stiffening members 64 experience a significant bend around a transverse axis that is aft of vent aftward edge 86 so that vent aftward edge 86 is forward of such axis (forward relative to forward direction of travel 76) and this causes vent aftward edge 86 to pivot in the opposite direction of trailing edge 80 relative to stiffening members 64. Alternatively, stiffening members 64 can be arranged to experience significant bending around a transverse axis that is significantly near or at vent aftward edge 86, or that is forward of vent aftward edge 86, relative to direction 76, or between vent aftward edge 86 and foot attachment member 60 so that vent aftward edge 86 is arranged to remain relatively stationary, experience reduced opposite movement, or experience similar movement to trailing edge 80 and in substantially the same direction as trailing edge 80 toward bowed position 100 during kick direction 74. Any variation, combination, or arrangement can be used as well.

In FIG. 3, a lengthwise sole alignment 104, shown by dotted lines, illustrates the lengthwise alignment of sole 72. A lengthwise blade alignment 106, shown by dotted lines, illustrates the lengthwise alignment of blade 62. Lengthwise blade alignment 106 of blade 62 is oriented at a predetermined angle 108 (shown by curved arrow) to lengthwise sole alignment 104 so that lengthwise blade alignment 106 may be substantially parallel to intended direction of travel 76 when the swim fin is in a substantially neutral position between strokes when the swim fin is at rest. This can allow blade 62 to have substantially similar blade angles relative to the water on both downstroke 74 and the upstroke 110. Predetermined angle 108 may be between the range of 15 and 40 degrees, between 20 and 35 degrees, between 25 and 35 degrees, between 30 and 35 degrees, between 35 and 45 degrees, at least 30 degrees, at least 35 degrees, at least 40 degrees, or between 40 and 45 degrees; however, predetermined angle 108 can be any desired angle.

Figure 4:
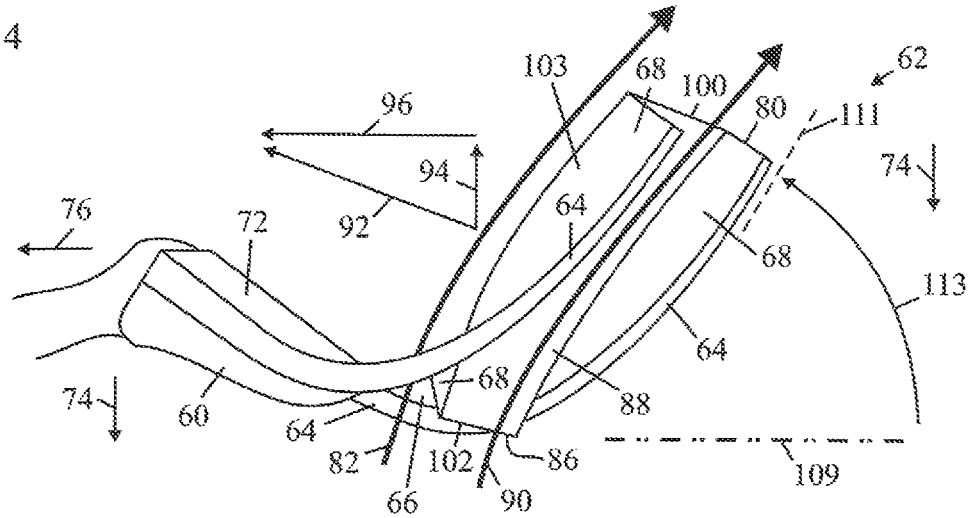
FIG. 4 shows a side perspective view of an alternate embodiment during a downward kick stroke phase of a kicking cycle.

FIG. 4 shows a side perspective view of an alternate embodiment during use that is similar to the embodiment shown in FIG. 3 in that two membranes 68 are used and vent aftward edge is arranged to pivot in the opposite direction as trailing edge 80. FIG. 4 is also similar to the embodiment in FIG. 1 because membranes 68 and harder portion 70 are arranged to cause harder portion 70 to form a longitudinally convex curvature around a transverse axis relative to lower surface 78 (the lee surface), and a longitudinally concave curvature around a transverse axis relative to upper surface (the attacking surface). In FIG. 4, stiffening members 64 are arranged to flex significantly around a transverse axis during use from a neutral position 109 to a stiffening member flexed position 111 at an angle 113. This can be arranged to permit harder portion 70 to be oriented at a predetermined reduced lengthwise angle of attack during use. This can permit flow direction 82 to flow through vent 66 and over lower surface 78 to cause lift vector 92 to be significantly tilted forward toward intended direction of travel 76. Forward component 96 of lift vector 92 is seen to be significantly large to show a significantly high forward component of lift and thrust. The predetermined reduced lengthwise angle of attack is may be between 15 and 60 degrees, between 20 and 50 degrees, between 20 and 45 degrees, between 20 and 40 degrees, between 20 and 30 degrees or any other desired range or angle.

Flow direction 90 is seen to be efficiently contained and directed along upper surface 88 (attacking surface) and between membranes 68, which are arranged to form a significantly deep scoop shape. Any desired depth of scoop can be arranged as desired. In this embodiment and view, the free end of blade 62 near trailing edge 80 is seen to be moving in downward stroke direction 74 relative to the water as foot pocket also moves in downward stroke direction 74.

In this particular embodiment in FIG. 4, vent aftward edge 86 is arranged to pivot in the opposite direction as trailing edge 80, so that vent aftward edge 86 is seen to protrude in a downward and/or forward direction relative to stiffening members 64 or the outer side edges of blade 62. Membrane 68 is visible below stiffening members 64 from this view near vent aftward edge 86. This shows that membrane 68 has inverted its orientation and crosses over stiffening members 64 from bowed position 100 near trailing edge 80 to inverted bowed position 102 near vent aftward edge 86. Membrane 68 may be highly flexible and relatively thin in order to permit membrane 68 to achieve a twisted shape with significantly low levels of resistance to achieving such shape so as to significantly reduce binding, catching, torsional resistance, folding resistance, delays in movement, restriction in movement and/or damping effects, and also permit efficient movement and recovery from such position during stroke direction changes.

It can be seen from FIG. 4 that blade 62 is arranged to concentrate a significantly amount of the water flow in a direction that focuses propulsion toward intended direction of travel 76, and the significant reduction in turbulence or wasted flow around blade 62 permits such improved propulsion to be created with significantly low levels of kicking resistance. This significantly increases propulsion efficiency, reduces energy and air consumption for divers, reduces fatigue and cramping, improves ability to carry heavy loads and high drag loads, improves torque and leverage against the water and in a direction that benefits propulsion, increases swimming speed, increases acceleration, and also increases ease, comfort and relaxation to the swimmer. The significantly reduced angle of attack, smooth flow (reduced turbulence) and contained flow also improved efficiency at the surface of the water. This combination of increased torque and reduced kicking resistance, permits divers to use any desired kicking stroke amplitude or range of motion to foot pocket 60. Testing has shown that prototypes using the present methods produce significantly increased efficiency, power, acceleration, low end torque, static thrust, and significantly improved leverage and ability to grip the water while significantly reducing muscle strain and energy consumption.

Figure 5:
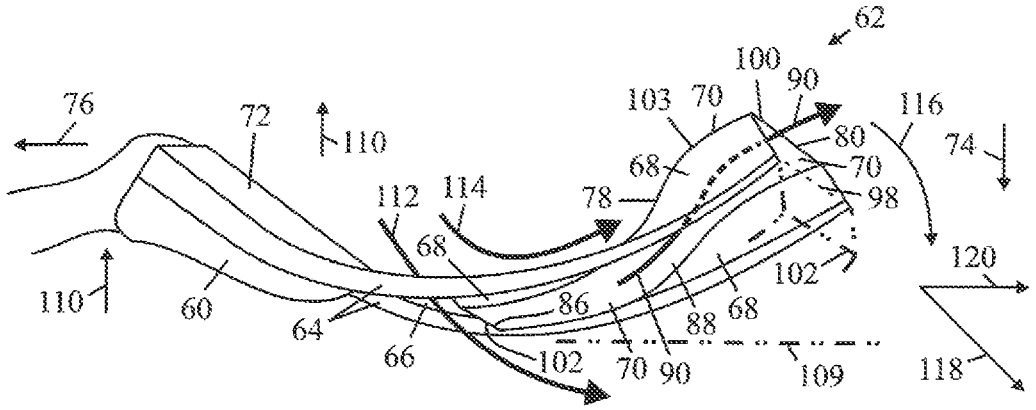
FIG. 5 shows the same embodiment shown in FIG. 4, during a kick direction inversion phase of a kicking stroke cycle.

FIG. 5 shows the same embodiment shown in FIG. 4, during an inversion phase of a kicking stroke cycle in which foot pocket 60 has changed from downward stroke direction 74 shown in FIG. 4 to an upward stroke direction 110 shown in FIG. 5. While upward stroke direction 110 has just begun in FIG. 5, the free end of blade 62 near trailing edge 80 is seen to still be moving in downward direction 74 through the water and flow direction 90 is still traveling along upper surface 88 (attacking surface) and within the scoop shaped formed by harder portion 70 and membranes 68 near trailing edge 80. Harder portion 70 may be sufficiently flexible to form a substantially s-shaped longitudinal sinusoidal wave that undulates along a significant portion of the length of blade 62 during at least one inversion phase of a reciprocating propulsion stroke cycle. The amplitude of the sinusoidal wave may be large enough to increase propulsion speeds and efficiency and can be any desired amplitude from significantly small to significantly large. The amplitude is shown be significantly large in FIG. 5 in order to visualize and illustrate desired flow conditions and blade orientations that can occur even when the amplitude of the sinusoidal wave is significantly small and more difficult to observe. The wave formation can be visualized with stop motion photography such as a stop frame in recorded video playback.

While a flow direction 112 is seen to flow downward through vent 66, a flow direction 114 is seen to impact against lower surface 78 and deflect from a downward direction to a rearward direction toward trailing edge 80. This deflecting of flow direction 114 shows pressure being exerted against lower surface 78 and moving toward trailing edge 80, and this pressure accelerates the movement of the sinusoidal wave along blade 62 and harder portion 70. Harder portion 70 may be sufficiently flexible enough to form a sinusoidal wave while also being sufficient stiff enough to not over deflect or collapse which could weaken, dampen or destroy propagation of the sinusoidal wave. Harder portion 70 may be sufficiently stiff enough to significantly resist bending around a significantly small radius of curvature around a transverse axis so that when the sinusoidal wave approaches or reaches such a predetermined radius of curvature, pressure applied to one end of the sinusoidal wave from flow direction 114 is not able to create significantly further bending around a transverse axis and build up spring tension that is released in a significantly fast and abrupt forward undulation of the sinusoidal wave that is leveraged by flow direction 114. Such an abrupt forward undulation of the sinusoidal wave may occur in a fast snapping motion made possible by the increased stiffness of harder portion 70, and such abrupt forward movement of the wave causes the curled portion of flow 90 in front of the undulating wave along upper surface 88 (attacking surface near trailing edge 80) to abruptly jetted aftward in substantially the opposite direction as intended direction of travel 76 for increased propulsion. As the undulation along upper surface 88 (attacking surface) is leveraged aftward by the bending resistance in harder portion 70 and flow direction, the large volume of water trapped within the deep scoop shape of bowed position 100 may be blasted out of the scoop and out the trailing edge and trailing edge 80 experiences an abrupt inversion movement 116 from bowed position 100, through transverse plane 98, and to inverted bowed position 102, such as like a fast cracking of a whip. This rapid oscillation and inversion in the shape of the scoop creates an inversion flow burst 118 in a downward and rearward direction, which has a horizontal component 120 that is in the opposite direction as intended direction of travel 76 for improved propulsion. Membranes 68 may be sufficiently large enough and flexible enough to permit harder portion 70 to form a significantly long sinusoidal wave so that large amounts of water are moved within the scoop shape formed by bowed position 100 along a significantly large length of blade 62 so that inversion flow burst 118 and horizontal component 120 contain a significantly large volume of water that is jettisoned at a high burst of speed under the leverage created by the significantly increased stiffness of harder portion 70. Stiffening members 64 and/or the outer side edges of blade 62 may be made with a high memory material that applies a significantly strong snapping motion near trailing edge 80 in downward direction 74 as inversion movement 116 is occurring so as to greatly increase the speed and power of inversion motion 116 through the water. A similar inverted wave form and flow conditions may exist during the opposite inversion of stroke direction as foot attachment member 60 moves from upward stroke direction 110 back to a downward stroke direction and/or during continuous rapid back and forth repetitions of the inversion phases of the kicking stroke at a significantly high frequency and/or significantly small range of motion for the kicking strokes.

FIG. 5 shows a desired situation in which the first half portion of blade 62, between foot attachment member 60 and the longitudinal midpoint of blade 62 (or between the longitudinal midpoint of blade 62 and vent aftward edge 86 and/or any desired root portion near foot attachment member 60 on any alternate embodiment), is seen to have a substantially opposite scoop shaped contour that the free end region of blade 62 near trailing edge 80. A harder portion 70 and membrane(s) 68 may be arranged to deflect along a significant portion of the first half portion of blade 62 to inverted bowed position 102 while the free end portion of blade 62 near trailing edge 80 is in bowed position 100 during at least one inversion portion of a reciprocating propulsion stroke cycle. During such inversion, the first half portion of blade 62 may form a scoop shaped contour relative to the attacking surface of blade 62 along the first half portion of blade 62, which in FIG. 5 is upper surface 78 (not shown). Inverted bowed position 102 along the first half portion of blade 62 may deflect a predetermined distance below the portion of transverse plane of reference 98 that exists within the first half portion, and that such deflection will be a predetermined vertical distance away from transverse plane of reference 98 and, such predetermined vertical distance from plane 98 may be at least 5% of the overall transverse dimension of blade 62 between the outer side edges of blade 62 at such position of such predetermined vertical distance along the first half portion of blade 62. Such predetermined vertical distance along at least one portion of the first half portion of blade 62 is at least 5%, at least 7%, at least 10%, at least 15%, at least 20%, at least 25%, at least 30%, at least 35%, at least 40%, at least 45% or at least 50% of the transverse dimension of blade 62 at such position. Such reverse scoop shape along at least one portion of the first half portion of blade 62 can greatly increase the amplitude, leverage, velocity and/or volume of water leveraged by flow direction 114 during the sinusoidal wave propagation along blade 62 during inversion, as well as the resulting amplitude, leverage, velocity and/or flow volume in flow direction 90 along the second half portion of blade 62 near trailing edge 80 during such inversion. The resulting propulsive power, efficiency and energy can be greatly increased during such inversion stroke and result in a significantly large increase in inversion flow burst 118 and horizontal component 120 for significantly improved performance.

Alternatively, the first half portion referred to above can also be described as a first portion that is arranged to exist between the longitudinal midpoint of blade member 62 and any desired portion of foot attachment member 62, and a second portion of blade member 62 can exist between the longitudinal midpoint of blade member 62 and trailing edge 80.

Figure 6:
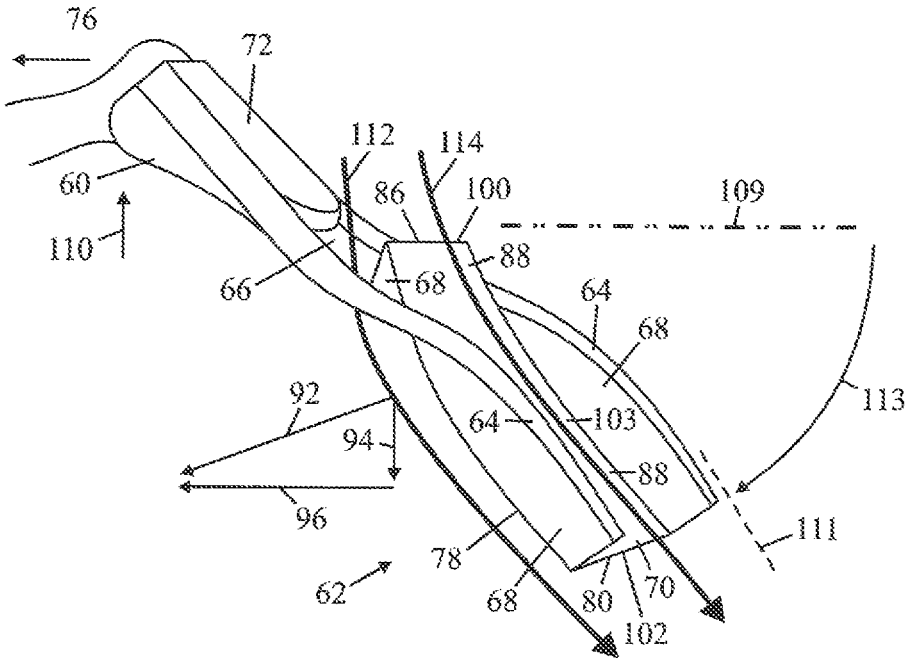
FIG. 6 shows the same embodiment shown in FIGS. 4 and 5, during an upstroke phase of a kicking stroke cycle.

FIG. 6 shows the same embodiment shown in FIGS. 4 and 5, during an upstroke phase of a kicking stroke cycle. By looking from FIG. 5 to FIG. 6 it can be seen that inversion movement 116 in FIG. 5 may continue moving to inverted bowed position 102 in FIG. 6, and flow direction 114 has changed from a deflected flow in FIG. 5 that builds up pressure, to a released condition in FIG. 6 that is channeled along lower surface 78 (attacking surface). Also, in FIG. 6, flow 112 is arranged to flow along upper surface 88 (lee surface) with reduced turbulence and improved curved flow to create a lift vector 122 that is significantly titled forward toward intended direction of travel 76 and has a vertical component 124 and a forward component 126 that can significantly increase propulsion. The view in FIG. 6 can show conditions around blade 62 when both foot pocket 60 and trailing edge 80 are both moving in upward stroke direction 110, or can show the conditions if trailing edge 80 is continuing to move in the opposite direction of upward stroke direction 110. Similarly, FIG. 4 can also show conditions existing if trailing edge 80 is moving in the opposite direction as foot pocket 60. FIG. 6 is seen to create substantially similar flow conditions as in FIG. 4 during the opposite stroke direction. However, blade 62 can be arranged to create different blade orientations, configurations, arrangements, contours, movements, deflections, angles of attack, depths of scoop, size of scoop, directions of movement, shapes, or any other variations to exist on different stroke directions if desired.

Figure 7:
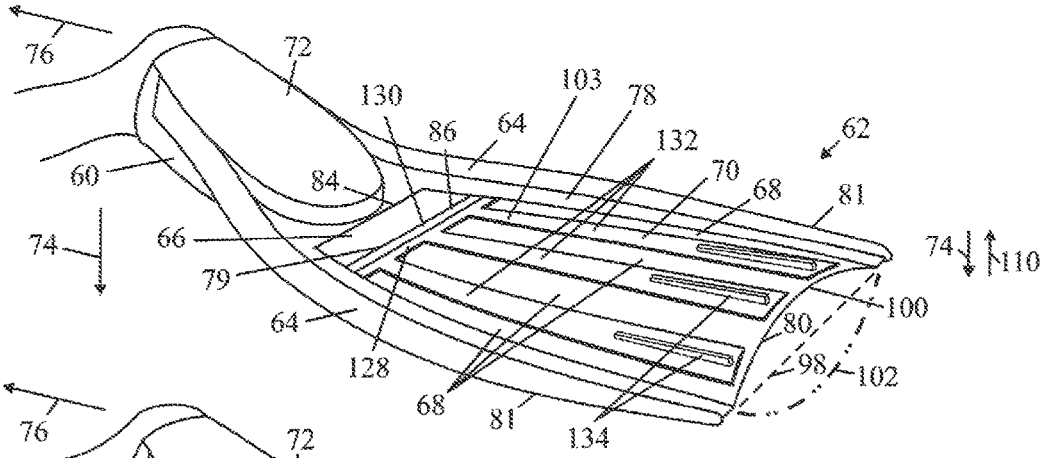
FIG. 7 shows a side perspective view of an alternate embodiment.

FIG. 7 shows a side perspective view of an alternate embodiment. In this embodiment in FIG. 7, harder portion 70 includes a transverse member 128 that may be made with a relatively harder material that the more flexible blade material used to make membranes 68 and is may be connected in any suitable manner to the material used to make membranes 68 with a thermal-chemical bond created during injection molding. In this example, vent aftward edge 86 has a transverse overmolded portion 130 that is made with a different material than transverse member 128 such as the material used to make membranes 68 or any other desired material. Harder portions 70 are shown in this example to include reinforcement members 132 connected to membrane (s) 68 that may extend from transverse member 128 and terminate near trailing edge 80. Members 132 may be molded at the same time as transverse member 128 so that these parts are inserted in one step into a subsequent mold in which membrane 68 is injection molded to blade 62 and connected to members 132 of harder portion 70 with a thermal-chemical bond.

The use of transverse member 128 near vent aftward edge 86, or similar, can be used by itself with any form of vented fin that uses a combination of at least one stiffer blade portion and at least one flexible blade portion aft of vent aftward edge 86 in an area between vent aftward edge 86 and trailing edge 80, regardless of whether or not a scoop or other blade contour is employed.

Any of the other features provided in this specification can be used by itself without any other features being required, any of such features can be eliminated entirely without limitation, and any combination of such with any other desired features can be used without limitation.

In FIG. 7, members 132 are seen to have a raised portion 132 that extends from lower surface 78. In this embodiment, stabilizing portions 132 are in the form of a small rib or fin; however, raised portion may have any size, shape, arrangement, configuration, contour, alignment, orientation or variation as desired. Stabilizing portions 132 may be arranged to permit members 132 to be stabilized in the mold while membrane 68 is injection molded around members 132. In alternate embodiments, stabilizing portions 132 can be a thickened region over any part or all of members 132 or can be a thinner, recessed or sunken portion of reduced thickness over any region of members 132.

In FIG. 7, bowed position 100 at trailing edge 80 is seen to have a substantially curved shape around a lengthwise axis and membrane 68 is arranged to bias members 132 of harder portion 70 away from transverse plane of reference 98 and to or toward bowed position 100. Inverted bowed position 102, shown by broken lines, illustrates an example of the shape of trailing edge 80 relative to transverse plane 98 when stroke direction 74 is reversed. Bowed position 100 is seen to include a predetermined arrangement of harder portion 70 being biased away from transverse plane of reference 98 by spring tension created within the material of membrane 68. In alternate embodiments, any portion of harder portion 70 can be arranged to have a pre-molded contour and spring tension sufficient to bias at least one portion of harder portion 70 away from plane 98 and toward, to or beyond either bowed position 100 or inverted bowed position 102 without any need for a biasing force provided by any membrane 68 or in combination with a biasing force provided by any membrane 68, or in opposition to any biasing force provided by any membrane 68. In alternate embodiments, at least one portion of harder portion 70 can provide a biasing force that biases itself or any other portion of harder portion 70 away from transverse plane 98 in any desired direction, and at least one membrane 68 can be positioned along at least one portion of harder portion 70 that is already biased away from plane 98 so that such at least one membrane 68 is biased away from plane 98 by the bias force provided by at least one portion of harder portion 70. In other words, any combinations, variations or reversals of configurations can be used in alternate embodiments without limitation. This can permit the portion of blade member 62 that is inwardly spaced from stiffening members 64 to have at least two different portions having different levels of stiffness, thickness, softness, rigidity or hardness, and at least one of such two different blade portions being arranged to bias the other of such two different blade portions away from transverse plane of reference 98 in any desired direction, shape, contour, arrangement, angle, orientation, alignment so that any deflection to such portions during use under the exertion of loading conditions will return to such biased position when such loading conditions are eliminated.

In other alternate embodiments, stiffening members 64 can be arranged to pivot around a transverse axis near foot pocket 60 and/or form a sinusoidal wave along its length that moves in a direction from foot pocket 60 toward trailing edge 80 in a similar manner as shown by harder portion 70 in FIG. 5 under relatively light loading conditions such as used in a relatively light kicking stroke to achieve a light cruising speed, and blade 62 can be made out of one material between stiffening members 64 and can be biased away from transverse plane 98 by spring tension in such one material and in any desired direction or orientation, including but not limited to bowed position 100 or inverted bowed position 102. Such pivotal motion and/or sinusoidal wave movement along stiffening members 64 can combine with biasing of one material to create rapid inversions through transverse plane 98 that can greatly increase propulsion speeds and/or efficiency.

Figure 8:
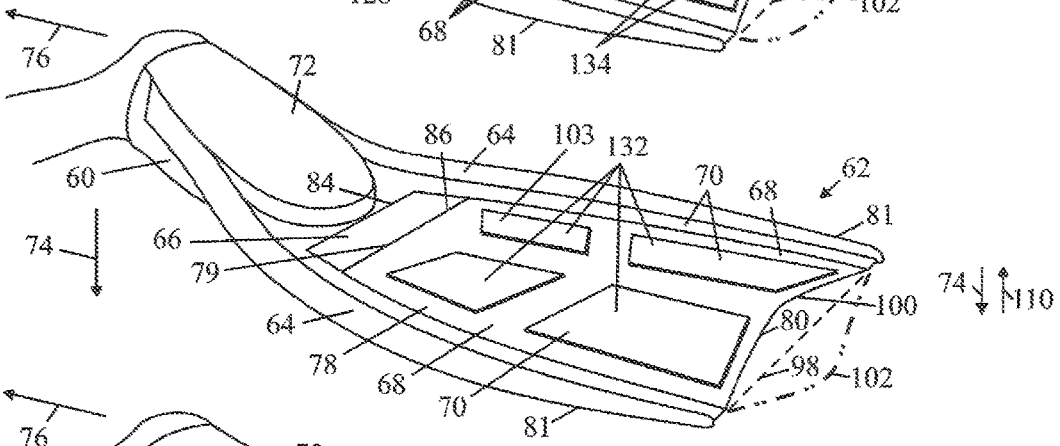
FIG. 8 shows a side perspective view of an alternate embodiment.

FIG. 8 shows a side perspective view of an alternate embodiment in which reinforcement members 132 are plate-like members; however, any desired shape can be used. In this example, membrane 68 is arranged to bias itself and members 132 of harder portion 70 away from plane 98 and to or toward bowed position 100 at trailing edge 80, and bowed position 100 is seen to form a substantially angled orientation that forms a substantially triangular shape with transverse plane of reference 98, and inverted bowed position 102 shown by broken lines illustrates a desired shape when stroke direction 74 is inverted. In alternate embodiments, bowed position 100 and/or inverted position 102 can have any desired shapes, contours, configurations, angles, curvatures, and orientations along any portion or portions of blade 62. Also, any features may be added or subtracted including any number of blade portions, vents, recesses, gaps, openings, ribs, grooves, hinges, flaps, or any other desired features.

Figure 9:
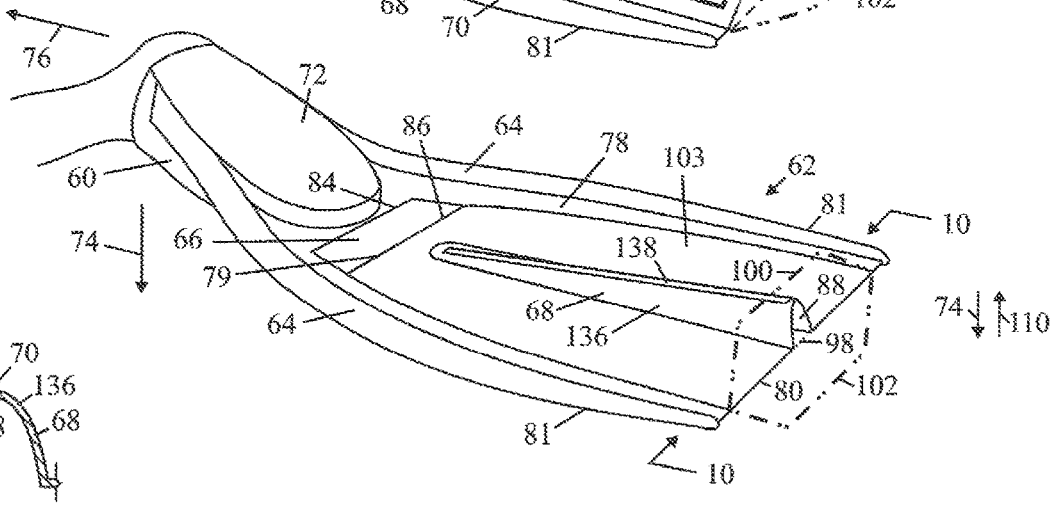
FIG. 9 shows a side perspective view of an alternate embodiment.

FIG. 9 shows a side perspective view of an alternate embodiment in which membrane 68 forms a curved blade portion 136 while the swim fin is at rest. In this embodiment, curved portion 136 has a predetermined structure member 138 along its length; however, structure member 138 can occur in any quantity, shape, form, alignment, angle, size, dimension, contour, configuration or arrangement, or can be eliminated if desired. In this embodiment, curved portion 136 is seen to curve away from transverse plane of reference 98 (shown by dotted lines) and the portions of blade 62 between curved portion 136 and stiffening members 64 (or the outer side edges of blade 62) are seen to be aligned with transverse plane of reference 98 while the swim fin is at rest; however, in alternate embodiments any desired variation can be made. For example, any portion or portions of blade 62 can be biased away from plane 98 if desired, and any portion of curved portion 136 can be oriented within or away from plane 98. Also, the portions of blade 62 that are between curved portion 136 and stiffening members 64 can either be made with the flexible material of membrane 68 or a different material that is relatively harder than the material of membrane 68, or any combination of materials, contours or thicknesses.

Any form of structure member 138 can be used such as a raised rib, a region of stiffer material, a region of reduced material, a region of thinner material, a hinge, a region of thicker material, or any other suitable feature or structure, or member 138 can be eliminated if desired.

While curved portion 136 is seen to extend in a convex manner away from lower surface 78, the reverse can occur where curved portion 136 extends in the opposite direction away from lower surface 78 and above upper surface 88 (not shown) so that curved portion 136 is concavely shaped relative to lower surface 78 and convexly shaped relative to upper surface 88 (not shown), and any number of curved portions 136 can be used in any quantity position, in any direction, and in any shape, size, form, configuration, arrangement, angle, alignment, orientation, contour, curvature, combinations or any other variation as desired.

Curved portion 136 may be arranged to expand from a curved shape to a less curved shape or an expanded shape under the exertion of water pressure so that the attacking surface of blade 62 forms a scoop shaped contour during at least one stroke direction, and may be on both opposing stroke directions. In alternate embodiments curved portion 136 can be made relatively stiff, rigid or less flexible if desired.

In alternate embodiments, curved portion 136 can have any transverse width so as to extend across a small portion, a majority or the entire width of blade 62 between stiffening members 64 (or the outer side edges of blade 62).

Figure 10A:
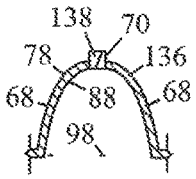
FIGS. 10*a* to 10*f* show alternate versions of a cross section view taken along the line 10-10 in FIG. 9.

FIGS. 10*a* to 10*f* show alternate versions of a cross section view taken along the line 10-10 in FIG. 9, with a focus on the cross section of curved member 136. In FIG. 10*a*, structure member 138 includes harder portion 70 made with a relatively harder material than membrane 68 and may be connected to membrane 68 with any suitable mechanical and/or chemical bond. In this example, harder portion 70 is biased away from transverse plane of reference 98. Harder portion 70 can be used to control the shape of curved portion 136 as curved portion 136 expands during use and/or as blade 62 bends around a transverse axis during use. In alternate embodiments of FIG. 10*a*, harder portion 70 can be arranged to provide a biasing force that pulls membrane 68 in curved portion 136 away from plane 98. For example, this can be achieved by connecting one end or portion of harder portion 70 to another portion of the swim fin in a manner that causes harder portion 70 to create spring tension or memory that is at an angle to plane 98 so that both harder portion 70 and membrane 68 within curved portion 136 are biased away from plane 98 while the swim fin is at rest. Also, harder portion 70 can provide abrasion resistance, reinforcement and protection for the softer or more flexible material of membranes 68 during use.

While member 138 is shown to exist at the apex of curvature of curved portion 136 in this example, any number of members 138 can be arranged to exist along any portion or portions of curved portion 136 in any manner, form, arrangement, configuration or combination.

Figure 10B:
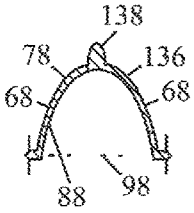

FIG. 10*b* shows an alternate embodiment of the cross section shown in FIG. 10*a*. In FIG. 10*b*, member 138 is seen to be a raised portion, rib or region of increased thickness made with the same material as membrane 68. This increased thickness can be used to control the shape of curved portion 136 that is biased away from plane 98 by spring tension within membranes 68 and/or can also be used to create an increase in stiffness and spring tension so that member 138 provides a biasing spring force that pulls membrane away from plane 99. This raised dimension of member 138 can also be used to reduce abrasions and wear along membranes 68 as at least one raised member 138 can take the brunt of many abrasions during use. This thickened region can also be used to permit membranes 68 within curved portion 136 to be made significantly thin for increased flexibility, resiliency and reduced resistance to bending or deforming during use while at least one member 138 provides improved focused structural support so that membranes 68 and/or curved portion 136 does not collapse excessively while at rest or under its own weight, or deform while being stored, packed or in the sun. Also, this thickened portion can be used to permit adjacent membranes 68 to be molded at significantly small thicknesses for increased flexibility by providing a thickened region for molten material to flow through the mold during molding before such material cools excessively so as to stop flowing before the mold is filled and/or to permit flow to occur quickly prior to excessive cooling so that at least one portion of membranes 68 can form a melt bond with a relatively harder material during injection overmolding. In other words, this thickened region in member 138 can provide a feeder flow path for hot material to flow quickly and then spread out from member 138 into the thinner portions of membrane 68. This is a big advantage because prior art membranes have a constant thickness which is arranged to permit adequate flow and this causes the thickness of injection molded prior art membranes to create excessive stiffness and inferior flexibility within such membranes which slows, limits, dampens, restricts and inhibits blade movement. In some of the methods, any number of thickened regions can be used to provide efficient hot flow of material through the mold that can feed adjacent significantly thin membrane portions so that significantly improved flexibility and molding ability is achieved. This method can also reduce cycle time in the molds, reduce energy used for initial feeding pressure and temperature during molding, and can reduced product weight, material volume and material costs.

In alternate embodiments, member 138 can be a much wider thickened portion that either raises up abruptly or in a smooth transition of tapering thickness in any manner or form as desired.

Figure 10C:
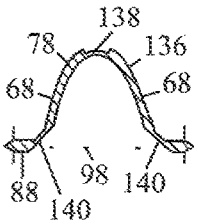

FIG. 10*c* shows an alternate embodiment of the cross section view in FIG. 10*b*. In Fib 10*c*, member 138 is seen to be a region of reduced thickness within the material of membrane 68 along curved portion 136. This region of reduced thickness along member 138 can provide a region of increased flexibility or a hinging region that significantly reduces resistance to expansion within membrane 68 as curved portion 136 expands under loading conditions during use. The thicker regions of membrane 68 adjacent member 138 can provide structural support, increased spring tension or biasing force, structural protection, control of shape or contour during deflection, and/or thickened flow regions for feeding hot material through curved portion 136 during molding. This example also has a hinging region 140 on either side of the base of curved portion 136 near plane 98. Hinging regions 140 are seen to be regions of reduced material that can reduced bending resistance and permit curved portion 136 to expand with greater ease and to greater distances of expansion. Any number of hinging regions 140 can be used in any form, shape, location, position, size, alignment, contour, angle, configuration, arrangement, combination or any variation as desired.

In alternate embodiments, hinging regions 140 and member 138 can be made with the flexible material of membrane 68 and the thicker portions curved portion 136 can be made with a harder material connected with any mechanical and/or chemical bond, and such harder portions can be any desired thickness or have any desired features, contours or form. Similarly, in alternate embodiments, the reverse can occur if desired, or any variation or combination.

Figure 10D:
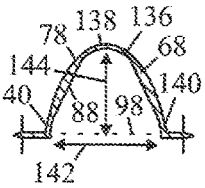

FIG. 10*d* shows an alternate embodiment of the cross section shown in FIG. 10*c*. In FIG. 10*d*, member 138 and hinging portions 140 are seen to be thinner sections of curved portion 136 and the thickened regions of membrane 68 are seen to be convexly curved along lower surface 78 and relatively flat or less curved along upper surface 88. Curved portion 136 is seen to have a transverse cross section dimension 142 and a vertical cross section dimension 144 which may be any desired dimension and/or ratio of dimensions. The ratio of vertical dimension 144 to transverse dimension 142 may be at least 1 to 2 or 50% near trailing edge 80 of blade 62 (such as along the line 10-10 in FIG. 9). Vertical dimension 144 may be at least 75%, at least 100%, at least 125%, at least 150%, at least 200% or greater than 200% of transverse dimension 142. Also, curved portion 132, near or at the longitudinal midpoint of the length of blade 62, or between such longitudinal midpoint and foot attachment member 60, may have vertical dimension 144 that is at least 50%, is at least 75%, at least 100%, at least 125%, at least 150%, at least 200% or greater than 200% of transverse dimension 142.

This can greatly increase the ability for curved portion 136 to expand to greater dimensions during use, not only because of a significantly increased amount of loose material within a given transverse dimension of blade 62 while the swim fin is at rest, but also because a greater portion of curved portion 136 because less curved and more straight which significantly reduced bending resistance to unfolding during use. Also, such increased distance of expansion can increase the amplitude of a sinusoidal wave formation as shown in FIG. 5, and the reduced resistance to expansion and deformation can permit such sinusoidal wave to undulate and snap with greater speed, less resistance and less damping forces within membrane 68. Also, the increased vertical height significantly reduced the relative radius of bending (or unbending) within the material of membrane 68 relative to the thickness used within the material of membrane 68 so as to significantly increase flexibility and efficiency of movement to desired deflected positions and blade shapes.

Figure 10E:
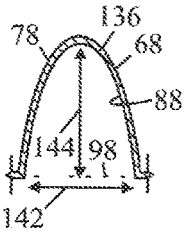

FIG. 10*e* shows an alternate embodiment of the cross sectional shape shown in FIG. 10*d*. In FIG. 10*e*, vertical dimension 144 is seen to be greater than transverse dimension 142 and this causes the side portions of curved portion 136 to be less curved. This is helpful because a highly curved wall portion is more resistant to deflection and bending than a less curved or straight wall portion, especially in the direction that attempts to uncurl the prearranged bend. This is because the concave surface of the bend (upper surface 88 in this example) must elongate a significantly long distance just to become straight, and then the material must stretch sufficiently further in order to achieve a reverse bend or curl. However, a relatively flat wall section is can flex similarly in opposing directions so that curved portion 136 can unfold with greater ease. While the sides of curved portion 136 are seen to be somewhat curved, in alternate embodiments, the side portions of curved portion 136 can be arranged to significantly straight. Similarly, while the upper end of curved portion is curved, alternate embodiments can have any desired shape such as a substantially flat section, a multi-faceted contour, hinging portions, rib portions, stiffening members, corrugated shapes or any desired configuration, shape, contour, angle, alignment, arrangement, orientation, size, thickness, number of materials, or any other desired form.

Figure 10F:
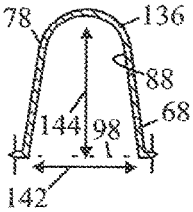

FIG. 10*f* shows an alternate embodiment of the cross sectional shape shown in FIG. 10*e*. In FIG. 10*f*, curved portion 132 is seen to have lateral side regions that are significantly straight with a curved top section between such straight sides. Such straight side wall portions may be at least slightly slanted or angled so as to improve mold operation and part removal from a mold; however, such straight wall portions may be arranged at any desired angle or even perpendicular to the mold parting line if desired. Any number of such straight side wall portions may be used in alternate embodiments as well as any number of bends to create zig zag or corrugated cross sectional shapes if desired.

Any variation of curved portion 132 can be used in combination with or in substitution of any variation of membrane 62 in any alternate embodiment, and curved portion 132 can be arranged to bias at least one harder portion 70 toward or to transverse plane of reference 98, or away from transverse plane of reference 98. Also, plane 98 may be arranged to pass through any portion or portions of curved portion 132 or plane 98 be arranged to be spaced from any or all portions of any curved portion 132. Any number of curved portions 132 may be used in any arrangement, angle, alignment, size, shape, contour, configuration, combination or variation.

Alternate embodiments can also provide any vents, openings, orifices, recesses, splits, cavities, voids, passageways and/or regions of reduced or eliminated material along any portion or portions of any curved portion 136, membrane 68 and/or blade 62. Such openings can be used to provide venting and/or to provide increased expandability, increased flexibility, increased ease of movement and/or reduced bending resistance, reduced catching or reduced binding along any portion or portions of any curved portion 136, membrane 68 and/or blade 62. Alternate embodiments can also avoid the use of any vents or openings whatsoever along blade 62 or between foot attachment member 30 and blade 62. Also, any openings created during an early phase of an injection molding process, if any, can be filled with any suitable flexible material, blade portion, rib or membrane during a later phase of injection molding to fill the gap created by such opening.

Looking back at FIG. 9, the lateral side edges of curved portion 136 that intersect blade 62 are seen to be relatively straight and in a substantially longitudinal direction in this embodiment; however, in alternate embodiments any variation may be used. For example, in alternate embodiments, at least one of the lateral side edges of curved portion 136 that intersect blade 62 can be arranged to be curved and/or bent around a vertical axis in a convex, concave and/or sinusoidal arrangement. The use of a convex outward curvature around a vertical axis along the lateral side edges of curved portion 136 can be used to provide increased expansion range to membrane 62 and curved portion 136 as curved portion 136 flexes and expands under loading conditions such as created by the exertion of water pressure during at least one propulsion stroke direction. Such increased expansion range can be arrange to exist along any portion of any variation of curved portion 136 and/or along any desired variation of any membrane 68 in any desired alternate embodiments, including providing increased expansion range near the longitudinal midpoint of blade 62, near vent aftward edge 86 (or alternatively near the root portion of blade 62 near foot pocket 60), and/or near the free end portion of blade 62 near trailing edge 80. This can be done to cause transverse dimension 142 shown in FIGS. 10*e* and 10*f* to be varied in a non-linear manner along the longitudinal length of any curved portion 136 or any membrane 68. This can be used to permit non-linear amounts or transitions in movement, deflection, displacement, shape, contour, curvature, angle of attack and/or expansion to exist along such curved portion 136 and/or membrane 68 as well as along blade 62 and bowed position 100 relative to or along the lengthwise alignment and/or transverse alignment of blade 62, either at rest, during use or both.

Figure 11:
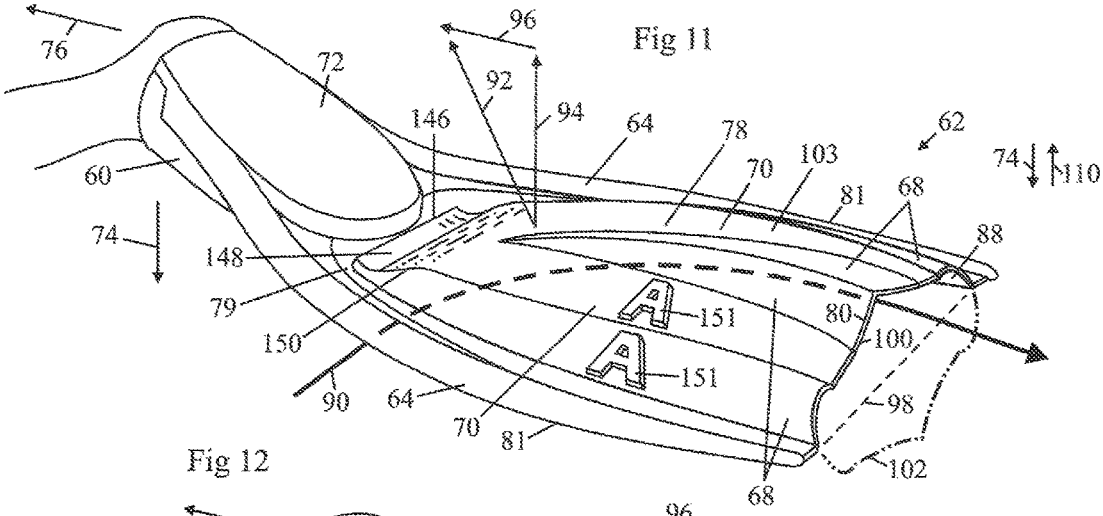
FIG. 11 shows a side perspective view of an alternate embodiment.

FIG. 11 shows a side perspective view of an alternate embodiment. This embodiment is seen to be similar to the embodiment in FIG. 1, with some variations illustrated, including that vent 66 in FIG. 1 is replaced with a hinging member 146 in FIG. 11. In this embodiment in FIG. 11, hinging member 146 has a substantially transverse alignment and is seen to have a region of reduced material 148 that extends in a transverse direction along hinging member 146. Hinging member 146 and region of reduced material 148 are arranged to permit pivotal motion around a transverse axis to control the movement of pivoting blade portion 103. The material within hinging member 146 may be arranged to have a predetermined amount of spring-like tension and biasing force that urges pivoting blade portion 103 toward bowed position 100 and away from plane of reference 98. As one example, hinging member 146 can be made with a suitable resilient thermoplastic material that is molded in an orientation that urges blade portion 103 toward position 100. Any suitable materials can be used, including EVA ethylene vinyl acetate, PP polypropylene, TPU thermoplastic polyurethanes, TPR thermoplastic rubbers, TPE thermoplastic elastomers, or other suitable materials. Any suitable alternative methods for urging pivoting blade portion 103 toward position 100 may be used.

In this embodiment, harder portion 70 of pivoting blade portion 103 is seen to have a sloped portion 150 near hinging member 146 that causes the scoop shaped contour to have increased depth near hinging member 146 so that more of pivoting blade portion 103 is spaced further away from plane of reference 98 over an increased amount of the longitudinal length of blade 62 that is between root portion 79 and trailing edge 80. This can be used to increase the volume of water being channeled by blade 62 along flow direction 90 during use during downward stroke direction 74.

FIG. 11 shows an example in which blade member 62 is provided with a predetermined design member 151 that can include a planar shaped stylized design of any desired shape or configuration, at least one predetermined number and/or letter and/or symbol, a worded message, a logo, a branding mark, or similar, that may be a raised portion, thickened portion, over-molded portion, embossed portion, recessed portion, textured portion, an insert member that is made with a different material than the portions of blade member 62 surrounding predetermined design member 151, an over-molded portion may be made with a relatively soft thermoplastic material and secured to blade member 62 with a thermo-chemical bond created during at least one phase of an injection molding process, a laminated portion that is laminated onto at least one portion of blade member 62 secured to blade member 62 with a thermo-chemical bond created during at least one phase of an injection molding process.

FIG. 11 illustrates one of the methods provided in this specification with a method of providing a swim fin with a predetermined design member 151 that is may be molded onto blade member on an elevated portion of blade member 62 that is oriented in a predetermined orthogonally spaced position that spaced in a substantially orthogonal direction away from transverse plane of reference 98 during molding and providing at least one portion of blade member 62 with a predetermined biasing force that urges such predetermined design member away to move away from transverse plane of reference 98 and away from at least one orthogonally deflected position occurring during at least one phase of a reciprocating kicking stroke cycle and to such predetermined orthogonally spaced position at the end of such an at least one phase of a reciprocating kicking stroke cycle and also while the swim fin is returned to a state of rest. The method of providing such an elevated and/or transversely inclined and/or substantially vertically inclined orientation of predetermined design member 151 that is significantly spaced in an orthogonal direction away from transverse plane of reference 98 can be used to arrange predetermined design member 151 to be more prominent, viewable and eye-catching to consumers from more angles than just a top view, and more viewable from a perspective view, side view or angled view, and can be used to create an enhanced three dimensional visual effect and impression by raising, elevating, lifting, inclining, extending or angling predetermined design member 151 in an orthogonally spaced position away from the more two dimension alignment of transverse plane of reference 98. In alternate embodiments, the method for providing predetermined design member 151 can include adding the step of providing an etched, polished, textured, electrostatically textured one surface portion of predetermined design member 151, or can include adding the step of providing an additional layer of material, such as an embossed, printed, or hot-stamped material that can add any desired color or colors, shine, reflectivity, contrast, picture or other layered or impressed finishing step.

FIG. 11 shows an example in which predetermined design member 151 is shown in the form of the letter A in two different locations in order to illustrate and exemplify some variations in three dimensional appearance, presentation and view. For example, the orientation of the predetermined design member 151 that is closer to outer side edge 81 is seen to be more vertically inclined than the orientation of the predetermined design member 151 that is closer to the longitudinal center axis of blade member 62 due to such portions of blade member 62 being oriented at different angles and distances from transverse plane of reference 98. The increased view ability from additional angles and such a raised, inclined and/or elevated origination that is maintained by a predetermined biasing force create unique benefits. In addition, when these methods are combined with an inverting or partially inverting shape of blade member 62 during use along with the biasing force, such methods can be arranged to enable the orthogonally elevated positioning of predetermined design member 151 to exhibit a unique and unexpected flashing or blinking effect to the design, logo or message that is highly viewable to other swimmers or scuba divers from a side view or angled view as blade member 62 is arranged to snap back and forth efficiently and rapidly and with reduced lost motion between stroke inversions.

The two exemplified positions in FIG. 11 for predetermined design member 151 also illustrate some of the variations in the methods for providing such predetermined design member 151. For example, the location of predetermined design member 151 that is nearer to outer side edge 81 is seen to be provided on flexible membrane 68 that may be made with a relatively soft thermoplastic material, so that this location of predetermined design member 151 can be a thickened portion or raised portion within membrane 68 and made with the same relatively soft thermoplastic material used to make membrane 68 during at least one phase of an injection molding process, or can be made with an even softer thermoplastic material that is made with a different color for contrast that is molded onto membrane 68 during at least one phase of an injection molding process, and/or can include embossing, stamping or laminating a hot stamp layer or image onto the raised surface of predetermined design member 151. As another example, the location of predetermined design member 151 that is arranged to be closer to the longitudinal center axis of blade member 62 is seen to be located on harder portion 70 that is may be made with a relatively harder thermoplastic material that is relatively harder than the relatively softer thermoplastic material that may be used to make membrane 68, and such relatively harder thermoplastic material of harder portion 70 may also be made with a different color than used to make membrane 68. Therefore, some methods for providing predetermined design member 151 that is located along harder portion 70 can include making predetermined design member 151 with the same relatively softer thermoplastic material and different color used to make membrane 68 and arranging such softer thermoplastic material to flow through at least one pathway within blade member 62 and/or at least one pathway in the injection mold assembly so that such softer material can flow into predetermined design member 151 and bond to harder portion 70 at the same time that membrane 68 is injection molded and connected to harder portion with the same bond, which may be a thermochemical bond created during at least one phase of an injection molding process. Such softer material can also be later embossed, stamped or hot stamped with a laminated design or different color or different shine or appearance if desired. In other variations, such predetermined design member 151 can be molded onto harder portion 70 with a different thermoplastic material and/or different color than used to make membrane 68, or predetermined design member 151 can be made in an injection molding process that occurs before harder portion 70 is formed and then inserted and substantially restrained into a mold prior to injection molding harder portion 70 so that the relatively harder thermoplastic material used to make harder portion 70 is arranged to flow onto and/or around predetermined design member 151 and bond to the material used to make predetermined design member 151 and may be made with a different color than used to make predetermined design member 151. When different colors are used to make harder portion 70 and predetermined design member 151, then the exposed surfaces of such parts can both be flush with each other or at different heights from each other as desired. In another example, predetermined design member 151 that exists along harder portion 70 can be made with the same material and color used to make harder portion 70, so that predetermined design member 151 is a raised surface portion of harder portion 70, and if desired, such raised surface portion can be textured, embossed, printed or hot stamped in any suitable manner. Any desired variation may be used.

Figure 12:
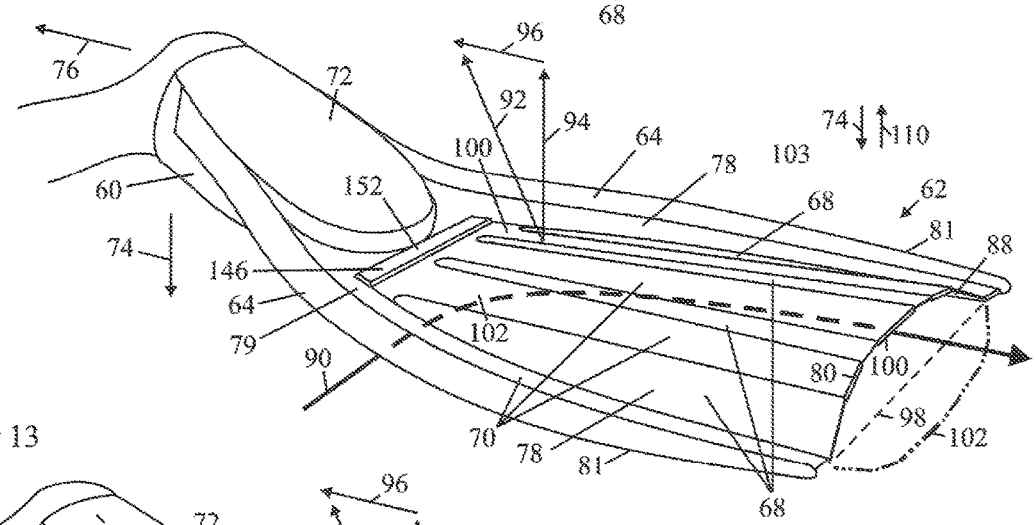
FIG. 12 shows a side perspective view of an alternate embodiment.

FIG. 12 shows a side perspective view of an alternate embodiment that is similar to the embodiment in FIG. 2, where vent 66 in FIG. 2 is replaced with hinging member 146 in FIG. 12. In this embodiment in FIG. 12, hinging member 146 includes a flexible member 152. In this embodiment, member 152 is seen to be a raised member that is made with a suitable elastomeric material, such a rubber material, a thermoplastic rubber, a thermoplastic elastomer, or any other suitable material. Element 150 can be an elastic member or an elastic rib member that is molded onto a portion of the surface of blade 62, such as molded to a portion of relatively harder blade material 70, such as with a lamination bond and/or or an end-to-end bond, to increase strength, durability, longevity, resiliency, biasing force, biasing efficiency, and/or biasing speed of hinging member 146 during use while urging pivoting blade portion 103 toward position 100 improve the durability and/or efficiency of hinging member 146.

Figure 13:
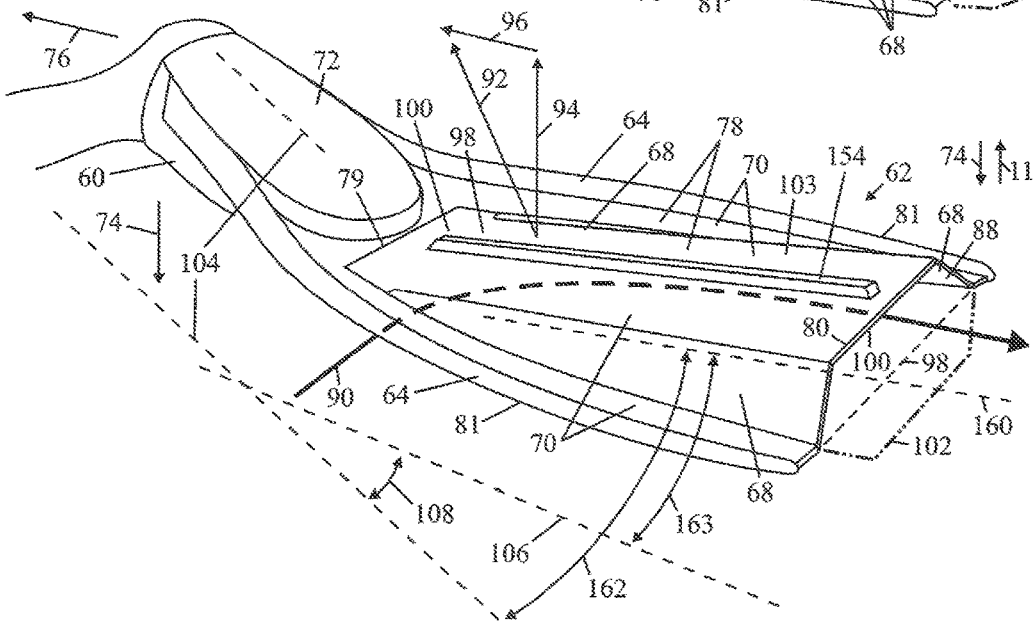
FIG. 13 shows a side perspective view of an alternate embodiment.

FIG. 13 shows a side perspective view of an alternate embodiment that is similar to the embodiment in FIG. 3, with changes that including replacing vent 66 in FIG. 3 with hinging member 146 in FIG. 13. In this embodiment in FIG. 13, a longitudinal stiffening member 154 is seen to be connected to pivoting blade portion 103 that is seen to have a trailing end portion 156 near trailing edge 80 and a forward end portion 158 that is near foot pocket 60. In this embodiment, forward end 158 of member 154 terminates at a predetermined distance from the toe portion of foot pocket 160, and hinge member 146 is a flexible blade portion that exists between forward end 158 and foot pocket 60. The increased stiffness of member 154 terminates near foot pocket 60 at forward end 158 to form a relatively more flexible portion within pivoting blade portion 103 to form hinging blade portion 146 that can experience focused bending around a transverse axis near forward end 158 as pivoting blade portion 103 moves back and forth between positions 100, 98, and/or 102 during use from reciprocating kicking strokes. Hinging member 146 may be a flexible blade portion of pivoting blade portion 103 and is molded with a resilient material in any suitable manner and/or orientation that provides a spring-like tension within such material that is arranged to provide a biasing force that urges both stiffening member 154 and pivoting blade portion 103 toward position 100 and away from position 98 along a significant portion of the length of pivoting blade portion 103 between root portion 79 and trailing edge 80. Stiffening member 154 may be also made with a resilient material that provides spring-like tension that also urges a significant portion of pivoting blade portion 103 toward position 100 and away from position 98.

In FIG. 13, a broken line shows a pivoting portion lengthwise blade alignment 160 that exists within at least one portion of the longitudinal plane of pivoting blade portion 103 as the swim fin is starting to be kicked and/or ready to be kicked in downward stroke direction 74. Blade alignment 160 shown in FIG. 13 exists while the swim fin is at rest due to one or more of the biasing force or forces being applied within the swim fin to urge pivoting blade portion 103 toward position 100 and away from position 98. Blade alignment 160 is seen to be at an angle 162 between blade alignment 160 and lengthwise sole alignment 104, wherein angle 162 may be at least 30 degrees, at least 35 degrees, at least 40 degrees, at least 45 degrees, between 35 and 40 degrees, between 35 degrees and 45 degrees, or between 40 degrees and 45 degrees; however, any suitable angle may be used. Alignment 160 is seen to be at an angle 164 to lengthwise blade alignment 106, and that angle 163 may be at least 3 degrees, at least 5 degrees, at least 7 degrees, or at least 10 degrees; however, angle 163 can be at any angle whatsoever, including a zero angle, any negative angle that converges toward alignment 106 rather than diverging away from alignment 106, or any altering angles. Alignment 160 can be straight, curved, concavely curved, convexly curved, sinuously curved and/or undulating in a lengthwise direction, or can have any desired shape or contour.

Figure 14:
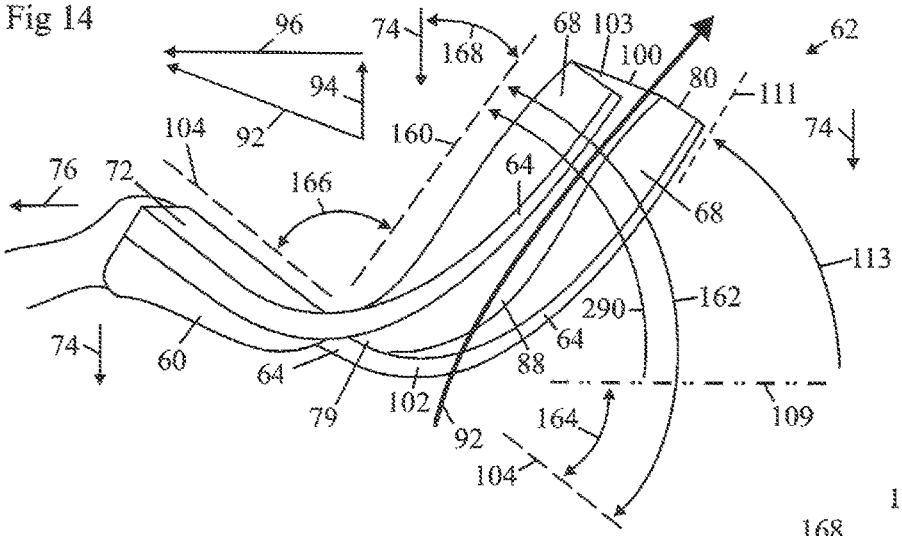
FIG. 14 shows a side perspective view of an alternate embodiment during a downward kick stroke phase of a kicking cycle.

FIG. 14 shows a side perspective view of an alternate embodiment during a downward kick stroke phase of a kicking cycle. The embodiment in FIG. 14 is similar to the embodiment shown in FIG. 4 with some changes, including that vent 66 in FIG. 4 is not used in the embodiment in FIG. 14. The embodiment in FIG. 14 shows the swim fin being kicked in downward stroke direction 74 and blade 62 and pivoting blade portion 103 may be in a fully flexed position and have stopped pivoting away from neutral position 109 during stroke direction 74. Sole alignment 104 is seen to be at an angle 63 relative to neutral position 109. In this view, pivoting blade portion lengthwise alignment 160 is at an angle 166 relative to lengthwise sole alignment 104. Pivoting blade alignment 160 may be arranged to stop pivoting around a transverse axis near foot pocket 60 when angle 166 is between 120 degrees and 80 degrees, between 80 and 110 degrees, between 80 and 100 degrees, between 80 and 95 degrees, between 85 degrees and 95 degrees, between 90 degrees and 120 degrees, between 90 degrees and 115 degrees, between 90 degrees and 110 degrees, between 90 degrees and 110 degrees, between 90 degrees and 120 degrees, between 90 degrees and 125 degrees, between 90 degrees and 130 degrees, between 90 degrees and 135 degrees, not less than 80 degrees, not less than 85 degrees, not less than 90 degrees, or approximately 90 degrees; however, any desired angle may be used. In other embodiments, pivoting blade alignment 160 can be arranged to stop pivoting around a transverse axis near foot pocket 60 when angle 166 is between 135 degrees and 100 degrees, between 140 degrees and 100 degrees, between 135 degrees and 100 degrees, between 130 degrees and 100 degrees, between 125 degrees and 100 degrees, between 120 degrees and 100 degrees, or between 115 degrees and 100 degrees. Angle 166 may be approximately 90 degrees so that the orientation of lengthwise sole alignment 104 during the middle of the kicking stroke occurring in downward stroke direction 74 causes pivoting blade alignment 160 to occur at an angle of attack 168 relative to downward stroke direction 74. Angle of attack 166 during the middle of the stroke cycle in downward stroke direction 74 may be approximately 45 degrees, between 30 and 40 degrees, between 40 and 50 degrees, or between 40 and 60 degrees. Angle 168 of pivoting blade alignment 160 may be arranged to increase the volume, velocity, and/or efficiency of water being directed by blade 62 in flow direction 90, and to push increased amounts of water in the opposite direction of travel 76. Angle 168 may be also arranged to significantly reduce turbulence within the water flowing around lower surface 78 that can create significant reductions in drag on the swim fin and reductions in kicking resistance experienced by the user. Angle 168 and pivoting blade alignment 160 may be also arranged to create lifting force 92 and forward component of lift 96. The embodiment in which angle 166 is arranged to be approximately 90 degrees after pivoting blade portion 103 and blade 62 have stopped pivoting, can be arranged to occur during a substantially hard kicking stroke in direction 74 such as used to reach a significantly high swimming speed, to accelerate rapidly, or to exert a strong leveraging force upon the water while maneuvering aggressively. Alternatively, pivoting blade portion 103 can be arranged to stop further pivoting when angle 166 is approximately 90 degrees during a significantly moderate kicking stroke such as used to reach a significantly moderate swimming speed and/or during a significantly light kicking stroke such as used to reach a significantly low swimming speed. Pivoting blade portion 103 may be arranged to stop further pivoting when angle 166 is approximately 90 degrees when using both a moderate kicking stroke force and a significantly hard kicking stroke force so that angle 166 is substantially constant during such variations in kicking stroke force to permit high levels of propulsion efficiency to be maintained during such variations in kicking stroke force. In alternate embodiments, angle 168 can be arranged to occur at any desired angle. Any method for significantly stopping further pivoting at a predetermined degree of angle 166 can be used, such as by using a suitable stopping device, arranging stress forces within stiffening members 64, blade 62, harder portion 70, root portion 79, and/or other suitable portions of the swim fin to increase significantly as pivoting blade alignment approaches and reaches angle 166. The material within stiffening members 64, harder portion 70, root portion 79, and/or other suitable portions of the swim fin, may be arranged to be biased with a predetermined biasing force that urges stiffening members 64 back toward neutral position 109 when kick direction 174 is stopped or reversed, and with a substantially strong spring-like tension that can create a significantly strong snapping force that efficiently snaps stiffening members 64 and pivoting blade portion 103 toward neutral position 109 at the end of a kicking stroke.

Figure 15:
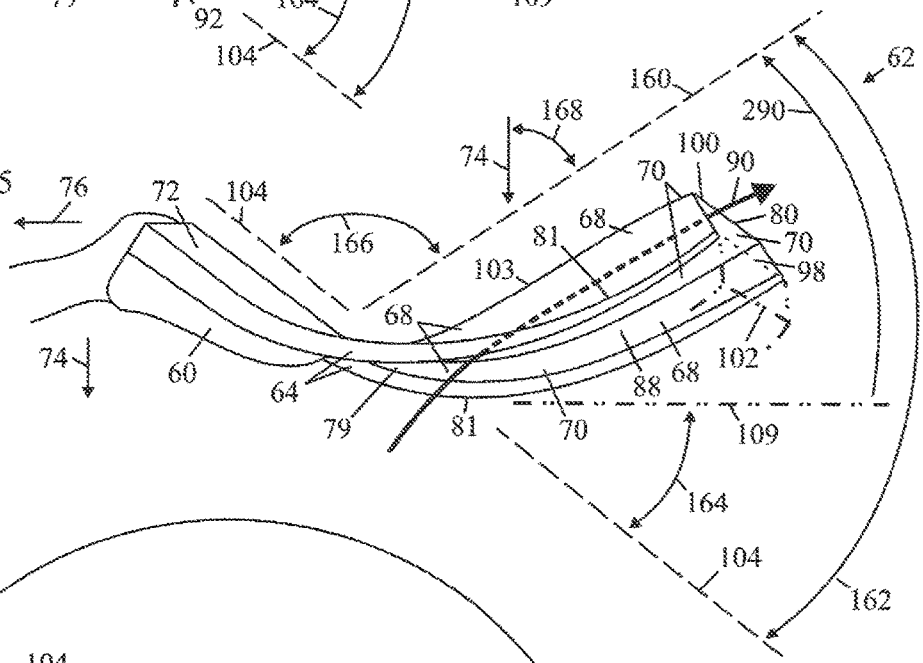
FIG. 15 shows the same embodiment shown in FIG. 4, during a kick direction inversion phase of a kicking stroke cycle.

FIG. 15 shows the same embodiment shown in FIG. 14; however, pivoting blade alignment 160 in FIG. 15 is seen to be less deflected during kick direction 74 than shown in FIG. 14. In FIG. 15, the lower degree of deflection can be the result of using a significantly light kicking force on the same embodiment shown in FIG. 14. In FIG. 15, the lower degree of deflection can alternatively be the result of using significantly stiffer materials within stiffening members 64 and/or blade 61 and/or root portion 79.

Figure 16:
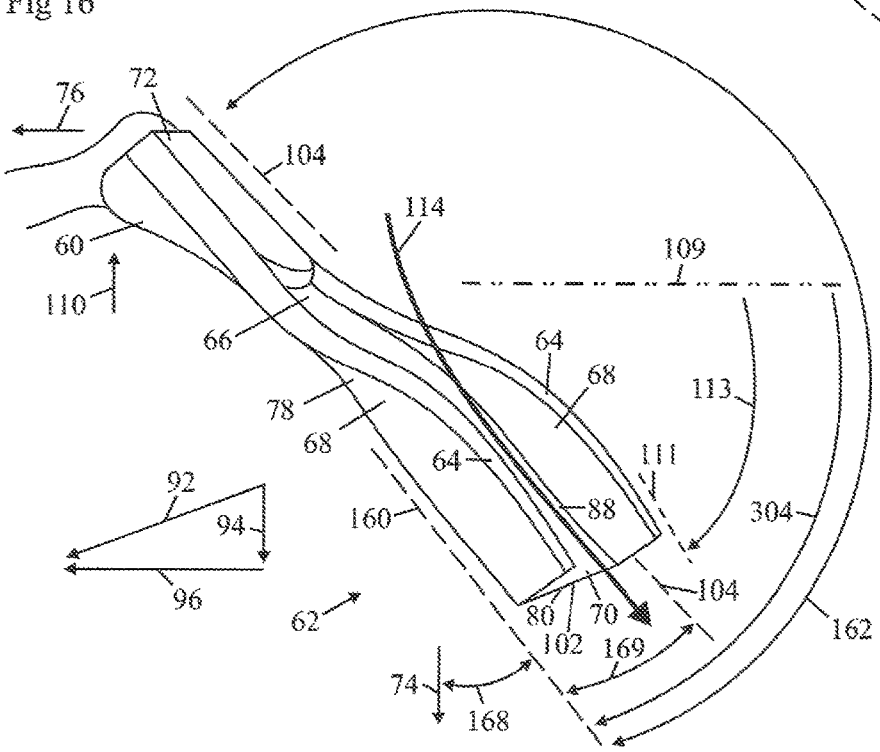
FIG. 16 shows the same embodiment shown in FIGS. 4 and 5, during an upstroke phase of a kicking stroke cycle.

FIG. 16 shows the same embodiment shown in FIGS. 14 and 15, during an upstroke phase of a kicking stroke cycle. In FIG. 16, the swim fin is being kicked upward in upward stroke direction 110 and blade 62 and pivoting blade portion 103 are shown to have deflected around a transverse axis near foot pocket 60 under the exertion of water pressure and stiffening members 64 have deflected from neutral position 109 to stiffening member flexed position 111 at angle 113. Pivoting blade alignment 160 is seen to be at angle 162 relative to lengthwise sole alignment 104, and during upstroke direction 110, angle 162 may be approximately 180 degrees so that pivoting blade alignment 160 is inclined relative to upward stroke direction 110 so that angle of attack 168 is approximately 45 degrees during the middle of the upward kicking stroke cycle in direction 110. Even though lengthwise sole alignment 104 is constantly changing as the user's leg bends around a transverse axis at the hip and at the knee and the user's foot pivots around a transverse axis at the ankle during sweeping motions of reciprocating kicking stroke cycles, some of the methods can be used to greatly increase efficiency and propulsion by optimizing the positioning of pivoting blade alignment 160 at optimum angles during the middle segment of the sweeping downward kicking stroke cycle in downward stroke direction 74 and during the middle segment of the sweeping upward kicking stroke cycle in upward stroke direction 110. This can create large increases in performance and efficiency by having longer durations of each kicking stroke direction being arranged to have maximized blade angles and angles of attack 168. This means that on average during each kick direction, angle of attack 168 has a longer duration at ranges of degrees that can produce the most propulsion on each stroke. Another major benefit created by this method is that while some lost motion can occur as stiffening members 64 pivot from neutral position 109 to deflected position 111 during the early phase of a kicking stroke, as the deflection stops (with use of a suitable stopping device or method) when reaching angle 113 and angle of attack 168 as it approaches and/or moves toward the middle portion of the same stroke direction and cycle, then blade 62 is arranged to have significantly improved performance as lost motion ends and increased propulsion begins, and such maximized angles are substantially sustained throughout the remainder of the same stroke cycle and direction, and then stroke reversal can significantly duplicate these conditions in the opposite direction and in a significantly symmetrical manner on both opposing stroke directions of a reciprocating kicking stroke cycle.

In FIG. 16, near trailing edge 80, an angle 169 between blade alignment 160 and sole alignment 104 illustrates that in this embodiment angle 162 is greater than 180 degrees as blade alignment 160 near trailing edge 80 has pivoted beyond sole alignment 104 during at least one portion of the kicking stroke during upward kicking stroke direction 110. In alternate embodiments, blade alignment 160 can be arranged to pivot to a further reduction to angle of attack 168, or pivot to an alignment that is substantially parallel to sole alignment 104 during upward stroke direction 110, or pivot to an alignment so that angle 162 is substantially less than 180 degrees.

Any desired angles may be used for angles 162, 113, 164, 166 and 168 in alternate embodiments.

A comparison of FIGS. 14 and 16 show that pivoting blade alignment 160 and angle of attack 168 are significantly symmetrical during both downward stroke direction 74 in FIG. 12 and during upward stroke direction 110 in FIG. 16, so that similar propulsion can be generated on both of opposing stroke direction 74 in FIG. 14 and stroke direction 110 in FIG. 16 during use. This can greatly increase overall propulsion efficiency, increased acceleration, increased ease of sustaining cruising speeds, increased ease of sustaining high swimming speeds, increased leverage and control, increased relaxation of muscles during use, reduced muscle and tendon strain, reduced cramps, reduced fatigue, reduced air consumption and increased bottom time for scuba divers and rebreather divers, and other benefits. This also increases the ability to maintain a more constant and consistent propulsion on both reciprocating stroke directions, which in turn can enable the swimmer to maintain a more constant and consistent swimming speed. This increases efficiency because repetitive changes in propulsion and speed between opposing kicking strokes is less efficient than a more consistent propulsion and speed, for reasons that include that intervals of reduced propulsion and speed require more energy consumption to be applied to regain lost momentum and speed.

In FIG. 14, angle 162 can be arranged to be between 145 degrees and 220 degrees, between 150 degrees and 210 degrees, between 155 degrees and 200 degrees, between 160 degrees and 200 degrees, between 170 degrees and 200 degrees, between 170 degrees and 210 degrees, between 170 degrees and 220 degrees, between 170 degrees and 225 degrees, between 170 degrees and 230 degrees, between 130 degrees and 200 degrees, between 135 degrees and 200 degrees, or between 135 degrees and 210 degrees. Alternate embodiments can use any desired angles for angle 162 and 168.

In alternate embodiments, pivoting blade portion 103 can be arranged to have sufficiently high biasing forces to both urge pivoting blade portion 103 toward bowed position 100 and to maintain pivoting blade portion 103 in bowed position 100 during both downward stroke direction (shown in FIGS. 14 and 15) and during upward stroke direction 110 (shown in FIG. 16) so that pivoting blade portion 103 does not invert and remains in bowed position 100 during upward stroke direction 110. In such a situation, stiffening members 64 can be arranged to continue to flex as shown in FIGS. 14-16; however, pivoting blade portion 103 will remain in bowed position 100 during both opposing kick directions. This type of alternate embodiment can be used to create flow and lift conditions as shown in FIGS. 14 and 15 during downward stroke direction 74 and still provide propulsion during the opposing upward stroke direction 110 without forming an inverted concave scoop shape during such opposing upward stroke direction 110. This method can be used to further reduce lost motion as bowed position 100 remains substantially or fully fixed in place, and can also be used to create increased propulsion during downward stroke direction 74 compared to during upstroke direction 110. For example, membranes 68 can be arranged to be sufficiently rigid to a smaller amount of movement or no movement at all during upward stroke direction 110, and in alternate embodiments, membranes 68 can be made out the same material as used in harder portion 70 if desired. Any degree of stiffness or any cross sectional shape can be used.

Figure 17:
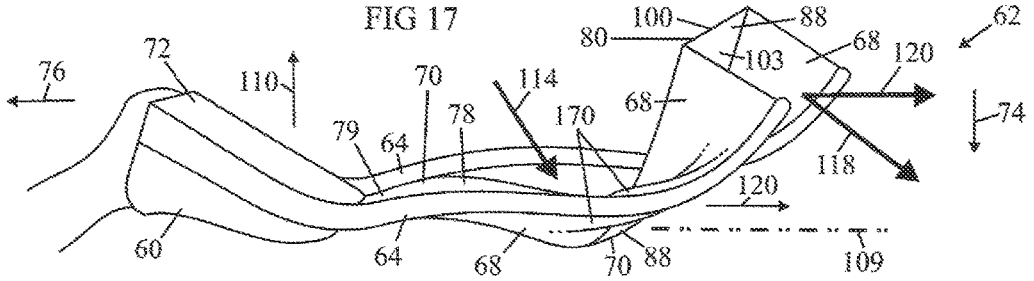
FIG. 17 shows a side perspective view of an embodiment during a kick direction inversion phase of a kicking stroke cycle.

FIG. 17 shows a side perspective view of an alternate embodiment during a kick direction inversion phase of a kicking stroke cycle. The embodiment in FIG. 17 is seen to be experiencing an inversion phase of a reciprocating kicking stroke cycle in which the swimmer's foot within foot pocket 60 has just reversed kicking direction and is moving upward in upward stroke direction 110 while the portions of blade 62 and pivoting blade portion 103 near trailing edge 80 are seen to still be moving downward in downward stroke direction 74. This is because the entire swim fin was just previously being kicked in downward stroke direction 74 prior to this view, so that the change in direction of foot pocket 60 to upward stroke direction 110 is progressing along the length of blade 62 toward trailing edge 80; however, upward stroke direction 110 has not yet reached trailing edge 80 in this view and the portions of blade 62 near trailing edge 80 are still moving in downward stroke direction 74. From this view, it can be seen that the portions of pivoting blade portion 103 near the longitudinal midpoint of blade 62, between root portion 79 and trailing edge 80, have deflected downward under the exertion of water pressure in flow direction 114 to an inverted bowed shape that extends below the transverse plane of reference between stiffening members 64 near such longitudinal midpoint of blade 62. This inversion of the scoop shaped contour contrasts with the oppositely formed scoop shaped contour of pivoting blade portion 103 near trailing edge 80. This can cause pivoting blade portion 103 to form a longitudinally undulating s-shaped wave form that moves in a direction from root portion 79 to trailing edge 80 during an inversion phase of the reciprocating kicking stroke cycle where the stroke direction is abruptly reversed. As this undulating wave causes pivoting blade portion 103 to experience two opposing scoop shaped contours between stiffening members 64, and in this embodiment, membranes 68 are seen to form a wrinkled membrane region 170 between harder portion 70 and stiffening members 64 in the region where opposing blade deflections intersect. Wrinkled membrane region 170 can form in some embodiments where certain conditions exist and can be controlled, reduced, improved, accommodated, mitigated, and/or eliminated after the conditions for their formation are understood, as explained further below. Methods may be employed to control or mitigate this situation because excessive formations of wrinkled membrane region 170 can obstruct pivoting blade portion 103 from efficiently inverting positions as the kicking stroke direction is inverted. For example, resistance to bending within the material of membranes 68 can oppose the formation of wrinkled membrane region and prevent the undulating blade shape from forming along pivoting blade portion 103, which can reduce propulsion during the inversion phase of reciprocating kicking stroke cycles. Furthermore, resistance within the material of membranes 68 can oppose pivoting blade portion 103 from inverting its scoop shaped contour on one of the two opposing stroke directions. If the material within membranes 68 are made sufficiently flexible enough to form wrinkled membrane region 170 with low levels of internal resistance, then the wrinkled membrane region can bend in a transverse direction and mechanically jam in between the outer side edges of pivoting blade portion 103 (harder portion 70) and the inner side edges of stiffening members 64. This jamming, or partial jamming, can restrict movement, dampen movement, reduce speed of undulating wave and reduce the speed and quantity of water flowing in flow direction 118 and 120 during the stroke inversion phase, and can also increase the duration and severity of lost motion experienced as blade 62 experiences an increased delay in reversing shape between kicking stroke directions and at the beginning of each kicking stroke direction, and potentially at the end of each kicking stroke direction as well. Some methods for controlling such situations are shown and described in subsequent sections of this description and specification.

Figure 18:
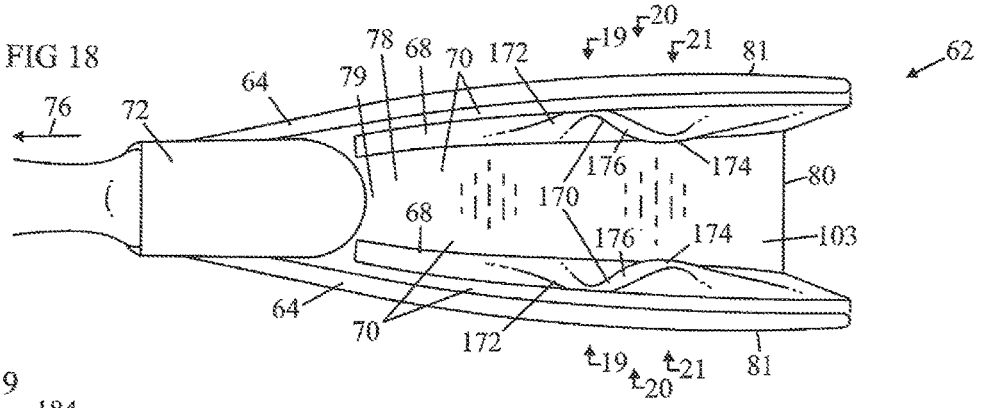
FIG. 18 shows an additional vertical view of the same embodiment shown in FIG. 17 while looking downward from above the view shown in FIG. 17 during the same kick inversion phase shown in FIG. 17.

FIG. 18 shows a vertical view of the same embodiment shown in FIG. 17 that is looking downward upon the swim fin from above during the same kick inversion phase shown in FIG. 17, so that sole 72 and lower surface 78 are seen from this view. From the downward vertical view shown in FIG. 18, wrinkled membrane portion 170 is seen to have taken on a longitudinally sinusoidal form in this embodiment in the area of blade 62 where pivoting blade portion 103 is reversing its deflection in a sinusoidal manner during an inversion phase of a reciprocating kicking stroke cycle as seen from the corresponding side perspective view in FIG. 17. In this embodiment in FIG. 18, wrinkled portion 170 is seen to have an outward bend 172 that deflects in an outward transverse direction toward stiffening member 64, and is encroaching on and/or extending over a portion of blade 62 between stiffening member 64 and membrane 68. In this embodiment in FIG. 18, wrinkled membrane portion 170 is also seen to have an inward bend 174 that deflects in an inward transverse direction toward pivoting blade portion 103 and harder portion 70, and is encroaching on and/or extending over a portion of harder portion 70 and pivoting blade 103. Wrinkled membrane portion 170 is also seen to have a vertical bend 174 in an area that is longitudinally in between outward bend 172 and inward bend 174. From this view in FIG. 18, it can be seen how outward bend 172 and/or inward bend 174 can partially or fully obstruct, restrict, block, or delay pivoting blade 103 and harder portion 70 from inverting its shape in a quick and efficient manner. While some embodiments can have any degree of resistance, restriction, obstruction, or delay for pivoting blade portion 103 inverting its shape during an inversion phase of reciprocating kicking stroke cycles due to any form of wrinkled membrane 170, outward bend 172, inward bend 174, vertical bend 176, and/or due to internal resistance to flexing within the material of membrane 68, methods are disclosed later in this description for reducing, controlling or mitigating such conditions so that pivoting blade portion 103 is able to invert its shape with increased efficiency, if desired.

Figure 19:
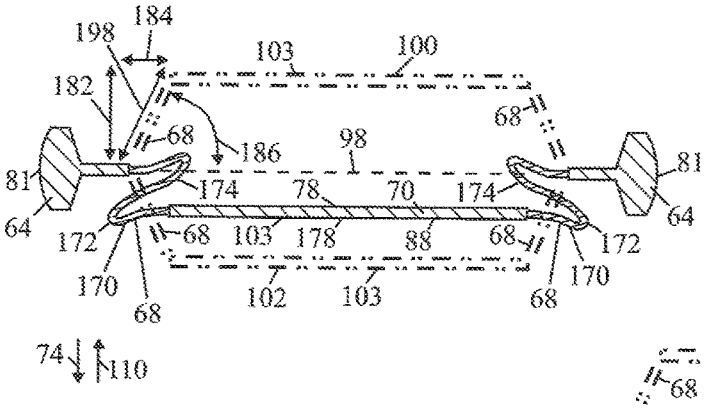
FIG. 19 shows a cross section view taken along the line 19-19 in FIG. 18.

FIG. 19 shows a cross section view taken along the line 19-19 in FIG. 18 that passes through a portion of outward bend 172 of wrinkled portion 170. From this cross sectional view in FIG. 19, it can be seen that in this embodiment, outward bend 172 of wrinkled membrane portion 170 on membrane 68 is seen to extend in an outward sideways direction relative to upper surface 88 of blade 62 while pivoting blade portion 103 is at an inverted transition position 178 that is in between inverted bowed position 102 and transverse plane of reference 98. This cross sectional view also allows inward bend 174 to be seen as extending inward sideways or transverse direction relative to lower surface 78 while portion 103 is at position 178. In this embodiment, the broken lines showing bowed position 100 illustrate that membrane 68 has a sloped alignment 180 while in position 100, which includes a vertical dimension component 182, a horizontal dimension component 184, and an alignment angle 186 between sloped alignment 180 and transverse plane of reference 98. Notably, horizontal dimension 184 of membrane 68 is the horizontal distance between the outer side edge of pivoting blade portion 103 and the inner edge of stiffening member 64 and/or the inner edge of the small inward blade portion connected to member 64. Consequently, when pivoting blade portion 103 inverts is position and passes near or through transverse plane of reference 98, then the entire actual length of membrane 68 must attempt to pass vertically through this transverse gap between pivoting blade portion 103 and stiffening member 64 across a width of no more than horizontal dimension 184. Often times, this transverse gap between pivoting blade portion 103 and stiffening member 64 is even smaller during use, including but not limited to being due to the material within membrane 68 having resistance to bending around a relatively small radius so that each outer side edge of membrane 68 will extend inward a small distance from each of its outer side edges and then start bending up or down so that the horizontal transverse gap that membrane 68 must pass vertically through during blade inversions is actually smaller than horizontal dimension 184. It can be seen in this embodiment that outward bend 172 extends in an outward transverse direction beyond the outer end of horizontal dimension 184 and inward bend 174 extends in an inward transverse direction beyond the inner end of horizontal dimension 184. In addition, the greater the biasing force used within membrane 86 to urge pivoting blade portion 103 toward position 100, if any is used within membrane 86, the greater the resistance within membrane 86 to bend under low loading conditions around a significantly small bending radius. This means that in this embodiment, it is likely that outward bend 172 and/or inward bend 174 will catch upon stiffening member 64 and/or pivoting blade portion 103 and/or catch upon themselves as portions of outward bend 172 and/or inward bend 174 impact and rub against each other during at least one portion of the inversion phase where pivoting blade portion 103 approaches or passes by transverse plane of reference 98. This is because the overall length of membrane 68 (seen along sloped alignment 180) is sufficiently larger than horizontal dimension 184 to cause membrane 68 to easily become transversely wider than horizontal dimension 184 when membrane 68 must fold in upon itself to fit through the gap between pivoting blade portion 103 and stiffening member 64 as pivoting blade portion 103 moves between position 100 and 102 and passes through position 98.

While this cross section view is taken while pivoting blade portion 103 is experiencing a longitudinal sinusoidal or s-shaped wave during an inversion phase of a reciprocating stoke cycle as seen in FIG. 17, the conditions shown in FIG. 18 of outward bend 172 and/or inward bend and/or any other formation or orientation of wrinkled membrane portion 170 can also occur without such a sinusoidal wave occurring, as variations of these conditions can also exist even when most or all portions of the entire length of pivoting blade portion 103 move substantially together in unison as portion 103 inverts its orientation and moves between position 100 and 102 and passes by plane of reference 98 during use with reciprocating stroke directions.

One way of illustrating the relative lengths of vertical dimension 182 and horizontal dimension 184 at once is by using alignment angle 186 as a point of reference. For example, if alignment angle 186 between sloped alignment 180 and plane of reference 98 that is significantly close to or at 90 degrees, then horizontal dimension 184 will be significantly close to zero or will be zero, so that membrane 68 will have a greater difficulty folding in upon itself and fitting through a near zero or zero horizontal gap between stiffening member 64 and pivoting blade portion 103 without jamming as blade portion 103 approaches or passes by plane of reference 98 during inversion portions of a reciprocating stroke cycle. This condition becomes more extreme as the vertical length of membrane 68 is increased along long vertical dimension 182 in order to permit blade 62 to form a significantly deep prearranged scoop. This is because the longer the vertical length of membrane 68 along vertical dimension 182, the greater the total length of material that must fold in upon itself when attempting to pass through the horizontal gap between stiffening member 64 and pivoting blade portion 103 as portion 103 passes though transverse plane of reference 98 during an inversion phase of reciprocating stroke cycles. Furthermore, as sloped angle 186 becomes significantly close to or at 90 degrees, sloped alignment 180 would be oriented significantly parallel to the alignment of vertical dimension 182, and this can cause membrane 68 to take on the structural orientation and increased stiffness characteristics of an I-beam like structure, so that membrane 68 becomes significantly more resistant to bending, folding, flexing and/or compacting in a vertical direction. Such a condition can be used on alternate embodiments where it is desired that pivoting blade portion remain at or significantly close to position 100 on both opposing stroke directions during use, or to only permit an inversion of portion 103 to or near position 102 under significantly high loading conditions such as used to achieve a significantly high swimming speed.

In embodiments where it is desired that membrane 68 has significantly low levels of resistance to flexing and enabling pivoting blade portion 103 to move with significantly low levels of resistance passing through transverse plane of reference 98 and moving between position 100 and position 102 and variations of positions within such ranges, alignment angle 186 may be less than 80 degrees, less than 75 degrees, less than 70 degrees, less than 65 degrees, less than 60 degrees, less than 55 degrees, approximately or significantly close to 45 degrees, less than 50 degrees, less than 45 degrees, between 45 degrees and 60 degrees, between 40 degrees and 60 degrees, between 35 degrees and 60 degrees, between 30 degrees and 60 degrees, between 25 degrees and 60 degrees, and between 20 degrees and 60 degrees. In embodiments where blade 62 is arranged to form a significantly deep prearranged scoop shape, alignment angle 186 may be between 45 degrees and 65 degrees. This can allow a significantly deep scoop to be prearranged in blade 62 due to an elongated vertical dimension 182, while also providing sufficient material within membrane 68 along horizontal dimension 184 so that membrane 68 can pass through an enlarged gap between stiffening member 64 and pivoting blade portion 103 with significant ease, significantly low resistance, and/or significantly reduced tendency to jam as portion 103 passes through transverse plane of reference 98 during stroke inversions. The material within membrane 68 may be selected to have sufficient flexibility to permit pivoting blade portion 103 to move efficiently between positions 100 and 102 during use. However, in alternate embodiments, alignment angle 186 can be any desired angle and/or membrane 68 can have any desired degree of flexibility, resiliency, bending resistance, and/or stiffness.

Figure 20:
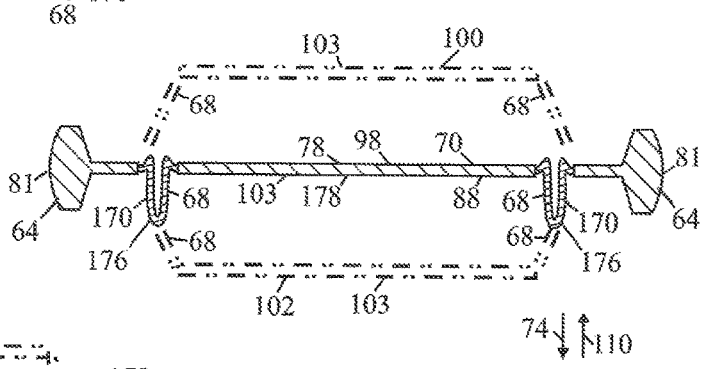
FIG. 20 shows a cross section view taken along the line 20-20 in FIG. 18.

FIG. 20 shows a cross section view taken along the line 20-20 in FIG. 18 that passes through a portion of vertical bend 176 of wrinkled portion 170. In this view, pivoting blade portion 103 is located along transverse plane of reference 98 in between bowed position 100 and inverted position 102. In this embodiment, vertical bend 176 can be formed within wrinkled portion 170 in areas adjacent to and/or in between outward bend 176 (seen in FIGS. 17-19, and 21) and inward bend 174 (seen in FIGS. 17-19, and 21). While this portion of membrane 68 at vertical bend 176 in FIG. 20 is not seen in this particular embodiment to bend in a transverse manner and/or jam within the gap between stiffening member 64 and pivoting blade portion 103, this is because vertical bend 176 is seen to have occurred around significantly small bending radii with significantly low resistance. For example, if bending resistance within membrane 68 were significantly high, then a much higher bending radius would occur within vertical bend 176, which could cause vertical bend 176 to balloon to a much wider transverse width that could approach or exceed the transverse dimension of the gap between stiffening member 64 and pivoting blade portion 103, which can increase the chances that the overall transverse width created by the folds around larger bending radii within membrane 68 would cause membrane 68 to obstruct, block and/or jam the movement of pivoting blade portion 103 at or near transverse plane of reference 98 while attempting to move between positions 100 and 102 during inversion phases of reciprocating stroke cycles.

Figure 21:
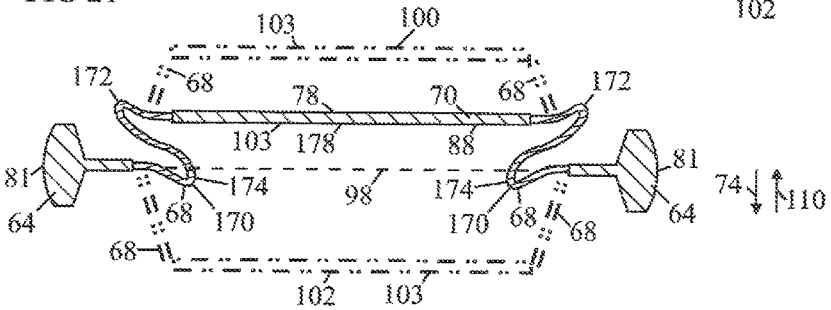
FIG. 21 shows a cross section view taken along the line 21-21 in FIG. 18.

FIG. 21 shows a cross section view taken along the line 21-21 in FIG. 18 that passes through a portion of inward bend 172 of wrinkled portion 170. In FIG. 21, the portion shown of pivoting blade portion 103 has moved from position 100 to a transition position 188 because it is being pushed from position 100 toward plane of reference 98 in the direction of downward stroke direction 74 during this inversion phase under the exertion of water pressure created by water moving in flow direction 114 (shown in FIG. 17) applied against other portions of lower surface 78 of pivoting blade portion 103 that are closer to foot pocket 60 (as shown in FIG. 17) during the formation and/or propagation of the sinusoidal wave form within portion 103 during this stroke inversion phase. Notably, while the entire portion of blade 62 shown in FIG. 21 is already moving in downward stroke direction 74 (see also FIG. 17), the additional downward movement of portion 103 from position 100 to position 188 causes the water along upper surface 88 of pivoting blade portion 103 to move at a faster rate of speed in downward direction 74 than the speed of stiffening members 64 that are moving in downward direction 74. In an embodiment where this accelerated movement of water is combined with a significantly deep prearranged scoop shape that is biased toward position 100 so that pivoting blade portion 103 immediately starts the beginning of its movement in downward stroke direction 74 with the movement of a large volume of water in an longitudinal direction along the length of blade 62 with significantly reduced or eliminated lost motion or delay in the initiation of propulsion, then the increased volume of channeled water created by the prearranged scoop shape biased toward position 100 can greatly increase the total volume and velocity of water accelerated by the added movement of portion 103 from position 100 to position 188 and then through position 98 to position 102 at the end of the inversion phase of a propulsion stroke. During the opposite inversion phase of reciprocating strokes where an inverted version of the sinusoidal wave moving along pivoting blade portion 103 is pushing the outer end region of portion 103 near trailing edge 80 in the opposite direction from inverted position 102 back toward bowed position 100, the biasing force that urges portion 103 toward position 100 combines with the leveraging force created by the sinusoidal wave and water pressure created by flow direction 114 (shown in FIG. 17) to further accelerate this outer region of portion 103 to create a significant increase in the volume and velocity of water ejected from blade 62 in the opposite direction of intended swimming. While the embodiment shown in FIG. 21 illustrates significantly large outward bends 172 and inward bends 174 that can slow, dampen, obstruct, block, or resist the accelerated movement of pivoting blade portion 103 from position 100 to position 188 as well as through plane of reference 98 and to position 102 (as well as in the opposite direction during an oppositely directed inversion phase during reciprocating stroke directions), this embodiment illustrating potential blockage, resistance or restriction is shown as an example to help teach how to avoid or reduce such less dampening conditions, especially in conjunction with subsequent drawings and description further below in this specification.

Objective tests using hand held underwater speedometers to measure both acceleration and top end swimming speeds have shown that using some of the methods exemplified herein can create dramatic increases in both acceleration and top end swimming speeds, along with reduced levels of exertion and muscle strain and increased ability to sustain significantly higher swimming speeds for significantly longer durations and distances.

Figure 22:
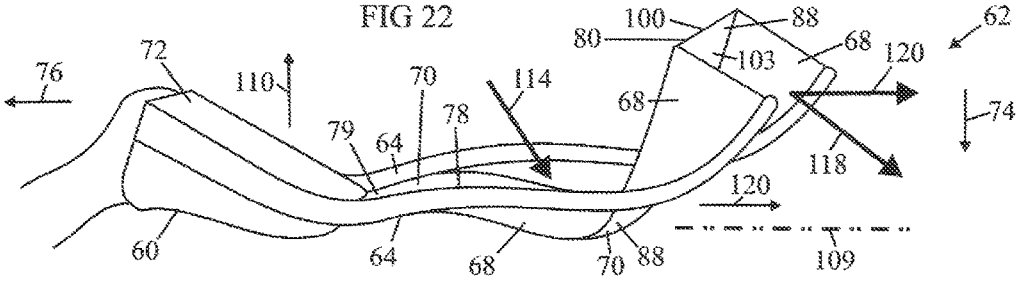
FIG. 22 shows a side perspective view of an alternate embodiment during a kick direction inversion phase of a kicking stroke cycle.

FIG. 22 shows a side perspective view of an alternate embodiment during a kick direction inversion phase of a kicking stroke cycle. The embodiment in FIG. 22 is similar to the embodiment shown in FIG. 17 that uses the same perspective view; however, the embodiment in FIG. 22 is seen to lack a significantly wrinkled membrane portion 170 as shown in FIG. 17, and this is because the embodiment in FIG. 22 uses methods described further below to reduce the formation of an excessively wrinkled portion 170 (as shown in FIG. 17).

Figure 23:
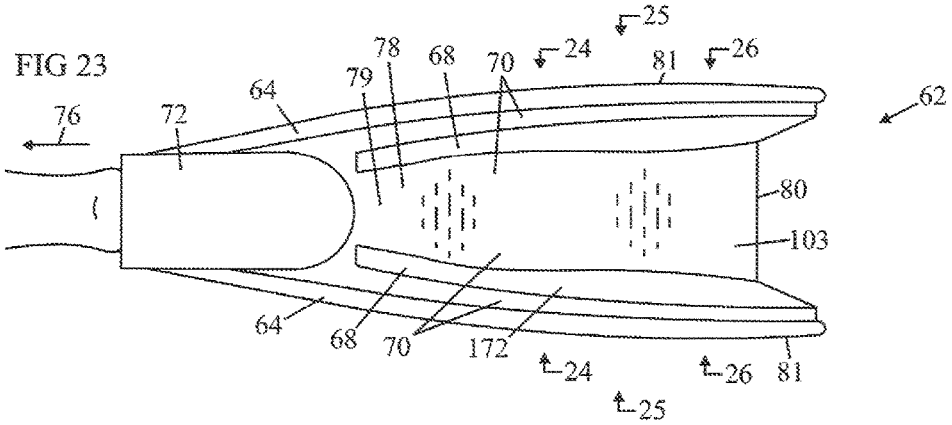
FIG. 23 shows an additional vertical view of the same embodiment shown in FIG. 22 while looking downward from above the view shown in FIG. 22 during the same kick inversion phase shown in FIG. 22.

FIG. 23 shows an additional vertical view of the same embodiment shown in FIG. 22 while looking downward from above the view shown in FIG. 22 during the same kick inversion phase shown in FIG. 22. The embodiment in FIG. 23 is similar to the embodiment shown in FIG. 18 that uses the same perspective view; however, the embodiment in FIG. 23 is seen to lack a significantly wrinkled membrane portion 170 as shown in FIG. 18, and this is because the embodiment in FIG. 22 uses methods described further below to reduce the formation of an excessively wrinkled portion 170 (shown in FIG. 18). While it is possible for wrinkled membrane portion 170, outward bend 172, inward bend 174, and/or vertical bend 176 (shown in FIGS. 19-21) to form in this embodiment or in similar embodiments, it is intended that the embodiment shown in FIGS. 22 to 27 are able to avoid forming such conditions in an amount sufficient to significantly increase the efficiency, comfort, acceleration, and/or top end swimming speeds of the swim fin.

Figure 24:
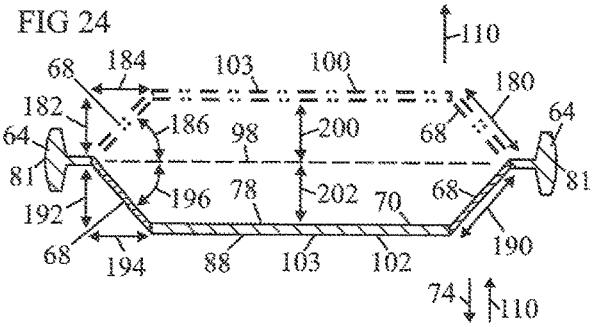
FIG. 24 shows a cross section view taken along the line 24-24 in FIG. 22.

FIG. 24 shows a cross section view taken along the line 24-24 in FIG. 22. In the embodiment in FIG. 24, the broken lines oriented at position permit the observation than when pivoting blade portion 103 is in position 100, then horizontal dimension 184 is seen to be substantially similar to vertical dimension 182 and alignment angle 186 is seen to be approximately 45 degrees. Although pivoting blade portion 103 is seen to be in inverted bowed position 102 under the exertion of water pressure applied against lower surface 78 by flow direction 114 (shown in FIG. 22), the swim fin is arranged to have a predetermined biasing force that biases pivoting blade portion 103 toward bowed position 100, so that when such water pressure in flow direction 114 (shown in FIG. 22) is reduced or eliminated, then pivoting blade portion 103 will automatically move from position 102 back to position 100. The cross sectional view of the embodiment in FIG. 24 shows that while pivoting blade portion 103 is in inverted position 102, membrane 68 is seen to have an, inverted slope alignment 190, an inverted vertical dimension 192, an inverted horizontal dimension 194 and an alignment angle 196, that are substantially symmetrical in a vertical direction to slope alignment 180, vertical dimension 182, horizontal dimension 184, and alignment angle 186. In alternate embodiments, inverted slope alignment 190, inverted vertical dimension 192, inverted horizontal dimension 194 and/or alignment angle 196, can have any desired degree of vertical or horizontal symmetry or asymmetry and can be varied in any desirable manner.

Figure 25:
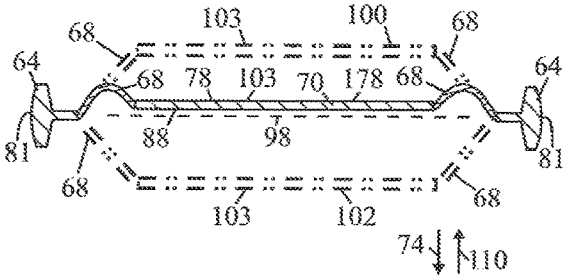
FIG. 25 shows a cross section view taken along the line 25-25 in FIG. 22.

FIG. 25 shows a cross section view taken along the line 25-25 in FIG. 22. In FIG. 25, pivoting blade portion 103 is in a transition position 198 between bowed position 100 and transverse plane of reference 98 and is moving downward in downward stroke direction 74 from position 100 toward plane of reference 98 and toward inverted bowed position 102 under the exertion of water pressure in flow direction 114 (shown in FIG. 22). Because this embodiment in FIG. 25 has a significantly large horizontal dimension 194 relative to vertical dimension 192, membrane 68 is seen to form a significantly smooth gently bending vertical bend 176 that bends around a substantially large bending radius to permit vertical bend 176 and wrinkled membrane portion 170 to avoid significantly resisting, obstructing, or jamming as pivoting blade portion 103 approaches plane of reference 98 and moves toward inverted bowed position 102. When this is combined with the use of significantly flexible material within membrane 68, significantly improved levels of efficiency and propulsion can be created. As one example of an embodiment, membrane 68 can be made with a resilient thermoplastic such as a thermoplastic rubber or thermoplastic elastomer having a Shore A hardness that is substantially between 60 and 85 durometer and a thickness that is substantially between 1.5 mm and 3 mm thick. In other embodiments, membrane 68 can be made with the same material as used for harder portion 70 and pivoting blade portion 103, but with a smaller vertical thickness that used for harder portion 70 in order achieve desired increase in flexibility within membrane 68.

Figure 26:
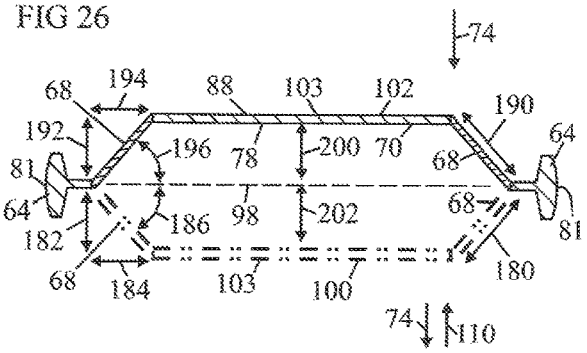
FIG. 26 shows a cross section view taken along the line 26-26 in FIG. 22.

FIG. 26 shows a cross section view taken along the line 26-26 in FIG. 22. In this embodiment shown in FIG. 26, pivoting blade portion 103 is seen to still be in bowed position 100 due to the exertion of predetermined biasing forces within the swim fin that urges portion 103 toward position 100.

Figure 27:
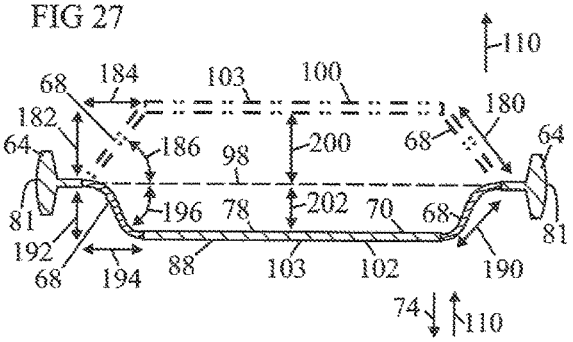
FIG. 27 shows an alternate embodiment of the cross section view shown in FIG. 24 taken along the line 24-24 in FIG. 22.

FIG. 27 shows an alternate embodiment of the cross section view shown in FIG. 24 taken along the line 24-24 in FIG. 22. In FIG. 27, pivoting blade portion 103 is seen to be in inverted position 102 under the exertion of water pressure applied against lower surface 78 by flow direction 114 (shown in FIG. 22); however, the swim fin is arranged to have a predetermined biasing force that is arranged to urge pivoting blade portion 103 toward bowed position 100, so that when such water pressure in flow direction 114 (shown in FIG. 22) is reduced or eliminated, then pivoting blade portion 103 will automatically move from position 102 back to position 100. In the embodiment in FIG. 27, the broken lines show the orientation of blade 62 in bowed position 100 and permit illustrating that blade 62 has a central depth of scoop dimension 200 that exists in the central portion of the scoop shape between bowed position 100 and transverse plane of reference 98 when blade 62 is oriented in bowed position 100.

While pivoting blade portion 103 is oriented in inverted position 102 under the water pressure exerted on lower surface 78 due to flow direction 114 (shown in FIG. 22), the alternate embodiment in FIG. 27 is arranged to have a predetermined biasing force urging portion 103 back toward position 100 with sufficient force to cause inverted position 102 to come to rest at a shorter distance away from plane of reference 98 to form an inverted central depth of scoop 202 that is smaller than depth of scoop 200 that exists when portion 103 is in bowed position 100. In this embodiment, while portion 103 is in inverted position 102, membranes 68 are seen to not be fully expanded and have taken on a partially bent transverse shape. This bent shape and/or not fully expanded condition of membranes 68, along with the comparatively smaller dimension of inverted depth of scoop 202 compared with the opposing depth of scoop 200, can be the result of an increased predetermined biasing force being exerted within the material of membranes 68, exerted within the material of harder blade portion 70 where pivoting blade portion 103 is connected in a pivotal manner around a transverse axis near foot pocket 60 (as previously described in exemplified alternative embodiments), and/or exerted upon any portion of blade 62 in any desirable manner with any suitable biasing device or method.

Although the example here is a cross sectional view taken along the line 24-24 in FIG. 22 while pivoting blade portion 102 is experiencing a longitudinal sinusoidal wave form during an inversion phase of a reciprocating stroke cycle, this cross sectional view in FIG. 27 (as well as all cross sectional views in this description and described examples of variations thereof) can also exist when little or no sinusoidal wave is created during inversion phases of reciprocating strokes and where a majority or the entirety of pivoting blade portion 103 moves substantially in unison back and forth between bowed position 100 and inverted position 102 during reciprocating strokes, and/or during the partially or fully deflected positions that exist between inversion phases as illustrated in the side perspective views exemplified in FIGS. 1-8, 11-16, or other variations illustrated and/or described in this specification.

Inverted depth of scoop 202 shown in FIG. 27 can either remain constant while pivoting blade portion is in inverted position 102 regardless of kicking force or degree of water pressure exerted upon portion 103 during use, or depth of scoop 202 can be arranged to vary according to changes in kicking stroke strength and exertion of water pressure during use. For example, depth of scoop 202 can be arranged to be significantly smaller when significantly light kicking forces are used such as when swimming at a significantly slow pace and then depth of scoop 202 can be arranged to become larger in a vertical dimension and further expand enduring increased kicking force and water pressure, such as created during a substantially moderate kick force used to achieve a substantially moderate swimming speed or when maneuvering with substantially moderate maneuvering kick force, and/or during a significantly a substantially hard kick force used to achieve a substantially high swimming speed or when maneuvering with substantially high maneuvering kick force. In such situations, the bent and not fully expanded membranes 68 shown in the example in FIG. 27 can exist during substantially light kicking strokes and can further expand when kicking force is increased to substantially moderate kicking forces and/or substantially high kicking forces. This can allow the vertical dimension of inverted depth of scoop 202 to be arranged to increase in size so that it can approach, equal, or exceed the vertical dimension of depth of scoop 200 as desired. In alternate embodiments, the vertical dimension of depth of scoop 202 can be arranged to be any desired dimension, including substantially large depths, substantially small depths, substantially near or at a zero depth or no depth, or a negative depth where inverted position 102 is partially or fully located in an area between transverse plane of reference 98 and bowed position 100 under the exertion of water pressure created during use. While some of the embodiments including having a significantly large inverted depth of scoop 202, alternate embodiments can further reduce or eliminate inverted depth of scoop 202 either during substantially light kicking stroke forces, during most kicking stroke forces, or during substantially all kicking stroke forces.

In this embodiment shown in FIG. 27, the transversely bent shape of membranes 68 that exists while portion 103 is in position 102 causes a significant portion of membranes 68 to have an increased slope alignment 204 having an alignment angle 206 between increased slope alignment 204 and transverse plane of reference 98. As a result, increased slope alignment 204 and alignment angle 206 during position 102 are seen to have a significantly higher degree of inclination than that which exists in slope alignment 180 and alignment angle 186 during position 100, respectively. In this situation, horizontal dimension 184 can be arranged to remain significantly large when blade 62 is in inverted position 102 so that membrane 68 can be arranged to avoid experiencing excessive restriction, jamming, blocking, obstruction, or resistance as pivoting blade portion 103 moves back and forth between position 100 and 102 during use. Also, the embodiment of arranging at least one portion of the swim fin to exert a predetermined biasing force that urges pivoting blade portion 103 in a direction from position 102 to position 100, such biasing force can be used to help move membranes 68 back from position 102 toward position 100 with increased efficiency, increased speed, increased movement of water in the opposite direction of intended swimming, increased propulsion, increased acceleration, increased maneuverability, increased ease of use, reduced duration of inversion, reduced delay, reduced lost motion, reduced muscle strain, reduced muscle cramping, reduced kicking effort, and increased performance. Furthermore, alternate embodiments can further include arranging the material within membranes 68 to experience increased resistance to bending to a desired degree so that such resistance to bending can be used to increase the total biasing forces within the swim fin that are arranged to urge pivoting blade portion 103 in a direction from position 102 toward position 100.

Figure 28:
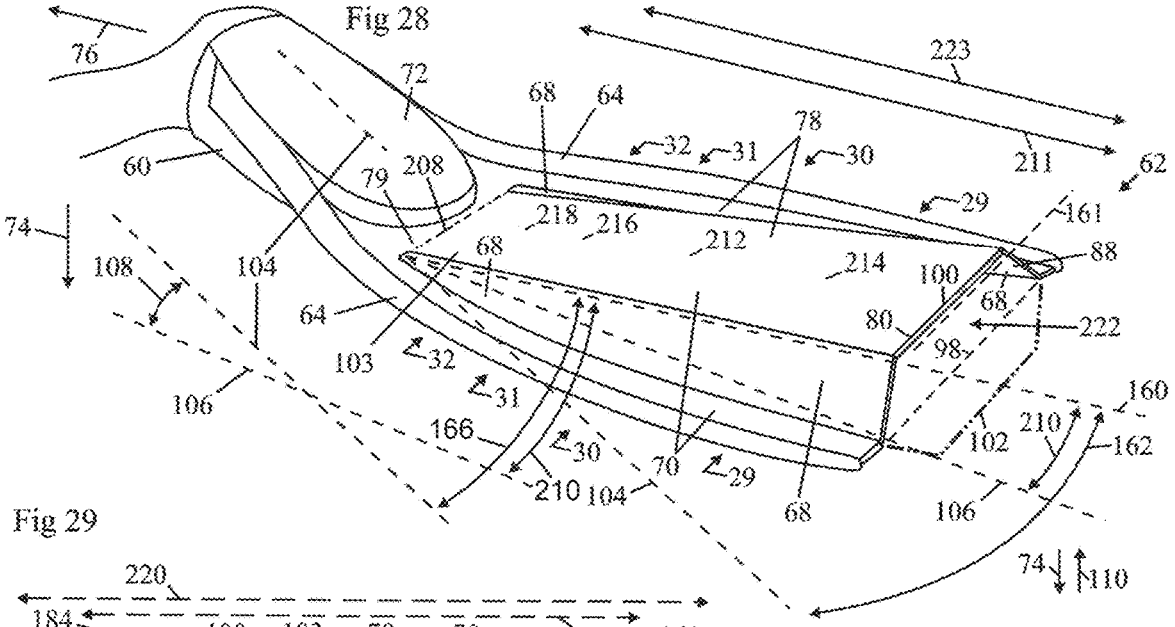
FIG. 28 shows a perspective view of an alternate embodiment.

FIG. 28 shows a perspective view of an alternate embodiment. In this embodiment, pivoting blade portion 103 is seen to be connected to root portion 79 with a transverse bend 208 (shown by a broken line). In this embodiment in FIG. 28, harder portion 70 within pivoting blade portion 103 is seen to have pivoting portion lengthwise blade alignment 160 that has an inclined planar orientation that diverges in a vertical manner further away from transverse plane of reference 98 along the length of pivoting blade portion 103 in a direction from transverse bend 208 to trailing edge 80. While This vertically divergent inclination of pivoting blade portion 103 begins to form at transverse bend 208 so that transverse bend 208 forms at the intersection of two planes, which is the intersection of the inclined plane that exist along inclined portions of harder portion 70 within pivoting blade portion 103 and portions of harder portion 70 that are within transverse plane of reference 98 along root portion 79 in between foot pocket 60 and transverse bend 208. In this embodiment, the divergent inclination of pivoting blade portion 103 is seen to start at transverse bend 208 and is illustrated by pivoting portion lengthwise blade alignment 160 (shown by dotted lines), and is also illustrated by an angle 210 between alignment 160 and alignment 106. In this embodiment, angle 210 can be arranged to at least 2 degrees, at least 3 degrees, at least 5 degrees, at least 7 degrees, at least 10 degrees, at least 15 degrees, at least 20 degrees, between 5 degrees and 10 degrees, between 5 degrees and 15 degrees, between 5 degrees and 20 degrees, between 5 degrees and 25 degrees, between 7 degrees and 25 degrees, or between 10 degrees and 25 degrees. In alternate embodiments, angle 210 can be any desired angle, a zero or no angle, any positive angle of divergence, any negative angle of convergence, or any alternations or combinations of such angles. In other alternate embodiments, pivoting portion lengthwise blade alignment 160 can have any desired alignment, including any divergent and/or convergent alignment, and can have any desired alternating, undulating, changing or reversing alignments. In the embodiment in FIG. 28, while pivoting blade portion 103 and harder portion 70 are urged by a predetermined biasing force to be positioned at bowed position 100 at rest, harder portion 70 is seen to be located within a harder portion transverse plane of reference 161 (shown by dotted lines) that vertically spaced in an orthogonal direction from transverse plane of reference 98.

The material within transverse bend 208 may be arranged to create a predetermined biasing force that urges at least a significant portion of, a majority of, or all of pivoting blade portion 103 away from transverse plane of reference 98 and away from lengthwise blade alignment 106 and urges pivoting blade portion 103 toward bowed position 100 and toward pivoting portion lengthwise blade alignment 160 while the swim fin is at rest, either while immersed in water and/or while at rest out of the water. Transverse bend 208 may be formed during a phase of an injection molding process and may be made with at least one resilient thermoplastic material that is used to make root portion 79, transverse bend 208, and harder portion 70 of pivoting blade portion 103, so that at least one portion of root portion 79, at least one portion of transverse bend 208, and at least one portion of pivoting blade portion 103 are integrally molded together and/or secured with at least one thermochemical bond during at least one phase of an injection molding process. This method permits the resilient material within vertical bend 208 to create sufficient elastic tension to substantially maintain pivoting blade portion 103 along pivoting portion lengthwise blade alignment 160 while simultaneously maintaining the orientation of root portion 79 and stiffening members 64 along longitudinal blade alignment 106 and along transverse plane of reference 98 while the swim fin is at rest. In other alternate embodiments, any additional biasing members can be used in conjunction with or in substitution with transverse bend 208, such as at least one transversely aligned resilient rib member, at least one longitudinally aligned resilient rib member, at least one resilient rib member oriented at any desired angle to the lengthwise alignment of blade 62, at least one resilient longitudinal rib member having longitudinally spaced notches of reduced vertical height disposed along the length of such rib member, at least one transversely aligned groove member having at least one elongated grove of reduced material thickness that extends in a substantially transverse direction at or near root portion and/or transverse bend 208 and/or pivoting portion 103, or any other variations as desired, that can be used to provide the biasing force in any suitable manner and/or to provide a suitable stopping device to substantially stop further pivoting of pivoting blade portion 103 at a desired predetermined amount of deflection.

In FIG. 28, blade member 62 is seen to have a longitudinal blade length 211 between root portion 79 and trailing edge 80. Blade 62 has a longitudinal midpoint 212 along longitudinal blade length 211 between root portion 79 and trailing edge 80, a three quarters blade position 214 between midpoint 212 and trailing edge 80, a one quarter blade position 216 between midpoint 212 and root portion 79, and a one eighth blade position 218 between quarter blade position 216 and root portion 79. In this embodiment in FIG. 28, it can been seen that while blade 62 is arranged to be in bowed position 100, the area between and stiffening members 64 and pivoting blade portion 103 and transverse plane of reference 98 form a predetermined scoop shaped region 222 that is significantly large in a transverse direction to channel a significantly large cross sectional area of water, and that extends in a significantly large longitudinal direction between root portion 79 and trailing edge 80. In some embodiments, a significantly large transverse cross sectional area of predetermined scoop shaped region 222 is extended along significantly large longitudinal dimension of blade 62 to permit significantly high volumes of water to be channeled within predetermined scoop shaped region 222. The use of predetermined biasing forces to urge pivoting blade portion 103 and predetermined scoop shaped region 222 toward bowed position 100, permits instant propulsion of high volumes of channeled water during downward stroke direction 74 with significantly reduced or even substantially eliminated lost motion during downward stroke direction 74, and a substantially assisted, rapid and efficient movement of pivoting blade portion 103 back toward bowed position 100 at the end of an oppositely directed stroke (upward stroke direction 110 shown in other Figs) in a direction from inverted position 102 and/or from transverse plane of reference 98 toward bowed position 100, so that lost motion is significantly reduced or substantially eliminated during such stroke inversion from position 100 toward position 102 due to reduced delay in inverting the large scoop shape. This creates a major improvement in performance by allowing larger scoop shapes and volumes to channel water without the larger delays and lost motion that would occur as substantially larger amounts of kick stroke durations are used up attempting to get the large scoop shapes to invert and reform between strokes.

In the embodiment in FIG. 28, it can be seen that predetermined scoop shaped region 222 has a longitudinal scoop dimension 223 that extends in a longitudinal direction along substantially the entire longitudinal blade length 211 between root portion 78 and trailing edge 80 of blade 62. In alternate embodiments, the percentage ratio of longitudinal scoop dimension 223 to longitudinal blade length 211 can be arranged to be at least 95%, at least 90%, at least 85%, at least 80%, at least 75%, at least 70%, at least 65%, at least 60%, at least 50%, at least 45%, at least 40%, at least 35%, at least 30%, and at least 25%. In alternate embodiments, the percentage ratio of longitudinal scoop dimension 223 to longitudinal blade length 211 can be arranged to be any desired percentage.

Figure 29:
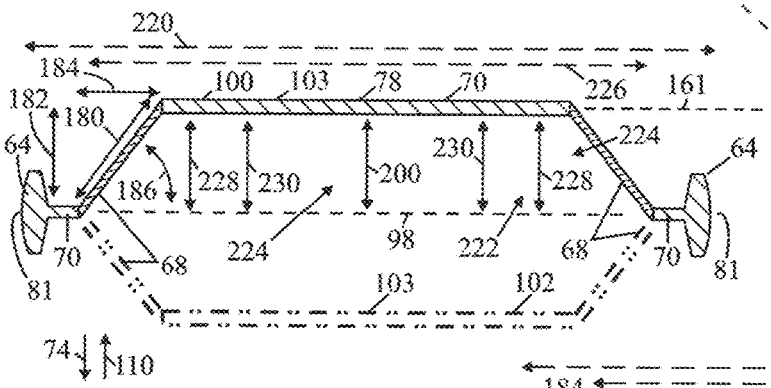
FIG. 29 shows a cross section view taken along the line 29-29 in FIG. 28.

FIG. 29 shows a cross section view taken along the line 29-29 in FIG. 28 that passes through three quarters blade position 214 in FIG. 28. The cross sectional view in FIG. 29 shows the swim fin at rest while pivoting blade portion 103 in bowed position 100 above transverse plane 98 (from this view) due to the exertion of a predetermined biasing force exerted upon pivoting blade portion 103 and urging portion 103 toward position 100. In this particular embodiment, inverted position 102 (shown by broken lines) is arranged to have a shape that is substantially symmetrical to bowed position 100 in a vertical direction. In bowed position 100, stiffening members 64, pivoting blade portion 103 and membranes 68 are seen to have a transverse blade region dimension 220 that extends in a transverse direction between outer side edges 81. Pivoting blade portion 103 and membranes 68 are biased away from transverse plane of reference 98 and toward bowed position 100 to form predetermined scoop shaped region 222 that has a predetermined scoop shaped cross section area 224 existing in the area that is between pivoting blade portion 103, membranes 68, and transverse plane of reference 98. Scoop shaped cross section area 224 is seen to have a central depth of scoop dimension 200. Scoop shaped cross section area 224 is seen to have a transverse scoop dimension 226 (shown by dotted lines) that is significantly large in comparison to transverse blade region dimension 220 (shown by dotted lines). The percentage ratio of transverse scoop dimension 226 to transverse blade region dimension 220 may be at least 50%, at least 60%, at least 65%, at least 70%, at least 75%, at least 80%, at least 90%, or at least 95%. In alternate embodiments, any desired percentage ratio of transverse scoop dimension 226 to transverse blade region dimension 220 can be used.

While the embodiment in FIGS. 28 to 32 show that predetermined scoop shaped region 222 has one large scoop shape extending across a significantly large portion of transverse blade region dimension 220, alternate embodiments can use any desired number of side-by-side scoop-like contours and/or escalating terraced scoop-like contours that together make up predetermined scoop shaped region 222 and together make up the total cross sectional area dimension within scoop shaped cross section area 224.

In FIG. 29, central depth of scoop dimension 200 is seen to be at the transverse midpoint of transverse blade region dimension 220 (shown by dotted lines). In between central depth of scoop dimension 200 and each outer side edge 81 is a one quarter transverse position depth of scoop 228 that represents the scoop depth at a position that is one quarter of the overall transverse distance inward from each side edge 81. A one third position depth of scoop 230 is seen on either side of central depth of scoop dimension 200 at a position that is one third of the transverse distance inward from each outer side edge 81 along transverse blade region dimension 220. In the embodiment in FIG. 29, pivoting blade portion 103 is seen to be flat and level in a transverse direction so that central depth of scoop dimension 200, one quarter transverse position depth of scoop 228, and one third position depth of scoop 230 are all seen to have the same vertical dimension; however, in alternate embodiments, pivoting blade portion 103 can have any desired shapes, contours, curves, oscillations, bends, angles, inclinations, or any other desired form. The central depth of scoop dimension 200, one quarter transverse position depth of scoop 228, and/or one third position depth of scoop 230 may be at least 5% of transverse blade region dimension 220 at three quarters blade position 214 shown in this cross sectional view in FIG. 29 and/or at trailing edge 80 (shown in FIG. 28) and/or at any other desired position along the longitudinal length of blade 62 (shown in FIG. 28). In alternate embodiments, the ratio of central depth of scoop dimension 200, one quarter transverse position depth of scoop 228, and/or one third position depth of scoop 230 to transverse blade region dimension 220 can be arranged to be at least 3%, at least 7%, at least 10%, at least 15%, at least 20%, at least 25%, and at least 30%, at three quarters blade position 214 shown in this cross sectional view in FIG. 29 and/or at trailing edge 80 (shown in FIG. 28) and/or at any other desired position along the longitudinal length of blade 62 (shown in FIG. 28).

An example of some embodiments of the view in FIG. 29 can arrange the square dimensional area within predetermined scoop shaped cross sectional area 224 at three quarters blade position 214 to equal at least the square of 20% of transverse blade region dimension 220, at least the square of 25% of transverse blade region dimension 220, at least the square of 30% of transverse blade region dimension 220, at least the square of 35% of transverse blade region dimension 220, at least the square of 40% of transverse blade region dimension 220, at least the square of 45% of transverse blade region dimension 220, at least the square of 50% of transverse blade region dimension 220, at least the square of 55% of transverse blade region dimension 220, at least the square of 60% of transverse blade region dimension 220. Alternate embodiments can arrange the square dimensional area within predetermined scoop shaped cross sectional area 224 at three quarters blade position 214 to equal at least the square of 10% of transverse blade region dimension 220, at least the square of 15% of transverse blade region dimension 220, at least the square of 17% of transverse blade region dimension 220, or can have any desired square dimensional area or computation.

For example, in an embodiment that is arranged to have the square dimensional area within predetermined scoop shaped cross sectional area 224 at three quarters blade position 214 equal to the square of 30% of a 22 cm transverse blade region dimension 220, then 30% times 22 cm equals 6.6 cm, and the square of 6.6 cm (6.6 cm times 6.6 cm) equals a 43.56 $cm^2$ predetermined scoop shaped cross sectional area 224. If transverse scoop dimension 226 (of scoop shaped cross sectional area 224) is arranged to be 80% of the 22 cm transverse blade region dimension 220 in this cross section, which equals a 17.6 cm transverse scoop dimension, then the overall "average" vertical dimension of the depth of scoop across transverse scoop dimension 226 can be computed by dividing the 43.56 $cm^2$ predetermined scoop shaped cross sectional area 224 by the 17.6 cm transverse scoop dimension 220, to equal an overall average vertical dimension of the depth of scoop (including any individual variations at depth of scoops 200, 228 and 230) of 2.475 cm across transverse scoop dimension 220.

Figure 30:
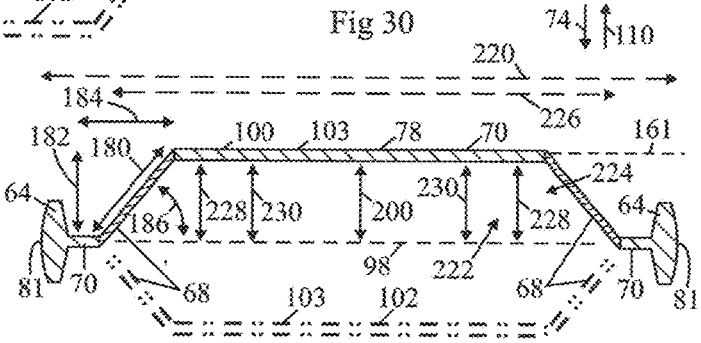
FIG. 30 shows a cross section view taken along the line 30-30 in FIG. 28.

FIG. 30 shows a cross section view taken along the line 30-30 in FIG. 28 that passes through longitudinal midpoint 212 in FIG. 28. The embodiment shown in cross section view in FIG. 30 has smaller vertical dimensions of depths of scoop 200, 228 and 230 than shown in FIG. 29 because of the inclined orientation of alignment 160. The alternate embodiments, variations, angles, ratios, percentages, and/or computations discussed in FIG. 29 (as well as in any other portions of this specification) can also be applied to FIG. 28. Any other desired variations may be used as well.

Figure 31:
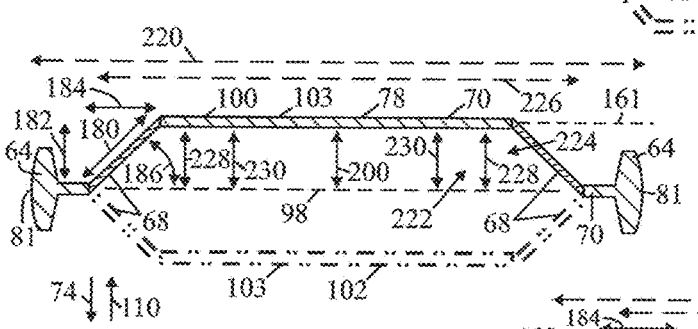
FIG. 31 shows a cross section view taken along the line 31-31 in FIG. 28.

FIG. 31 shows a cross section view taken along the line 31-31 in FIG. 28 that passes through one quarter blade position 216 in FIG. 28. The embodiment shown in cross section view in FIG. 31 has smaller vertical dimensions of depths of scoop 200, 228 and 230 than shown in FIGS. 29 and 30 because of the inclined orientation of alignment 160. The alternate embodiments, variations, angles, ratios, percentages, and/or computations discussed in FIG. 29 (as well as in any other portions of this specification) can also be applied to FIG. 31. Any other desired variations may be used as well.

Figure 32:
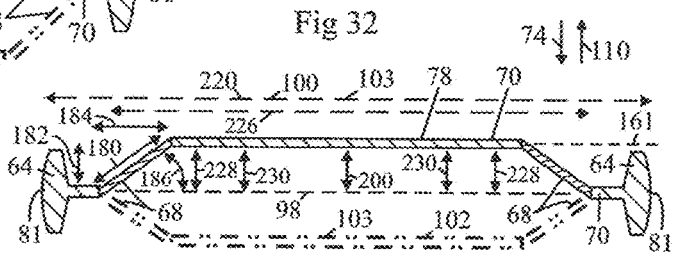
FIG. 32 shows a cross section view taken along the line 32-32 in FIG. 28.

FIG. 32 shows a cross section view taken along the line 32-32 in FIG. 28 that passes through one eighth blade position 218 in FIG. 28. The embodiment shown in cross section view in FIG. 32 has smaller vertical dimensions of depths of scoop 200, 228 and 230 than shown in FIGS. 29, 30 and 31 because of the inclined orientation of alignment 160. The alternate embodiments, variations, angles, ratios, percentages, and/or computations discussed in FIG. 29 (as well as in any other portions of this specification) can also be applied to FIG. 32. Any other desired variations may be used as well.

Looking at FIGS. 28-32 together, it can be seen that examples of total volume of water channeled within predetermined scoop shaped region 222 can be arranged, chosen and determined. By first looking at FIG. 28 and determining the longitudinal dimension and/or percentage of the longitudinal dimension of blade 62 that is desired to have predetermined scoop shaped cross sectional area 224, then determining the average predetermined scoop shaped cross sectional area 224 (including variations), and then multiplying such average desired predetermined scoop shaped cross sectional area 224 across a desired longitudinal dimension of blade 62, overall desired volumes of water within the length of predetermined scoop shaped region 222 can be determined as a general guide for various embodiments. By looking at the average of predetermined scoop shaped cross sectional areas 224 exemplified at each of cross sectional FIGS. 29-32 taken along the longitudinal length of blade 62 in FIG. 28 at three quarters blade position 214, midpoint blade position 212, one quarter blade position 216, and one eighth blade position 218 in FIG. 28, respectively, as well as by considering similar computations of cross section area dimensions at any other desired cross sectional position along scoop length 223, including but not limited at trailing edge 80 and at or near root portion 79 as desired, an average cross sectional area for predetermined scoop shaped region 222 along scoop length 223 can be arranged or planned as desired. While individual designs can utilize exact computations and specific design preferences and contours, etc., the general guidelines described herein can be used to permit a greater understanding of some volumes for some embodiments.

An example of one embodiment can have the overall volume within predetermined scoop shaped region 222 be at least equal to the following: the square of 20% of transverse blade region dimension 220, divided by 2 to create a rough average of changing predetermined scoop shaped cross sectional area 224 along scoop length 223, multiplied by a scoop length 223 that is 50% of longitudinal blade length 211.

Another example of an embodiment can have the overall volume within predetermined scoop shaped region 222 be at least equal to the following: the square of 30% of transverse blade region dimension 220, divided by 2 to create a rough average of changing predetermined scoop shaped cross sectional area 224 along scoop length 223, multiplied by a scoop length 223 that is 75% of longitudinal blade length 211.

Another example of an embodiment can have the overall volume within predetermined scoop shaped region 222 be at least equal to the following: the square of 30% of transverse blade region dimension 220, divided by 2 to create a rough average of changing predetermined scoop shaped cross sectional area 224 along scoop length 223, multiplied by a scoop length 223 that is 75% of longitudinal blade length 211.

Another example of an embodiment can have the overall volume within predetermined scoop shaped region 222 be at least equal to the following: the square of 40% of transverse blade region dimension 220, divided by 2 to create a rough average of changing predetermined scoop shaped cross sectional area 224 along scoop length 223, multiplied by a scoop length 223 that is 40% of longitudinal blade length 211.

Another example of an embodiment can have the overall volume within predetermined scoop shaped region 222 be at least equal to the following: the square of 30% of transverse blade region dimension 220, divided by 2 to create a rough average of changing predetermined scoop shaped cross sectional area 224 along scoop length 223, multiplied by a scoop length 223 that is approximately 100% of longitudinal blade length 211 (as seen in FIG. 28). To further illustrate this example, the same prior computation described previously in FIG. 29 for predetermined scoop shaped cross sectional area 224 at three quarters position 214 is being repeated here as if such computation were instead made at trailing edge 80, so that a 22 cm transverse blade region dimension 220 would have a 43.56 $cm^2$ predetermined scoop shaped cross sectional area 224, along with a zero predetermined scoop shaped cross sectional area 224 at root portion 79, so that a rough approximation of the average between these two points is 43.56 $cm^2$ divided by 2 equals 21.78 $cm^2$ for an average of predetermined scoop shaped cross sectional area 224 along scoop length 223. If longitudinal blade length 211 is selected to be 33 cm in this example and scoop length 223 is selected to be approximately 100% of the 33 cm longitudinal blade length 211, then scoop length 223 would also be 33 cm. Multiplying a 33 cm scoop length 223 by a 21.78 $cm^2$ (33 cm times 21.78 $cm^2$) creates an average of predetermined scoop shaped cross sectional area 224 along scoop length 223 that is approximately 719 $cm^3$ (cubic centimeters), which is equals approximately 0.7 liters for blade that is 22 cm wide and 33 cm long in such example of one embodiment. In alternate embodiments, any desired volume may be used for predetermined scoop shaped cross sectional area 224.

Looking at FIGS. 28-32 together, alternate embodiments can including arranging the biasing forces to urge pivoting blade portion 103 toward inverted position 102 rather than bowed position 100, so that pivoting blade portion 103 is inclined downward below transverse plane of reference 98 when the swim fin is at rest. This can be arranged to create increased propulsion during upward stroke direction 110, and can allow pivoting blade portion 103 to rapidly snap back from bowed position 100 toward inverted position 102 at the end of a downward kick stroke in downward stroke direction 74 so that the predetermined biasing force urging portion 103 toward position 102 at the end of downward stroke direction 74 can be arranged to further assist in pushing water in the opposite direction of direction of travel 76. In other alternate embodiments, the location and direction of predetermined biasing forces can be varied in any manner. As one example, portions of pivoting blade portion 103 near root portion 79 can be arranged to be biased toward inverted position 102 while portions of pivoting blade portion 103 near trailing edge 80 are biased toward bowed position 100, or vice versa. In other embodiments, one, several or all portions of pivoting blade portion 103 can be arranged to be substantially less movable, unmovable, or fixed in a desired orientation toward or at bowed position 100 and/or inverted position 102, and any portions of pivoting blade portion 103 that are desired to be movable can be arranged to be biased toward bowed position 100 or inverted position 102. Any of the embodiments discussed in this specification and any alternate embodiments can also be arranged to have any portion or all portions of pivoting blade portion biased toward inverted position 102, and any features or variations can be combined, substituted, interchanged or varied in any desired manner.

Figure 33:
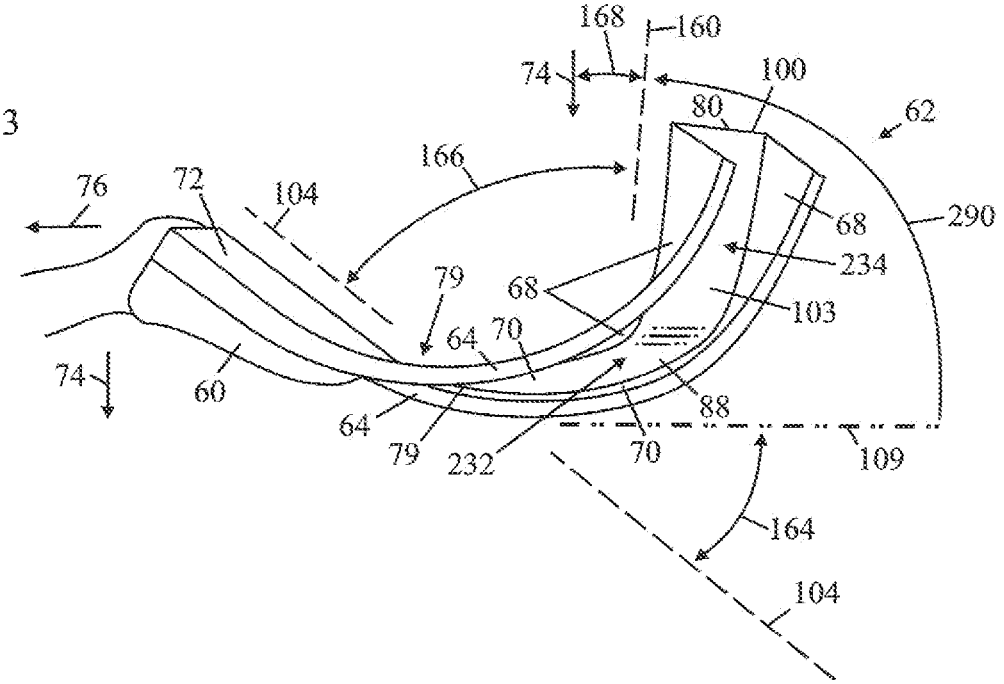
FIG. 33 shows a side perspective view of an alternate embodiment during a downward kick stroke phase of a kicking cycle.

FIG. 33 shows a side perspective view of an alternate embodiment during a downward kick stroke phase of a kicking cycle. In the embodiment in FIG. 33, harder portion 70 of pivoting blade portion 103 is sufficiently flexible along the longitudinal length of pivoting blade portion 103 between root portion 79 and trailing edge 80 to cause harder portion 70 to experience a structural collapse zone 232 (shown by shaded lines) that causes zone 232 to experience a significantly large amount of focused bending around a transverse axis under the exertion of water pressure created during downward stroke direction 74. Structural collapse zone 232 causes the outer portion of pivoting blade portion 103 between zone 232 and trailing edge 80 to become a collapsed region 234 that has pivoted around a transverse axis near or at zone 232 to a significantly reduced angle where pivoting portion lengthwise blade alignment 160 is seen to be substantially vertical between zone 232 and trailing edge 80. This collapsed region 234 causes pivoting blade alignment 160 to be oriented at angle 166 which is seen to be approximately 45-50 degrees in this example, and angle of attack 168 is significantly close to or at zero due to alignment 160 being substantially parallel to downward stroke direction 74. Similarly, as this example has neutral position 109 aligned substantially parallel to intended direction of travel 76 and substantially perpendicular to downward kicking stroke direction 74, lengthwise blade alignment 160 is seen to be at a reduced angle of attack 290 relative to neutral position 109 wherein angle 292 is seen to be substantially close to 90 degrees relative to neutral position 109 and direction of travel 76. This causes a collapsed region 234 in this example to behave substantially like a flag in the wind so that it more likely to direct water vertically and less able to direct water in the opposite direction of intended direction of travel 76 during downward kicking stroke direction 74. Also, because the near zero degree of angle of attack 168, collapsed region 234 in this example creates significantly reduced overall leverage against the portions of pivoting blade portion 103 that are between collapse zone 232 and root portion 79 during downward kicking stroke direction 74, as well as resultant reduced leverage against the portions of stiffening members 64 between collapse zone 232 and root portion 79 during downward kicking stroke direction 74. This reduced leverage of water pressure against blade 62 can causes blade 62 to experience reduced leverage against the water and resultant reductions in efficiency and propulsion compared to more embodiments that are arranged to experience either lower degrees of collapse, more controlled bending, and or reduce or even eliminate excessive levels of transverse bending and/or collapse. The reduced leverage caused by collapse zone 232 and collapsed region 234 can also inhibit or even prevent stiffening members 64 from pivoting near foot pocket 60 so that there is reduced snap back energy at the end of a kicking stroke and so that the portions of blade portion 103 between collapse zone 232 and root portion 79 do not pivot to a sufficiently reduced angle of attack to push water behind the swimmer and instead push water in downward in downward direction 74. However, in alternate embodiments, any amount degree or positioning of one or more areas of collapse zone 232 or the like can be arranged to occur if desired.

Figure 34:
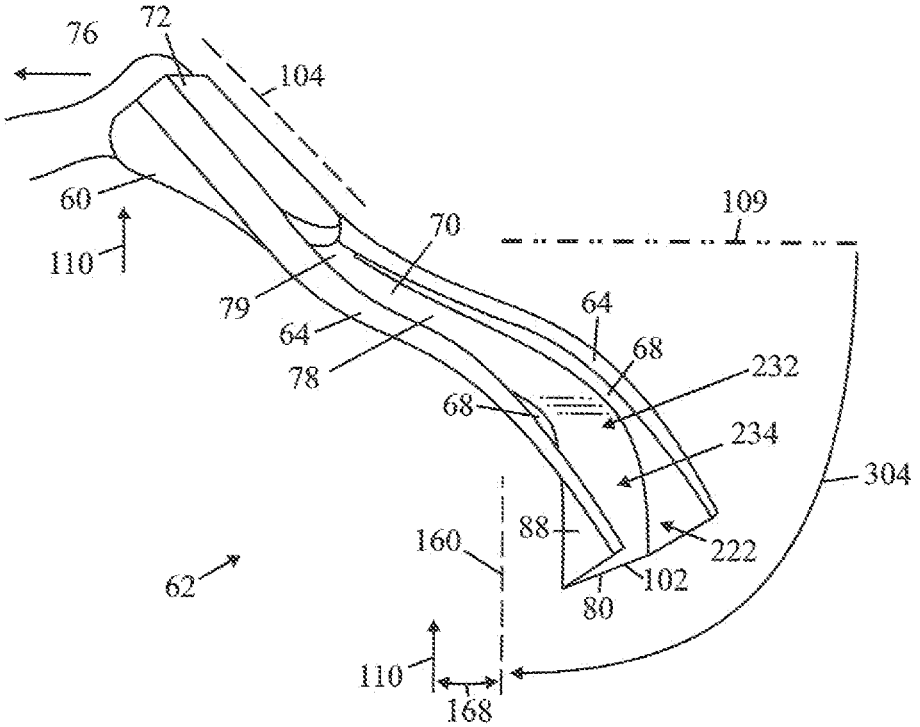
FIG. 34 shows the same embodiment shown in FIG. 33 during an upstroke phase of a kicking stroke cycle.

FIG. 34 shows the same embodiment shown in FIG. 33 during an upstroke phase of a kicking stroke cycle. FIG. 34 is seen to flex during upward stroke direction 110 in a similar manner as seen in FIG. 33 during downward stroke direction 4. In FIG. 34, collapsed region 234 is seen to cause nearby alignment 160 to be substantially aligned with upward stroke direction 110 so that angle of attack 168 is significantly small, close to zero or at zero, and angle 304 between alignment 160 and neutral position 109 (and direction of travel 76) is approximately 90 degree, near 90 degrees or at 90 degrees, so that in this particular example the results occurring during upstroke kicking stroke direction 110 in FIG. 34 can have similar to the results described in FIG. 33 during downward stroke direction 74. While such orientations can be used in alternate embodiments, these can be less desired during static vertical stroke directions 74 and/or 110.

Such reduced angles of attack 304 (or angle of attack 290 shown in FIG. 33) of approximately 90 degrees or substantially near 90 degrees can be arranged to occur on at least a portion of the outer half of the length of blade member 62 during inversion phases of reciprocating kicking stroke cycles such as exemplified in FIGS. 5, 17, 22, 54, 74 and 77, including during increased loading conditions, including during relatively hard kicking strokes used to accelerate substantially quickly and/or to reach significantly high swimming speeds as well as during significantly rapid repetitions and/or high frequency repetitions of successive inversion stroke portions of a reciprocating kicking stroke cycle.

Looking at both FIGS. 33 and 34 permits explaining that methods including providing pivoting blade portion 103 with a sufficient stiffness in a longitudinal direction between root portion 79 and trailing edge 80 to significantly reduce the tendency for pivoting blade portion 103 to experience excessive bending and/or collapsing around a transverse axis in a manner that can cause a significant reduction in the volume of water than can be channeled through scooped shape region 222 during use in the opposite direction as intended direction of travel 76. For example, the methods can include using at least one or more longitudinal stiffening members secured to pivoting blade portion in any desirable manner that can reduce or prevent excessive structural collapse of portion 103 around a transverse axis, such as stiffening member 154 shown in FIG. 13, for example. Any desired method for providing suitable structural support may be used in alternate embodiments.

Figure 35:
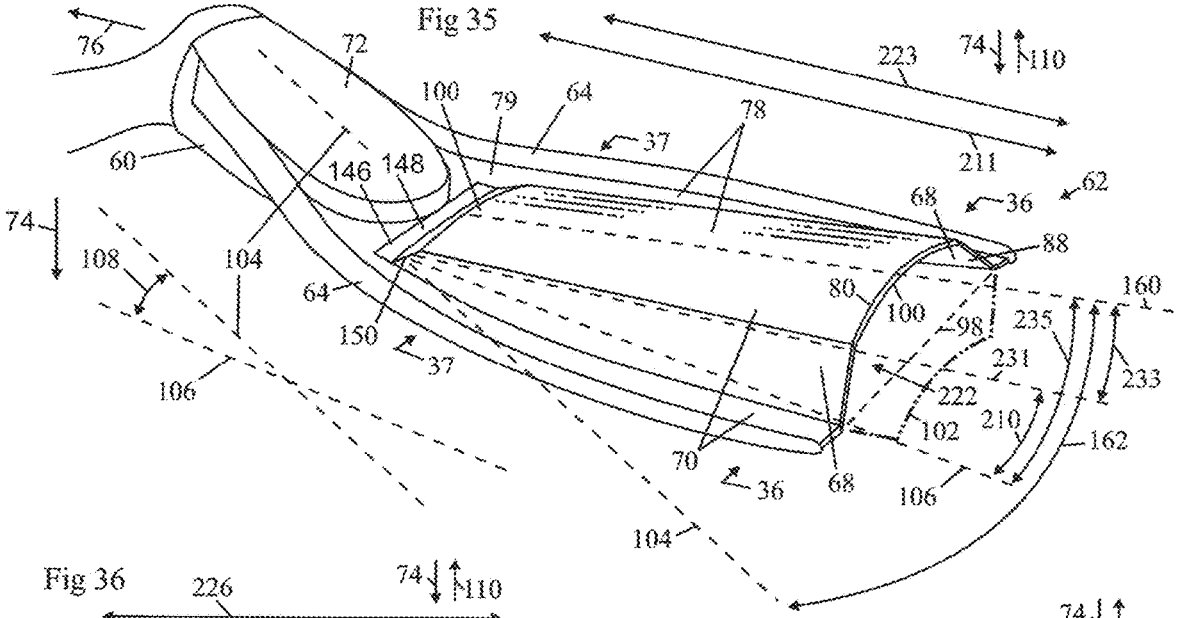
FIG. 35 shows a perspective view of an alternate embodiment.

FIG. 35 shows a perspective view of an alternate embodiment. In this embodiment, lower surface 78 of harder portion 70 and pivoting blade portion 103 are seen to be convexly curved around a lengthwise axis along scoop length 223 between the beginning of sloped portion 150 and trailing edge 80, while the opposing surface of upper surface 88 (not shown in this view) of harder portion 70 and pivoting blade portion 103 is seen to be concavely curved as viewed from trailing edge 80, which is concave down in this view relative to predetermined scoop shaped region 222 that is between transverse plane of reference 98 and bowed position 102. This curved shape may be created during molding and the material used may be a resilient thermoplastic material that is arranged to be biased toward retaining and/or springing back to this curved shape when flexed. This shape, and variations thereof, can be used to provide multiple benefits. For example, this shape can be used to increase the volume within predetermined scoop shaped region 222 as seen at trailing edge 80. In addition, by extending this curved shape over scoop length 223, this curved shape creates increased structural integrity and stiffness that can significantly control, reduce or eliminate excessive bending backward around a transverse axis along scoop length 223 and/or collapsing around a transverse axis under the exertion of water pressure created during downward stroke direction 74 (as shown in FIG. 33). Tests with this embodiment show that the curved shape can be used to control such backward bending with similar effectiveness as using a lengthwise stiffening member attached to pivoting blade portion 103, and additional benefits can be derived as well. Also, the curved shape can be made with sufficiently resilient material so that if some degree of backward bending along scoop length 223 is permitted and/or arranged to occur under the exertion of water pressure during use in downward kick direction 74, which can cause such a curved shape to flatten), then such resiliency can cause this curved shape to quickly snap back from a substantially flattened condition to a the prior curved condition for an increased snapping motion at the end of a kicking stroke and/or during inversion phases of reciprocating kicking strokes. In addition, resiliency of the material within pivoting blade portion 103 can be used to provide additional biasing force to urge pivoting blade portion 103 away from transverse plane of reference 98 and toward bowed position 100.

In FIG. 35, blade alignment 160 (shown by dotted lines) while the swim fin is at rest is seen to be oriented along the lengthwise alignment of pivoting portion 103 relative to the peak of curvature seen along trailing edge 80 which represents the region of pivoting portion 103 that is displaced the greatest orthogonal distance from transverse plane of reference 98 in this example. A blade alignment 231 (shown by dotted lines) is seen to be oriented in a lengthwise manner along the outer side edge region of pivoting blade portion 103 that represents the region along pivoting portion 103 that is closest to transverse plane of reference 98 while at rest. An angle 233 is seen to exist between alignment 231 and alignment 160 (shown by dotted lines) and an angle 235 is seen to exist between lengthwise blade alignment 106 (shown by dotted lines) along the portions of blade member 62 that are adjacent stiffening member 64 and alignment 160 (shown by dotted lines) at the peak of curvature along pivoting portion 103 while at rest.

Figure 36:
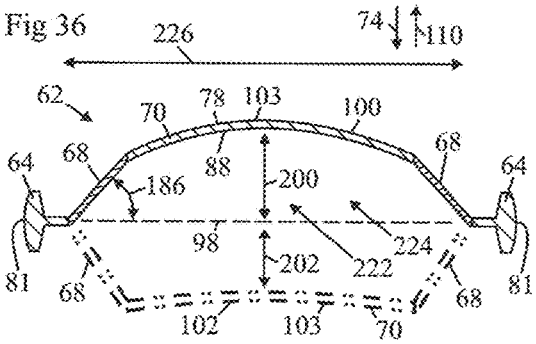
FIG. 36 shows a cross section view taken along the line 36-36 in FIG. 22.

FIG. 36 shows a cross section view taken along the line 36-36 in FIG. 22 near trailing edge 80. In the embodiment in FIG. 36, it can be seen that upper surface 88 of harder portion 70 has a concave down curvature that increases the vertical dimension of central depth of scoop dimension 200 while pivoting portion is in bowed position 100. When pivoting blade portion inverts to inverted position 102 (shown by broken lines), it can be seen that upper surface 88 of harder portion 70 is seen to still have a concave down curvature in this embodiment, and lower surface 78 has a convex up curvature that causes inverted central depth of scoop 202 during to be comparatively smaller than central depth of scoop dimension 200. This is because this embodiment is arranged to have harder portion 70 sufficiently stiff enough to significantly avoid harder portion 70 from becoming less curved, flattening and/or inverting when it is moved to inverted position 102 under the exertion of water pressure during use. In alternate embodiments, harder portion 70 can be arranged to be more flexible so as to become significantly less curved, flattened and/or inverted in curvature when it is moved to inverted position 102 under the exertion of water pressure during use.

Figure 37:
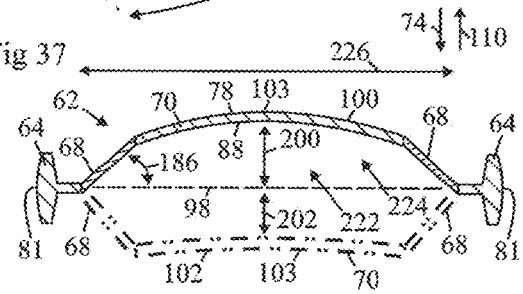
FIG. 37 shows a cross section view taken along the line 37-37 in FIG. 22.

FIG. 37 shows a cross section view taken along the line 37-37 in FIG. 22 near root portion 79. The cross section view in FIG. 37 illustrates that the curved shape of harder portion 70 is arranged to be significantly similar to the cross sectional shape shown in FIG. 36. This comparison of cross sectional shapes between FIGS. 36 and 37 show that this curved shape continues in a significantly constant manner along scoop length 223 between region 150 and trailing edge 80 (shown in FIG. 35). Also, pivoting blade portion 103 is seen to substantially maintain the same curvature in inverted position 102 (shown by broken lines) as in bowed position 100, as is shown in FIG. 36. However, in alternate embodiments, any degree of flexing may occur within pivoting blade portion 103 near portion 150 and/or near root portion 79. For example, the material within harder portion 70 can be arranged to be sufficiently stiff and/or less movable and/or immovable in areas near root portion 79 so that pivoting portion 103 and harder portion 70 does not invert to inverted position 102 and remains substantially in bowed position 100 while the cross sectional view in FIG. 36 taken near trailing edge 80 does invert to inverted position 102. In such a situation, along scoop length 223 (shown in FIG. 35) harder portion 70 and pivoting blade portion 103 would experience bending around a transverse axis along scoop length 223 in a direction from bowed position 100 toward inverted position 102 so that the portions of pivoting blade portion 103 in FIG. 37 remain substantially near or at bowed position 100 while the portions of pivoting blade portion 103 in FIG. 36 flex under the exertion of water pressure during an upward stroke direction 110 to inverted position 102. This method of flexing can be used to create a significant biasing force as the resilient material used within harder portion 70 in FIG. 37 that remains in bowed position 100 near root portion 79 and urges the portion of pivoting blade portion 103 near trailing edge 80 back from inverted position 102 toward bowed position 100 when the exertion of water pressure is reduced or reversed. While this can cause the inverted scoop shape to have reduced overall volume along scoop length 223 between transverse plane of reference 98 and inverted bowed position 102, this can significantly increase a desirable biasing force and enable pivoting blade portion 103 to snap back quicker from inverted position 102 to bowed position 100 with a shorter duration, with less lost motion, and more channeling capability during downward stroke direction 74 where the curved shape also provides increased structural integrity and leverage during downward stroke direction. This can be beneficial as downward stroke direction is often referred to in scuba diving as the power stroke and the opposing upward stroke direction is often referred to as the rest stroke. These methods can be used to create excellent propulsion during both opposing stroke directions yet with an emphasis on arranging the swim fin to produce additional leverage and power during such downward directed power stroke in downward stroke direction 74.

Figure 38:
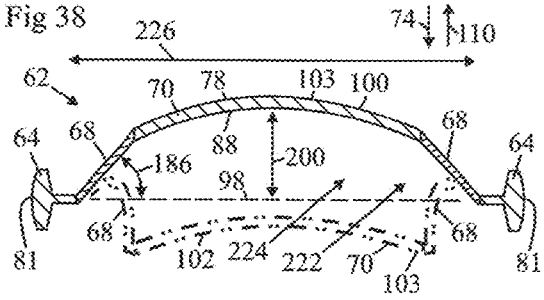
FIG. 38 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35.

FIG. 38 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35. The alternate cross sectional configuration in FIG. 38 shows that when pivoting blade portion 103 and harder portion 70 are pushed to inverted position 102 (shown by broken lines) under the exertion of water pressure created during an opposing stroke direction, then lower surface 78 of harder portion 70 is significantly close to and/or at transverse plane of reference 98, and membranes 68 are seen to be bent, curved, and/or not fully extended. Also, while in inverted position 102, the inverted scoop shape formed between transverse plane of reference 98, pivoting blade portion 103 and membranes 68 is significantly small and comparatively smaller than predetermined scoop shaped cross sectional area 224 when pivoting blade portion 103 is in bowed position 100. This can result during a significantly light kicking stroke that creates significantly light levels of water pressure so that the biasing force that urges portion 103 toward position 100 causes a smaller deflection to occur toward inverted position 102. In such situations, pivoting blade portion 103 and membranes 68 can be arranged to deflect further away from transverse plane of reference 98 and in a direction toward inverted position 102 to a further expanded position during significant increases in kicking strength.

Figure 39:
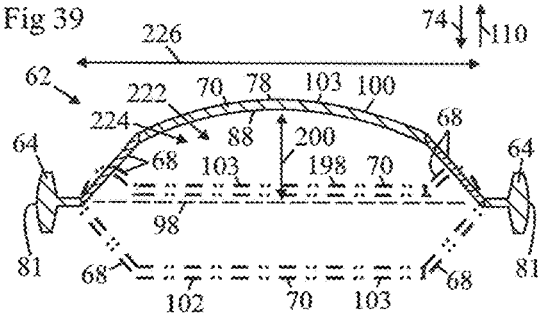
FIG. 39 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35.

FIG. 39 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35. In this embodiment in FIG. 39, when pivoting blade portion 103 and harder portion 70 have moved to in transitional position 198 (shown by broken lines) and/or inverted position 102 (shown by broken lines), blade portion 103 and harder portion 70 are seen to have flexed from a curved shape in bowed position 100 to a substantially flat position in transitional position 198. This is because the material within harder portion 70 is arranged to be sufficiently flexible in this embodiment to flex in this manner to a less curved and/or significantly flat shape. This flat shape can also occur at or near transitional position 198 and/or near transverse plane of reference 98 and/or in the areas in between bowed position 100 and inverted position 102 while pivoting blade portion 103 and harder portion 70 are arranged to form a longitudinal sinusoidal wave as exemplified in FIG. 22. This flattened shape can allow such a longitudinal sinusoidal wave to form and propagate more easily and efficiently for increased propulsion during rapid successive inversions of the reciprocating kicking stroke cycle. Furthermore, arranging harder portion 70 to have a highly resilient material can create an increased snapping motion and as harder portion 70 and/or pivoting blade portion 103 snap back from such a flat shape to the biased curved shape at the end of a stroke direction and/or at the end of such longitudinal wave near trailing edge 80.

Figure 40:
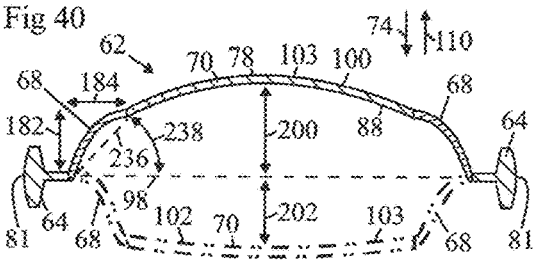
FIG. 40 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35.

FIG. 40 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35. In FIG. 40, when pivoting blade portion 103 is in bowed position 100, membranes 68 are also seen to have a concave down curvature. In this situation, the curvature of membranes 68 are seen to further increase predetermined scoop shaped cross sectional area 224 for increased water channeling capacity. In addition, the curved shape can be combined with the use of resilient material molded within membranes 68 to increase the desired biasing force that urges pivoting blade portion 103 away from transverse plane of reference 98 and toward bowed position 100. Furthermore, the additional material within curvature of membranes 68 can be arranged to have a predetermined amount of looseness to permit predetermined scoop shaped cross sectional area 224 to further expand during either light, moderate or harder kicking stroke forces in downward kick direction 74 and permit pivoting blade portion 103 to move further away from transverse plane of reference 98 as this predetermined amount of looseness in membranes 68 is permitted to experience further expansion during such situations. In alternate embodiments, membranes 68 can have any desired curvature and/or multiple curves, bellows-like shapes, alternative shapes, contours, folds, or any other desired variation. In this embodiment, harder portion 70 is arranged to have sufficiently increased flexibility to permit flexing to an oppositely bowed orientation during inverted position 102 (shown by broken lines). This can increase scoop volume during inverted position 102 and can also result in an increased snap back to position 100 as the resilient material within harder portion 70 snaps back to its original curvature at the end of a kicking stroke.

In the embodiment in FIG. 40, the curved shape of membrane 68 is seen to have an average membrane alignment 236 (shown by dotted line) that shows the average alignment of membrane 68 resulting from vertical dimension component 182 and horizontal dimension component 184. Average membrane alignment 236 is seen to be oriented at an average alignment angle 238. Horizontal dimension component 184 may be arranged to be sufficiently large enough to permit pivoting blade portion 103 to move from bowed position 100 toward transverse plane of reference 98 and/or inverted position 102 in a substantially efficient manner during inversion phases of reciprocating stroke directions in those embodiments where such substantially efficient movement is desired.

Figure 41:
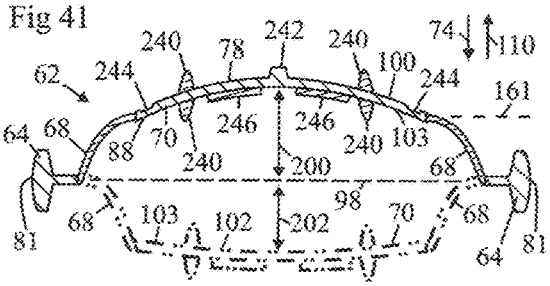
FIG. 41 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35.

FIG. 41 shows an example of an alternate embodiment of the cross section view shown in FIG. 36 taken along the line 36-36 in FIG. 35 and/or an alternate embodiment of the cross section view shown in FIG. 37 taken along the line 37-37 in FIG. 35. The embodiment in FIG. 41 is similar to the embodiment in FIG. 40 except that additional structures have been added to harder portion 70 as seen in bowed position 100. These additional structures are seen to include resilient rib members 240 that are may be made with a resilient thermoplastic material that has a different level of softness and/or hardness than harder portion 70. For example, rib members 240 can be made with a relatively softer thermoplastic elastomer or a relatively harder thermoplastic material and connected to harder portion 70 with a thermochemical bond, a mechanical bond or a combination of chemical and mechanical bonds. Rib member 240 can be used to vary the stiffness, resiliency and snapback characteristics of harder portion 70. A raised rib member 242 is seen to be a thickened or raised portion of harder portion 70 that can be used to vary the stiffness, resiliency and snapback characteristics of harder portion 70. Recessed groove members 244 are seen to be recessed indentations or depressions within at least one surface portion of harder portion 70. Recessed groove members can be used to increase the flexibility of harder portion 70. A laminated member 246 can either be a relatively softer member or a relatively harder member that is laminated to harder portion 70 and/or connected in an edge-to-edge manner with harder portion 70 with a suitable chemical and/or mechanical bond. For example, laminated members 246 can be made with a resilient thermoplastic material, such as a thermoplastic rubber or elastomer, to vary the stiffness, resiliency and snapback characteristics of harder portion 70. Any of members 240, 242, 244 and 246 can extend along any desired distance of scoop length 223 and/or longitudinal blade length 211 (not shown) and/or any portion of the swim fin, and may have any desired form, shape, size contour, alignment, and configuration. Any alternative features can be added or subtracted from any portion of blade 62.

In this example, blade member 62 is arranged to have a predetermined biasing force that urges harder portion 70 and/or pivoting blade portion 103 toward and/or to bowed position 100 in a substantially orthogonal direction away from transverse plane of reference 98 (which in this example extends between outer side edges 81) and away from bowed position 102 while the swim fin is at rest, so that at least one portion of harder portion 70 is arranged to be oriented within harder portion transverse plane of reference 161 that is spaced from transverse plane of reference 98 while the swim fin is at rest. In this example, members 240, 242, 244 and 246 are connected to harder portion 70 so that at least one of such members 240, 242, 244 or 246 is arranged to be substantially orthogonally spaced from transverse plane of reference 98 while the swim fin is at rest.

Figure 42:
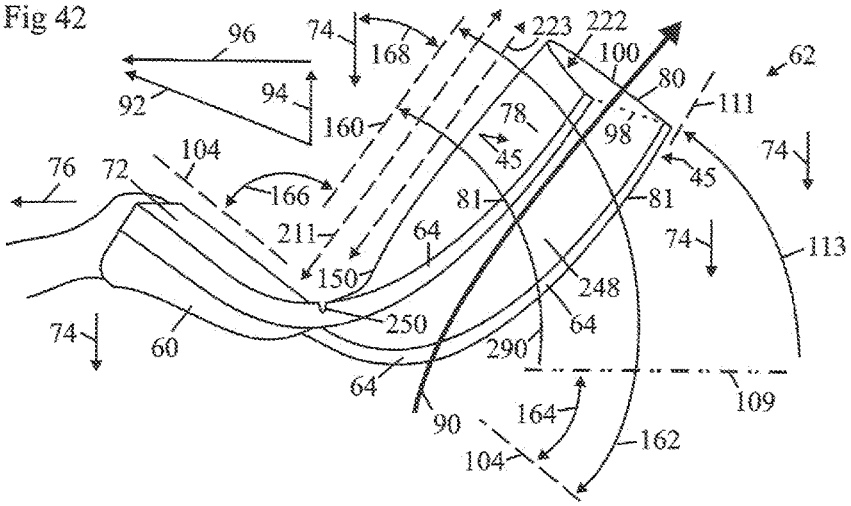
FIG. 42 shows a side perspective view of an alternate embodiment during a downward kick stroke phase of a kicking cycle.

FIG. 42 shows a side perspective view of an alternate embodiment during downward stroke direction 74 phase of a reciprocating kicking stroke cycle. The swim fin is being kicked in downward direction and blade 62 has pivoted to around a transverse axis near foot pocket 60 to angle 113 during use. In this embodiment, blade 62 has a prearranged scoop shaped blade member 248 that significantly remains at bowed position 100 during both opposing kick directions and predetermined scoop shaped region 222 may form a significantly large volume as previously discussed) scoop shaped region that exists between upper surface R8 of blade member 248 and transverse plane of reference 98 between outer side edges 81). In this embodiment, scoop shaped region 222 is arranged so that blade 248 has sloped portion 150 near foot pocket 60 and has pivoting portion lengthwise blade alignment 160 between portion 150 and trailing edge 80, and pivoting portion lengthwise blade alignment 160 is arranged to be oriented at angle of attack 168 relative to downward stroke direction 74 and at angle 166 relative to sole alignment 104. In this embodiment, blade 248 is arranged to be sufficiently rigid to not flex significantly away from bowed position 100.

In this embodiment in FIG. 42, a notch member 250 is disposed within stiffening member 64 near foot pocket 60 relative to lower surface 78 of blade member 62. Notch 250 is used in this embodiment to create a region of increased flexibility within the swim fin near foot pocket 60. Notch 250 can also be arranged to be used as one example of a stopping device if desired to limit or control angle 113, angle 166 and/or angle 168. In alternate embodiments, one or more notch members 250 and/or any alternative region of increased flexibility can be used at any desired portions of the swim fin and can have any desired shapes, locations, flexibility, stiffness, contour, configuration, arrangement, or any other desired variation.

Figure 43:
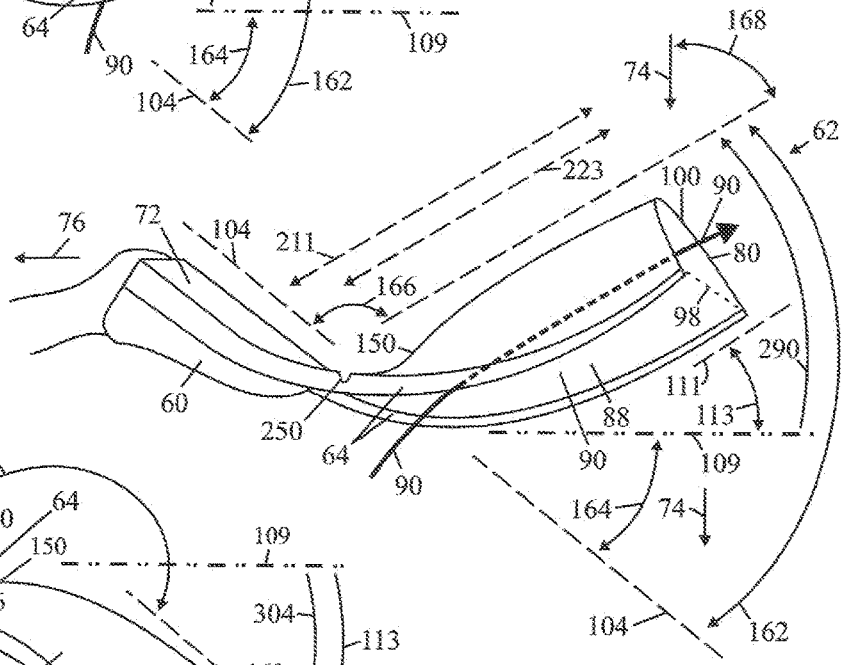
FIG. 43 shows a side perspective view of an alternate embodiment during a downward kick stroke phase of a kicking cycle.

FIG. 43 shows a side perspective view of the same embodiment shown in FIG. 42 during downward stroke direction 74 that has a smaller deflection angle 113 than shown in FIG. 42. The smaller deflection angle 113 in FIG. 43 can be the result conditions such as the use of stiffer materials used within blade 62 and/or stiffening members 64 and/or notch 250, the result of a significantly lighter kicking stroke force in downward stroke direction 74, and/or other conditions arranged within or along blade 62.

Figure 44:
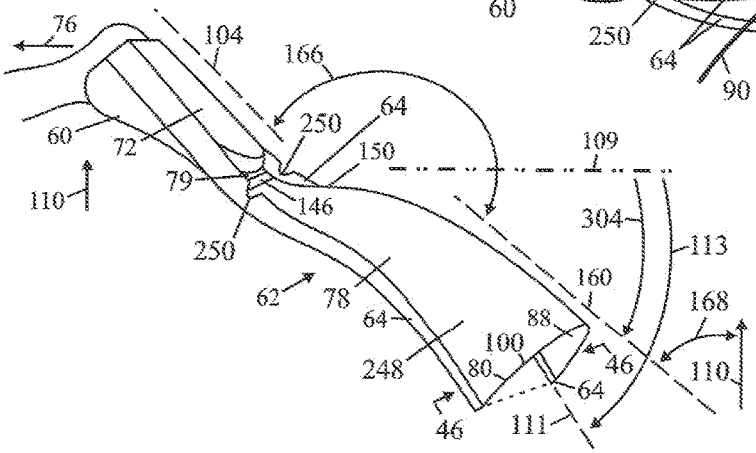
FIG. 44 shows the same embodiment shown in FIG. 43 during an upstroke phase of a kicking stroke cycle.

FIG. 44 shows the same embodiment shown in FIG. 43 during upward stroke direction 110 of a kicking stroke cycle. In this embodiment, it can be seen that scoop shaped blade member 248 of blade 62 remains substantially in bowed position 100 and does not experience an inversion of shape during upward stroke direction 110. In this embodiment, lengthwise blade alignment 160 is significantly close to or significantly parallel to sole alignment 104 so that angle of attack 168 is within or relatively near previously described ranges.

Figure 45:
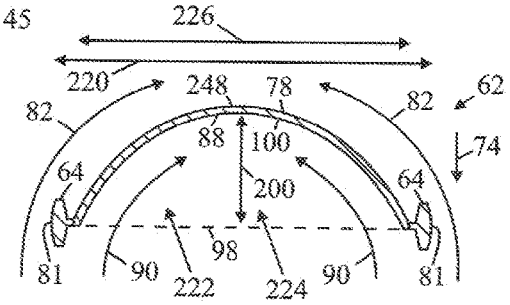
FIG. 45 shows a cross section view taken along the line 45-45 in FIG. 42 during a downward stroke direction.

FIG. 45 shows a cross section view taken along the line 45-45 in FIG. 42 during downward stroke direction 74. In FIG. 45, water flow direction 82 during downward stroke direction 74 can be arranged to experience some degree of curved inward movement along upper surface 88 if desired, while flow direction 90 can also be arranged to experience some degree of curved inward movement along lower surface 78 if desired. In alternate embodiments, flow 88 and/or 90 can be arranged to flow in any desired manner along upper surface 88 and/or lower surface 78 of blade member 62. In some embodiments, vertical dimension 200 and transverse scoop dimension 226 are arranged to create significantly large ranges of cross sectional area 224 and a significantly large ranges of scoop volume along a significant portion of scoop length 211 (see FIG. 42), such as previously described within predetermined scoop shaped region 222.

Figure 46:
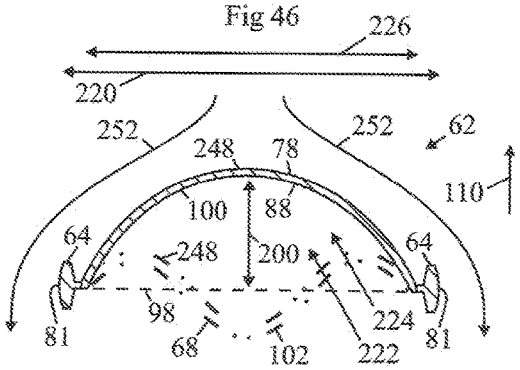
FIG. 46 shows the same a cross section view in FIG. 45 taken along the line 45-45 in FIG. 42; however.

FIG. 46 shows the same a cross section view in FIG. 45 taken along the line 45-45 in FIG. 42; however, FIG. 46 shows water flow during upward stroke direction 110. In FIG. 46, water is seen to flow in a flow direction 252. While flow direction 252 is seen to flow in an outward divergent manner around lower surface 78 during upstroke direction 110, alternate embodiments can be arranged to cause flow direction 252 to flow in any desired direction or combinations of directions.

Figure 47:
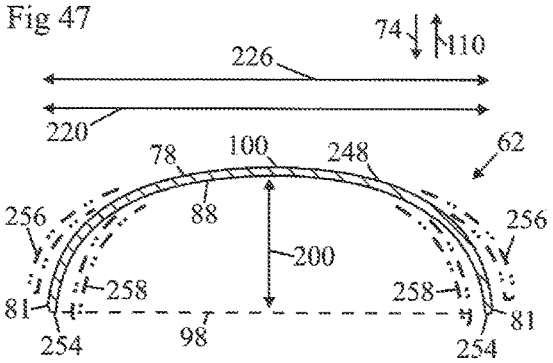
FIG. 47 shows an alternate embodiment of the cross section view shown in FIG. 45 taken along the line 45-45 in FIG. 42.

FIG. 47 shows an alternate embodiment of the cross section view shown in FIG. 45 taken along the line 45-45 in FIG. 42. In the embodiment in FIG. 47, outer edges 81 are seen to not have stiffening members 64 shown in FIGS. 45 and 46, and outer edges 81 in FIG. 47 are seen to terminate at transverse plane of reference 98 (shown by a dotted line that extends between outer edges 81). In this embodiment, transverse scoop dimension 226 is equal to or substantially equal to transverse blade dimension 220, which can increase the overall cross section area 224 and resultant internal volume of predetermined scoop shaped region 222 along longitudinal blade length 211 (shown in FIG. 42). In the embodiment in FIG. 47, outer edges 81 arc arranged to flex during opposing stroke directions so that outer edges 81 flex in an outward direction from a neutral position 254 to outward flexed position 256 (shown by broken lines) under the exertion of water pressure created when blade member 62 is kicked in downward stroke direction 74, and outer edges 81 to flex in an inward direction from neutral position 254 to an inward flexed position 258 (shown by broken lines) under the exertion of water pressure created when blade member 62 is kicked in upward stroke direction 110. Upper surface 88 of blade member 62 may be arranged to substantially maintain a significantly concave shape and significantly large cross section area 224 during use under the exertion of oncoming water pressure applied against upper surface 88 when upper surface 88 is the leading surface that moves through the water such as during downward stroke direction 74, and outward flexed position 256 may be arranged to not cause such concave curvature along upper surface 88 to flatten excessively and/or change to a concave curvature under the exertion of oncoming water pressure exerted against upper surface 88 during use. In alternate embodiments, outer side edges 81 can be arranged to not experience significant flexing in outward or inward directions during opposing stroke directions, or outer edges 81 can be arranged to experience flex directions 256 and/or 258 in any desired manner, direction, degree, or variation.

Figure 48:
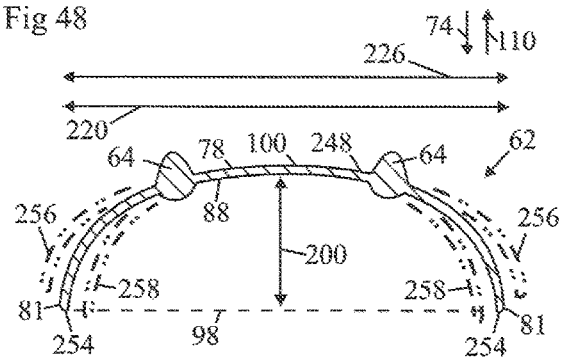
FIG. 48 shows an alternate embodiment of the cross section view shown in FIG. 45 taken along the line 45-45 in FIG. 42.

FIG. 48 shows an alternate embodiment of the cross section view shown in FIG. 45 taken along the line 45-45 in FIG. 42. The embodiment in FIG. 48 is similar to the embodiment in FIG. 47; however, rib members 268 are seen to be added to blade 62 in an area that is in between outer side edges 81. At least one of rib members 268 may be arranged to extend along a significant portion of blade length 211 (not shown) and can also be arranged to be connected to at least one portion of foot pocket 60 (not shown) if desired. In alternate embodiments, one or more rib members 268 can be arranged to be secured to any portion of blade 61, in any alignment, configuration, orientation, or in any desired manner.

Figure 49:
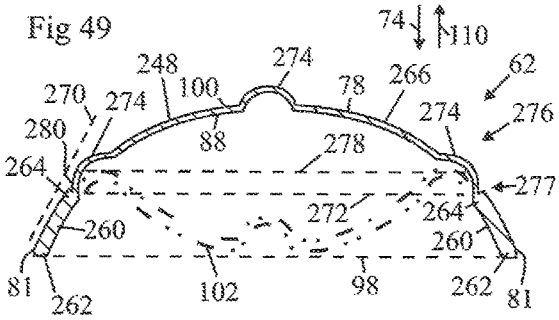
FIG. 49 shows an alternate embodiment of the cross section view shown in FIG. 45 taken along the line 45-45 in FIG. 42.

FIG. 49 shows an alternate embodiment of the cross section view shown in FIG. 45 taken along the line 45-45 in FIG. 42. In FIG. 49, blade member 62 has a relatively stiffer blade portion 260 that is seen in this embodiment to be a region of increased thickness that extends from a thickened portion outer end 262, near both outer side edges 81, to a thickened portion inner end 264 that is spaced from outer ends 262 and outer side edges 81.

Blade 62 is seen to have a relatively more flexible blade portion 266 that extends in a substantially transverse direction between both thickened portion inner ends 264, and relatively more flexible blade portion 266 is arranged to be relatively more flexible than relatively stiffer blade portion 260. In this embodiment, flexible blade portion 266 is a region of reduced thickness within blade 62 so that at least a significant portion of flexible blade portion 266 is significantly less thick than relatively stiffer blade portion 260. In this embodiment, relatively more flexible blade portion 266 and relatively stiffer blade portion 260 are made with the same material and the discussed change in thickness creates the desired change in flexibility and/or stiffness. In alternate embodiments, relatively more flexible blade portion 266 and relatively stiffer blade portion 260 can each be made with different materials and may each have any desired thicknesses. The increased flexibility within relatively more flexible blade portion 266 may be arranged to flex during use from bowed position 100 to inverted position 102 when downward kick stroke direction 74 is reversed during reciprocating stroke direction cycles.

In this embodiment, stiffer blade portion 260 is seen to have an alignment 270 that extends between outer ends 262 to inner ends 264 and in a direction that extends outside of transverse plane of reference 98 and causes a significant portion of stiffer blade portion 260 to be positioned outside of transverse plane of reference 98. Alignment 270 can be varied in any desired manner. In this embodiment, alignment 270 causes inner ends 264 of stiffer portion 260 to be oriented within a thickened portion transverse plane of reference 272 that is spaced in a vertical direction away from transverse plane of reference 98.

In this embodiment, blade 62 has a folded member 274 that is folded in a transverse direction around a substantially lengthwise axis (into the plane of the page) that may be made with a substantially flexible material that may bend, flex, expand, contract, and/or pivot during use under the exertion of water pressure; however, in alternate embodiments, folded member 274 can have any desired degrees of flexibility, elasticity, resiliency, stiffness, rigidity, curvature, directions of curvature, multiple curvatures, non-curvature, alternate contours, alternate shapes, and/or any combination of such varied properties. In this embodiment, blade 62 is seen to have three folded members 274 that are spaced apart in a substantially transverse manner with the center folded member 274 being further spaced away from plane of reference 98 that the other two folded members 274 that arc near outer side edges 81; however, any desired number of folded members 274 may be used along any desired portions of blade 62.

The portions of blade 62 that are in between inner ends 264 are seen to form a transverse pivoting region 276 that can be arranged to flex from bowed position 100 toward inverted position 102 (shown by broken lines) when downward kick direction 74 is reversed. A longitudinally aligned hinge portion 277 is seen at or near the connection between inner ends 264 and transverse pivoting region 276. Longitudinally aligned hinge portion 277 is arranged to be oriented along the length of blade 62 to permit transverse pivoting of region 276 around a substantially lengthwise or longitudinal axis, which is into the plane of the page relative to the cross section view example shown in FIG. 49. At least one portion of blade 62 and/or transverse pivoting region 276 and/or longitudinally aligned hinge portion 277 may be arranged to have a predetermined biasing force that can urge blade 62 and/or transverse pivoting region 276 toward bowed position 100 and away from inverted position 102 when the swim fin is at rest. However, in alternate embodiments, any desired form of blade 62 and any desired biasing force can be arranged to urge any portion of blade 62 toward bowed position 100 and/or to a reversed configuration where any portion of blade 62 is urged toward inverted position 102 and away from position 100, while the swim fin is at rest, and such variations apply to any embodiments shown and described in this specification and/or to any other desired alternate embodiments or variations. In this embodiment in FIG. 49, the portions of blade 62 that are in between inner ends 264 are seen to be relatively thinner than thickened portion 260. This is one method of arranging the portions of blade 62 in between inner ends 264 to be relatively more flexible than stiffer portion 260 in order to help transverse pivoting region 276 to flex from bowed position 100 toward inverted position 102 (shown by broken lines) when downward kick direction 74 is reversed. In this embodiment, folded members 274 are also used to further increase the relative increased flexibility of transverse pivoting region 276. In alternate embodiments, any method for creating an increase in the relative flexibility of any portion of transverse pivoting region 276 may be used. For example, while the embodiment shown in FIG. 49 is made with one material with stiffer portion 260 being made thicker than the relatively thinner portions of transverse pivoting blade region 276, in alternate embodiments, different portions of blade 62 can be made with different materials. For example, in alternate embodiments, stiffer portion 260 can be made with at least one relatively less flexible, relatively harder, and/or relatively stiffer material that may include at least one thermoplastic material, and any desired portion blade 62 near or within transverse pivoting region 276 can be made with at least one relatively more flexible, relatively softer, relatively less rigid, and/or relatively more resilient material that may include at least one thermoplastic material.

In the embodiment in FIG. 49, blade member 62 is at rest and ready to be moved in downward kicking direction 74 or in the opposite direction of upward kick direction 110 and upper ends 264 of stiffer portion 260, folded members 274, and transverse pivoting region 276 are arranged to be biased toward bowed position 100 while at rest so that upper ends 264 of stiffer portion 260, folded members 274, and transverse pivoting region 276 are vertically spaced and urged away from transverse plane of reference 98 while the swim fin is at rest. In this embodiment, transverse pivoting region 276 has a transverse pivoting plane of reference 278 that extends in a transverse direction from areas of pivoting blade region 276 that experience transverse pivotal motion around a substantially lengthwise axis (into the plane of the page) as blade 62 flexes from bowed position 100 toward inverted bowed position 102, and/or vice versa during use with reciprocating kicking stroke directions. In some embodiments, blade 62 is arranged to have a predetermined biasing force that urges at least one transverse pivoting region 276 and at least one transverse pivoting plane of reference 278 to be vertically spaced away from transverse plane of reference 98 when the swim fin is at rest.

In this embodiment, outer edges 81 are arranged to be at outer ends 262 so that transverse plane of reference 98

(shown by broken lines) extends in between both outer ends 262 and outer edges 81, and transverse pivoting plane of reference 278 is seen to be vertically spaced from transverse plane of reference 98, and position 102 (shown by broke lines) is seen to be in between transverse plane of reference 98 and bowed position 100. In alternate embodiments, any desired orientations, contours, positions, and/or combinations or variations thereof, may be used for inverted position 102, transverse pivoting plane of reference 78, and/or transverse plane of reference 98, including individually or relative to one another.

Figure 50:
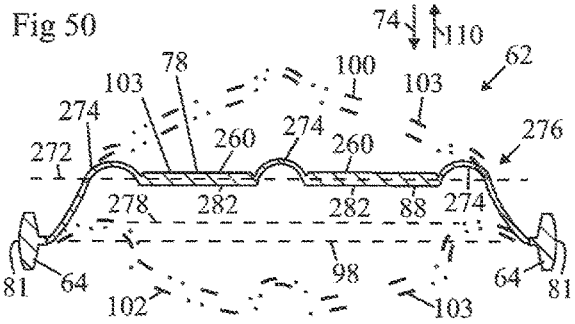
FIG. 50 shows an alternate embodiment of the cross section view shown in FIG. 45 taken along the line 45-45 in FIG. 42 while the swim fin is at rest.

FIG. 50 shows an alternate embodiment of the cross section view shown in FIG. 45 taken along the line 45-45 in FIG. 42 while the swim fin is at rest. The embodiment in FIG. 50 is similar to the embodiment in FIG. 49 with some changes, as the embodiment in FIG. 50 includes a thickened blade portion 282 disposed within blade 62 in between folded members 274. In this embodiment, thickened blade portions 282 in between folded portions 274 are seen to be regions of increased thickness; however, in alternate embodiments, at least one portion of at least one thickened blade portion 282 can be made with a different material than used to make folded member 274, that may be made with any desired material, including a relatively stiffer, relatively harder, or relatively less flexible thermoplastic material. In any embodiment discussed in this description or any desired alternate embodiment, any combinations of relatively stiffer or relatively harder material can be connected to any relatively more flexible or relatively softer material with any suitable mechanical and/or chemical bond, including for example a thermo-chemical bond created during at least one phase of any injection molding process. Blade 62 may be arranged to have a predetermined biasing force that urges at least one of portion of relatively more flexible blade portion 266 in an orthogonal vertical direction away from transverse plane of reference 98 when the swim fin is at rest.

In this embodiment, outer edges 81 are arranged to be near the vertically middle region of stiffening members 64 and transverse plane of reference 98 extends between outer edges 81 near this vertical middle region of stiffening members 81; however, in alternate embodiments, outer edges 81 can be arranged to be positioned along any desired portion of blade 62 and/or along any desired portion of stiffening members 64 when stiffening members 64 are used. In this embodiment, a plurality of folded members 274 and stiffer blade portions 260 (which in this embodiment portions 260 are also thicker blade portions 282) between folded members 274 are located within thickened portion plane of reference 272. In alternate embodiments, blade 62 can be arranged to have a predetermined biasing force that is arranged to urge at least one folded member 274 and/or at least one flexible membrane-like member and/or at least one portion of at least one thickened blade portion 282 and/or at least one relatively stiffer blade portion 260 to be vertically spaced in an orthogonal direction from transverse plane of reference 98 while the swim fin is at rest.

Figure 51:
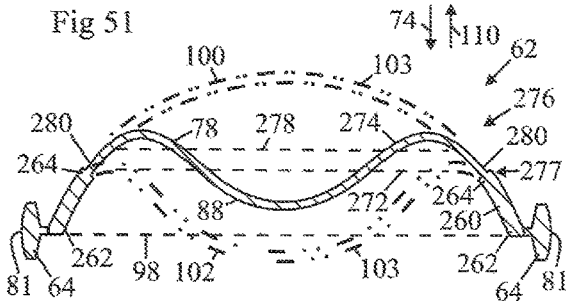
FIG. 51 shows an alternate embodiment of the cross section view shown in FIG. 45 taken along the line 45-45 in FIG. 42 while the swim fin is at rest.

FIG. 51 shows an alternate embodiment of the cross section view shown in FIG. 45 taken along the line 45-45 in FIG. 42 while the swim fin is at rest. In FIG. 51, folded member 274 extends along a substantial portion of transverse pivoting region 276 and a substantial portion of the width of blade 62 and has a substantially undulating form that terminates at folded member transverse ends 280, near inner ends 264 of stiffer portion 260. In this embodiment, stiffer portion 260 is made with a different material than used to make folded member 274. Stiffer portion 260 can be made with a material that is relatively stiffer and/or relatively harder than the material used to make folded portion 274. In other embodiments, the material used to make stiffer portion 260 can be made with a material that is relatively softer, more resilient, and/or more flexible that the material used to make folded portion 274. At least one portion of blade member 62 may be arranged to have a predetermined biasing force that urges at least one portion of stiffer portion 260, at least one transverse end portion 280 of folded member 274, and/or at least one portion of transverse pivoting plane of reference 278 to be significantly spaced in a vertical direction that is orthogonal to transverse plane of reference 98 while the swim fin is at rest.

Figure 52:
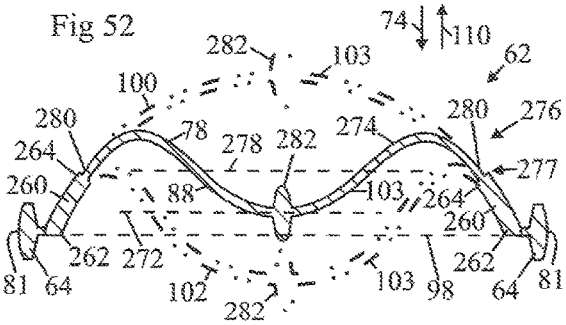
FIG. 52 shows an alternate embodiment of the cross section view shown in FIG. 45 taken along the line 45-45 in FIG. 42 while the swim fin is at rest.

FIG. 52 shows an alternate embodiment of the cross section view shown in FIG. 45 taken along the line 45-45 in FIG. 42 while the swim fin is at rest. FIG. 52 is similar to the embodiment shown in FIG. 51 with some changes, including that longitudinal stiffening member 154 is connected to folded member 274. In this embodiment, longitudinal stiffening member 154 is a thickened region 282 within folded member 274 and is made with the same material as folded member 274; however, in alternate embodiments, longitudinal stiffening member 154 can be made with a different material than used to make folded member 274, and member 154 can be arranged to be made with at least one material that is relatively harder, relatively stiffer, relatively softer, relatively more resilient, or relatively more flexible than the material used to make folded member 274, and may have any desired thickness.

Figure 52B:
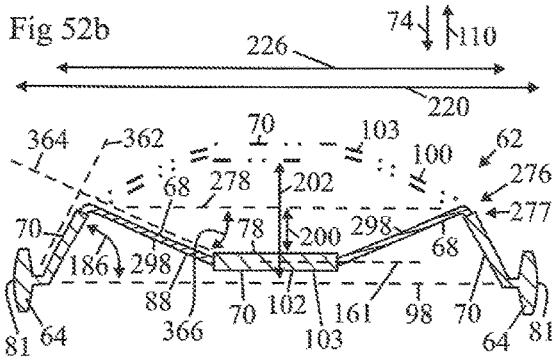
FIG. 52*b* shows an alternate embodiment of the cross section view shown in FIG. 52 while the swim fin is at rest.

FIG. 52*b* shows an alternate embodiment of the cross section view shown in FIG. 52 while the swim fin is at rest. In the embodiment in FIG. 52*b*, harder portions 70 are seen near outer edges 81 and stiffening members 64 and extends along a transverse alignment 362 that is seen to extend in a substantially inward and upward transverse direction away from plane of reference 98 and relative to outer edges 81 and/or stiffening members 64, and these upwardly angled harder portions 70 are similar to the similarly angled stiffer portions 260 shown in FIG. 52. The example in FIG. 52*b* also uses a substantially planar shaped member 283 that is made with harder portion 70 near the central region of blade 62, and planar member 283 is seen to be an example of an alternate embodiment that is similar to the ovular or rounded shaped thicker portion 260 shown in the example in FIG. 52 near the central portion of blade member 62. In the example in FIG. 52*b*, membranes 68 are made with relatively softer portion 298 and are seen to be substantially planar shaped and inclined along a transverse alignment 364 that extends in an inward and downward orientation away from transverse pivoting plane of reference 278 and toward planar member 283 near the center of blade member 62 from this view. In this example, angle 186 is seen to exist between transverse alignment 362 and transverse plane of reference 92, and an angle 366 is seen to exist between transverse alignment 364 and transverse pivoting plane of reference 278. In this example, membranes 68 are seen to have a substantially flat planar cross sectional shape that can be arranged to act like a flexible pivoting panel and/or a transversely elongated pivoting hinge member that pivots relative to transverse pivoting region 276 and transverse pivoting plane of reference 278 around a substantially lengthwise axis near longitudinally aligned hinge portion 277 as the more centrally positioned portions of blade member 62 and/or planar member 283 move between inverted position 102 and bowed position 100 (shown by broken lines) during opposing reciprocating kicking stroke directions. One of the methods herein is arranging a substantially flat and planar shape and a substantially transversely inclined alignment for membranes 68 that is arranged to create a substantial reduction in the stress forces within membranes 68 that oppose moving between the opposing bowed positions 100 and 102 during reciprocating kicking stroke cycles in an amount sufficient to significantly reduce the occurrence of lost motion during the inversion portion of such reciprocating kicking stroke cycles. This is because the planar alignment of membranes 68 are less oriented like an I-beam and more like a spring board or a door pivoting around a hinge relative to the vertical direction of movement of blade member 62 between bowed positions 102 and 100 (shown by broken lines), and this includes the method of arranging at least a significant portion of membranes is arranged to be oriented in a direction that is substantially transverse to the vertical direction of movement within blade member 62 that occurs when moving between positions 102 and 100 during reciprocating kicking stroke cycles. In addition, the method of arranging at least one portion of blade member 62, membranes 68 and/or harder portion 70 to have a predetermined biasing force that urges at least one portion of blade member 62 away from transverse pivoting plane of reference 278 and toward either bowed position 102 or bowed position 100 (shown by broken lines) while the swim fin is at rest, may be combined with methods for reducing the resistance within the materials of membranes 68 or any other portion of blade member 62 so as to further maximize efficiency of such movement during use and to further reduce lost motion for increased performance. Other related benefits and methods using similar arrangements are shown and described in FIGS. 22 to 27.

Any of the methods in this description may be arranged to create a reduction in lost motion (using any embodiment, alternate embodiment or any variation thereof) may be arranged to be sufficient to create a significant increase in propulsion efficiency, a significant reduction in air consumption and/or oxygen mixture consumption for scuba divers and rebreather divers, an increase in the total volume of water channeled in the opposite direction of intended swimming 76 along blade member 62 during such strokes, a significant reduction in the kicking effort needed to reach or sustain a predetermined swimming speed such as a moderate cruising speed or substantially high swimming speed, a significant increase in acceleration, a significant increase in sustainable cruising speed or top swimming speed, a significant increase in the ability to make progress while swimming against significantly strong underwater currents, a significant increase in the ability to carry or tow or push bulky or heavy gear or objects while swimming, and/or a significant increase in total thrust, cruising thrust, static thrust or high speed thrust created during the act of swimming.

The example in FIG. 52*b* demonstrates one of the methods provided in this specification that can include arranging transverse pivoting plane of reference 278 within blade member 62 to be significantly spaced in an orthogonal direction from transverse plane of reference 98 that extends between outer side edges 81. In alternate embodiments, transverse pivoting plane of reference 278 can be arranged to be oriented significantly close to or within transverse plane of reference 98, which is exemplified in the embodiments shown in FIGS. 22 to 27. Such methods, arrangements and orientations, and any desired variation thereof, may be used with any of the exemplified embodiments in this specification or any other alternate embodiment or desired variation thereof. Any of the individual variations, methods, arrangements, elements or variations thereof used in any of the embodiments, drawings, and ensuing description, or any desired other alternate embodiment or desired variation thereof, may be used alone or combined with any number of other individual variations, methods, arrangements, elements or variations thereof and in any desired combination in any desired manner.

This example in FIG. 52*b* at least one portion of blade member 62 is arranged to have a predetermined biasing force that urges planar member 283 and/or membranes 68 away from transverse pivoting plane of reference 278 and/or away from bowed position 100 and/or toward inverted position 102. In this embodiment, planar member 283 that is made with harder portion 70 is oriented within harder portion transverse plane of reference 161, which in this example is arranged to be substantially near transverse plane of reference 98 while the swim fin is at rest. Also, depth of scoop 202 relative to inverted position 102 is seen to be significantly smaller than depth of scoop 200 relative to bowed position 100 (shown by broken lines). In alternate embodiments, any of these configurations can be varied in any desired manner.

Figure 52C:
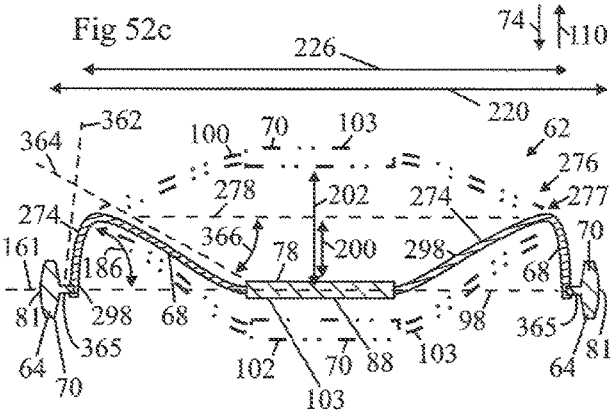
FIG. 52*c* shows an alternate embodiment of the cross section view shown in FIG. 52*b* while the swim fin is at rest.

FIG. 52*c* shows an alternate embodiment of the cross section view shown in FIG. 52*b* while the swim fin is at rest. The embodiment example in FIG. 52*c* is similar to the embodiment in FIG. 52*b* with some changes. These changes include that the vertically aligned harder portions 70 in FIG. 52*b* in between membranes 68 and stiffening member 64 are replaced in FIG. 52*c* with extended portions of membrane 68 to form folded member 274 that is seen to be asymmetrically shaped with alignment 362 being more vertically oriented than transversely oriented and with alignment 364 being more transversely oriented than vertically oriented. In FIG. 52*c*, blade member 62 is seen to have a transverse blade portion 365 between each stiffening member 64 and the outer ends of each membrane 68. Transverse plane of reference 98 is seen to be oriented relative to transverse blade portion 365. Transverse blade portion 365 is significantly small in this example, and in alternate embodiments transverse blade portion 365 may have any desired size and may be eliminated entirely as desired. In this example, the outer side edge portions of membranes 68 are made with relatively softer portion 298 and connected to relatively harder portion 70 of transverse blade portion 365 with a thermochemical bond created during at least one phase of an injection molding process. In alternate embodiments, transverse blade portion 365 can be eliminated entirely and the outer portions of membranes 68 near alignment 362 can be connected directly to stiffening members 64, and to a vertical surface portion of stiffening members 64 that are made with harder portion 70 and secured with a thermochemical bond created during at least one phase of an injection molding process.

In the example shown in FIG. 52*c*, pivoting blade portion 103 is seen to be significantly planar shaped and is arranged to be oriented within transverse plane of reference 98 while the swim fin is at rest. The transversely inclined portion of membrane 68 along transverse alignment 364 is arranged to be significantly spaced in any orthogonal direction away from transverse plane of reference 98, and at least one portion of blade member 62 is arranged to provide a predetermined biasing force that urges at least such transversely inclined portion of membrane 68 away from transverse plane of reference to a predetermined orthogonally spaced position that is significantly spaced from transverse plane of reference 98 while the swim fin is at rest, such as the position exemplified in FIG. 52*c*, and is arranged to automatically move such inclined portion or all of membrane 68 back from a deflected position created under the exertion of water pressure during at least one phase of a reciprocating kicking stroke cycle to a predetermined orthogonally spaced position at the end of such at least one phase of a reciprocating kicking stroke cycle and when the swim fin is returned to a state of rest.

In FIG. 52*c*, the transversely asymmetrical shape of membrane 62, which is also folded member 274 in this example, effectively causes folded member 74 to be made up of two different membranes that function differently from each other even though they intersect each other and are formed integrally in this example. Because the outer side portion of membrane 68 is oriented in alignment 362 that is significantly more vertically oriented than horizontally oriented, this more vertically oriented portion acts more like an I-beam structure in response to forces of water pressure applied to blade member 62 in vertical directions that are orthogonal to transverse plane of reference 98 during the vertical kicking stroke directions of downward stroke direction 74 and/or upward stroke direction 110. Such an I-beam orientation relative to these orthogonal forces of water pressure created on blade member 62 during use causes this more vertical outer portion to be significantly less deformable than the more transversely aligned portion of membrane 62 that is oriented along alignment 364. This significantly more transversely aligned portion of membrane 62 is more oriented like a leaf spring or a diving board on a pool rather than oriented like a vertical I-beam relative to the orthogonally directed forces created during reciprocating kicking strokes. This more horizontal orientation relative to the orthogonally directed vertical forces created during kicking strokes causes this more horizontally aligned portion of membrane 68 to have significantly less structural resistance to vertical forces created during kicking strokes. Because membrane 68 is made with a relatively soft thermoplastic material, the reduced structural resistance to vertical forces may be arranged to permit this more transversely aligned portion of membrane 68 to experience significantly more vertical or orthogonal movement and deflection during vertical kicking strokes than experienced by the more vertical portion of membrane 68. This shows that this asymmetrical cross sectional shape of membrane 68 in this example enables membrane 68 to effectively act like two different membranes or two different blade portions having different structural characteristics and different levels of deflection. In FIG. 52*c*, the more vertical outer portions of membranes 68 are seen to experience significantly less or even no significant movement as pivoting blade portion 103 moves between bowed position 100 (shown by broken lines) and inverted bowed position 102 (shown by broken lines) during reciprocating vertical kicking strokes, while the more transversely aligned portions of membrane 68 are seen to experience significant deflection and pivotal motion during use. This is because the more vertical outer portion of membrane 68 causes such outer portion to be structurally more rigid than the more horizontal portion of membrane 68 that is seen to pivot around a lengthwise axis created by longitudinally aligned hinge portion 277 that is formed at the juncture between alignments 362 and 364 due to the significant change in structurally induced flexibility created along such juncture.

Figure 53:
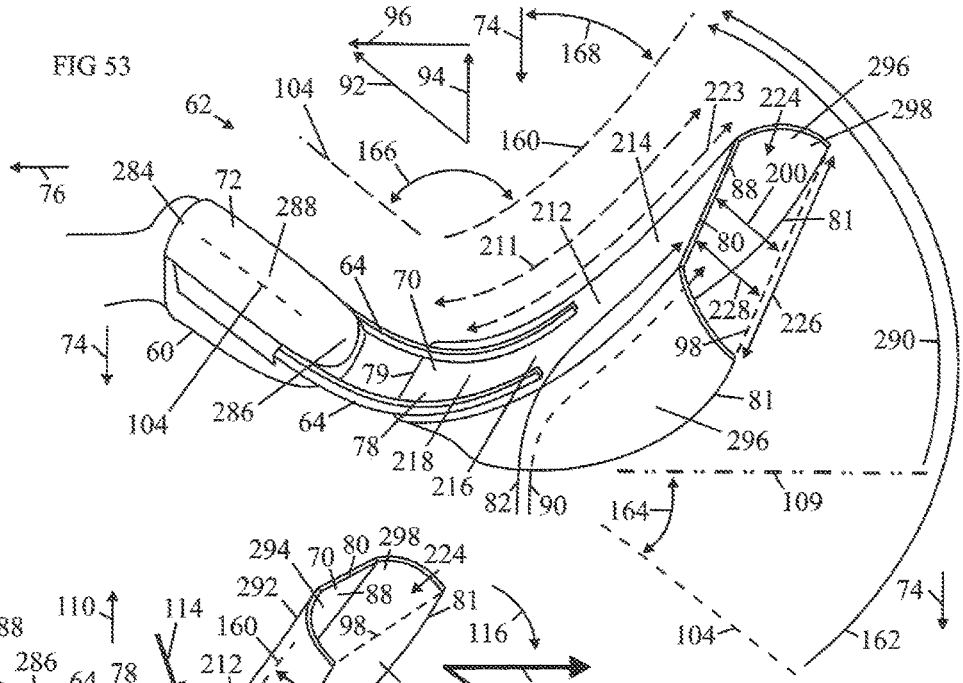
FIG. 53 shows a side perspective view of an alternate embodiment.

FIG. 53 shows a side perspective view of an alternate embodiment. The embodiment in FIG. 53 is seen to be similar to the embodiment shown in FIGS. 42 to 44, with some exemplified alternatives. In FIG. 53, foot attachment member 60 is seen to have a heel portion 284, a toe portion 286 and a foot attachment member midpoint 288 that is midway between heel portion 284 and toe portion 286. In the embodiment in FIG. 53, root portion 79 of blade member 62 is seen to be spaced from toe portion 286 with stiffening members 64 bridging the gap between foot attachment member 60 and root portion 79; however, alternate embodiments can have root portion 79 connected to foot attachment member 60 in any manner and/or any other desired arrangement of blade 62 may be used. In this embodiment in FIG. 53, rib members 64 are seen to be connected to foot attachment member 60 in an area near toe portion 286 that is in between toe portion 286 and midpoint 288, and rib members 60 are seen to extend to a portion along blade member 62 that is near midpoint 212 that exists between root portion 79 and trailing edge 80. In this embodiment, blade member 62 is being kicked in downward kick direction 74 and has experienced a deflection from neutral position 109 to a deflected position 292 in which pivoting portion lengthwise blade alignment 160 has pivoted around a transverse axis to reduced angle of attack 290. In this example, neutral position 109 is seen to be substantially parallel to intended direction of travel 76 while the swim fin is at rest and the swimmer is aligned horizontally in the water in a prone position. Reduced angle of attack 290 may be arranged to be substantially close to 45 degrees during a significantly moderate kicking stroke such as used to reach a significantly moderate swimming speed and/or during a significantly light kicking stroke such as used to reach a significantly low swimming speed, and/or during a significantly hard kicking stroke such as used to achieve a significantly high swimming speed, and/or during a significantly hard kicking stroke such as used to achieve significantly high levels of acceleration or leverage for maneuvering. In alternate embodiments, reduced angle of attack 290 can be arranged to be at least 50 degrees, at least 45 degrees, at least 40 degrees, at least 35 degrees, at least 30 degrees, at least 25 degrees, at least 20 degrees, at least 15 degrees, at least 10 degrees, between 20 and 60 degrees, between 30 degrees and 50 degrees, between 20 and 40 degrees, between 30 and 40 degrees, between 40 and 60 degrees, or other degrees as desired, such as during a significantly moderate kicking stroke such as used to reach a significantly moderate swimming speed, and/or during a significantly light kicking stroke such as used to reach a significantly low swimming speed, and/or during a significantly hard kicking stroke such as used to achieve a significantly high swimming speed, and/or during a significantly hard kicking stroke such as used to achieve significantly high levels of acceleration or leverage for maneuvering.

In the embodiment in FIG. 53, blade member 62 is seen to have a substantially horizontal member 294 and two substantially vertical members 296. In this embodiment, horizontal member 294 is made with relatively harder blade portion 70 and vertical portions are made with a relatively softer portion 298 that may be connected to harder portion 70 with a thermochemical bond created during at least one phase of an injection molding process. In alternate embodiments, any materials can be used for either horizontal member 294 or vertical members 296, and can be connected with any desired mechanical and/or chemical bond, or portions 294 and 296 can also be made with the same material if desired. In this embodiment, both horizontal member 294 and vertical members 296 are arranged to have sufficient flexibility around a predetermined transverse axis to permit pivoting portion lengthwise blade alignment 160 to take on a convexly curved contour along at least a portion of longitudinal blade length 211. This is one reason why this embodiment may use a relatively softer material for vertical members 296 so that vertical members 296 are more able to deform and not act as an excessively rigid I-beam type structure that could otherwise prevent horizontal portion from bending around a transverse axis and excessively inhibit blade alignment 160 from taking on a convexly curved contour along at least a portion of longitudinal blade length 211 while deflecting toward or to deflected position 292 during use. Vertical members 296 may be arranged to be sufficiently strong enough to maintain a substantially vertical and/or angled orientation so as to not excessively buckle or collapse around a substantially lengthwise axis during use, and thereby may continue to provide a substantially large vertical dimensions 200 and 230 and/or substantially large predetermined scoop shaped cross sectional area 224 during use while blade 62 is oriented at or near deflected position 292.

In the embodiment in FIG. 53, vertical members 296 are seen to be angled and flare outward in a transverse and downward direction from harder portion 70 toward outer edges 81 to form a concave scoop shape relative to downward kick direction 74, as viewed near trailing edge 80. In this embodiment, vertical portions 286 are also seen to be concavely curved relative to downward kick direction 74. This method of using outwardly angled and/or concavely curved orientations for vertical members 296 can be used to reduce bending resistance within members 296 due to being less vertical and I-beam shaped, so as to not excessively inhibit or prevent horizontal member 294 from bending around a transverse axis and thereby assist blade alignment 160 to take on a convexly curved contour along at least a portion of longitudinal blade length 211 while deflecting toward or to deflected position 292 during downward stroke direction 74. Horizontal member 294, vertical members 296, and/or stiffening members 64 may be made with at least one highly resilient material capable of snapping blade 62 back toward neutral position 109 at the end of a kicking stroke occurring in downward kicking stroke direction 74. The angled and/or concave orientation of vertical members 296 can also be used as a method for encouraging or increasing smoother flow around the lee surfaces and/or attacking surfaces of vertical members 296 and/or horizontal member 294 during downward stroke direction 74, as exemplified by the arrows showing flow direction 82 (lee surface flow) and flow direction 90 (attacking surface flow). This can also be used as a method for reducing turbulence and resulting drag as well increasing lifting forces on blade 62, including but not limited to those exemplified by lift vectors 92, 94 and 96. In alternate embodiments, horizontal member 294 and/or vertical members 296 may be arranged to have any desired shape, contour, alignment, orientation, resiliency, rigidity, hardness, flexibility or stiffness. In addition, vertical members 296 may have any desired vertical dimension and/or lengthwise dimension, or any desired variations thereof, along longitudinal blade length 211 or along the length of any portion of the swim fin. In the embodiment in FIG. 53, outer edge 81 of vertical members 296 are seen to have a curved shape; however, outer edge 81 and/or vertical members 296 can have any desired shape, contour, configuration, curvature, lack of curvature, arrangement and/or structure in alternate embodiments.

Figure 54:
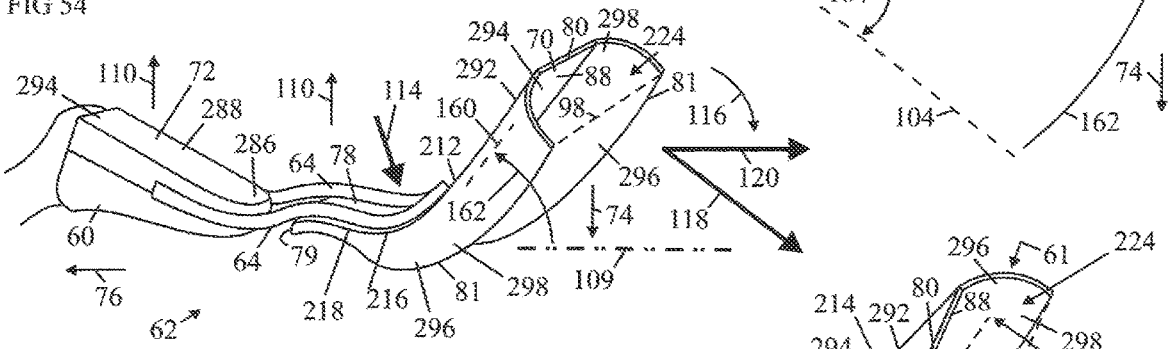
FIG. 54 shows a side perspective view of an alternate embodiment.

FIG. 54 shows a side perspective view of an alternate embodiment that is similar to the embodiment shown in FIG. 53 with some examples of alternate configurations. In FIG. 54, stiffening members 64 are seen to be connected to foot attachment member 60 in an area near foot attachment member midpoint 288, in a manner that may permit relative movement thereof around a transverse axis in an area along foot attachment member 60 that is near midpoint 288 and/or that is between midpoint 288 and toe portion 286. In FIG. 54, the swim fin is experiencing an example a kick stroke inversion portion of a reciprocating kicking stroke cycle in which downward kick direction 74 has reversed to upward kick direction 110 at foot attachment member 60, while at the same time, the outer portions of blade member 62 near trailing edge 80 are experiencing opposite movement in downward kick direction 74. In this example, such opposite movement is seen to create an undulating sinusoidal wave shape along the length of stiffening members 64 and a significant portion of blade member 62 between root portion 79 and midpoint 212. Upward kick direction 110 created by the upward movement of foot attachment member 60 also creates additional downward flow 114 that applies additional downward pressure upon the outer portions of blade 62 that can be used to increase the outward and downward movement of the prearranged scoop shaped contour of blade 62 near trailing edge 80 and/or along the outer portions of blade 62 between midpoint 212 and trailing edge 80 and/or between one quarter blade position 216 and trailing edge 80. This can be arranged to also create an increased leveraging force that moves the outer portions of blade 62 near trailing edge 80 in the outward and downward abrupt inversion movement 116 so as to increase the intensity of inversion flow burst 118 having horizontal component 120 to create increased thrust in the opposite direction of intended swimming 76. The efficiency and power of inversion flow burst 118 may be greatly increased by the large volume of water contained by the significantly large vertical members 296 to form a significantly large predetermined scoop shaped cross sectional area 224 along a significantly large portion of the longitudinal length of blade 62 due to the prearranged deep scoop shape. In addition, the prearranged scoop shape provides instantaneous increases in acceleration, propulsion, efficiency and speed due to reduced delay or even zero delay in forming this deep scoop shape during abrupt inversion movement 116 and/or during downward stroke direction 74. This can create significant reductions in lost motion and significant increases in power, acceleration, leverage and swimming speeds, and can also be used to create significant decreases in muscle strain and fatigue during use. In alternate embodiments, the amplitude and/or wavelength of the sinusoidal wave form is shown in FIG. 53 can be arranged to be significantly large, significantly small, significantly noticeable, not significantly noticeable, or even eliminated so that only the opposite movement between foot attachment member 60 and trailing edge 80 is viewable during at least one inversion portion of a reciprocating stroke cycle.

Figure 55:
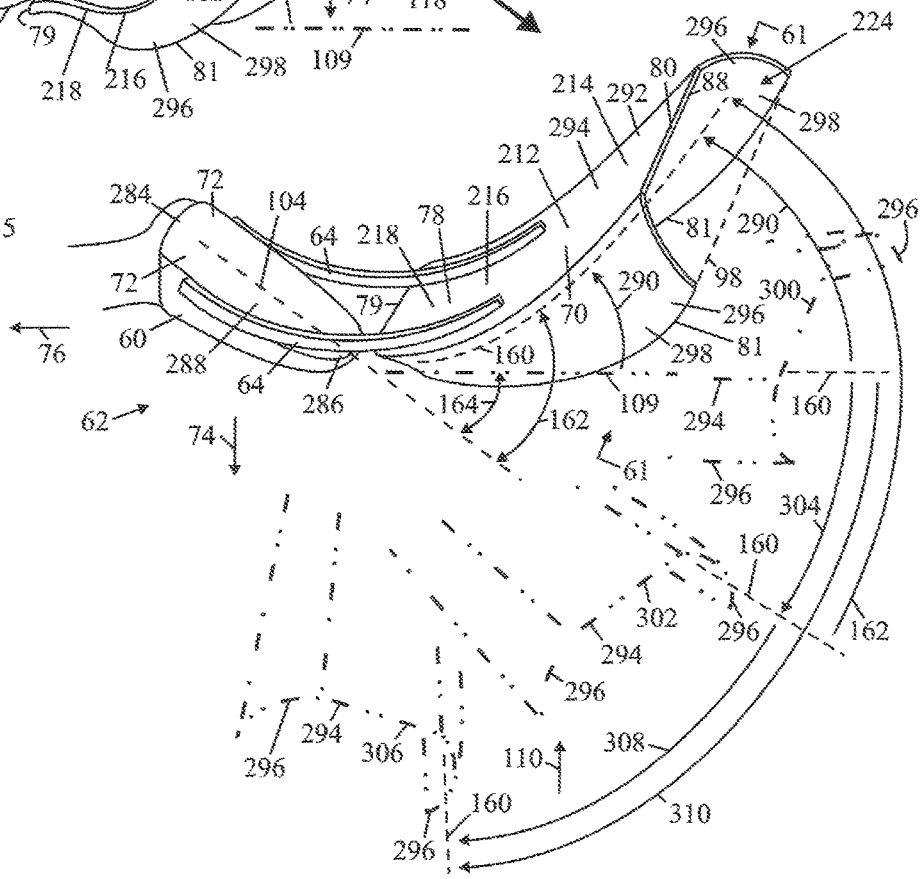
FIG. 55 shows a side perspective view of an alternate embodiment.

FIG. 55 shows a side perspective view of an alternate embodiment that is similar to the embodiment shown in FIG. 53. In FIG. 55, stiffening members 64 are seen to be connected to foot attachment member 60 in an area near heel portion 284 and/or in an area between heel portion 284 and midpoint 288, in a manner that may permit relative movement thereof around a transverse axis in an area along foot attachment member 60 that is near heel portion 284 and/or that is between midpoint heel portion 284 and toe portion 286. The swim fin is being kicked in downward kick direction 74 and blade member 62 has pivoted around a transverse axis near heel portion 284 and has moved under the exertion of water pressure to deflected position 292. Blade member 62 is seen to have moved from a neutral blade position 300 (shown by broken lines providing a perspective view) that is parallel with neutral position 109 (also seen in FIG. 53) and is also desired to be parallel to direction of intended travel 76 while the swim fin is at rest and the swimmer is in a prone position in the water. From the perspective view on neutral blade position 300 (shown by broken lines), it can be seen that in this embodiment that the lengthwise planar alignment of the deepest portion of the prearranged scoop created by horizontal portion 284 permits pivoting portion lengthwise blade alignment 160 to be aligned with neutral position 109 while the swim fin is at rest. This alignment can be achieved by arranging blade member 62 during neutral blade position 300 (shown by broken lines) to be at angle 164 that is seen between sole alignment 104 and neutral position 109. Angle 164 may be arranged to be approximately 40 to 45 degrees; however, in alternate embodiments angle 164 can be arranged to be between 30 and 40 degrees, between 20 and 30 degrees, at least 30 degrees, at least 20 degrees, at least 15 degrees, or at last 10 degrees. One method of achieving this angle 164 alignment at rest can include arranging stiffening members 64 to hold blade 62 in neutral position 300 (shown by broken lines) at angle 164 with horizontal member 294 aligned with neutral position 109 so that pivoting portion lengthwise blade alignment 160 is substantially aligned with neutral position 109 while the swim fin is at rest. This can allow blade member 62 and pivoting portion lengthwise blade alignment 160 to be aligned with intended direction of travel 76 while the swim fin is at rest, so that blade member 62 and stiffening members 64 can be arranged to equally deflect above and below the plane of neutral position 109 during opposing kicking stroke directions.

For example, when the swim fin is kicked in upward stroke direction 110 then blade member 62 can be arranged to move in a downward direction under the exertion of water pressure from neutral blade position 300 (shown by broken lines) to deflected position 302 (shown by broken lines) so that so that pivoting portion lengthwise blade alignment 160 at position 300 (shown by broken lines) is arranged to move from being substantially aligned with neutral position 109 and direction of travel 76 while at rest, to blade alignment 160 at position 302 (shown by broken lines) being substantially aligned with lengthwise sole alignment 104 during upstroke direction 110. This causes blade alignment 160 to be oriented at a reduced angle of attack 304 when blade member 62 has moved to deflected position 302 (shown by broken lines) during upward stroke direction 110. As stated previously, in this embodiment blade alignment 160 is parallel to the longitudinal planar alignment of horizontal member 294. Reduced angle of attack 304 of blade alignment 160 in position 302 (shown by broken lines) may be arranged to be approximately 45 degrees relative to neutral position 109 and/or direction of intended travel 76 during upward stroke direction 110. This method for arranging blade alignment 160 of blade member 62 to be substantially parallel to direction of travel 76 and neutral position 109 while at rest, can be used to enable blade alignment 160 in position 300 (shown by broken lines) to be substantially equidistant between deflected position 292 during downstroke 74 and deflected position 304 (shown by broken lines) during upstroke 110. This method can also be used to permit stiffening members 64 to have substantially equal degrees of flexibility as blade alignment 160 flexes from position 300 (shown by broken lines) to deflected position 292 and from position 300 (shown by broken lines) to deflected position 304 (shown by broken lines) during use. This method can also be used permit reduced angle of attack 290 to be substantially equal to reduced angle of attack 304 as stiffening members 64 and blade alignment 160 oscillate back and forth between positions 292 and 302 (shown by broken lines) during reciprocating kicking stroke cycles. This method can also be combined with using highly elastic materials within stiffening members 64 and/or horizontal member 294 and/or vertical members 296 to permit such elastic materials to store energy while being deflected and then return such stored energy at the end of a kicking stroke direction for an increased snapping motion from deflected position 292 and/or deflected position 302 (shown by broken lines) back toward neutral blade position 300 and neutral position 109. In addition, such snapping motion can be used to not only return to neutral position 109, but also continue with momentum passed neutral position 109 toward the opposing deflected position so as to provide a quicker reversal to the opposing deflected position and further reduce longitudinal lost motion that can occur while repositioning blade alignment 160 to the opposing deflected positing for the next opposing stroke direction. This is because using substantially symmetric flexibility in stiffening members 64 and/or other portions of blade 62 can permit reduced damping forces to exist or be created therein so that energy storage and return is maximized on both strokes and can even be arranged to feed upon each other during rapid reversals of reciprocating kicking stroke directions, which can be arranged to create significant increases in acceleration, top end speed, sustainable speed, cruising speed, efficiency, ease of use, muscle relaxation and total movement of water in the opposite direction of intended swimming direction 76.

This method for arranging blade alignment 160 of blade member 62 to be substantially parallel to direction of travel 76 and neutral position 109 while at rest, can be used to enable neutral blade position 300 (shown by broken lines) to be in an optimum position at rest to minimize lost motion in a longitudinal direction because blade alignment 160 can begin deflecting immediately to a reduced angle of attack below 90 degrees in response to the swimmer initiating either downward stroke direction 74 or upward stroke direction 110. For example, if instead, blade alignment 160 was oriented at angle 304 in position 302 (shown by broken lines) and was thereby substantially parallel to sole alignment 104 while the swim fin was at rest, then longitudinal lost motion would occur during downward stroke direction 74 as blade alignment must first move from position 302 to 300 (shown by broken lines) before forward thrust can even start to be created, and then blade alignment 160 must move further from position 300 (shown by broken lines) toward or to deflected position 292 in order to generate significant forward propulsion. In addition, this large range of pivoting from position 302 (shown by broken lines) all the way to deflected position 292 would occur over a substantially large angle 162 that is approximately 90 degrees of movement before reaching a reduced angle of attack 290 of approximately 45 degrees. In such an example, as blade alignment 160 moved across this large range of approximately 90 degrees of angle 162, a large portion of the total range of leg motion used by the swimmer in downward kick direction 74 would be used up just to reposition blade alignment 160 from position 302 (shown by broken lines) to deflected position 292 to create large amounts of lost motion on such stroke so that the amount of such kicking range available for generating forward propulsion is greatly reduced and substantially lost, to exemplify a significantly large amount of lost motion that can be used. Similarly, in this example of arranging blade alignment 160 to be at position 302 (shown by broken lines) while the swim fin is at rest, would cause additional disadvantages when the stroke is reversed during upward kick direction 110, as this could cause blade alignment 160 to move from position 302 (shown by broken lines) to a deflected position 306 and across an angle 308 and to a reduced angle of attack 310, in which reduced angle of attack 310 is seen to be approximately 90 degrees from neutral position 109 and direction of travel 76, which is excessively low angle of attack of approximately zero degrees due to being substantially parallel to upward kick direction 110. This is similar to a flag waving in the wind, which is unable to generate substantial propulsion. Also, if stiffening members 64 are arranged to have substantially symmetrical flexibility relative to downward stroke direction 74 and upward stroke direction 110, then if members 64 are arranged to be significantly stiff enough to avoid further flexing beyond position 306 (shown by broken lines) where angle 308 is further increased, such as could occur if the swimmer's toe and/or lower leg is rotated upward in direction 110, then the symmetrical bending resistance could substantially restrict stiffening members 64 from pivoting to angles during the opposing kicking stroke in downward direction 74, so that blade alignment 160 stops pivoting substantially close to position 300 (shown by broken lines) or in an area in between positions 300 and 292 so that reduced angle of attack 290 is lower than other levels. For example, if blade alignment 160 in position 302 (broken lines) is oriented substantially parallel to sole alignment 104 while so that angle 304 is approximately 45 degrees from position 109 and direction of travel 76 while the swim fin is at rest, while blade alignment 160 in position 306 causes angle 310 to be approximately 90 degrees from position 109 and direction of travel 76 during upward kick direction 110, then the difference between angles 304 and 310 would be 45 degrees; and therefore, a symmetrical flexion of stiffening members 64 during downward stroke direction 74 would cause blade alignment 160 to stop moving after pivoting a substantially equal angle of 45 degrees upward from position 302 (broken lines) so that blade alignment 160 during downward kick direction 74 would stop pivoting near or at position 300 (broken lines), which would cause alignment 160 to be substantially parallel to direction of travel 76 and substantially perpendicular to downward kick direction 74, which causes the actual angle of attack 168 to be at an undesirable excessively high angle of attack of approximately 90 degrees relative to kick direction 74. Consequently, in this example with symmetric flexibility of stiffening members 64 and/or blade member 62, arranging blade alignment 160 to be in position 302 (broke lines) and substantially parallel to sole alignment 104 while the swim fin is at rest, could cause blade alignment 160 to be substantially parallel to upward kick direction 110 in position 306 during an upward kicking so that angle of attack 168 becomes close to or at an excessively low angle of approximately zero degrees relative to upward kick direction 110, and could also cause blade angle 160 to become oriented substantially perpendicular to downward kick direction 74 at position 300 during a downward kicking stroke so that angle of attack 168 becomes an excessively high angle of approximately 90 degrees relative to downward kick direction, so that propulsion is significantly limited during both upward kick direction 110 and downward kick direction 74 and kicking resistance, muscle strain and fatigue is significantly high during downward kick direction 74. In such situations, a large scoop shape can be rendered highly ineffective, moot, or even counterproductive in terms of propulsion, so as to not be one of the more arrangements.

However, in another method of arranging blade alignment 160 to be substantially parallel to direction of travel 76 and neutral position 109 while at rest in position 300 (broken lines) can allow symmetrical flexion of stiffening members 64 and/or other portions of blade member 62 to enable blade alignment 160 to be oriented at a reduced angle of attack 290 of approximately 45 degrees relative to direction of travel 76 (which is also an actual angle of attack 168 of approximately 45 degrees relative to downward kick direction 74), and can also enable blade alignment 160 to be oriented position 302 (broken lines) with an angle of attack 304 of approximately 45 degrees relative to direction of travel 76 (which is also causes actual angle of attack 168 to be approximately 45 degrees relative to upward kick direction 110). These orientations and angles of attack may be combined with at least one prearranged significantly large prearranged scoop shape (which may be prearranged to significantly reduce lost motion to form a large scoop shape) having a significantly large predetermined scoop shaped cross sectional area 224 and a significantly large prearranged longitudinal scoop dimension 223 (shown in FIG. 53) to create a significantly increased total volume of water that has shown through extensive tests with handheld digital underwater speedometers to produce unexpected dramatic increases in acceleration, top end speed, torque, total thrust, and ease of use that were never anticipated, predicted or achieved previously. For example, speedometers showed that acceleration from zero to 2.5 mph was more than doubled with some prototypes using methods in this specification compared to existing swim fins, which demonstrates more than double the propulsive force. In addition, tests of methods herein using underwater speedometers showed significantly large increases in top end swimming speeds and significantly large increases in sustainable swimming speeds that can be maintained for longer distances and longer durations. Counterintuitively, these dramatic increases in acceleration, speed and sustainable speeds, occurred in combination with significant reductions in kicking resistance and muscle fatigue to show dramatic and unexpected increases in efficiency due to significantly increased power combined with simultaneous significantly large reductions in kicking effort, muscle strain, muscle cramping and fatigue. Such increases in efficiency and reductions in muscle strain can create major reductions in air consumption for SCUBA divers and allow them to greatly increase their underwater "bottom time" for a given size tank of compressed air. Reductions in fatigue can significantly reduce the occurrence of severe muscle cramps that can render a diver immobile in the water. Increased acceleration and sustainable swimming speeds can significantly improve a swimmer's or diver's ability to escape a dangerous situation or overcome and make progress against a fast current. Other unexpected results were produced as speedometers showed that cruising speeds were not significantly reduced when drag was increased, such as while extending arms out to either side, to show significantly increases in low end torque, leverage and raw power. In addition, reestablishing the speed existing prior to increasing drag was achieved with significant reductions in kicking effort and muscle strain. In the highly competitive swim fin market, an increase in acceleration, speed, ease of use, bottom time, and/or efficiency of even 5 or 10% can be revolutionary over the competition and can command a leadership position and cause disruptive gains in worldwide market share. Even such lower levels of increased performance can command sales to military divers who are often dropped off 7 or 8 miles off shore from a mission and must swim to the mission, complete the mission, and then swim all the way back, so that even a small increase in performance and efficiency can make a decisive difference in such a mission, as well is in preparatory training for such missions. This is especially the case because drag in water is known to increase with the square of the speed, so that even a small increase in speed causes an exponential increase in drag that must be overcome with an equal or greater exponential increase in thrust generation, and often with an exponential increase in effort and muscle strain. Thus the ability to produce significant increases in top speeds, sustainable speeds, torque, efficiency and acceleration in combination with significant reductions in overall levels of exertion, muscle strain, muscle cramping, and fatigue, demonstrates achievement of dramatic and substantial unexpected results from the various methods exemplified in this specification.

In alternate embodiments, reduced angle of attack 304 can be arranged to be at least 50 degrees, at least 45 degrees, at least 40 degrees, at least 35 degrees, at least 30 degrees, at least 25 degrees, at least 20 degrees, at least 15 degrees, at least 10 degrees, between 20 and 60 degrees, between 30 degrees and 50 degrees, between 20 and 40 degrees, between 30 and 40 degrees, between 40 and 60 degrees, or other degrees as desired, such as during a significantly moderate kicking stroke such as used to reach a significantly moderate swimming speed, and/or during a significantly light kicking stroke such as used to reach a significantly low swimming speed, and/or during a significantly hard kicking stroke such as used to achieve a significantly high swimming speed, and/or during a significantly hard kicking stroke such as used to achieve significantly high levels of acceleration or leverage for maneuvering.

Asymmetric deflections can also be arranged using any desired structure and/or suitable stopping device. Asymmetric deflections can be arranged to cause reduced angle of attack 290 to be approximately 50 degrees and reduced angle of attack 304 to be approximately 40 degrees, or angle 290 to be approximately 45 degrees and angle 304 to be approximately 30 degrees, or angle 290 to be approximately 40 degrees and angle 304 to be approximately 20 degrees, or angle 290 to be approximately 40 degrees and angle 304 to be approximately 50 degrees, or angle 290 to be approximately between 30 and 50 degrees and angle 304 to be approximately between 20 and 60 degrees, or angle 290 to be approximately between 40 and 60 degrees and angle 304 to be approximately between 40 and 60 degrees, or any other desired symmetric or asymmetric angles.

Figure 56:
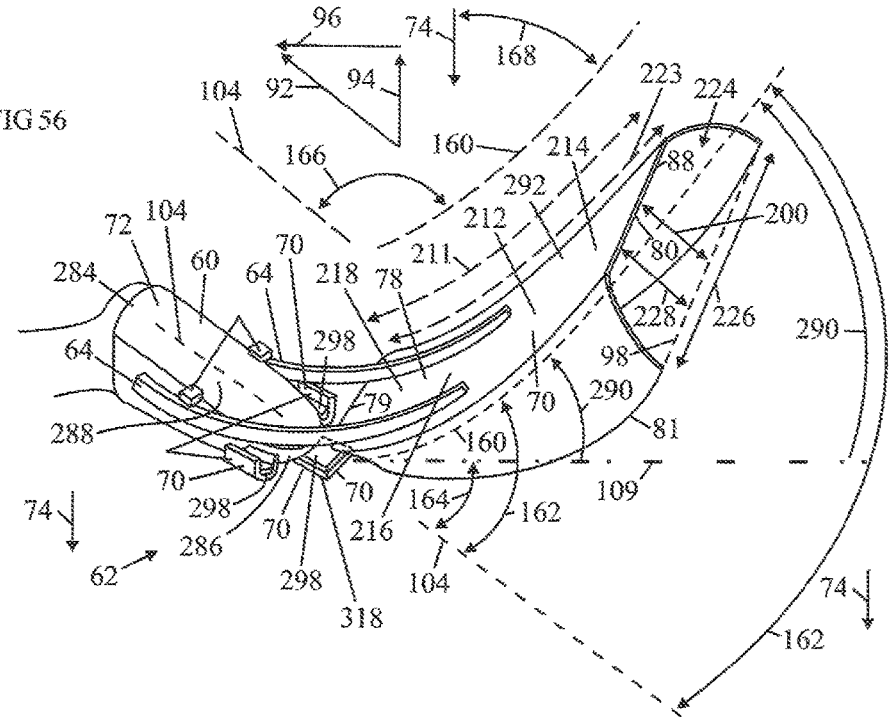
FIG. 56 shows a side perspective view of an alternate embodiment during a downward kicking stroke direction.

FIG. 56 shows a side perspective view of an alternate embodiment during downward kicking stroke direction 74. This embodiment is similar to the embodiment in FIG. 55 with some exemplified changes. FIG. 56 demonstrates a method for creating asymmetrical blade deflections on opposing kicking stroke directions relative to direction of travel 76 and/or neutral position 109. FIG. 56 shows an example of one embodiment for achieving this method that employs upward deflection limiting members 312 and downward deflection limiting members 314; however, any desired alternative structure, combinations of structures, configurations, arrangements, devices can be used to facilitate this method for creating asymmetrical blade deflections on opposing kicking stroke directions.

In the exemplified embodiment in FIG. 56, upward limiting members 312 are seen as stopping devices connected to foot attachment member 30 near midpoint 288 that extend in an outward direction from foot member 60, and members 312 may be vertically spaced from members 64 while the swim fin is at rest and blade alignment 160 of blade member 62 is arranged to be in a desired alignment relative to sole alignment 104 and/or neutral position 109 during neutral blade position 300. Such vertical spacing can be arranged to permit stiffening members 64 to pivot up and down around a transverse axis near heel portion 284 and/or in an area between heel portion 288 and limiting members 312 through a predetermined range of motion before members 64 come into contact with limiting members 312. Such vertical spacing while at rest can be arranged to permit members 64 to pivot upward and then collide with limiting members 312 during downward kick direction 74 after members 64 have pivoted upward to a desired upper limit of such predetermined range of motion. The view in FIG. 56 shows blade member 62 in deflected position 292 and shows members 64 pivoted upward and have come into contact with the underside of limiting members 312. This contact with limiting members 312 can stop and/or reduce the portions of members 64 between heel portion 284 and members 312 from experiencing further upward pivoting. If stiffening members 64 are arranged to be significantly stiff, then this collision with limiting members 312 can also significantly limit the total range of upward pivoting experienced by blade member 62 in an area between heel portion 288 and trailing edge 80 and/or between limiting members 312 and trailing edge 80. If stiffening members 64 are arranged to be significantly flexible, then the portions of members 64 that are forward of limiting members 312 can then be forced to pivot around a new transverse axis that is at or forward of limiting members 312. This can be used to create a shortened lever arm of pivoting for blade member 62 and members 64 between limiting members 312 and training edge 80, compared to the previously larger lever arm between heel portion 284 and trailing edge 80. Such a shortened lever arm can be arranged to reduce the overall torque created by water pressure and applied against members 64 during downward kick direction 74. This reduced torque can be used to reduce and/or substantially limit upward pivoting of blade member 62 between limiting members 312 and trailing edge 80 during downward stroke direction 74. These exemplified methods can also be used to create a relative increase in the bending resistance within members 64 and can be used to limit the upper range of upward pivoting of blade member 62 during downward stroke direction 74. For example, because in this example, the transverse axis of pivoting within members 64 shifts forward from an area near heel portion 284 to an area that is at and/or forward of the position of limiting members 312 (which in this example is in an area at or forward of midpoint 288), this forward movement of the transverse bending axis can be arranged to force members 64 to bend around a relatively reduced bending radius around such forwardly moved transverse axis of pivoting for a given amount of total deflection for blade member 62, and members 64 can also be arranged to have a sufficient predetermined vertical dimension to experience a significant predetermined increase in bending resistance when bending radius is reduced beyond a predetermined level. This can also be used to limit upward pivoting of blade member 62 to predetermined levels. For example, these methods can be used to permit blade alignment 160 of blade member 62 to be significantly limited from further deflection once blade 62 approaches or reaches deflected position 292 and reduced angle of attack 290.

In the example in FIG. 56, it can be seen from this view that even though stiffening members 64 have pivoted upward and come into contact with limiting members 312 during downward kick direction 74, stiffening members 64 are arranged to have sufficient flexibility to take on an arch-like bend between members 312 and root portion 79 of blade member 62 as well as between members 312 and the trailing ends of stiffening members 64 near midpoint 212 of blade member 62. Stiffening members 64 may be made with a highly resilient thermoplastic material, so that this arch-like bending of stiffening members 64 between limiting members 312 and blade member 62 can permit stiffening members to store elastic energy during such bending and then release such stored energy in a highly elastic snapping motion that is capable of snapping blade member 62 back from deflected position 292 toward neutral position 109 at the end of downward kicking stroke direction 74. In addition, this predetermined continued amount of bending along stiffening members 64 between members 312 and blade 62 that is seen to occur after members 64 have come into contact with members 312, can be used to gradually decelerate and/or stop pivoting to deflected position 292 and avoid or reduce the intensity or occurrence of an irritating sudden shock wave or clicking feeling that can be transmitted to the swimmers feet and legs that can otherwise occur from a sudden or abrupt stop in pivotal motion.

In FIG. 56, downward limiting members 314 are seen arranged to be forward of members 312, near toe portion 286, and downward limiting members 314 are seen to be vertically spaced below and not in contact with stiffening members 64 in this view. Limiting members 314 are seen to arranged in this example to have a substantially U-shaped or L-shaped transverse cross sectional shape along their longitudinal lengths, and this shape can be used to hold or cup stiffening members 64 in both a vertical and transverse dimension when members 64 pivot downward and come into contact with limiting members 314 during the opposite kicking stroke. Alternatively, members 314 may have any desired shape or configuration.

In FIG. 56, a blade limiting member 316 is seen in this example to extend from foot attachment member 60 and toe portion 286 and terminates at a trailing portion 318 that extends toward root portion 79 of blade member 62. In the view of FIG. 56, root portion 79 is vertically spaced from blade limiting member 316 while blade member 62 has pivoted to deflected position 292 under the exertion of water pressure created during downward kicking direction 74. In this example, the portions of member 316 that are near trailing portion 318 are arranged to come into contact with a portion of blade member 62 near root portion 79 during an upward kick direction 110 (not shown) and after a predetermined amount of pivotal motion has occurred in a direction from deflected position 292 back toward neutral position 109, and/or after pivoting through angle 162 toward an alignment that is substantially close to or parallel to sole alignment 104.

At least one portion of blade limiting member 316 may be arranged to impact against at least one portion of blade member 62 in any suitable manner that can be arranged to limit pivotal motion to a predetermined desired range or angled orientation. In alternate embodiments, blade limiting member 316 can be attached to root portion 79 or any other suitable portion of blade member 62 while being disconnected from and spaced from at least one portion of foot attachment member 60, so that member 316 pivots with blade member 62 and comes into contact with at least one portion of foot attachment member 60 (or a part that is connected to foot attachment member 60) to reduce, limit or stop further pivoting after a predetermined amount or range of pivotal motion has occurred. Similarly, in alternate embodiments, members 312 can be attached or molded to stiffening members 64 and extend in a transverse inward direction toward foot attachment member 60 while being disconnected from foot attachment member 60 so that such portions of members 312 move with stiffening members 64 during pivoting and can be arranged to impact against a predetermined portion of foot attachment member 60 in any suitable manner to provide any desired limitation, reduction, or stop to pivotal motion occurring between stiffening members 64 and foot attachment member 60.

In the embodiment in FIG. 56, members 314 and members 316 are seen to be made with two different materials so that these are made with harder portion 70 and softer portion 298. In this example, softer portion 298 is made with a relatively softer thermoplastic material and harder portion is made with a relatively harder thermoplastic material and softer portion 298 is injection molded onto harder portion 70 and secured thereof with a thermal-chemical bond creating during at least one phase of an injection molding process; however, any method of fabrication and any suitable mechanical and/or chemical bond may be used. Softer portion 298 can act as a cushion to soften the impact of stiffening members 64 onto members 314 after the downward kicking stroke direction 74 in FIG. 56 is reversed. This can be used to help avoid or reduce the occurrence of annoying clicking sensations, vibrations, shockwaves, and/or sounds as members 64 impact against members 64 and/or when members 64 disconnect or disengage from members 314 during use. In alternate embodiments, most or even all of members 314 can be made with softer portion 298. If desired, members 314 can be made relatively flexible so that members 314 flex, bend, deform, pivot, or move relative to foot attachment member 60 when stiffening members 64 impact against limiting members 314 to reduce impact shock forces upon impact, with or without using softer portion 298 for any portion of members 314. In alternate embodiments, members 312 can also be made with two materials and can use these same methods or any desired alternate variations.

While members 312 are seen to be substantially planar and members 314 are seen to be substantially U-shaped or L-shaped, members 312 and/or members 314 may be arranged to have any desired shape, configuration, contour, configuration, alignment, positioning or alternative variation. In alternate embodiments, members 312 and/or members 314 can have any desired vertical spacing from members 64 (or alternatively any portion or portions of blade member 62), longitudinal positioning, transverse configurations, shapes, contours, alignments, materials, flexibility, rigidity, and can be substituted with any desired devices or methods. In alternate embodiments, limiting members 312 and/or members 314 can also be arranged to be adjustable in any manner, in vertical and/or longitudinal positioning and/or inclinations, and/or alignments, and/or can be removable or attachable in any desired manner. In the example shown in FIG. 56, members 312 and/or members 314 can be permanently molded to foot attachment member 60, or attached after molding foot attachment member 60, or connected in any manner as desired. If desired, stiffening members 64 and blade member 62 can be attached or removably attached to foot attachment member 60 in any suitable or desired manner, before or after members 312 and/or members 314 are connected to foot attachment member 60 in any suitable or desired manner. In alternate embodiments, members 312 and/or members 314 can be arranged to always be in contact with a predetermined portion or portions of members 64 if desired. In alternate embodiments, any other desired or suitable pivotal limiting or stopping device or devices may be used in any combination with members 312 and/or members 314 and any manner whatsoever, or may be substituted partially or entirely for members 312 or members 314. Also, members 312 and/or members 314 can arranged to be made with significantly rigid and/or hard materials, such significantly hard thermoplastics, or can be made with significantly flexible and/or soft materials, such as significantly flexible or soft thermoplastics, or any combination of both significantly rigid and significantly soft materials.

Figure 57:
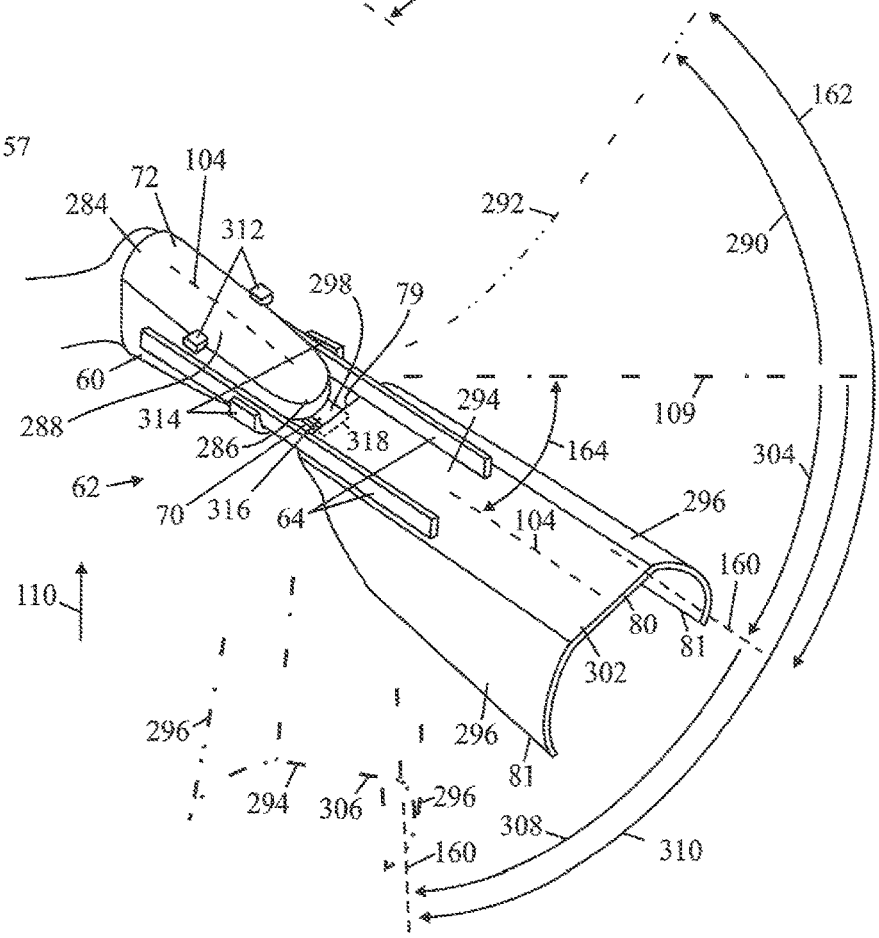
FIG. 57 shows a side perspective view of the same embodiment in FIG. 56 during an upward kicking stroke direction.

FIG. 57 shows a side perspective view of the same embodiment in FIG. 56 where the swim fin has pivoted to deflected position 302 during upward kicking stroke direction 110. In FIG. 57, stiffening members 64 have pivoted to deflected position 302 around a transverse axis near heel portion 284 and have disengaged and moved vertically away from limiting members 312. Stiffening members 64 are also seen to have pivoted toward and come into contact with limiting members 314 so that the portions of stiffening members 64 between heel portion 288 and limiting members 314 are stopped from pivoting further downward under the exertion of downward water pressure created during upward stroke direction 110. In this example, the longitudinal distance between the beginning of members 64 near heel portion 284 and limiting members 314 is seen to be significantly greater that the longitudinal distance between the beginning of members 64 near heel portion 284 and limiting members 314, and this can be used as a method to create asymmetrical bending along members 64 and/or blade member 64 between opposing kicking strokes in a reciprocating kicking stroke cycle. For example, if stiffening members 64 are arranged to be substantially stiff or rigid along their lengths, then arranging limiting members 314 closer to toe portion 286 of foot attachment member 64 can allow limiting members 314 to exert an increased amount of stabilizing leverage to significantly hold blade member 62 in deflected position 302 under the downward exertion of water pressure created during upward kicking stroke direction 110, including during significantly harder kicking strokes, and may be used to reduce or prevent blade member 62 from deflecting excessively passed deflected position 302 and reduced angle of attack 304, such as to the less desired deflected position 306 (shown by broken lines) and reduced angle of attack 110. If stiffening members 64 are arranged to be significantly flexible and bendable, then the effective bending region along length of stiffening members 64 is shortened to occur in an area between limiting members 314 and the trailing end of stiffening members 64 that are connected to blade member 62, and this reduces the lever arm length and torque that water pressure can exert upon stiffening members 64 so as to permit relatively reduced levels of bending to occur along members 64 between limiting members 314 and blade portion 62. If stiffening members 64 are made to be significantly flexible, then this reduced lever arm length can cause significantly flexible stiffening members 64 to experience reduced levels of bending beyond limiting members 314 and this can be used to reduce or significantly limit further deflection of blade member 62 during upstroke direction 110. In addition, this shortened bending distance would require stiffening members 64 to bend around a smaller bending radius in order to experience further downward bending and deflection between limiting members 314 and blade 62. This can allow arranging the materials within members 64 to experience significant or exponential increases in bending resistance when the bending radius is reduced to a predetermined level so as to cause an increase in bending resistance to occur and increased limitation to further deflection. In addition, the materials within members 64 can be arranged to be significantly elastomeric and/or resilient so that reducing the bending radius can create increased energy storage within the resilient material that can be released at the end of a kicking stroke as snapping motion that moves members 64 and blade member 64 away from deflected position 302 and toward neutral position 109 and/or toward deflected position 292 at the end of kicking stroke.

In addition, the example in FIG. 57 shows that root portion 79 of blade member 62 is arranged to pivot downward in a manner that can overlap and come into contact with limiting member 316 near trailing portion 318 (shown by dotted lines underneath root portion 79) during upward stroke direction 110 so as to limit or reduce further deflection of root portion 79 and/or blade member 62 to predetermined levels. Limiting member 316 (or multiple members 316) can be used alone or in addition to limiting members 312 and/or limiting members 314. Member 316 can be used as a substitute for members 314 or together with members 314, as both are shown in this example to limit pivotal motion to predetermined levels during upward kick direction 110. If member 316 is used with members 314 during upward kick direction 110, then the stopping force applied by member 316 against root portion 79 of blade member 62 can further reduce overall loading forces applied to stiffening members 64 in general, and can also reduce the amount of bending that can occur along the length of stiffening members 64 between heel portion 288 and root portion. This can also further shorten the effective lever arm length or torque applied against stiffening members 64 by the exertion of water pressure during upward stroke direction 110 because the effective longitudinal range of bending along the length of stiffening members 64 can be shortened to the portions of stiffening members 64 that are between root portion 79 and the trailing ends of stiffening members 64 near midpoint 212 on blade member 62.

One of the major and unique benefits to these methods exemplified by using limiting members 314 and/or limiting member 316 is that these methods can be used to limit, reduce or stop blade member 62 from pivoting excessively to positions where reduced angle of attack 304 is excessively low so as to no longer be able to generate significant propulsion in direction of swimming 76, such as shown by reduced angle of attack 310 while blade member is in deflected position 306 (shown by broken lines). These methods can be used to greatly increase symmetry, or planned asymmetry so that significant propulsion is generated on both opposing kicking stroke directions during use, rather than just on one kicking stroke direction. However, in alternate embodiments, these methods can be used to create increased propulsion during one desired stroke direction, and can be used to provide reduced or even very little or no propulsion on the opposing kick direction, if desired.

These methods can be arranged to provide any degree of symmetrical bending or asymmetrical bending between opposing kicking strokes, and can be used to arrange blade member 62 to achieve any desired level of reduced angle of attack 290 and any desired level of reduced angle of attack 304. For example, if the swim fin is arranged to cause blade alignment 160 to be substantially parallel to neutral position 109 while the swim fin is at rest, then limiting members 312 can be arranged to limit pivotal motion of blade member 62 beyond deflection 292 and reduced angle of attack to a predetermined level during downward kick direction 74 (as shown in FIG. 56) such as arranging angle 290 to be approximately 45 or 50 degrees as desired, and limiting members 314 and/or limiting member 316 can be arranged to limit pivotal motion of blade member 62 beyond deflected position 302 and reduced angle of attack 302 to predetermined levels, such as arranging angle 304 and/or angle 164 to be approximately 30 degrees. This exemplifies arranging limiting members 312, 314 and/or 316 to create asymmetric deflections.

As another example of asymmetric deflections, if blade alignment 160 is arranged to be substantially parallel to sole alignment 104 so that blade member is arranged to be in position 302 and at reduced angle of attack 604 while the swim fin is at rest and no kicking stroke direction is occurring, then limiting members 314 and/or limiting member 316 can be arranged to remain substantially in position 302 during upstroke direction 100 and to significantly hold stiffening members 64 and/or blade member 62 stable in position 302 and limit or stop blade member 62 from deflecting excessively toward or to deflected position 306 and/or toward or to reduced angle of attack 310, if desired. While limiting members 314 and/or limiting member 316 can be arranged to permit blade member 62 to be in position 302 while at rest and remain substantially in position 302 during upward kicking stroke direction 110, limiting members 312 and/or the flexibility of stiffening members 64 (with or without limiting members 312) can be arranged to permit blade member 62 to pivot to deflected position 292 (shown by broken lines) and to reduced angle of attack 290 during downward kick direction 74 as shown in FIG. 56.

These methods, and any desired variation thereof, for limiting pivotal or flexion motion may be used with any variation or type of blade member 62, with or without any type of scoop shape whatsoever, and can benefit any blade shape, including for example, flat blades, blades that form scoop shapes with flexible portions that move from a more planar orientation to a more scooped orientation under the exertion of water pressure, split blades, planar blades with side rails, vented blades, multiple blades, angled blades, or any other desired propulsion blade shape, configuration, arrangement, contour or type.

Figure 58:
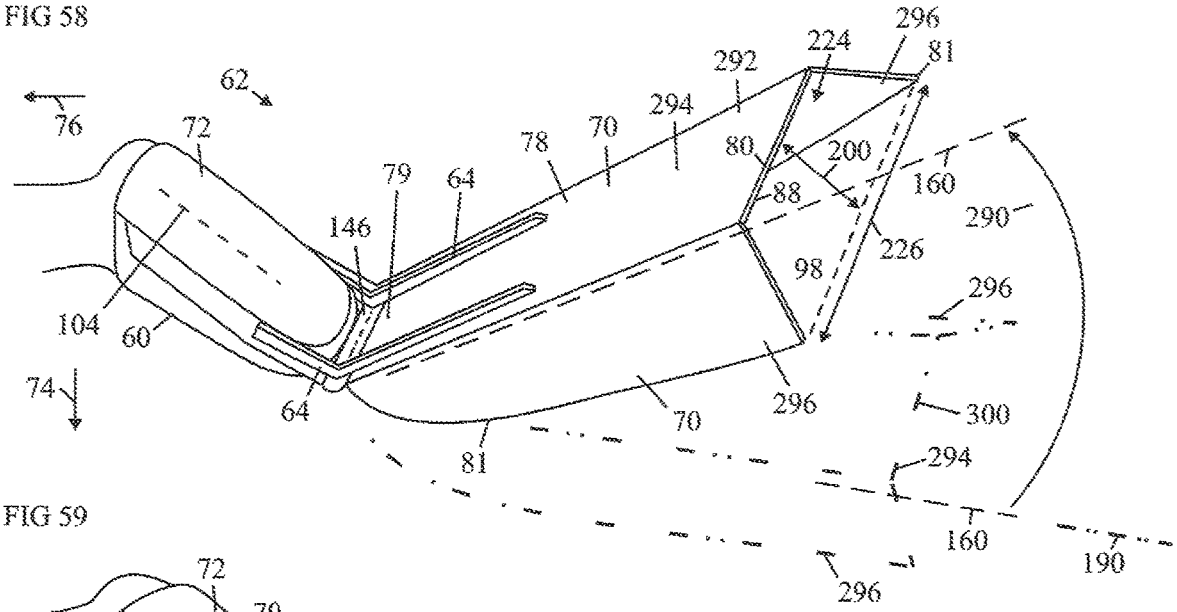
FIG. 58 shows a side perspective view of an alternate embodiment that is being kicked in a downward kicking stroke direction.

FIG. 58 shows a side perspective view of an alternate embodiment that is being kicked in downward kicking stroke direction 74. This exemplifies an alternate embodiment in which blade member 62 is arranged to be significantly rigid during use and horizontal member 294 and vertical members 296 are made with harder material 70. In other embodiments, a softer thermoplastic material can be molded onto any portion of harder portion 70 on blade member 62 and secured with any desired chemical, thermochemical, and/or mechanical bond. In this example, hinging member 146 and stiffening members 64 are arranged to provide pivotal motion around a transverse axis near root portion 79; however, any method for providing blade member 62 with pivotal motion relative to foot attachment member 62 may be used.

Figure 59:
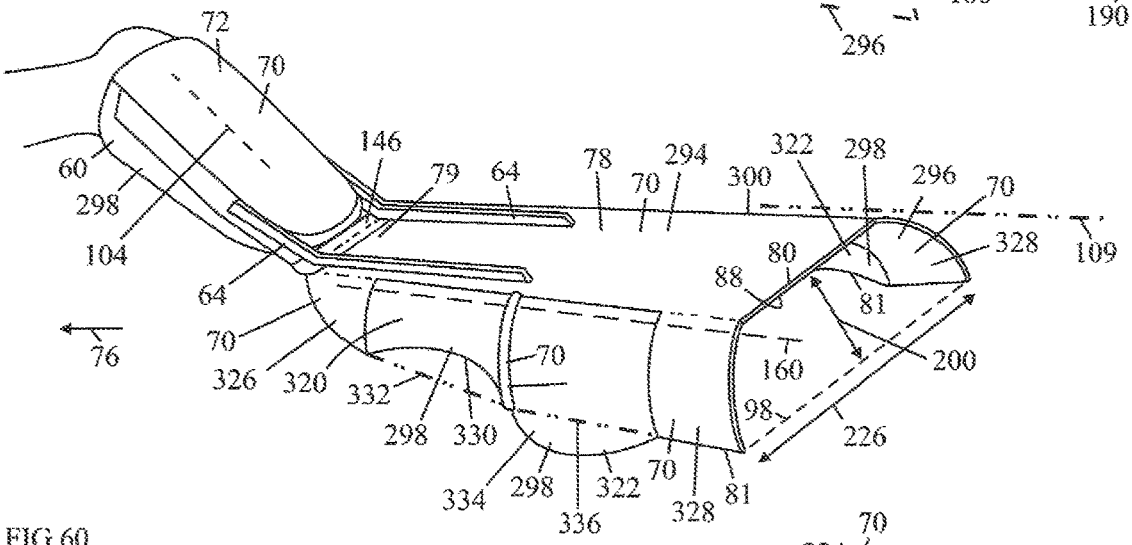
FIG. 59 shows a side perspective view of an alternate embodiment that is at rest.

FIG. 59 shows a side perspective view of an alternate embodiment that is at rest. In this example, vertical members 296 are seen to have a concave vertical member 320 and a convex vertical member 322 that are made with a relatively softer portion 298 such as a relatively softer thermoplastic material, such as a thermoplastic rubber or elastomer. In this example, concave member 320 and concave member 322 are separated by a vertical rib member 324 that is made with relatively harder portion 70 (such as a polypropylene "PP", ethylene vinyl acetate "EVA", or thermoplastic urethane "TPU", or other desired materials); however, in alternate embodiments, vertical rib member 324 can be made with a thickened portion of relatively softer portion 298 or may be eliminated entirely so that concave member 320 and convex member 322 join to form one vertical member that is bent in a substantially sinusoidal manner along its length and/or along outer edge 81 and/or or the free end of vertical members 296. Even with vertical rib member 324, concave member 320 and convex member 322 are seen to form a sinusoidal undulating shape along the length of vertical members 296 and/or along outer edge 81 and/or or the free end of vertical members 296. In this embodiment, the portions of vertical members 296 that are between concave member 320 and root portion 70 of blade member 62 are made with relatively harder material 70 to form a relatively stiffer vertical portion 326. Similarly, in this example the portions of vertical members 296 that are between convex member 322 and trailing edge 80 of blade member 62 are made with relatively harder material 70 to form a relatively stiffer vertical portion 328. In this example, stiffer vertical portions 326 and 326 as well as vertical rib member 324 are arranged to be relatively stiffer than concave member 320 and convex member 322 so as to provide structural support to substantially control the orientations and alignments of members 320 and 322 during use. Concave member 320 is seen to have a prearranged concave bend around a vertical axis relative to the outer surface of member 320. This prearranged concave bend may be arranged to have a predetermined amount of looseness in a lengthwise direction to permit concave member 320 to expand in a lengthwise direction as blade member 62 bends along its length during use and also may move in an outward direction from a relatively folded condition 330 to a relatively expanded position 332 (shown by broken lines) during use. Similarly, convex member 322 is seen to have a prearranged convex bend around a vertical axis relative to the outer surface of member 322. This prearranged convex bend may be arranged to have a predetermined amount of looseness in a lengthwise direction to permit concave member 322 to expand in a lengthwise direction as blade member 62 bends along its length during use and also may move in an inward direction from a relatively folded condition 334 to a relatively expanded position 336 (shown by broken lines) during use.

Figure 60:
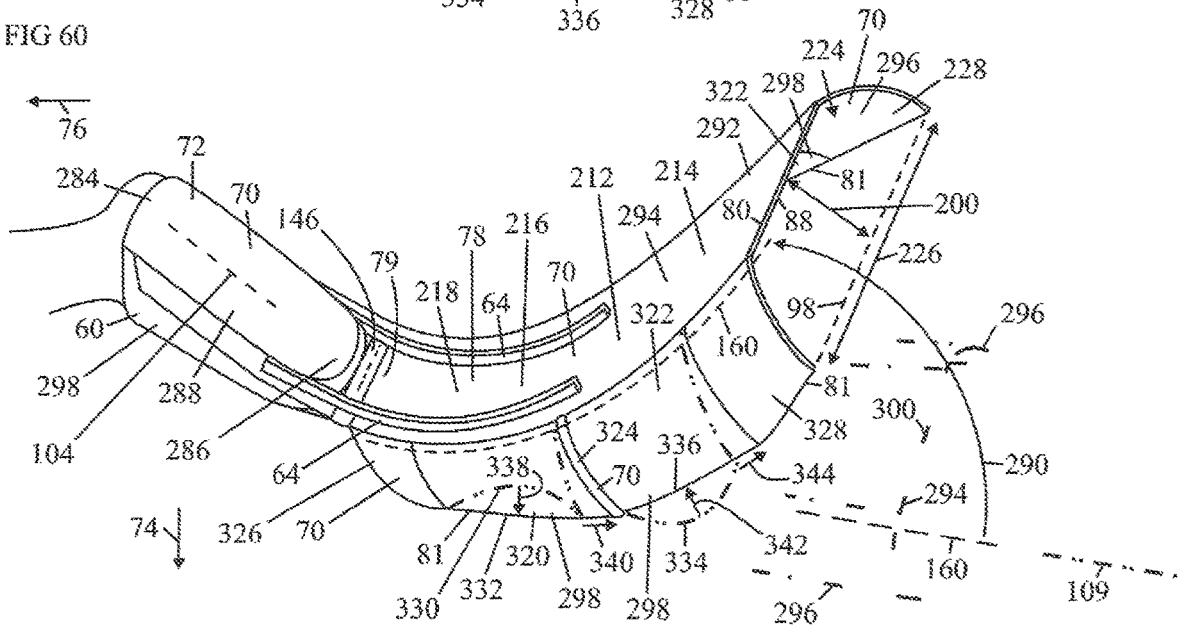
FIG. 60 shows a side perspective view of the same embodiment in FIG. 59 that is being kicked in a downward kicking stroke direction.

FIG. 60 shows a side perspective view of the same embodiment in FIG. 59 that is being kicked in downward kicking stroke direction 74. In this example of FIG. 60, horizontal portion 284 is seen to have taken on an arch-like bend around a transverse axis so that pivoting portion lengthwise blade alignment 160 is curved in a lengthwise direction around a transverse axis along with horizontal portion 284. The methods provided here can be used to increase the ease and efficiency for forming this curved shape. This is because in this example concave member 320 and convex member 322 are seen to have expanded along their lengths near outer edge 81 and/or along the free ends members 320 and 322. Concave member 320 is seen to have experienced an outward movement 338 (shown by an arrow) from folded condition 330 (shown by broken lines) to expanded position 332, and outer edge 81 along member 320 is also seen to have experienced a lengthwise expansion 340 as blade alignment 160 of blade member 62 at blade position 300 (shown by broken lines) pivots and bends to deflected position 292 during downward kicking stroke direction 74. Similarly, convex member 322 is seen to have experienced an inward movement 342 (shown by an arrow) from folded condition 334 (shown by broken lines) to expanded position 336, and outer edge 81 along member 320 is also seen to have experienced a lengthwise expansion 344 as blade alignment 160 of blade member 62 at blade position 300 (shown by broken lines) pivots and bends to deflected position 292 during downward kicking stroke direction 74. This expansion of members 320 and 322 can be used to reduce bending resistance within blade member 62 due to the significantly large vertical heights of vertical members 296. This method can permit predetermined desired amounts of curvature and flexing to occur within blade member 62 during use while also substantially maintaining the significantly vertical orientation of vertical members 296 and thereby enable large volumes of water to be channeled within predetermined scoop shaped cross sectional area 224 and along an increased length of blade member 62, as desired.

This increased longitudinal bending and flexibility can also be used to create a sinusoidal wave along the length of blade member 62 during at least one inversion phase of a reciprocating kicking stroke cycle in which the portions of blade member 62 near trailing edge 80 are arranged to move in the opposite direction of foot attachment member 60 during such kick inversion phase, as illustrated in other drawing figures and descriptions in this specification.

Also, these methods for increasing curvature can be used to permit spring-like tension to be built up within the material of horizontal portion 284 and/or stiffening members 64 (which can extend any desired distance along horizontal portion 284), so that such stored energy can create a significantly strong snapping motion at the end of a kicking stroke in a direction toward neutral blade portion 109.

In alternate embodiments, any portion of vertical members 296 can be arranged to have any number or size of prearranged bends or curvatures around a substantially vertical axis, including any straight or curved axis, any diagonal axis having a vertical component, any transverse axis or transversely inclined or diagonal axis, as well as any other desired axial orientation. For example, the entire length of vertical members 296 can be made with relatively softer portion 298 and can be arranged to have one prearranged curve or bend around a substantially vertical axis that extends along substantially the entire longitudinal length of vertical portion 296 with either a relatively large bending radius, or multiple prearranged curvatures can be arranged to create any desired form of successive or undulating series of curvatures having any desired shapes and contours, including for example undulating shapes, scalloped shapes, sinusoidal shapes, zig-zap shapes, angular shapes, cornered shapes, sharper folds created around sharper corners, sharper folds made around relatively small bending radii, or variations in material thicknesses.

In alternate embodiments, members 326, 320, 324, 322 and 328 can all be made with softer portion 298. If desired, members 326, 324 and 329 shown in FIG. 60 can be arranged to have greater thicknesses to provide relatively increased structure and/or stiffness, while members 32 and 322 are arranged to have smaller thicknesses to provide increased flexibility, extensibility, and/or expandability.

In alternate embodiments, members 320 and/or members 320 can be made with a significantly extensible material that is arranged to stretch to create lengthwise expansion 340 and/or lengthwise expansion 344 during use, with or without using any curvature, folds, or loose material bent around a transverse axis or any other desired axis.

In alternate embodiments, any hinge or pivoting member that is arranged to hinge or pivot around a substantially vertical axis (or any other desired axis) can be used to permit at least one portion of vertical members 296 to expand or extend in a substantially longitudinal direction along at least one portion of the length of horizontal member 294 and/or any form of blade member 62 during use as any portion of blade member 62 bends around a transverse axis to a reduced angle of attack during use.

In alternate embodiments, any desired variations, shapes, alignments, contours, configurations, arrangements, arrays, and/or number of substantially vertical flexible members. Also, any desired variations, shapes, alignments, contours, configurations, arrangements, arrays, and/or number of substantially vertical stiffening members or substantially vertical rib members may be used.

In alternate embodiments, any method of using at least one folded member that has at least one prearranged fold around any desired axis can be used to expand a predetermined amount in a substantially lengthwise direction to enable at least one portion of a blade member to pivot to a desired predetermined reduced angle of attack and then substantially reduce, limit or stop further pivoting of the blade member when such folded member has reached a substantially expanded position. In other alternate embodiments, at least one expandable member can be used connected to at least one portion of blade member 62 and/or vertical members 296 and arranged to stretch and/or expand a predetermined amount in a substantially lengthwise direction to enable at least one portion of a blade member to pivot to a desired predetermined reduced angle of attack and then substantially reduce, limit or stop further pivoting of the blade member when such folded member has reached a substantially expanded position.

Figure 61:
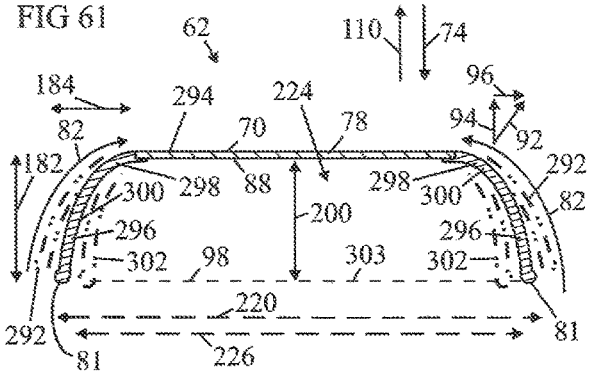
FIG. 61 shows a cross sectional view taken along the line 61-61 in FIG. 55.

FIG. 61 shows an alternate embodiment of the cross sectional view taken along the line 61-61 in FIG. 55. The cross sectional view in FIG. 61 shows one example of variation where vertical members 296 are arranged to have sufficient flexibility to experience a predetermined amount of flexing around a lengthwise axis during use. For illustration, the cross sectional view here shows the orientation of members 296 while the swim fin is and is in neutral position 300 and are seen to flex to an outward flexed position 346 (shown by broke lines) when blade member is has pivoted to deflected position 292 that exists during downward kick direction 74. Similarly, members 296 are seen to flex to an inward flexed position 348 (shown by broke lines) when blade member is has pivoted to deflected position 302 that exists during upward kick direction. Such examples of movements toward or to positions 346 and 348 can occur to members 296 under the exertion of water pressure created during use and/or under the exertion of bending forces applied to horizontal portion 294 and/or any other portion of blade member 62 during use. The material and/or materials used to make members 296 may be arranged to have sufficient resiliency to store energy while flexing and then releasing such energy with a spring-like tension that can cause members 296 to snap back toward neutral position 300 at the end of a kicking stroke, and this spring-like tension and snapping motion can be arranged to occur in both a transverse and longitudinal direction (into the plane of the page) if desired to increase the overall snapping motion of blade member 62 along its length back to neutral position 300 at the end of a kicking stroke, and can be arranged to move an increased amount of water in the opposite direction of intended direction of swimming 76.

Outward flexed position 346 may be arranged to be sufficiently limited to not excessively reduce central depth of scoop dimension 200 and/or predetermined scoop shaped cross sectional area 224 when blade member 62 has pivoted along its length to deflected position 292 during downward kicking stroke direction 74 as seen in perspective view FIG. 55. In FIG. 61, alternate embodiments can include arranging softer portions 298 in vertical members 296 to have sufficient flexibility to permit outward flexed position 346 to extend any desired outward distance and can cause members 296 to take on any desired orientation or alignment relative to the alignment of horizontal member 294 while blade member 62 is in deflected position 292. Similarly, inward flexed position 348 may be arranged to be sufficiently limited to not excessively reduce central depth of scoop dimension 200 and/or predetermined scoop shaped cross sectional area 224 when blade member 62 has pivoted along its length to deflected position 302 during upward kicking stroke direction 110. To exemplify some variations of the embodiment shown in FIG. 61, alternate embodiments can include arranging softer portions 298 in vertical members 296 to be sufficiently flexible to permit outward flexed position 346 to extend any desired inward distance and/or cause members 296 to take on any desired orientation or alignment relative to the alignment of horizontal member 294 while blade member 62 is in deflected position 302 during upward kicking stroke direction 110. In the example in FIG. 61, transverse plane of reference 98 can also be further described as an outer vertical edge transverse plane of reference 303 that extends in a transverse direction between the outer vertical edges of blade member 62 relative to a portion of blade member 62 that may have a prearranged scoop shaped configuration that is arranged to exist while the swim fin is at rest as well as during at least one kicking stroke direction or during at least one phase of a reciprocating kicking stroke cycle.

Figure 62:
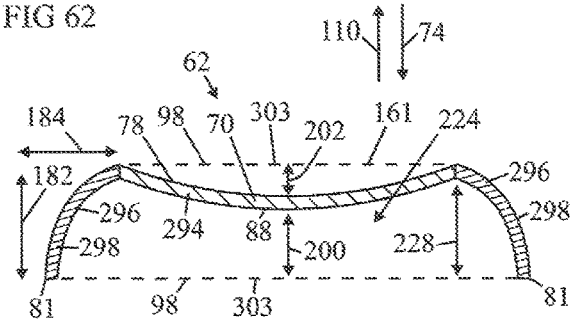
FIG. 62 shows an alternate embodiment of the cross sectional view shown in FIG. 61.

FIG. 62 shows an alternate embodiment of the cross sectional view shown in FIG. 61. In FIG. 62, horizontal member 294 is seen to have a prearranged curved shape formed around a lengthwise axis that is concave up relative to upward kicking direction 110 and concave down relative to downward kick direction 74. This can be used to form a prearranged scoop shape having a predetermined size and a predetermined central depth of scoop 202 relative to harder portion transverse plane of reference 161 during upward stroke direction 110. While horizontal portion 294 is seen to be made with harder portion 70, alternate embodiments arrange horizontal portions to be made with softer portion 298, any desired combination of both harder portion 70 and softer portion 298, and/or any desired combination of different materials in any desired configuration.

Figure 63:
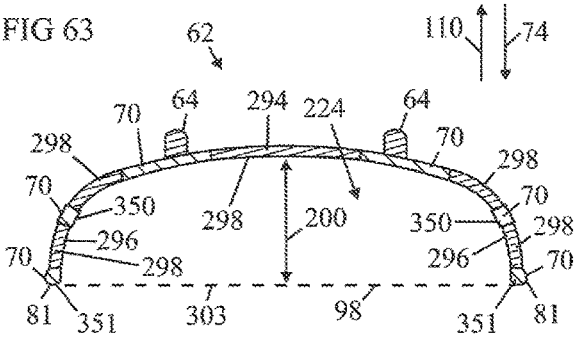
FIG. 63 shows an alternate embodiment of the cross sectional view shown in FIG. 61.

FIG. 63 shows an alternate embodiment of the cross sectional view shown in FIG. 61. In FIG. 63, horizontal portion 294 is seen to be convexly curved relative to upward stroke direction 110 and concavely curved relative to downward stroke direction 74. Stiffening members 64 are visible from this view to show a variation where stiffening members 64 extend a majority of the longitudinal length of blade 62 in this example rather than terminating near midpoint 212 of blade member 62 as shown in FIG. 55. FIG. 63 also shows another variation in which vertical members 296 are made with at least two different materials, for example, such as with a rib member 350 and a rib member 351 that pass through this cross sectional view and is made with harder portion 70 while other portions of member 296 are made with softer portion 298.

Figure 64:
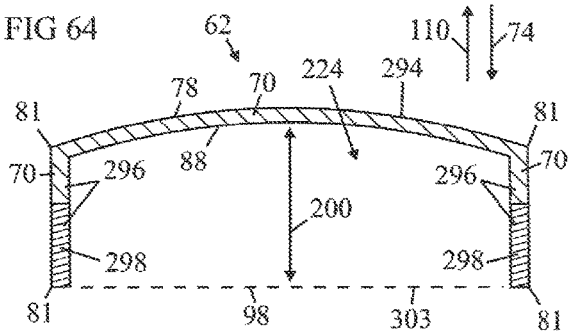
FIG. 64 shows an alternate embodiment of the cross sectional view shown in FIG. 61.

FIG. 64 shows an alternate embodiment of the cross sectional view shown in FIG. 61. In FIG. 64, vertical members 296 are seen to have a substantially vertical alignment and are made with at least two different material, which is exemplified here with the portions of vertical members 296 near horizontal portion 294 as well as harder portion 294 are made with harder portion 70 and the outer portions of vertical members 296 are made with softer portion 298. In this example horizontal portion 294 is seen to be concavely curved relative to downward kick direction 74.

Figure 65:
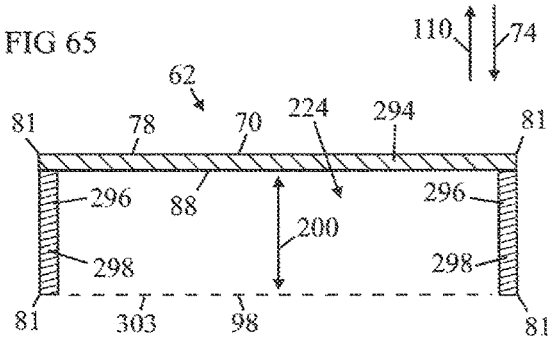
FIG. 65 shows an alternate embodiment of the cross sectional view shown in FIG. 61.

FIG. 65 shows an alternate embodiment of the cross sectional view shown in FIG. 61 in which vertical members 296 have a substantially vertical alignment that is substantially at or close to a 90 degree angle with horizontal portion 294.

Figure 66:
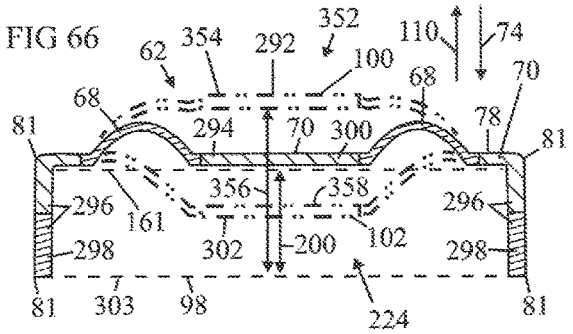
FIG. 66 shows an alternate embodiment of the cross sectional view shown in FIG. 65.

FIG. 66 shows an alternate embodiment of the cross sectional view shown in FIG. 65. FIG. 66 is similar to the cross section shown in FIG. 65 with some exemplified changes. In FIG. 66, vertical members 296 are seen to extend in a substantially vertical direction and are arranged to have a harder portion 70 that extend vertically below the outer ends of horizontal member 294 that are also made with harder portion 70, and outer portions of vertical members 296 are made with softer portion 298 in this example. The outer portions of horizontal member 294 that are near vertical members 296 and are made with harder portion 70 create harder portion transverse plane of reference 161. In this example, an expandable scoop system 352 is seen to be disposed within horizontal member 294, which in this example includes two transversely spaced apart membranes 68 made with softer portion 298 that have prearranged folds that are arranged to be able to expand under the exertion of water pressured created during use. The central portion of horizontal member 294 between membranes 68 is made with harder portion 70 and is arranged in this example to be aligned substantially within harder portion transverse plane of reference 161 while the swim fin is at rest and blade member 62 is in neutral blade position 300; however, in alternate embodiments, at least one portion of blade member 62 between at least two membranes 60 can be arranged to be vertically spaced from plane of reference 161 and urged toward such position with a predetermined biasing force while the swim fin is at rest and blade member is a neutral blade position 300 as is described in other embodiments. Any embodiments and/or individual variations thereof in this specification can be combined with any other embodiments and/or individual variations thereof in this specification, in any manner whatsoever.

In this example, blade member 62 is arranged to form a large prearranged scoop having a significantly large vertical depth exemplified by depth of scoop 200 relative to transverse scoop dimension 226 and transverse blade region dimension 220 so that predetermined scoop shaped cross sectional area 224 can be ready to channel a substantially large amount of water along a predetermined longitudinal length of blade 62 even before expandable scoop system 352 can even begin to deform during use. This can greatly reduce lost motion because a substantially large volume prearranged scoop already exists prior to the beginning of downward kicking stroke direction 74 so that water can quickly begin efficient channeling for high levels of propulsion to begin more quickly or instantly even before expandable scoop system 352 can begin to deform and expand significantly. Therefore, the already large predetermined scoop shaped cross sectional area 224 that pre-exists while the swim fin is at rest and at the very beginning of downward stroke direction 74 can create greater propulsion, acceleration and efficiency, and then this substantially large prearranged scoop be further increased in size as expandable scoop system 352 deforms by having membranes 68 expand so as to permit the central portion of horizontal member 294 made with harder portion 70 to move to upward deflected position 354 under the upward exertion of water pressure created during downward kicking stroke direction 74 and as blade member moves toward or is at deflected position 292. Upward deflected position 354 is arranged to further increase the pre-existing depth of scoop 200 that exists while the swim fin is at rest and in neutral blade position 300, to an expanded depth of scoop 356 during downward kick direction 74. Expanded depth of scoop 356 can be used to further increase predetermined scoop shaped cross sectional area 224 that is arranged to exist while the swim fin is at rest.

A major advantage of this example, is that only a relatively small amount of expansion between depth of scoop 200 to expanded depth of scoop 356 is needed to occur from neutral position 300 in order to create the massive expanded depth of scoop 356, whereas attempting to create such a proportionally large expanded depth of scoop 356 without pre-existing depth of scoop 200 would instead create massive amounts of lost motion that could render a major portion or a majority of downward kicking stroke direction less effective or even significantly ineffective at generating significant propulsion for the swimmer while such expansion is forced to occur across such a large distance. This is because expandable scoop system 352 would be required to expand vertically along a major portion, most, or substantially all the distance exemplified by expanded depth of scoop 356 (including in proportion to transverse scoop dimension 226 rather than the much smaller proportional distance between depth of scoop 200 and expanded depth of scoop 356. This can permit significantly reduced levels of lost motion to occur to create a large expanded depth of scoop 356. For example, if a swimmer is using reciprocating kicking stroke cycles at a rate of one full cycle per second, and each opposing kicking stroke is half this amount or approximately 0.5 seconds per individual stroke, then if expandable scoop system 352 takes 0.5 seconds to deform a majority or all of expanded scoop depth 356 during downstroke 74 without having a head start from a large prearranged depth of scoop 200 before beginning such stroke, then the entire 0.5 second duration of downward kick stroke direction 74 would be subject to lost motion as energy and time is wasted creating a large scale scoop deflection during stroke direction 74 rather than creating efficient propulsion during such deformation phase. Furthermore, on the reverse stroke, this large scale deformation would need to first move all the way back to the neutral position existing while the swim fin is at rest and then move past such neutral position to an inverted scoop shape that is similarly deep so that an even further distance of vertical movement must occur in order to create an inverted scoop shape on subsequent kicking strokes that begin with an expandable scoop system that has been significantly or fully expanded during the prior stroke direction and is then expanded in the opposite direction that the new opposing stroke requires, thus requiring both recovery to a neutral position and then re-expansion in the opposite direction.

In addition, because the large depth of scoop 200 that is pre-existing while the swim fin is at rest to permit large volumes of water channeling instantaneously, lost motion can be further reduced by arranging the flexible material in membranes 68 to be sufficiently stiff so that vertical expansion occurs with a predetermined amount of resistance and tension so that movement to upward deflected position 354 occurs more during hard kicking strokes and less during relatively light kicking strokes, so that such resistance and tension can apply back pressure against the water for increased propulsion and/or for further reduced levels of lost motion during kicking strokes as well even further reduced lost motion during lighter kicking strokes in which the arranged increased relative stiffness of membranes 68 either reduce or even eliminate significant expansion of expandable scoop system 352 during relatively light kicking strokes.

Another benefit of the example in FIG. 66 is that many divers consider downward kicking stroke direction 74 to be the main propulsion generating stroke for them, as divers often call downward stroke 74 the "power stroke", and the cross sectional shape in FIG. 66 is arranged to favor downward stroke direction 74 due to providing a substantially larger scoop area 224 in downward direction 74 than exists relative to upward stroke direction, in this example.

During upward stroke direction 110, this example shows the central portion of horizontal member 294 has experienced downward movement under the exertion of water pressure created during upward kick direction 110 to a downward deflected position 358 (shown by broken lines) to show that this example can be used to form a scoop shaped contour relative to upward kick direction 110 during use.

Figure 67:
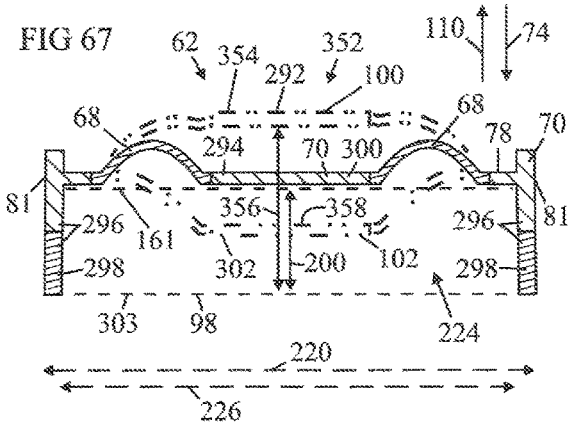
FIG. 67 shows an alternate embodiment of the cross sectional view shown in FIG. 66.

FIG. 67 shows an alternate embodiment of the cross sectional view shown in FIG. 66. In FIG. 67, vertical members 296 are seen to also extend both below and above the plane of horizontal member 294. In the example in FIG. 67 illustrate that the portions of members 296 that extend above the plane of horizontal member 294 in this view can be used to increase the amount of water channeled along blade member 62 during upstroke direction 110 in comparison to FIG. 66.

Figure 68:
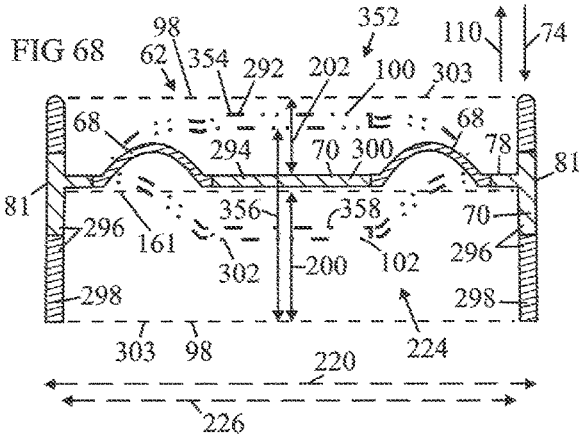
FIG. 68 shows an alternate embodiment of the cross sectional view shown in FIG. 67.

FIG. 68 shows an alternate embodiment of the cross sectional view shown in FIG. 67. In FIG. 68, vertical members 296 are further extended in a vertical direction above the plane of horizontal member 294 in comparison to the example shown in FIG. 67, and the example in FIG. 68 uses softer portion 298 at the upper ends of members 296 in this view. Outer vertical edge transverse plane of reference 303 is shown by dotted lines extending between the upper ends of vertical members 296 and depth of scoop 202 (from the viewer's perspective) is seen to extend between outer vertical edge transverse plane of reference 303 and the central portion of horizontal member 294. Depth of scoop 200 is seen to be significantly larger than depth of scoop 202 in order to create a significantly asymmetrical configuration that can be arranged in this example to permit blade member 62 to generate significantly more water channeling with a significantly larger prearranged scoop shape when kicked in downward direction 74 that when kicked in upward kick direction 110. Vertically asymmetric configurations such as this can also be used to increase propulsion and/or efficiency during downward stroke direction 74 while arranging the swim fin to be easier to walk with on land as lower surface 78 is directed toward land during the act of walking while wearing the swim fins. In alternate embodiments, this asymmetrical arrangement can be varied in any desirable manner and/or can be reversed so that depth of scoop 202 is arranged to be significantly larger than depth of scoop 200, and so that increased water channeling capability and/or propulsion can be generated during upstroke direction 110 if desired in comparison to during downward stroke direction 74. For example, the cross sectional shape in FIG. 68 can be reversed in a vertical manner in order to channel more water during upward kicking stroke direction 110. Similarly, any of the other cross sectional views in this description and/or other perspective views and/or portions of blade 62 can be arranged to have reversed configurations or any other alternative configuration as desired, whether or not such reversed or alternative configurations can be used to increase water channeling and/or propulsion and/or efficiency during upward kicking stroke direction 100 or during any other desired kick direction. In other alternate embodiments, asymmetry can be replaced with substantial symmetry so that depth of scoop 200 is arranged to be substantially equal to depth of scoop 202, if desired.

Figure 69:
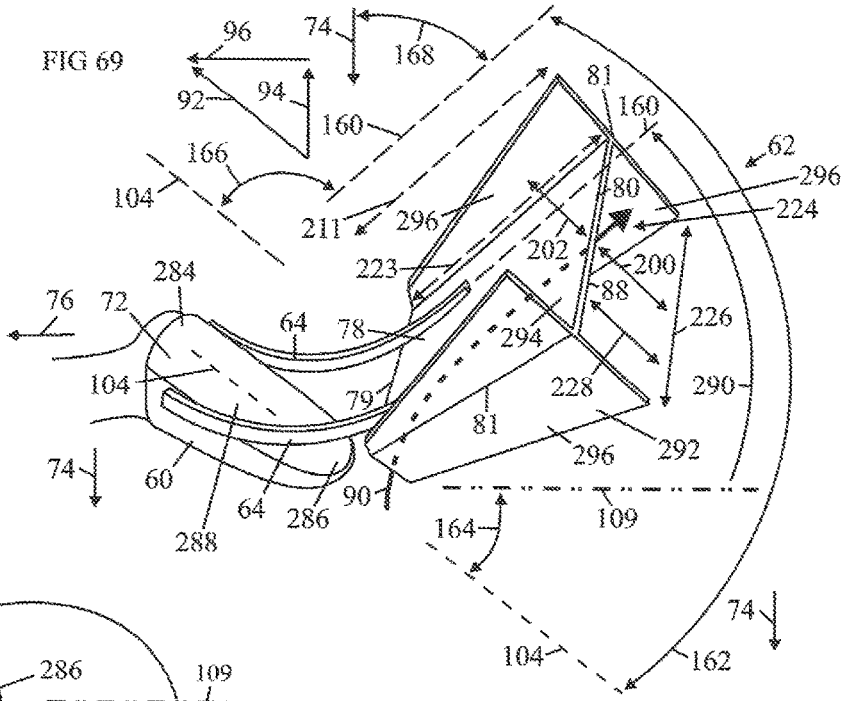
FIG. 69 shows a side perspective view of an alternate embodiment that is being kicked in a downward kicking stroke direction.

FIG. 69 shows a side perspective view of an alternate embodiment that is being kicked in downward kicking stroke direction 74. The perspective view of blade member 62 near trailing edge 80 in FIG. 69 shows that blade member 62 has a cross sectional shape (viewed from trailing edge 80) that is similar to the cross sectional shape in FIG. 68; however, the example in FIG. 68 shows a simplified structure for blade member 62 that does not use an expandable scoop system 352 shown in FIG. 68. In alternate embodiments; horizontal member 294 can have any form of expandable scoop system 352, and/or can be made with two or more different thermoplastic materials connected to each other with at least one thermochemical bond created during at least one phase of an injection molding process, and/or can be varied in any manner.

The side perspective view in example in FIG. 69 illustrates a combination of the significantly large predetermined scoop shaped cross sectional area 224 along with one of the desired orientations of blade member 62 as it moves through the water during downward kick direction 74 in deflected position 292 and at reduced angle of attack 290. This example of a combination permits the viewer to see how the significantly large reduced angle of attack 290 is sufficiently inclined relative to neutral position 109 to efficiently deflect a significantly increased volume of water to flow within the large scoop area 224 and through the large depth of scoop 200 in a rearward direction from root portion 79 to trailing edge 80 along flow direction 90. As stated previously, testing with prototypes using underwater speedometers, show that this combination of methods can be arranged to create dramatic and unexpected increases in acceleration, propulsion, top end speed, low end torque, efficiency, ease of use and/or reductions in lost motion.

In addition, flow visualization tests with prototypes using the methods herein have identified and solved previously unrecognized and unexpected flow condition problems that can greatly reduce overall performance. For example, if the large prearranged scoop area 224 and depth of scoop 200 are used while the lengthwise blade alignment 160 of blade member 62 is arranged to remain substantially parallel to sole alignment 104, then the water flowing into scoop shaped area 224 will be inclined in the wrong direction relative to direction of travel 76 and will cause water to flow in the wrong direction from trailing edge 80 toward rood portion 79 for negative flow relative to direction of travel 76, which is an unexpected exact opposite result because a rigid scoop shape is only anticipated and expected to channel water away from the foot attachment member 60 and toward the trailing edge 80 during the "power stroke" that occurs in downward kick direction 74. As another example, if the large prearranged scoop area 224 and depth of scoop 200 are used while the lengthwise blade alignment 160 of blade member 62 is arranged to remain substantially horizontal in the water and parallel to direction of travel 76 and neutral position 109 during a major duration of a kicking stroke in downward kick direction 74, then the water flowing into scoop area 224 will be not be sufficiently inclined to flow in the direction from root portion 79 toward trailing edge 80; and instead, the water entering scoop area 224 would stagnate, divide and flow outward around all edges of blade member 62 in all directions like water spilling equally around all edges of an overfilled cup. In this situation, any amount of water that is directed within scoop shape 224 toward trailing edge 80 is limited to portions near and around trailing edge 80 and is also substantially nullified by a substantially equal and opposite directed amount of water flowing within scoop shape 224 in the opposite direction toward root portion 79 in an areas that are near and around root portion 79, and at the same time a majority of the water spills in an outward transverse or sideways direction around the elongated outer edges 81 rather than in a longitudinal direction within scoop shape 224, which is directly contrary the common expectation that a scoop type swim fin having a scoop alignment 160 that is horizontally oriented in the water and aimed in the opposite direction of intended swimming 76 during downward kick direction 74 would normally be expected to generate forward propulsion by directing water along such horizontal scoop in the opposite direction of intended travel 76. However, tests of the methods herein show that this does not actually occur and that a horizontally aligned scoop shaped blade will cause water to spill outward in all directions. Prototypes using deep lengthwise scoop shaped blades that are arranged to be oriented at significantly high angles of attack during downward kick direction 74, such as where the lengthwise alignment of the blade is substantially perpendicular to downward kicking stroke direction 64 or substantially parallel to the direction of travel 76 or substantially parallel to sole alignment 104, have been tested to create relatively high levels of muscle strain, low levels of forward propulsion, and relatively lower levels of acceleration, top end speed, sustainable speeds, and efficiency; and therefore, such orientations are less desired during downstroke direction 74.

In addition, creating a prearranged deep scoop shape, and/or an expandable blade region that can deform to a deep scoop shape, unexpectedly creates large vertically aligned portions of the blade member that can act like an I-beam to significantly reduce or prevent the blade member from bending, flexing or arching around a transverse axis to a reduced angle of attack during use and/or to a sufficiently reduced angles of attack relative to the intended direction of travel 76 to an amount effective to facilitate longitudinal flow toward the trailing edge during downward kick direction 74. Also, additional unforeseen problems can occur because if such vertically aligned portions of a deep scoop shaped blade configuration are made flexible enough to bend around a transverse axis, then the increased bending stresses on such vertical portion can cause such vertical portions to twist, bend, flex, deform and/or collapse to a substantially horizontal orientation that causes a collapse, reduction or elimination of the prior deep scoop shape after the blade member has flexed around a transverse axis to a significantly reduced angle of attack during downward kick direction 74. The methods described in this specification solve and alleviate many of these unexpected problems.

In addition, tests with prototypes using the methods herein produce unexpected results and flow conditions as well as unexpected flow problems for an inclined blade member 62. Lack of proper understanding of such unanticipated and unexpected flow problems addressed herein can prevent the methods and combinations of methods provided in this specification from even be expected to create substantial advantages, let alone new and unexpected results of dramatically improved performance. For example, three dimensional outward and sideways transversely directed water flow around the outer side edges of a blade member are unanticipated, unrecognized and unexpected source of energy loss and inefficiency for swim fin blades that are inclined to significantly reduced angles of attack relative to the intended direction of travel 76 while swimming. Because it is unexpected that a major portion or even a majority of the water flowing along such an inclined blade member is actually flowing in an outward sideways direction around the blade during downward kick direction 74, it would not be anticipated that adding significantly tall vertical members to the sides edges of the blade member, or alternatively using other forms of prearranged scoop shaped blade arrangements exemplified and described in this entire specification, could significantly reduce solve major flow problems that are unanticipated and are not even recognized to exist in the first place. Tests with prototypes using the methods herein show that even with a significantly inclined reduced angle of attack, without significantly tall vertical members 296 that are significantly tall compared to the width of the blade member 62, a major portion or even an overwhelming majority of the water flow is wasted by flowing in a substantially outward sideways direction around side edges 81 of blade member 62 (including large outward sideways vector component of any partially longitudinal flow) and a much smaller amount of water (and longitudinal vector component of flow) is directed toward the trailing edge 80 of blade member 62. Furthermore, it is also unexpected and unanticipated that an even smaller total vector component of such flow occurs in the opposite direction of intended swimming 76, and that such horizontal vector component of can further decrease as angle of attack 290 is increased. Tests with prototypes using various methods herein show that such methods can be used to produce unexpected increases in performance and also can be used to significantly improve and/or significantly reduce previously unrecognized and unanticipated flow problems.

Figure 70:
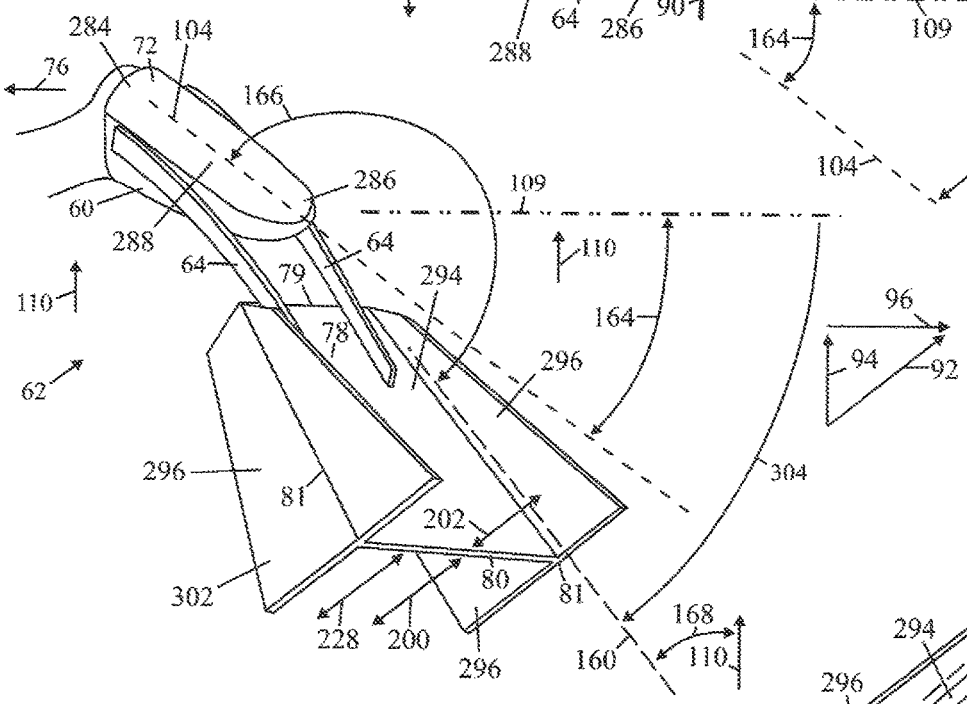
FIG. 70 shows a side perspective view of the same alternate embodiment in FIG. 69 that is being kicked in an upward kicking stroke direction.

FIG. 70 shows a side perspective view of the same alternate embodiment shown in FIG. 69 that is being kicked in upward kicking stroke direction 110. In FIG. 70, blade alignment 160 in deflected position 302 during upward kicking stroke direction 110 is seen to have pivoted to reduced angle of attack 304. Angle 166 between sole alignment 104 and blade alignment 160 is seen to exceed 180 degrees in this example due to passing through the plane of sole alignment 104, and actual angle of attack 168 relative to upward kick direction 110 is seen to be significantly greater than zero so as to not act like a flag in the wind as described previously.

Figure 71:
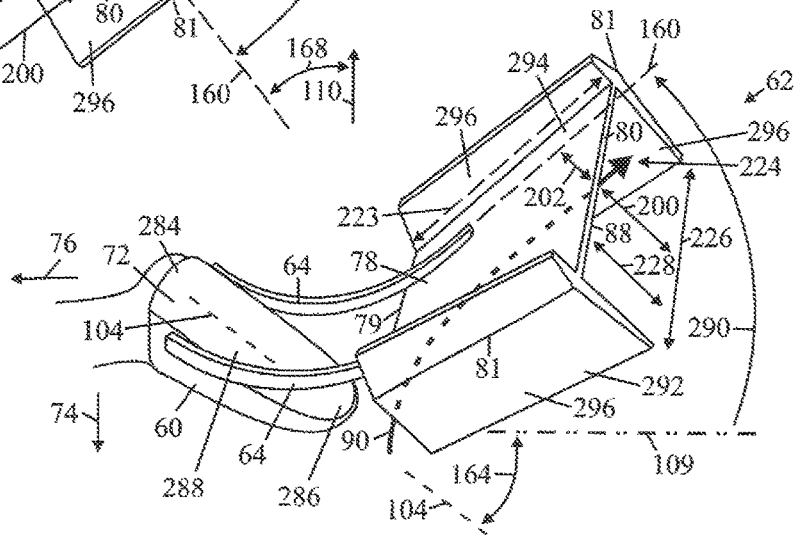
FIG. 71 shows a side perspective view of an alternate embodiment that is being kicked in a downward kicking stroke direction.

FIG. 71 shows a side perspective view of an alternate embodiment that is being kicked in downward kicking stroke direction 74 and is similar to the embodiment in FIGS. 69 and 70, except that the shape of vertical portions 296 has be changed to illustrate an example of an alternate configuration.

Figure 72:
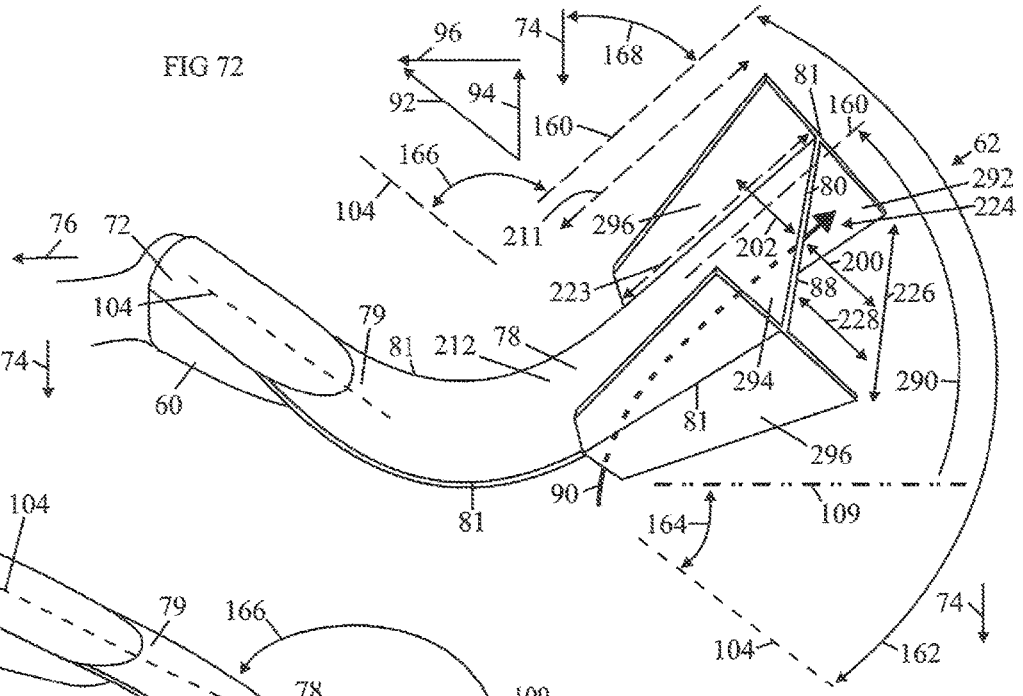
FIG. 72 shows a side perspective view of an alternate embodiment that is being kicked in a downward kicking stroke direction.

FIG. 72 shows a side perspective view of an alternate embodiment that is being kicked in downward kicking stroke direction 74. The embodiment in FIG. 72 is similar to the embodiment showing in FIG. 69, with a change that stiffening members 64 in FIG. 69 are replaced in FIG. 72 with an elongated horizontal member 284 that extends between trailing edge 80 and foot attachment member 60 and vertical members 296 are arranged to occupy a significant portion of the outer half of blade member 62 between trailing edge 80 and longitudinal midpoint 212. In this example in FIG. 72, it can be seen that lengthwise blade alignment 160 along the outer half of blade member 62 between the significantly large vertical members 296 is inclined at reduced angle of attack 290 while the portions of horizontal portion 294 between midpoint 212 and foot attachment member 60 are oriented at a higher angle of attack relative to downward kick direction 74, and the portions of horizontal member 294 near root portion 79 are seen to have a lengthwise alignment that is substantially parallel to sole alignment 104 in this example. In this situation, large vertical members 296 are used along the outer half of blade member 62 where reduced angle of attack 290 in deflected position 292 is sufficient to work with such large vertical members 296 to deflect water flow in flow direction 90 through the significantly large scoop shape 224 with depth of scoop 200, while large vertical members 296 are omitted in this example along the first half of blade member 62 between midpoint 212 and root portion 79 where substantially large vertical members 296 are less desired due to the significantly higher angles of attack of horizontal member 294 in these areas. In addition, omitting substantially large vertical members 296 from the first half of blade member 62 in this example can be used as a method to increase flexibility along the first half of blade member 62 so as to enable the outer half of blade member to efficiently and quickly pivot to reduced angle of attack 290 and avoid an excessive I-beam like stiffening effect along the first half of blade member 62.

Figure 73:
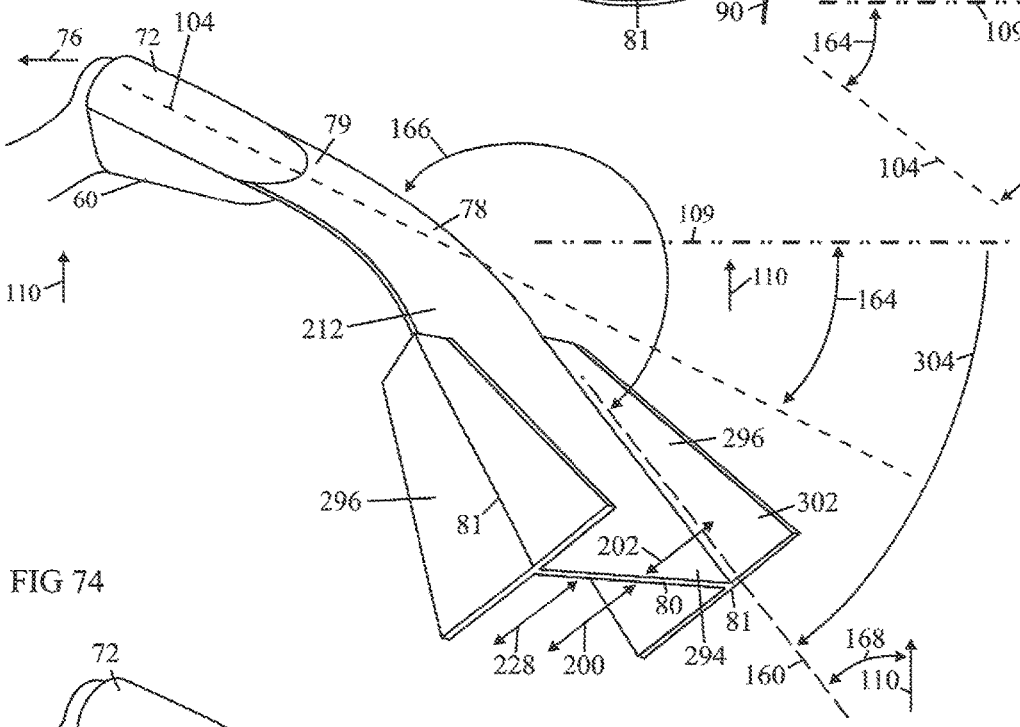
FIG. 73 shows a side perspective view of the same alternate embodiment in FIG. 72 that is being kicked in an upward kicking stroke direction.

FIG. 73 shows a side perspective view of the same alternate embodiment in FIG. 72 that is being kicked in upward kicking stroke direction 110.

Figure 74:
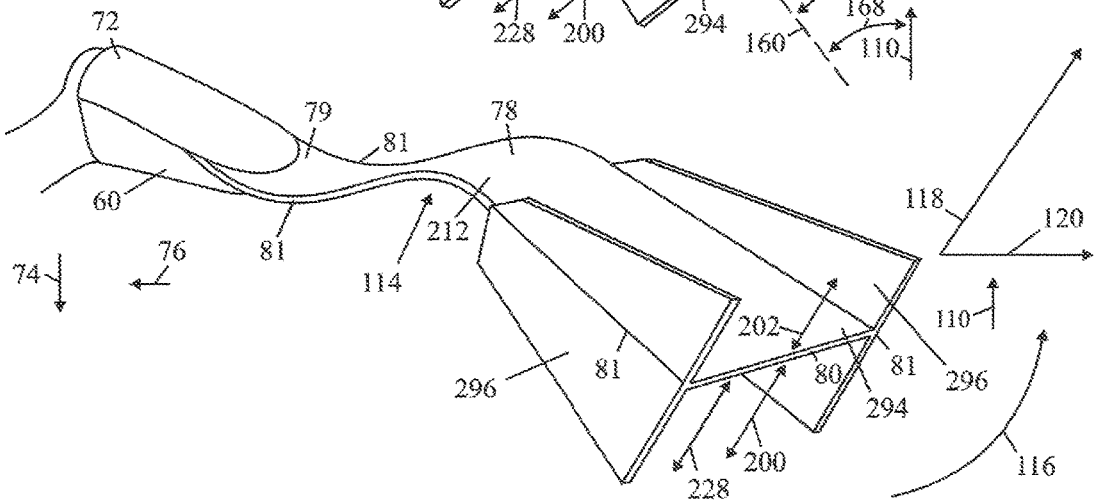
FIG. 74 shows a side perspective view of the same alternate embodiment in FIGS. 72 and 73 during a kicking stroke direction inversion phase of a reciprocating kicking stroke cycle.

FIG. 74 shows a side perspective view of the same alternate embodiment in FIGS. 72 and 73 during a kicking stroke direction inversion phase of a reciprocating kicking stroke cycle. In FIG. 74, it can be seen that horizontal portion 294 of blade member 62 is arranged to have sufficient flexibility to form a substantially sinusoidal wave form along the length of blade member 62 during an inversion phase of a reciprocating kicking stroke cycle in which foot attachment member 62 has reversed its direction of movement from upward kick direction 110 shown in FIG. 73 to downward kick direction 74 in FIG. 74, and in which an outer portion of blade member 62 near trailing edge 80 is still moving in upward kick direction 110 as was occurring previously in FIG. 72. This sinusoidal wave form can be significantly pronounced or not noticeable at all while trailing edge 80 can be observed moving in the opposite direction of foot attachment member 60 during at least one inversion phase of a reciprocating kicking stroke cycle. The large volume of water contained within the significantly large prearranged scoop shaped formed in this example by vertical members 296 having a significantly large depth of scoop 202 can be rapidly moved in the opposite direction of intended swimming 76 for increased propulsion during the snapping motion occurring during abrupt inversion movement 116 as previously described. The methods in this description can be used with rapid successive repetitions of such stroke inversions to create dramatic increases in acceleration, cruising speeds, sustainable speeds, and top end speeds.

Figure 75:
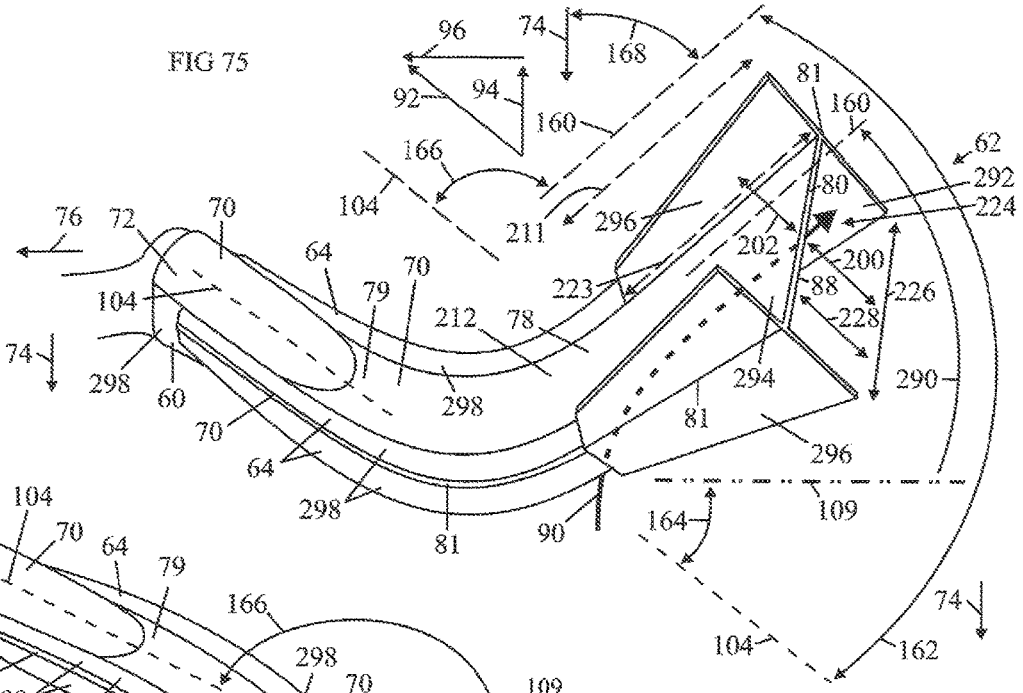
FIG. 75 shows a side perspective view of an alternate embodiment that is being kicked in a downward kicking stroke direction.

FIG. 75 shows a side perspective view of an alternate embodiment that is being kicked in downward kicking stroke direction 74. The embodiment in FIG. 75 is similar to the embodiment shown in FIG. 72, except that stiffening members 64 are seen to be made with at least two different materials, which include a central portion made with harder portion 70 as well as an upper and lower portion made with softer portion 298 that extend vertically above harder portion 70 on member 64 and below harder portion 70 on member 64, respectively. The use of softer portion 298 can be arranged to permit the first half of blade member 62 to be significantly flexible around a transverse axis between foot attachment member 60 and the leading portions of vertical members 296 near midpoint 212, and can also be arranged to provide sufficient structural support to reduce, limit or prevent the outer half of blade member 62 from deflecting excessively beyond deflected position 292 and the desired ranges of reduced angle of attack 290 during downward kick direction 74. The use of softer portion 298 can also be used to significantly increase energy storage while blade member 62 deflects to deflected position 292 and to release such stored energy in the form of a snap back motion that can snaps blade member 62 in a direction away from deflected position 292 and toward neutral position 109 at the end of downward kicking stroke 74.

Figure 76:
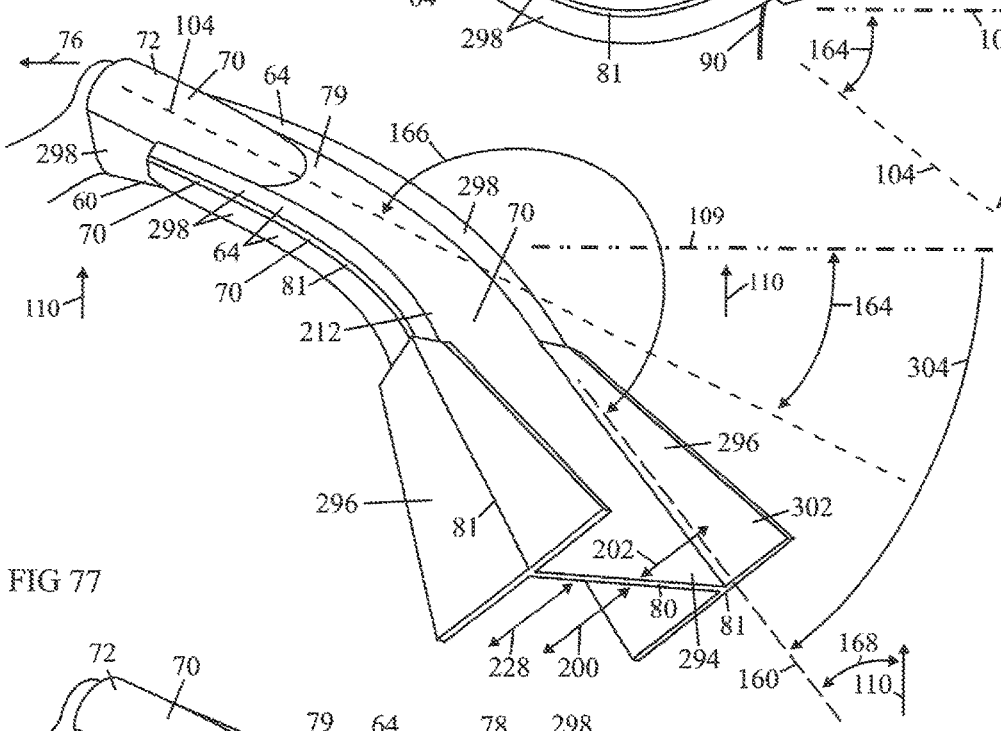
FIG. 76 shows a side perspective view of the same alternate embodiment in FIG. 75 that is being kicked in an upward kicking stroke direction.

FIG. 76 shows a side perspective view of the same alternate embodiment in FIG. 75 that is being kicked in upward kicking stroke direction 110.

Figure 77:
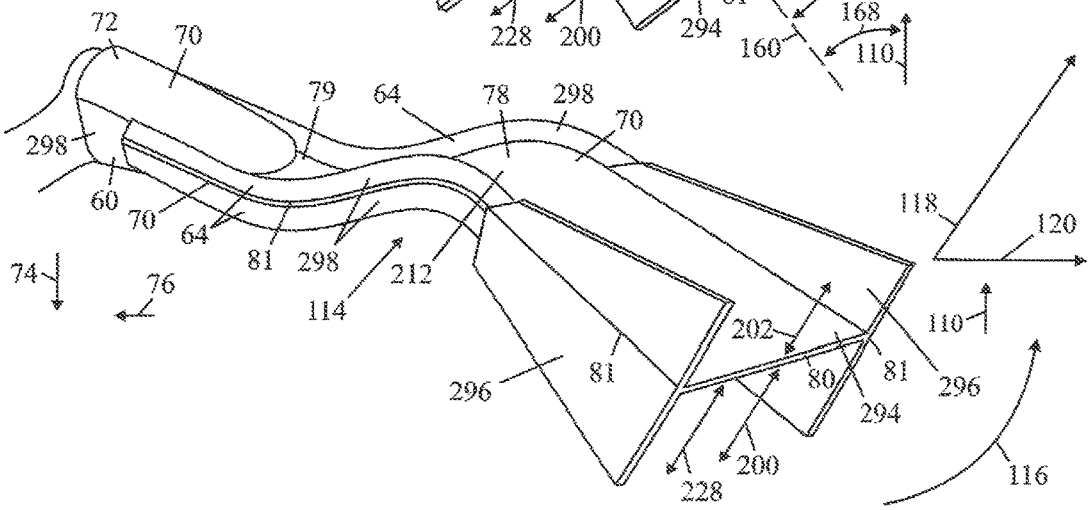
FIG. 77 shows a side perspective view of the same alternate embodiment in FIGS. 75 and 76 during a kicking stroke direction inversion phase of a reciprocating kicking stroke cycle.

FIG. 77 shows a side perspective view of the same alternate embodiment in FIGS. 75 and 76 during a kicking stroke direction inversion phase of a reciprocating kicking stroke cycle. The use of softer portion 298 in stiffening members 64 can also be used to significantly increase abrupt inversion movement 116 of blade member 62 near trailing edge 80 created as the portions of blade member 62 near trailing edge 80 are arranged to move in the opposite direction of foot attachment member 60 during at least one kicking direction inversion phase of a reciprocating kicking stroke cycle.

While FIGS. 72 to 74 and FIGS. 75 to 77 illustrate arranging the first half of blade member 62 to flex and allow the second half or outer half of blade member 62 to pivot to reduced angle of attack 290, any variations may be used. For example, the total bending that is seen to occur around the first half of blade member 62 in this example could alternatively be arranged to be concentrated into a smaller portion of the overall length of blade member 62, such as within the first eighth, quarter, or third of the overall length of blade member 62, and vertical members 296 can be arranged to substantially occupy the respective remaining outer portion of the length of blade member 62.

Figure 78:
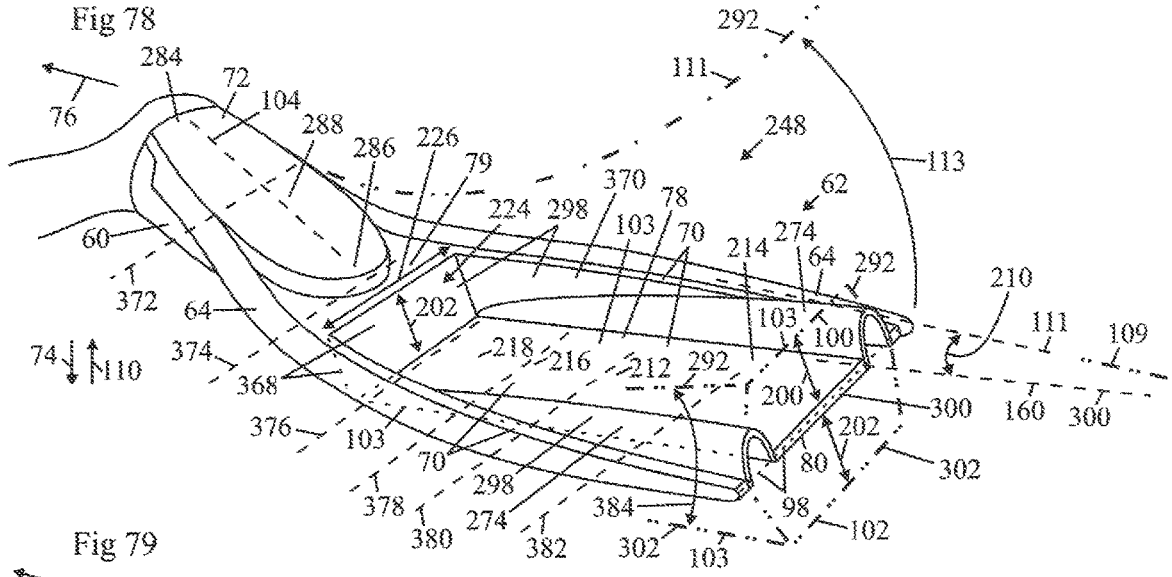
FIG. 78 shows a side perspective view of an alternate embodiment while the swim fin is at rest.

FIG. 78 shows a side perspective view of an alternate embodiment while the swim fin is at rest. In FIG. 78, blade member 62 is seen to include prearranged scoop shaped blade member 248. In this example, prearranged scoop shaped blade member 248 is seen to extend a predetermined longitudinal distance between root portion 79 and trailing edge 80. Scoop shaped cross sectional area 224 of prearranged scoop shaped blade member 248 is arranged to have a predetermined transverse scoop dimension 226 and a predetermined depth of scoop 202 near root portion 79. In this example, depth of scoop 202 near root portion 79 is formed with a transversely aligned vertical blade member 368. In this embodiment, transversely aligned vertical blade member 368 is seen to have a substantially transverse alignment that is substantially perpendicular to the lengthwise alignment of blade member 62 between root portion 79 and trailing edge 80; however, in alternate embodiments transversely aligned vertical blade member 368 may be varied in any desired manner and may have any desired alignment that extends in at least a partially transverse manner or extends with at least some transverse component to its alignment, such as any desired angled alignment, diagonal alignment, curved alignment, V-shaped alignment, U-shaped alignment, or any other desired variation. In this embodiment, transversely aligned vertical blade member 368 is seen to have a substantially flat and rectangular shape; however, in alternate embodiments transversely aligned vertical blade member 368 may be arranged to have any desired shape, contour, arrangement or configuration. Transversely aligned vertical blade member 368 is seen to have a substantially flat and steep vertically inclined orientation relative to the lengthwise alignment of blade member 62; however, in alternate embodiments any desired inclination and/or contour and or any inclination angle or combinations of multiple inclination angles may be used, including for example, curved inclinations, stepped inclinations, or any other desired contour, configuration or arrangement.

In this example, pivoting blade portion 103 is arranged to be connected to the trailing portion of transversely aligned vertical blade member 368. In this example, pivoting blade portion 103 is arranged to be relatively harder portion 70, which is made with at least one relatively harder thermoplastic material, and transversely aligned vertical blade member 368 is arranged to be made with at least one relatively softer portion 298 that is made with a relatively softer thermoplastic material, and such relatively harder thermoplastic material of harder portion 70 is connected to the relatively softer thermoplastic material of softer portion 298 with a thermo-chemical bond created during at least one phase of an injection molding process. In alternate embodiments, pivoting blade portion 103 and transversely aligned vertical blade member 368 can be made with either the same material or different materials, and each can use any desired material, any degree of hardness, softness, flexibility, resiliency, stiffness, or rigidity, and can be connected to each other with any suitable mechanical and/or chemical bond. In alternate embodiments can replace transversely aligned vertical blade member 368 with a void, opening, recess, vent, vented member, so as to permit water to flow through such an opening, recess, void or vent and into blade member 62 and/or pivoting blade member 103. In such a situation, at least one portion of blade member 62 would be arranged to provide a predetermined biasing force that is arranged to urge such venting system and/or the structure surrounding or creating such vent or void and/or at least one other portion of blade member 62 that is spaced from such vented structure away from transverse plane of reference 98 in a substantially orthogonal direction to a predetermined orthogonally spaced position while the swim fin is at rest, and permit at least one portion of such venting structure and/or at least one other portion of blade member 62 that is spaced from such vented structure to experience a predetermined amount of orthogonally directed movement relative to transverse plane of reference 98 to at least one orthogonally deflected position as water pressure is exerted on blade member 62 during at least one phase of a reciprocating kicking stroke cycle, and such predetermined biasing force is also arranged to move such at least one portion of such venting structure and/or at least one other portion of blade member 62 that is spaced from such vented structure away from such orthogonally deflected position and back toward or to such predetermined orthogonally spaced position at the end of such at least one phase of a reciprocating kicking stroke cycle and/or when the swim fin is returned to a state of rest.

In FIG. 78, a substantially lengthwise vertical portion 370 is seen to be connected to the outer side portions of transversely aligned vertical blade member 368 and extends in a substantially longitudinal direction along the length of blade member 62 and extends in between the outer side portions of pivoting blade portion 103 and stiffening members 64. It can be seen that substantially lengthwise vertical portion 370, transversely aligned vertical blade member 368 and pivoting blade portion 103 together can be used form a predetermined the shape for prearranged scoop shaped blade member 248, and such predetermined shape is formed by molding these parts together during at least one phase of an injection molding process. The outer edge portions of vertical member 368 that are obstructed from view by the stiffening member 64 that is closed to the viewer are shown by dotted lines, and the outer side edge of pivoting blade portion 103 that is obstructed from view by the stiffening member 64 that is closest to the viewer is also shown by dotted lines, and this is to further illustrate the shape in this example of prearranged scoop shaped blade member 248 from the perspective view shown in FIG. 78, as well as in FIGS. 79 and 80.

In FIG. 78, substantially lengthwise vertical portion 370 is made with relatively softer portion 298, which in this example is a relatively soft and flexible thermoplastic material, such a thermoplastic elastomer, thermoplastic rubber, or any other relatively soft and/or relatively flexible material. This use of the relatively flexible material of softer portion 298 for substantially lengthwise vertical portion 370 and transversely aligned vertical blade member 368 can be used as a method to encourage vertical portions 370 and 368 to flex and deflect away from their respective orientations at rest to at least one predetermined deformed orientation during at least one phase of a reciprocating kicking stroke cycle during use. In this example, vertical portion 370 can be made part of membrane 68 and can be made with the same material and formed integrally together, if desired, during at least one phase of an injection molding process. In alternate embodiments, the flexibility of relatively softer portions 298 in vertical portions 370 and 368 can be arranged to be sufficiently flexible to deflect to an inverted shape or a partially inverted shape relative to the shape shown in FIG. 78 during upward kicking stroke direction 110. At least one portion of blade member 62 and/or at least one portion of any of portions 103, 368, 370, membrane 68, folded member 270 in this example, is arranged to have a predetermined biasing force, such as an elastic, resilient or spring like tension that is arranged to exist within the material of at least one of such portions, and which is arranged to urges blade member 62 back from such a deflected, inverted or partially inverted shape to the shape shown in FIG. 78 when the swim fin is at rest. Such biasing force may be arranged to be sufficiently low to permit a significantly deflected, inverted or partially inverted shape to occur under relatively light loading conditions created during at least one phase of a reciprocating kicking stroke cycle, such as created during relatively light kicking strokes used to reach a relatively low or moderate swimming speed or during relatively harder kicking strokes used to reach relatively high swimming speeds, and then such predetermined biasing force may be arranged to be sufficiently strong enough to urge the blade member back to the prior predetermined prearranged scoop shape 248 in which at least one portion of blade member 62 is spaced from transverse plane of reference 98 in a predetermined orthogonal direction at the end of at least one kicking stroke direction and/or when the swim is returned to a state of rest. Such predetermined biasing force may be also arranged to significantly reduce lost motion as described in other portions of this specification. Such methods for arranging a predetermined biasing force can be used with any portion of any of the embodiments or may be used with any of the individual methods or variations shown or described in this specification as well as any desired variation thereof or with any other desired alternate embodiment, and may be varied in any desirable manner. The methods of arranging biasing forces to move or positing a predetermined blade member portion can be arranged or used in any alternate embodiments to bias away from transverse plane of reference 98 any desired blade feature or element, including a predetermined blade element, a flexible membrane, a flexible membrane made with the at least one relatively softer thermoplastic material, a flexible hinge element, a flexible hinge element having a substantially transverse alignment, a flexible hinge element having a substantially lengthwise alignment, a thickened portion of the blade member, a relatively stiffer portion of the blade member, a region of reduced thickness, a folded member, an expandable member, a rib member, a planar shaped member, a laminated member that is laminated onto at least one portion of the blade member, a reinforcement member made with the at least one relatively harder thermoplastic material, a recess, a vent, a venting member, a venting region, an opening, a void, a region of increased flexibility, a region of increased hardness, a transversely inclined membrane, a transversely inclined folded membrane, a transversely inclined curved membrane, a transversely asymmetrical membrane, a transversely asymmetrical folded membrane, a transversely aligned member, a longitudinally inclined member, a blade region arranged to have design or logo printed or molded or embossed or hot stamped or etched or electrostatically textured onto such blade region during at least one phase of a molding process, a region of increased stiffness or any other desired feature, element or structure.

In FIG. 78, broken lines show an example of an orientation of stiffening member flexed position 111 during deflected position 292 under the exertion of water pressure created when the swim fin is kicked in downward kick direction 74 and stiffening members 64 are arranged to flex to deflected position 292, as is previously shown and described in other drawings and description in this specification. These broken lines for stiffening member flexed position 111 during deflected position 292 show that the swim fin and/or blade member 64 and/or stiffening members 64 are arranged to flex around a transverse axis 372 that in this example is in between foot attachment member midpoint 288 and heel portion 284. In any alternate embodiment, at least one transversely aligned bending axis, bending region or pivotal axis, such as transverse axis 372, can be arranged to exist along any portion or multiple portions of the length of the swim fin, including any along the length of foot attachment member 60 between toe portion 286 and heel portion 284, at or near heel portion 288, at or near toe portion 286, at or near root portion 79, any portion or portions of blade member 62 between root portion 79 and trailing edge 80, and/or any portion or portions along the length of stiffening members 64. In the example in FIG. 78, the broken lines for stiffening member flexed position 111 during deflected position 292 are seen to be curved to show that stiffening members 64 are arranged in this example to flex around more than one transverse axis along the length of stiffening members 64. For example, FIG. 78 is also arranged to experience flexing around a transverse axis 374 near toe portion 286 and root portion 79 of the swim fin.

In any embodiment or alternate embodiment, pivoting blade portion 103 can also be arranged to pivot around at least one predetermined transverse axis, transverse bending zone, transverse bending region, transverse hinging region, transverse flexing region, transverse hinge, any other transverse bending member, and such can be located along any portion or portions of the swim fin. For example, in FIG. 78, pivoting blade portion 103 is arranged to have sufficient flexibility during use to experience pivotal motion during use around a transverse 376, transverse 378, transverse 380, and/or transverse 382. In this example, transverse axis 376 is seen to be in between root portion 79 and one eight blade position 218, and is near the connection between transversely aligned vertical blade member 368 and pivoting blade portion 103; transverse axis 378 is seen to be near one quarter blade position 216; transverse axis 380 is seen to be near one half blade position 212; and transverse axis 382 is seen to be near three quarter blade position 214 and near trailing edge 80. Any transverse axis shown or described in FIG. 78 or any other drawing figure or description in this specification, or any variation thereof, can be oriented, positioned, configured, arranged or varied in any manner along any portion of the swim fin, and can be used independently or in any combination with other individual features, elements, methods and/or variations exemplified in this specification or with any other desired alternate embodiment or variation. For example, any transverse axis and its related portion of blade member 62 having a transversely aligned pivotal region, transversely aligned flexible or flexing region, transversely aligned bending region, and/or transversely aligned hinging region can be arranged to be oriented within transverse plane of reference 98 while the swim fin is at rest, or alternatively, can be arranged to significantly spaced in an predetermined orthogonal direction away from transverse plane of reference 98 while the swim fin is at rest. For example, in FIG. 78, transverse axis 374 is positioned on the portion of blade member 62 near root portion that is oriented within the plane of transverse plane of reference 98. As another example, in FIG. 78, transverse axis 376 near vertical member 368 is positioned on a portion of pivoting blade portion 103 (which is part of blade member 62) that is vertically spaced in a predetermined orthogonal direction away from the plane of transverse plane of reference 98 by depth of scoop 202. Similarly, in the example of FIG. 78, transverse axis 378, transverse axis 380, and transverse axis 382 are all positioned on portions of pivoting blade portion 103 (which is part of blade member 62) that are all vertically spaced a significant predetermined distance in an orthogonal direction away from transverse plane of reference 98. Because in FIG. 78 transverse axis 378, transverse axis 380, and transverse axis 382 are all intended to show transversely aligned bending regions, transversely aligned pivotal regions, transversely aligned flexing regions, or the like, that at least one portion of pivoting blade portion 103, which is at least one portion of blade member 62, is arranged to experience bending around such transverse axis 378, transverse axis 380, and/or transverse axis 382 under the exertion of water pressure created during use with reciprocating kicking stroke cycles. If desired, pivoting blade portion 103 can be arranged to take on a partially or continuously curved shape during use to form along a significantly large portion or the entirety of the length of pivoting blade portion 103 during at least one phase of a reciprocating motion kicking stroke cycle.

Pivoting blade portion 103 is arranged to also form a substantially sinusoidal wave form along a significant portion of or the entirety of the length of pivoting blade portion 103 during at least one inversion portion of a reciprocation kicking stroke cycle, such as previously shown, described and exemplified in FIGS. 4, 5, 6, 17, 22, 54, 74 and 77.

In the example in FIG. 78 in which the swim fin is shown at rest, trailing edge 80 is seen to be oriented within transverse plane of reference 98. In this example, pivoting portion lengthwise blade alignment 160 existing at rest is seen to be oriented at angle 210 relative to stiffening member alignment 111 existing at rest, with alignment 160 converging toward stiffening member alignment 111 in a direction from the portions of pivoting blade portion 103 near vertical member 368 toward trailing edge 80 or toward the free end of blade member 62. In this example, stiffening member alignment 111 is arranged to be parallel to neutral position 109 (shown by broken lines). This example where angle 210 is a convergent angle toward trailing edge 80 is an example of one of many possible variations of the example shown in FIG. 28 where angle 210 is oriented at a divergent angle, and of the example in FIG. 3 where such an angle 210 (not shown in FIG. 3) would be convergent within the first half of blade member 62 along pivoting portion 103 in a direction between vent aftward edge 86 and an area adjacent the longitudinal midpoint of blade 62 (midpoint 212 shown in other drawing figures), and then divergent in a direction between an area adjacent the longitudinal midpoint of blade 62 (midpoint 212 shown in other drawing figures) toward trailing edge 80 which is the free end of blade member 62, so that a majority of the first half of blade member 62 is convergently aligned and the majority of the second half of blade member 62 is divergently aligned relative to angle 210.

In FIG. 78, the flexed or pivoted position of pivoting blade portion 103 during downward kicking stroke direction 74 is shown by broken lines by bowed position 100 near trailing edge that occurs when pivoting blade portion 103 pivots to defected position 292. While stiffening members 64 and the entire assembly of blade member 62 may be arranged to pivot around at least one of transverse axis 372, 374, 376, 378, 380, 382 and/or any other transverse axis or combinations thereof, as shown in other drawings and descriptions in this specification, FIG. 78 assumes such examples of flexing by reference to prior examples and by showing an example of a flexed, pivoted and curved orientation of stiffening member alignment 111 (shown by broke lines) while in deflected position 292 that is created during downward kicking stroke direction 74, the view in FIG. 78 (as well as FIGS. 79 and 80) enable isolated viewing and illustration of various exemplified orientations and movement positions of pivoting blade portion 103 that occur while stiffening members 64 and or other portions of blade member 62 and/or other portions of the swim fin experience separate and/or additional flexing, bending or pivoting. In addition, the view in FIG. 78 permit such independent movements of pivoting blade portion 103 in embodiments where stiffening members 64 are made less flexible, relatively rigid or stiff, or remain relatively still during use. In situations where such independent movement of pivoting blade portion 103 occurs in combination with the separate and additional flexing of stiffening members 64 and/or other portions of blade member 62 around at least one transverse axis, such as in the views exemplified in FIGS. 78, 79 and 80, the individual orientations and deflections of pivoting blade portion 103 during use would be added to the separate deflections exemplified by stiffening member alignment 111 during deflected position 292 (shown by broken lines) so that the actual deflected orientation of pivoting blade portion 103 would be sum total of all deflection angles and orientations.

Because the example in FIG. 78 shows that trailing edge 80 is arranged to be aligned within transverse plane of reference 98 while at rest, depth of scoop 200 illustrated at trailing edge 80 does not exist in a prearranged state while the swim fin is at rest, and is instead created at trailing edge 80 when pivoting blade portion 103 pivots from neutral position 300 at rest to bowed position 100 during deflected position 292 (shown by broken lines) that is created as trailing edge 80 pivots and/or deflects under the exertion of water pressure exerted against pivoting blade portion 103 during downward kick direction 74. If vertical members 368 and 370 are made sufficiently stiff enough to not be able to experience significant deformation or deflection under the relatively light loading forces exerted by water pressure during downward kick direction 74, then depth of scoop 200 will be greatest near trailing edge 80 during downward kick stroke direction 74 and decrease in a direction from trailing edge 80 toward vertical member 368. However, If vertical members 368 and 370 are made sufficiently flexible enough to be able to experience significant deformation, deflection, partial inversion of shape or full inversion of shape under the relatively light loading forces exerted by water pressure during downward kick direction 74, then average vertical dimension of depth of scoop 200 occurring along the overall portion of the length of blade member 62 experiencing depth of scoop 200 would be increased accordingly.

Similarly, depth of scoop 202 illustrated in FIG. 78 at trailing edge 80 does not exist in a prearranged state while the swim fin is at rest, and is instead created at trailing edge 80 when pivoting blade portion 103 pivots from neutral position 300 at rest to inverted bowed position 102 during deflected position 302 (shown by broken lines) that is created as trailing edge 80 pivots and/or deflects under the exertion of water pressure exerted against pivoting blade portion 103 during upward kick direction 110. Because depth of scoop 202 is prearranged and significantly large near vertical member 368 relative to upward kicking stroke direction 110, when pivoting blade portion 103 pivots near trailing edge 80 to inverted bowed position 102 during deflection 302 (shown by broken lines) with a significantly large depth of scoop 202 seen at trailing edge 80 in FIG. 78, then the pivotal motion of pivoting blade portion 110 in this example acts like a draw bridge lowering so that depth of scoop 202 is significantly deep along the majority of blade member 62 between root portion 79 and trailing edge 80. Furthermore, a relatively smaller amount of pivoting by pivoting blade portion 103 during upstroke 110 creates a significantly large and deep scoop shape during upward stroke direction 110. This is one of the benefits for the method of positioning a transverse bending region or bending axis, such as exists with transverse axis 376, within a portion of blade member 62 that is arranged to be orthogonally spaced from transverse plane of reference 98. The configuration shown in FIG. 78 can be used to create additional propulsion during upward stroke direction 110 if desired; or alternatively, this configuration in FIG. 78 can be reversed or inverted while the swim fin is at rest so as to create additional or increased propulsion during downward kicking stroke direction 74.

In FIG. 78, as pivoting blade portion 103 pivots between bowed positions 100 and 102 (shown by broken lines), pivoting blade portion 103 is seen to have a predetermined pivotal range of motion 384 that exists between bowed positions 100 and 102 (shown by broken lines). Predetermined pivotal range of motion 384, or a predetermined range of motion of pivoting portion 103 between a neutral position at rest and at least one deflected position created during at least one phase of a reciprocating kicking stroke cycle, may be arranged to be at least 5 degrees, at least 10 degrees, at least 15 degrees, at least 20 degrees, at least 25 degrees, at least 30 degrees, at least 35 degrees, or at least 40 degrees. Predetermined pivotal range of motion 384 can be at least partially limited by the flexibility, resiliency, elasticity, expandability, and/or predetermined amount of loose material within folded members 274, which are seen to be connected between the outer side edges of pivoting blade portion 103 and the portions of blade member 64 that are adjacent to stiffening members 64 in this example and are made with harder portion 70. Folded members 274 are may be made with relatively softer portion 298 and may be connected to harder portion 70 of pivoting blade portion 103 and to harder portion 70 along the portions of blade member 62 adjacent to stiffening members 64 with a thermo-chemical bond created during at least one phase of an injection molding process; however, any suitable mechanical and/or chemical bond may be used. In this example, vertical portions 370, vertical portion 368 and folded members 274 may be molded during the same phase of injection molding process and are may be made with the same relatively soft thermoplastic material; however, any material or any combinations of materials may be used in any manner desired.

Figure 79:
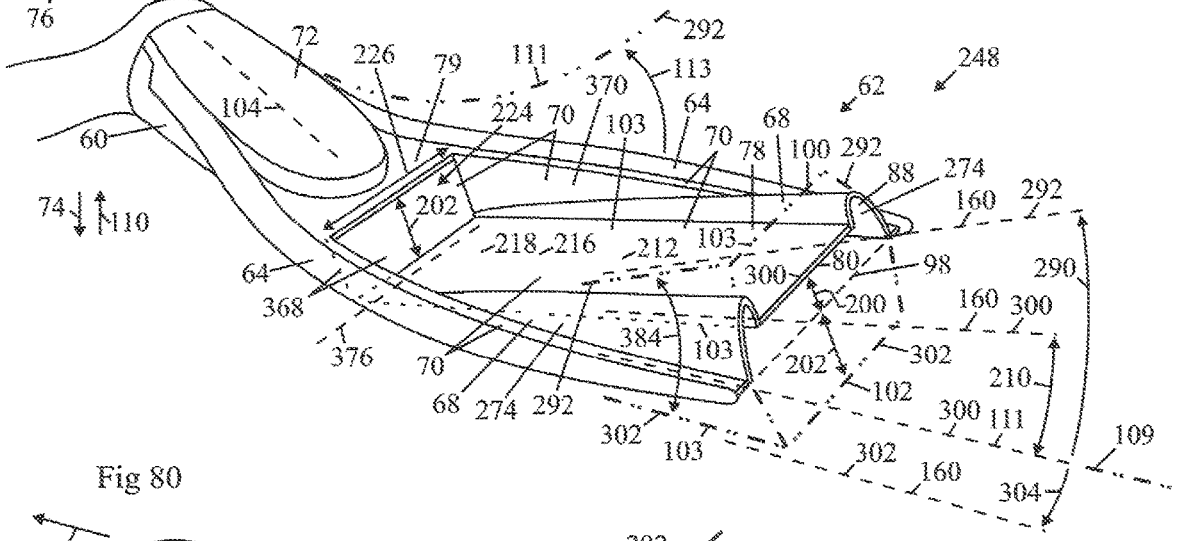
FIG. 79 shows a side perspective view of an alternate embodiment while the swim fin is at rest.

FIG. 79 shows a side perspective view of an alternate embodiment while the swim fin is at rest. The embodiment in FIG. 78 is similar to the embodiment shown in FIG. 78, except for some changes, including that in FIG. 79, trailing edge 80 is seen to be orthogonally spaced from transverse plane of reference 98 by depth of scoop 200, and the other longitudinal end of pivoting blade portion 103 near vertical member 368 is seen to be orthogonally spaced from transverse plane of reference 98 in the opposite direction by the oppositely directed depth of scoop 202 while the swim fin is at rest. In the example in FIG. 79, pivoting blade portion 103 is arranged to pivot around transverse axis 376 in order to illustrate an example using simplified movements.

FIG. 79 illustrates the pivotal movement of pivoting blade portion 103 around transverse axis 376 in an area between stiffening members 64. Pivotal blade portion 103 is arranged to experience relatively more overall pivotal movement around a transversely aligned axis through the water column during use than experienced by stiffening members 64. This is because pivoting blade portion 103 experiences extra pivotal motion that is on top of and/or in addition to any pivotal motion around a transverse axis that is experienced by stiffening members 64 during use, such as shown by stiffening member alignment 111 during deflected position 292 (shown by broken lines).

FIG. 79 illustrates some examples of pivoting portion lengthwise blade alignment 160 at rest and during use and various angles thereof. In FIG. 52*b*, pivoting portion lengthwise alignment 160 during neutral position 300 (shown by dotted lines) is seen to be parallel to the outer edge of pivoting portion 103 that is closest to the viewer (shown by dotted lines) that would otherwise be hidden from this perspective view by membrane 68 (which is also folded member 274 in this example). Alignment 160 during neutral position 300 (shown by dotted lines) is seen to be oriented at angle 210 relative to both stiffening member alignment 111 during neutral position 300 (shown by dotted lines) as well as to neutral position 109 (shown by broken lines) in this example. In this example, angle 210 causes alignment 160 during neutral position 300 (shown by dotted lines) to be inclined while at rest to a reduced lengthwise angle of attack relative to neutral position 109 (shown by broken lines) which is arranged to be parallel to direction of travel 76. This enables pivoting blade portion 103 to be able to direct more water toward trailing edge 80 along such inclination even at the beginning of downward kicking stroke direction 74. Angle 210 may be at least 2 degrees, at least 5 degrees, at least 10 degrees, or at least 15 degrees while the swim fin is at rest; however, angle 210 may be arranged to any desired positive angle of divergent alignment, a zero angle, or a negative angle of convergent alignment as exemplified in FIG. 78. As shown in FIG. 79, as pivoting blade portion 103 further deflects during downward kick direction 74 from angle 210 at rest, it continues to direct water toward trailing edge 80 and reaches alignment 160 during deflected position 292 (shown by dotted lines), which is seen to be parallel to the outer side edge region of portion 103 during bowed position 100 in deflected position 292 (shown by broken lines) resulting in reduced angle of attack 290, which may be a significantly reduced lengthwise angle of attack. Because alignment 160 during neutral position 300 (shown by dotted lines) is pre-arranged to be at angle 210, the oppositely directed the pivotal deflection of portion 103 during upward kicking stroke direction 110 requires pivoting portion 103 to first recover from the preset inclination of angle 210 before passing through the plane of neutral position 109 (shown by broken lines) so that alignment 160 during deflection 302 (shown by dotted lines) is oriented at reduced angle of attack 304 that is seen to be comparatively smaller than reduced angle of attack 290 relative to neutral position 109 (shown by broken lines) that is parallel to direction of travel 76. These methods for creating asymmetric deflection angles relative to direction of travel 76 can be used to greatly improve performance, efficiency, power and performance with improved angles of attack during each opposing kicking stroke direction. For example, alignment 160 during deflection 302 (shown by dotted lines) is seen to be significantly parallel to stiffening member alignment 111 during neutral position 300 (shown by dotted lines) so that alignment 160 does not deflect to an excessively low angle of attack during upward kick direction 110. This can also be beneficial because the swimmer's ankle often rotates in an adverse manner during upstroke direction 110 by pivoting to a near 90 degree angle relative to the swimmer's shin or lower leg in response to water pressure exerted on blade member 62 during upward stroke 110, and this can cause sole alignment 104 (shown by dotted lines) along sole portion 72 to pivot to a vertical or near vertical angle that would rotate the orientation of sole alignment 104 from the angled view shown in FIG. 79 to a vertical orientation that aims downward in this view and potentially at or near a right angle relative to direction of travel 76 so that if stiffening member alignment 111 and/or blade alignment 160 during deflected position 302 are permitted to pivot to excessively reduced angles of attack relative to sole alignment 104, and thus relative to direction of travel 76, then propulsion would be significantly reduced or even lost entirely over a significant portion of upward kicking stroke direction 110. The asymmetry of pivotal movement of portion 103 relative to neutral position 109 (shown by broken lines) that is arranged in this example to be parallel with direction of travel 76, can also be seen by the orientation of predetermined pivotal range of motion 384 relative to stiffening member 111 during deflected position 300 (shown by dotted lines) as such predetermined pivotal range of motion 384 is seen to extend a significant distance above stiffening member 64 relative to this view, and extends a significantly smaller distance below stiffening member 64 relative to this view.

In this example or in alternate embodiments, some desired angles for deflection angle 290 during downward stroke direction 74 can be arranged to be at least 15 degrees, at least 20 degrees, at least 25 degrees, or at least 30 degrees not including any additional pivoting of stiffening members 64 and/or other portions of blade member 62 around a transverse axis to an additionally reduced lengthwise angle of attack during use; or alternatively, at least 10 degrees, at least 15 degrees, at least 20 degrees, at least 25 degrees, at least 30 degrees, at least 35 degrees, at least 40 degrees, at least 45 degrees, or at least 50 degrees when combined with any additional pivotal movement of stiffening members 64 and/or other portions of blade member 62 during use. In this example or alternate embodiments, some desired angles for deflection angle 304 during upward kicking stroke direction 110, including if the swimmer's ankle experiences excessive adverse rotation as previously described, can be arranged to be at negative angles of at least −20 degrees, at least −15 degrees, at least −10 degrees, at least −5 degrees, at least −3 degrees, zero degrees, or at positive angles of at least 3 degrees, at least 5 degrees, at least 10 degrees, at least 15 degrees, at least 20 degrees, at least 25 degrees, or at least 30 degrees not including any additional pivoting of stiffening members 64 and/or other portions of blade member 62 around a transverse axis to an additionally reduced lengthwise angle of attack during use; or alternatively, at least 10 degrees, at least 15 degrees, at least 20 degrees, at least 25 degrees, at least 30 degrees, at least 35 degrees, at least 40 degrees, at least 45 degrees, or at least 50 degrees when combined with any additional pivotal movement of stiffening members 64 and/or other portions of blade member 62 during use. In alternate embodiments, such angles can be adjusted by the degree of angle 164 (not shown) that is described previously in this description that is arranged to exist between sole alignment 104 and neutral position 109 (shown by broken lines) of stiffening members 64 during rest that may be desired to be parallel to intended direction of travel 76 during rest, and this is because such angle 164 can be used to compensate for deflection angles and ranges by creating further asymmetry of deflection angles, especially when combined with other methods provided in this specification.

Figure 80:
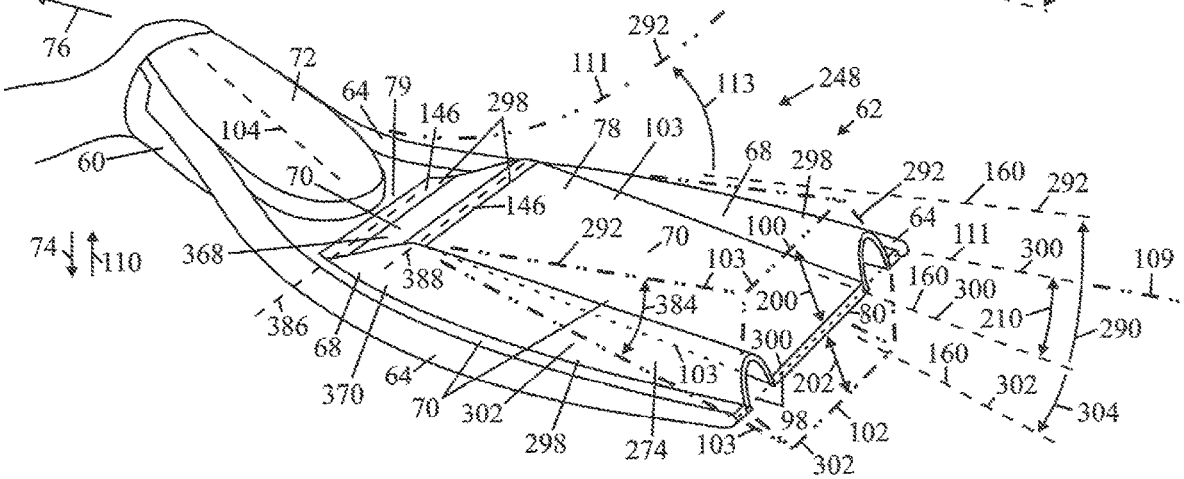
FIG. 80 shows a side perspective view of an alternate embodiment while the swim fin is at rest.

FIG. 80 shows a side perspective view of an alternate embodiment while the swim fin is at rest that is similar to the embodiment shown in FIG. 78 with changes including that the configuration of prearranged scoop shaped blade member 248 in FIG. 80 is substantially inverted from the shape exemplified in FIG. 78, along with some other exemplified changes. In FIG. 80, transversely aligned vertical blade member 368 is seen to be inclined in an upward and reward direction relative to the viewer (however the swimmer in this view is swimming in a face down prone position in the water so that the swim fin is actually upside down as previously described), which is significantly opposite to the inclination of member 368 shown in FIGS. 78 and 79. The inclination of member 368 in FIG. 80 is arranged to favor movement of water toward trailing edge 80 during downward kick direction 74 and the overall configuration of prearranged scoop shaped blade member 248 is also arranged to favor downward kick stroke direction 74.

In FIG. 80, blade member 62 is provided with hinging member 146 that is arranged to bend around transverse axis 386 in an area between root portion 79 and vertical member 368 and is also provided with hinging member 146 that is arranged to bend around transverse axis 388 in an area between vertical member 386 and pivoting blade portion 103. In this embodiment, both hinging members 146 may be made with relatively softer portion 298 that is used to make membranes 68 on either side of pivoting blade member 103, while vertical member 368 and pivoting blade portion 103 may be made with harder portion 70. In this example, trailing edge is seen to be oriented within transverse plane of reference 98, and the inclined orientation of portion 103 shown by alignment 160 during neutral position 300 (shown by dotted lines) is seen to cause the majority of portion 103 between trailing edge 80 and vertical portion 368 to be orthogonally spaced from transverse plane of reference 98 while the swim fin is at rest in neutral position 300. Hinging member 146 positioned between vertical member 386 and pivoting portion 103 may be arranged in this example to permit pivoting portion 103 to bend or pivot around transverse axis 388 during use, which is seen to cause portion 103 to be able to pivot upward relative to the viewer like lifting the hood of a car during downward stroke direction 74 so that alignment 160 during deflection 292 (shown by dotted lines) moves trailing edge 80 and the rest of pivoting portion 103 to bowed position 100 during deflection 292 (shown by broken lines). While pivoting portion 103 is in bowed position 100 (shown by broken lines) and in alignment 160 during deflection 292 (shown by dotted lines), blade member 62 is seen to be able to form a significantly large scoop or scoop shaped contour for directing a large amount of water during downward kicking stroke direction.

If desired, hinge member 146 between root portion 79 and vertical member 368, hinging member 146 between vertical member 368 and pivoting portion 103, membranes 68 (which includes folded portion 274) can be arranged to have sufficient flexibility to permit prearranged scoop shape 248 to a deflected, partially inverted or fully inverted position during upward stroke direction 110, and that at least one portion of blade member 62 may be arranged to provide a predetermined biasing force that is sufficient to automatically move blade member 62 back from such deflected, partially inverted or fully inverted position and to prearranged scoop shape 248 at the end of upward kicking stroke direction 110 and when the swim fin is returned to a state of rest. In alternate embodiments, any desired orientation, configuration, arrangement, contour, or shape may be used to create any desired variation of prearranged scoop shape 248 and/or to create any desired placement of any portion of blade member 62 at an orthogonally spaced orientation away from transverse plane of reference 98 while the swim fin is at rest and any form or degree of biasing force may be used as desired.

In view of the many methods, embodiments, examples, configurations and individual variations provided in this specification that can be arranged to be used alone or in any combination with each other as stated throughout this specification, below are some additional arrangements and methods that can be used as desired. Variations in the ensuing paragraphs below refer to part numbers in general that are used throughout the specification for many different drawings and ensuing descriptions in order to further communicate some additional variations that can apply to many of the embodiments and drawings in this specification, and such references to part numbers below are not intended in this portion of the specification to refer any one particular drawing Figure or Figures.

For embodiments having a prearranged scoop shape within blade member, a significant portion of blade member 62 may be arranged to experience significant deflections around a transverse axis to a substantially lengthwise angle of attack during use, such as exemplified by angle 292 during downward stroke direction 74 and angle 302 during upward stroke direction 110 in this specification, which may be measured between the intended direction of travel 76 (as exemplified by the alignment of neutral position the lengthwise alignment of the deepest portion of the scoop shaped region of blade member, such as exemplified in this description by pivoting portion lengthwise blade alignment 160. Such reduced angles of attack during use may be substantially close to 45 degrees during use; however, in alternate embodiments such reduced angles of attack can be arranged to be at least 10 degrees, at least 15 degrees, at least 20 degrees, substantially between 20 degrees and 50 degrees, and substantially between 30 degrees and 50 degrees, or any other angle as desired. A major portion of the longitudinal blade length 211 may be arranged to deflect to such reduced angles of attack 290 and/or 302 during use, such as the entire length 211, the portions of blade member 62 and the swim fin that are between heel portion 284 and trailing edge 80 or any portion or region there between, the portions of blade length 211 that are between one eighth blade position 218 and trailing edge 80, the outer three quarters of blade length 211 that is between one quarter blade position 216 and trailing edge 80, the outer half of blade member 62 between midpoint 212 and trailing edge 80, the first half of blade member between any portion of foot attachment member 60 and midpoint 212, or the outer quarter length of blade member 62 between three quarter position 214 and trailing edge 80.

Scoop shapes that are prearranged to exist while the swim fin is at rest, transverse scoop dimension 226 may be at least 85% of transverse blade region dimension 220 at any given point along blade length 211. Other desired ratios of transverse scoop dimension 226 to transverse blade region dimension 220 at any given point along blade length 211, can be arranged to be at least 95%, at least 90%, at least 85%, at least 80%, at least 75%, at least 70%, at least 65%, at least 60%, at least 55%, at least 50%, at least 45%, and at least 40%; however, such ratios can be varied as desired in any suitable manner in alternate embodiments.

For scoop shapes that are prearranged to exist while the swim fin is at rest, longitudinal scoop dimension 223 may be arranged to exist along the majority or substantially the entirety of blade length 211. In alternate embodiments, longitudinal scoop dimension 223 can be arranged to exist within the portions of blade length 211 that are between one eighth blade position 218 and trailing edge 80, the outer three quarters of blade length 211 that is between one quarter blade position 216 and trailing edge 80, the outer half of blade member 62 between midpoint 212 and trailing edge 80, the first half of blade member between any portion of foot attachment member 60 and midpoint 212, or the outer quarter length of blade member 62 between three quarter position 214 and trailing edge 80. The ratio of longitudinal scoop dimension 223 to blade length 211 may be arranged to be 100%, at least 95%, at least 90%, at least 85%, at least 80%, at least 75%, at least 70%, at least 65%, at least 60%, at least 55%, at least 50%, at least 45%, at least 40%, at least 35%, at least 30%, at least 25%, or at least 20%; however, any desired ratio may be used as desired.

For scoop shapes that are prearranged to exist while the swim fin is at rest, depths of scoop, such as central depth of scoop 200 during downward kicking stroke 74 and inverted central depth of scoop 202 during upward kick direction 110 in which such depths of scoop are prearranged to exist while the swim fin is at rest, may be at least 15% of the overall transverse blade region dimension 220 relative to at least one kicking stroke direction in a reciprocating kicking stroke cycle. Other desired ratios of central depth of scoop 200 and/or inverted central depth of scoop 202 relative to transverse blade region dimension 220 at a given position along blade length 211 for scoop shapes that are prearranged to exist while the swim fin is at rest, can be arranged to be at least 7%, at least 10%, at least 15%, at least 20%, at least 25%, at least 30%, at least 35%, at least 40%, at least 45%, and at least 50%.

Accordingly, some of the methods exemplified herein can provide one or more of the following advantages, independently or in any combination, such as:

(a) improved water channeling;
(b) improved lift generation;
(c) reduced lost motion between strokes;
(d) faster inversion of the scoop between strokes on versions where such inversion is desired;
(e) deeper scoop shapes with reduced inversion times and/or reduced lost motion;
(f) improved scoop shapes;
(g) improved blade angles;

(h) improved sinusoidal wave propagation along the length of the blade and/or near the center regions of the scoop;
(i) improved acceleration and/or propulsion speeds;
(j) improved efficiency;
(k) improved comfort;
(l) improved thrust;
(m) improved torque;
(n) reduced muscle strain;
(o) improved leverage; and/or
(p) other benefits or advantages described and illustrated in the specification.

Although the description above contains many specifics, these should not be construed as limiting the scope of the invention but as merely providing illustrations of some of the embodiments of this invention. For example, membranes 68 can be arranged to be sufficiently flexible to permit harder portion 70 to move under very light forces, including the force of gravity while out of the water and at rest so that membranes 68 and harder portion 70 move either toward or away from transverse plane of reference 98 under the force of gravity without any significant biasing force existing, or with small biasing forces that are sufficiently small enough to permit such movement to occur under the force of gravity. Membranes 68 and/or harder portion 70 can be arranged in any quantities, shapes, lengths, widths, configurations, combinations of arrangements, angles, alignments, contours, sizes, thicknesses, types of materials, combinations of materials, positions, orientations, elevations, curvatures, or any other desired variations.

While some methods are described in this specification to illustrate ways to incrementally improve or maximize performance and minimize disadvantages, alternate embodiments can be and are explicitly intended to be arranged to use some methods or structure to achieve certain benefits while selectively choosing to not use other certain methods or structures even though this can cause less than optimum results, such as combinations that including one or more improved characteristics together with one or more less desirable or even undesirable conditions, methods, variations or structures that can result in at least one aspect of the swim fin being improved even if other aspects of the swim fin are not. In other words, alternate embodiments, methods and/or structures that can be used to create at least one substantially limited, isolated or incremental level of improvement, advantages, performance and/or structural characteristic while also intentionally choosing to allow less desirable characteristics or even undesirable characteristics to coexist with such at least one characteristic that is improved in some way. Therefore, any reference to less desirable, not desirable, undesirable or counterproductive conditions, is merely for teaching how to create various degrees of total improvement as desired, and is explicitly not intended to be construed as a partial or complete disavowal of any of such less than desirable or undesirable conditions, methods, structures, arrangements, or characteristics in regards to the specification as a whole or in regards to the scope of any of the claims and their legal equivalents.

Also, any of the features shown in the embodiment examples provided can be eliminated entirely, substituted, changed, combined, or varied in any manner. In addition, any of the embodiments and individual variations discussed in the above description may be interchanged and combined with one another in any desirable order, amount, arrangement, and configuration. Any of the individual variations, methods, arrangements, elements or variations thereof used in any of the embodiments, drawings, and ensuing description, or any desired other alternate embodiment or desired variation thereof, may be used alone or combined with any number of other individual variations, methods, arrangements, elements or variations thereof and in any desired manner, arrangement, configuration, form and/or combination, and may be further varied in any desired manner.

Furthermore, the methods exemplified herein or other alternate embodiments may be used on any type of hydrofoil device including propeller blades, impellers, paddles, oars, reciprocating hydrofoils, propulsion systems for marine vessels, propulsion systems for underwater machines, remote control devices and robotic devices, or any other situation in which a hydrofoil may be used.

Accordingly, the scope of the invention should not be determined not by the embodiments illustrated, but by the appended claims and their legal equivalents.

What is claimed is:

1. A method for providing a swim fin, said method comprising:

(a) providing a foot attachment member and a blade member in front of said foot attachment member, said blade member having a longitudinal alignment relative to said foot attachment member, said blade member having opposing surfaces, blade member outer side edges and a blade member transverse distance between said blade member outer side edges, two sideways spaced apart elongated rib members that are connected to said blade member adjacent to said blade member outer side edges, said elongated rib members each having a rib upper edge portion and a rib lower edge portion with a vertical rib distance between said rib upper edge portion and said rib lower edge portion and a rib vertical midpoint that is midway between said rib upper edge portion and said rib lower edge portion, a rib member midpoint transverse plane of reference that extends in a transverse direction between said rib vertical midpoints of said two sideways spaced apart elongated rib members, a root portion adjacent to said foot attachment member and a free end portion spaced from said root portion and said foot attachment member, a blade member length between said root portion and said free end portion, a longitudinal midpoint between said root portion and said free end portion, a three quarter position between said root portion and said midpoint, a one quarter position between said longitudinal midpoint and said free end portion, a first half portion between said root portion and said longitudinal midpoint, a second half portion between said longitudinal midpoint and said free end portion, a three quarter portion between said three quarter position and said free end portion, and a one quarter portion that is between said one quarter position and said free end portion, said blade member having a blade member longitudinal center axis midway between said outer side edges;

(b) providing said swim fin with a pivoting blade region that is arranged to pivot to a lengthwise reduced angle of attack of at least 10 degrees around a transverse axis that is between the heel portion of said foot attachment member and said longitudinal midpoint during at least one kicking stroke direction that uses a cruising speed kicking stroke force used to achieve a cruising speed while swimming;

(c) arranging at least one of said opposing surfaces of said blade member within said pivoting blade portion to form an orthogonally spaced resting state transversely concave surface region that is orthogonally spaced away from said rib member midpoint transverse plane of reference to an orthogonally spaced resting state position when said swim fin is in a motionless state of rest;

(d) providing said blade member with two transversely spaced apart folded flexible membrane members made with a flexible material that is disposed in said blade member, each of said flexible membranes having flexible membrane outer side edge regions;

(e) providing each of said flexible membrane members with a transversely asymmetrical cross sectional shape that has at least one transverse fold formed around a substantially longitudinal axis when said swim fin is in said motionless state of rest, each of said folded membrane members being arranged to experience reciprocating orthogonal movement relative to said rib member midpoint transverse plane of reference during a reciprocating kicking stroke cycle;

(f) providing said swim fin with a biasing force arranged to urge at least two transversely spaced apart portions located on each of said folded flexible membrane members between said flexible membrane outer side edge regions to be spaced away from each other in an orthogonal direction by an orthogonally spaced resting state vertical distance that is at least 5% of said blade member transverse distance and extends along at least 40% of said blade member length while said swim fin is in said motionless state of rest; and (g) arranging at least one portion of said folded membrane member between said flexible membrane outer side edge regions to experience substantially orthogonal directed expansion across an orthogonally spaced expanded state vertical distance that is between a substantially folded position existing when said swim fin is in said motionless state of rest and an orthogonally spaced expanded position created under said exertion of water pressure created during at least one phase of said reciprocating kicking stroke cycle while using said cruising speed kicking stroke force, said orthogonal expansion vertical distance is at least 5% of said blade member transverse distance along at least 70% of said blade member length under said exertion of water pressure created during said at least one phase of said reciprocating kicking stroke cycle that uses said cruising speed kicking stroke force.

2. The method of claim 1 wherein said orthogonally spaced expanded state vertical distance is at least 3% of said blade member transverse distance along at least 75% of said blade member length.

3. The method of claim 1 wherein said orthogonally spaced expanded state vertical distance is at least 5% of said blade member transverse distance along at least 75% of said blade member length.

4. The method of claim 1 wherein said orthogonally spaced expanded state vertical distance is at least 7% of said blade member transverse distance along a region of said blade member that is at least 70% of said blade member length.

5. The method of claim 1 wherein said orthogonally spaced expanded state vertical distance is at least 10% of said blade member transverse distance along a region of said blade member that is at least 60% of said blade member length.

6. The method of claim 1 wherein said orthogonally spaced expanded state vertical distance is at least 15% of said blade member transverse distance along a region of said blade member that is at least 25% of said blade member length.

7. The method of claim 1 wherein said orthogonally spaced expanded state vertical distance is at least 15% of said blade member transverse distance along a region of said blade member that is at least 50% of said blade member length.

8. The method of claim 1 wherein said orthogonally spaced expanded state vertical distance is at least 20% of said blade member transverse distance along a region of said blade member that is at least 25% of said blade member length.

9. The method of claim 1 wherein said orthogonally spaced expanded state vertical distance is at least 5% of said blade member transverse distance along a majority of said first half portion of said blade member and causes a significant increase in the ability to sustain significantly increased swimming speeds.

10. The method of claim 1 wherein said swim fin is arranged to create a significant increase in swimming speed while using rapid successive kicking stroke inversions during said repetitive reciprocating kicking stroke cycles.

11. The method of claim 1 wherein said orthogonally spaced resting state vertical distance is at least 3% of said blade member transverse distance along at least 70% of said blade member length when said swim fin is in said motionless state of rest.

12. The method of claim 1 wherein said orthogonally spaced resting state vertical distance is at least 5% of said blade member transverse distance along at least 60% of said blade member length when said swim fin is in said motionless state of rest.

13. The method of claim 1 wherein said orthogonally spaced resting state vertical distance is at least 7% of said blade member transverse distance along at least 25% of said blade member length when said swim fin is in said motionless state of rest.

14. The method of claim 1 wherein said orthogonally spaced resting state vertical distance is at least 7% of said blade member transverse distance along at least 50% of said blade member length when said swim fin is in said motionless state of rest.

15. The method of claim 1 wherein said orthogonally spaced resting state vertical distance is at least 10% of said blade member transverse distance along at least 25% of said blade member length when said swim fin is in said motionless state of rest.

16. The method of claim 1 wherein said orthogonally spaced resting state position of said orthogonally spaced resting state transversely concave surface region is orthogonally spaced away from said rib member midpoint transverse plane of reference by an orthogonal distance that is at least 3% of said blade member transverse distance along a portion of said blade member that is at least 25% of said blade member length and is at least 40% of said blade member transverse distance.

17. A method for providing a swim fin, said method comprising:

(a) providing a foot attachment member and a blade member in front of said foot attachment member, said blade member having a longitudinal alignment relative to said foot attachment member, said blade member having opposing surfaces, blade member outer side edges and a blade member transverse distance between said blade member outer side edges, two sideways spaced apart elongated rib members that are connected to said blade member adjacent to said blade member outer side edges, said elongated rib members each having a rib upper edge portion and a rib lower edge portion with a vertical rib distance between said rib upper edge portion and said rib lower edge portion and a rib vertical midpoint that is midway between said rib upper edge portion and said rib lower edge portion, a rib member midpoint transverse plane of reference that extends in a transverse direction between said rib vertical midpoints of said two sideways spaced apart elongated rib members, a root portion adjacent to said foot attachment member and a free end portion spaced from said root portion and said foot attachment member, a blade member length between said root portion and said free end portion, a longitudinal midpoint between said root portion and said free end portion, a three quarter position between said root portion and said midpoint, a one quarter position between said longitudinal midpoint and said free end portion, a first half portion between said root portion and said longitudinal midpoint, a second half portion between said longitudinal midpoint and said free end portion, a three quarter portion between said three quarter position and said free end portion, and a one quarter portion that is between said one quarter position and said free end portion, said blade member having a blade member longitudinal center axis midway between said outer side edges;

(b) providing said swim fin with a pivoting blade region that is arranged to pivot to a lengthwise reduced angle of attack of at least 10 degrees around a transverse axis that is between the heel portion of said foot attachment member and said longitudinal midpoint during at least one kicking stroke direction that uses a cruising speed kicking stroke force used to achieve a cruising speed while swimming;

(c) arranging at least one of said opposing surfaces of said blade member within said pivoting blade portion to form an orthogonally spaced resting state transversely concave surface region that is orthogonally spaced away from said rib member midpoint transverse plane of reference to an orthogonally spaced resting state position when said swim fin is in a motionless state of rest;

(d) providing said blade member with two transversely spaced apart folded flexible membrane members made with a flexible material that is disposed in said blade member, each of said flexible membranes having flexible membrane outer side edge regions;

(e) providing each of said flexible membrane members with a transverse cross sectional shape that has at least one transverse fold formed around a substantially longitudinal axis when said swim fin is in said motionless state of rest, each of said folded membrane members being arranged to experience reciprocating orthogonal movement relative to said rib member midpoint transverse plane of reference during a reciprocating kicking stroke cycle;

(f) providing said swim fin with a biasing force arranged to urge at least two transversely spaced apart portions located on each of said folded flexible membrane members between said flexible membrane outer side edge regions to be spaced away from each other in an orthogonal direction by an orthogonally spaced resting state vertical distance that is at least 5% of said blade member transverse distance and extends along at least 40% of said blade member length while said swim fin is in said motionless state of rest; and (g) arranging at least one portion of each said folded membrane member between said flexible membrane outer side edge regions to experience substantially orthogonal directed expansion across an orthogonally spaced expanded state vertical distance that is between a substantially folded resting state position existing when said swim fin is in said motionless state of rest and an orthogonally spaced expanded position created under said exertion of water pressure created during at least one phase of said reciprocating kicking stroke cycle while using said cruising speed kicking stroke force, said orthogonal expansion vertical distance is at least 5% of said blade member transverse distance along at least 70% of said blade member length under said exertion of water pressure created during said at least one phase of said reciprocating kicking stroke cycle that uses said cruising speed kicking stroke force, said biasing force automatically returning said at least one portion of each said folded membrane member to said substantially folded resting state position after said at least one phase of said reciprocating kicking stroke cycle when said swim fin is returned to said motionless state of rest.

18. The method of claim 17 wherein said orthogonally spaced expanded state vertical distance is at least 3% of said blade member transverse distance along at least 75% of said blade member length.

19. The method of claim 17 wherein said orthogonally spaced expanded state vertical distance is at least 5% of said blade member transverse distance along at least 75% of said blade member length.

20. The method of claim 17 wherein said orthogonally spaced expanded state vertical distance is at least 7% of said blade member transverse distance along a region of said blade member that is at least 70% of said blade member length.

21. The method of claim 17 wherein said orthogonally spaced expanded state vertical distance is at least 10% of said blade member transverse distance along a region of said blade member that is at least 60% of said blade member length.

22. The method of claim 17 wherein said orthogonally spaced expanded state vertical distance is at least 15% of said blade member transverse distance along a region of said blade member that is at least 25% of said blade member length.

23. The method of claim 17 wherein said orthogonally spaced expanded state vertical distance is at least 15% of said blade member transverse distance along a region of said blade member that is at least 50% of said blade member length.

24. The method of claim 17 wherein said orthogonally spaced expanded state vertical distance is at least 20% of said blade member transverse distance along a region of said blade member that is at least 25% of said blade member length.

25. The method of claim 17 wherein said orthogonally spaced expanded state vertical distance is at least 5% of said blade member transverse distance along a majority of said first half portion of said blade member and causes a significant increase in the ability to sustain significantly increased swimming speeds.

26. The method of claim 17 wherein said swim fin is arranged to create a significant increase in swimming speed while using rapid successive kicking stroke inversions during said repetitive reciprocating kicking stroke cycles.

27. The method of claim 17 wherein said orthogonally spaced resting state vertical distance is at least 3% of said blade member transverse distance along at least 70% of said blade member length when said swim fin is in said motionless state of rest.

28. The method of claim 17 wherein said orthogonally spaced resting state vertical distance is at least 5% of said blade member transverse distance along at least 60% of said blade member length when said swim fin is in said motionless state of rest.

29. The method of claim 17 wherein said orthogonally spaced resting state vertical distance is at least 7% of said blade member transverse distance along at least 25% of said blade member length when said swim fin is in said motionless state of rest.

30. The method of claim 17 wherein said orthogonally spaced resting state vertical distance is at least 7% of said blade member transverse distance along at least 50% of said blade member length when said swim fin is in said motionless state of rest.

31. The method of claim 17 wherein said orthogonally spaced resting state vertical distance is at least 10% of said blade member transverse distance along at least 25% of said blade member length when said swim fin is in said motionless state of rest.

32. The method of claim 1 wherein said orthogonally spaced resting state position of said orthogonally spaced resting state transversely concave surface region is orthogonally spaced away from said rib member midpoint transverse plane of reference by an orthogonal distance that is at least 3% of said blade member transverse distance along a portion of said blade member that is at least 25% of said blade member length and is at least 40% of said blade member transverse distance.

33. A method for providing a swim fin, said method comprising:

(a) providing a foot attachment member and a blade member in front of said foot attachment member, said blade member having a longitudinal alignment relative to said foot attachment member, said blade member having opposing surfaces, blade member outer side edges and a blade member transverse distance between said blade member outer side edges, two sideways spaced apart elongated rib members that are connected to said blade member adjacent to said blade member outer side edges, said elongated rib members each having a rib upper edge portion and a rib lower edge portion with a vertical rib distance between said rib upper edge portion and said rib lower edge portion and a rib vertical midpoint that is midway between said rib upper edge portion and said rib lower edge portion, a rib member midpoint transverse plane of reference that extends in a transverse direction between said rib vertical midpoints of said two sideways spaced apart elongated rib members, a root portion adjacent to said foot attachment member and a free end portion spaced from said root portion and said foot attachment member, a blade member length between said root portion and said free end portion, a longitudinal midpoint between said root portion and said free end portion, a three quarter position between said root portion and said midpoint, a one quarter position between said longitudinal midpoint and said free end portion, a first half portion between said root portion and said longitudinal midpoint, a second half portion between said longitudinal midpoint and said free end portion, a three quarter portion between said three quarter position and said free end portion, and a one quarter portion that is between said one quarter position and said free end portion, said blade member having a blade member longitudinal center axis midway between said outer side edges;

(b) providing said swim fin with a pivoting blade region that is arranged to pivot to a lengthwise reduced angle of attack of at least 10 degrees around a transverse axis that is between the heel portion of said foot attachment member and said longitudinal midpoint during at least one kicking stroke direction that uses a cruising speed kicking stroke force used to achieve a cruising speed while swimming;

(c) arranging at least one of said opposing surfaces of said blade member within said pivoting blade portion to form an orthogonally spaced resting state transversely concave surface region that is orthogonally spaced away from said rib member midpoint transverse plane of reference to an orthogonally spaced resting state position when said swim fin is in a motionless state of rest;

(d) providing said blade member with two transversely spaced apart flexible membrane members made with a flexible material that is disposed in said blade member, each of said flexible membranes having flexible membrane outer side edge regions, each of said flexible membrane members being arranged to experience reciprocating orthogonal movement relative to said rib member midpoint transverse plane of reference during a reciprocating kicking stroke cycle;

(e) providing said swim fin with a biasing force arranged to urge each of said flexible membrane members to form at least one transversely inclined region having at least two transversely spaced apart portions between said flexible membrane outer side edges while said swim fin is in said motionless state of rest, said biasing force urging said at least two transversely spaced apart portions to be spaced away from each other in an orthogonal direction by an orthogonally spaced resting state vertical distance that is at least 5% of said blade member transverse distance and extends along at least 40% of said blade member length while said swim fin is in said motionless state of rest; and (g) arranging said biasing force to permit at least one of said at least two transversely spaced apart portions on each of said flexible membranes to experience an orthogonal deflection across an orthogonally spaced deflected vertical distance that is between a substantially inclined resting state position existing when said swim fin is in said motionless state of rest and an orthogonally spaced position created under said exertion of water pressure created during at least one phase of said reciprocating kicking stroke cycle while using said cruising speed kicking stroke force, said orthogonally spaced deflected vertical distance is at least 5% of said blade member transverse distance along at least 70% of said blade member length under said exertion of water pressure created during said at least one phase of said reciprocating kicking stroke cycle that uses said cruising speed kicking stroke force, said biasing force automatically returning said at least one of said at least two transversely spaced apart portions on each of said flexible membranes to said substantially inclined resting state position after the end of said at least one phase of said reciprocating kicking stroke cycle when said swim fin is returned to said motionless state of rest.

34. The method of claim 33 wherein said orthogonally spaced deflected state vertical distance is at least 3% of said blade member transverse distance along at least 75% of said blade member length.

35. The method of claim 33 wherein said orthogonally spaced deflected vertical distance is at least 5% of said blade member transverse distance along at least 75% of said blade member length.

36. The method of claim 33 wherein said orthogonally spaced deflected vertical distance is at least 7% of said blade member transverse distance along a region of said blade member that is at least 70% of said blade member length.

37. The method of claim 33 wherein said orthogonally spaced deflected vertical distance is at least 10% of said blade member transverse distance along a region of said blade member that is at least 60% of said blade member length.

38. The method of claim 33 wherein said orthogonally spaced deflected vertical distance is at least 15% of said blade member transverse distance along a region of said blade member that is at least 25% of said blade member length.

39. The method of claim 33 wherein said orthogonally spaced deflected vertical distance is at least 15% of said blade member transverse distance along a region of said blade member that is at least 50% of said blade member length.

40. The method of claim 33 wherein said orthogonally spaced deflected vertical distance is at least 20% of said blade member transverse distance along a region of said blade member that is at least 25% of said blade member length.

41. The method of claim 33 wherein said swim fin is arranged to create a significant increase in swimming speed while using rapid successive kicking stroke inversions during said repetitive reciprocating kicking stroke cycles.

42. The method of claim 33 wherein said orthogonally spaced deflected vertical distance is at least 5% of said blade member transverse distance along a majority of said first half portion of said blade member and causes a significant increase in the ability to sustain significantly increased swimming speeds.

43. The method of claim 33 wherein said orthogonally spaced resting state vertical distance is at least 3% of said blade member transverse distance along at least 70% of said blade member length when said swim fin is in said motionless state of rest.

44. The method of claim 33 wherein said orthogonally spaced resting state vertical distance is at least 5% of said blade member transverse distance along at least 60% of said blade member length when said swim fin is in said motionless state of rest.

45. The method of claim 33 wherein said orthogonally spaced resting state vertical distance is at least 7% of said blade member transverse distance along at least 25% of said blade member length when said swim fin is in said motionless state of rest.

46. The method of claim 33 wherein said orthogonally spaced resting state vertical distance is at least 7% of said blade member transverse distance along at least 50% of said blade member length when said swim fin is in said motionless state of rest.

47. The method of claim 33 wherein said orthogonally spaced resting state vertical distance is at least 10% of said blade member transverse distance along at least 25% of said blade member length when said swim fin is in said motionless state of rest.

48. The method of claim 33 wherein said orthogonally spaced resting state position of said orthogonally spaced resting state transversely concave surface region is orthogonally spaced away from said rib member midpoint transverse plane of reference by an orthogonal distance that is at least 3% of said blade member transverse distance along a portion of said blade member that is at least 25% of said blade member length and is at least 40% of said blade member transverse distance.

* * * * *